US012396557B2

(12) United States Patent
Nelson et al.

(10) Patent No.: US 12,396,557 B2
(45) Date of Patent: Aug. 26, 2025

(54) MODULAR FURNITURE AND RECLINING ASSEMBLIES

(71) Applicant: THE LOVESAC COMPANY, Stamford, CT (US)

(72) Inventors: Shawn D. Nelson, Washington, UT (US); David M. Underwood, Hurricane, UT (US); Lynn Curtis Strong, St. George, UT (US); Stephen Ciccarelli, St. George, UT (US); Zach Gaarder, Central, UT (US); Casey Lee Webb, Washington, UT (US); Jacob D. Forman, Washington, UT (US); Braquel L Urie, Cedar City, UT (US); Brian Kuchler, Hurricane, UT (US); Tyler Sanders, St. George, UT (US)

(73) Assignee: The Lovesac Company, Stamford, CT (US)

( * ) Notice: Subject to any disclaimer, the term of this patent is extended or adjusted under 35 U.S.C. 154(b) by 219 days.

(21) Appl. No.: 18/298,839

(22) Filed: Apr. 11, 2023

(65) Prior Publication Data

US 2024/0415284 A1 Dec. 19, 2024

Related U.S. Application Data

(60) Provisional application No. 63/362,809, filed on Apr. 11, 2022.

(51) Int. Cl.
*A47C 1/028* (2006.01)
*A47C 1/034* (2006.01)
(Continued)

(52) U.S. Cl.
CPC ..... *A47C 1/0342* (2013.01); *A47C 1/028* (2013.01); *A47C 1/124* (2013.01); *A47C 4/02* (2013.01); *A47C 13/005* (2013.01); *A47C 7/748* (2013.01)

(58) Field of Classification Search
CPC ..... A47C 1/028; A47C 1/124; A47C 4/02; A47C 13/005; A47C 1/0342
(Continued)

(56) References Cited

U.S. PATENT DOCUMENTS 988,059 A 3/1911 Allen
2,480,552 A * 8/1949 Colvez ..... A47C 1/028 297/411.27
(Continued)

FOREIGN PATENT DOCUMENTS

CN 2236262 Y 10/1996
CN 201341645 Y 11/2009
(Continued)

OTHER PUBLICATIONS http://homefurniturecomponents.com, A foundation of comfort, printed on Oct. 21, 2016, 12 pages.
(Continued)

*Primary Examiner* — Rodney B White
(74) *Attorney, Agent, or Firm* — Workman Nydegger

(57) ABSTRACT

Disclosed are furniture systems including at least one reclining assembly. The reclining assembly can be configured to seamlessly integrate and couple to a modular furniture assembly, having a footprint that substantially fits within the geometric specifications of the footprint of the modular furniture assembly. The reclining assembly can have a general appearance that is substantially similar to the modular furniture assembly when the reclining assembly is in the un-reclined position. The reclining assembly can include a
(Continued)

reclining mechanism that permits transitioning the reclining assembly between a shallow and deep seat configuration. The reclining assembly can include a rotatable footrest panel. The reclining mechanism can include rotating gears that ride on gear rails, to effect the reclining movement and/or extension of the footrest panel.

22 Claims, 72 Drawing Sheets

(51) Int. Cl.

| | |
|---|---|
| ***A47C 1/035*** | (2006.01) |
| ***A47C 1/124*** | (2006.01) |
| ***A47C 4/02*** | (2006.01) |
| ***A47C 13/00*** | (2006.01) |
| *A47C 7/74* | (2006.01) |

(58) Field of Classification Search
USPC ..... 297/1, 130, 283.1
See application file for complete search history.

(56) References Cited

U.S. PATENT DOCUMENTS 2,625,983 A 1/1953 Slyter et al.
2,653,648 A 9/1953 Marshall
3,113,633 A 12/1963 Eberhardt et al.
3,870,297 A 3/1975 Elder
3,893,731 A 7/1975 Maggs
3,972,559 A * 8/1976 Anacker ..... A47C 1/028 297/1 X
4,124,249 A 11/1978 Abbeloos
4,321,717 A 3/1982 Serra
4,561,692 A * 12/1985 Yestadt ..... A47B 9/00 297/130
4,846,525 A 7/1989 Manning
5,064,244 A * 11/1991 Sproule ..... A47C 15/002 297/257 X
5,106,153 A 4/1992 Durling
5,326,153 A * 7/1994 Muffi ..... A47C 17/04 297/232 X
5,352,017 A * 10/1994 Berning ..... A47C 13/005 297/440.1
5,362,296 A 11/1994 Wang et al.
5,368,359 A 11/1994 Eakin
5,544,938 A 8/1996 Saul et al.
5,683,139 A 11/1997 Golynsky et al.
5,735,573 A 4/1998 Vredevoogd
5,740,564 A * 4/1998 Hankins ..... A47C 17/225 297/232 X
5,790,993 A 8/1998 Roma et al.
5,895,365 A 4/1999 Tomlinson
5,967,820 A 10/1999 Siegal et al.
5,995,634 A 11/1999 Zwolski
6,000,353 A 12/1999 De Leu
6,000,758 A 12/1999 Schaffner et al.
6,322,146 B1 11/2001 Fisher
6,814,709 B2 11/2004 Schwartz et al.
7,090,297 B2 8/2006 Mohn et al.
7,172,196 B2 2/2007 Randall
7,213,885 B2 5/2007 White et al.
D547,087 S 7/2007 Natuzzi
7,312,393 B2 12/2007 McCarthy
7,317,176 B2 * 1/2008 Boucher ..... H05B 1/0275 297/180.12
7,421,608 B2 9/2008 Schron
7,448,689 B2 11/2008 Carter et al.
7,547,073 B2 6/2009 White, III et al.
7,553,288 B2 6/2009 Cohen
7,575,279 B2 8/2009 Robertson
7,631,937 B2 12/2009 Robertson
7,699,389 B2 4/2010 Robertson
7,735,912 B2 6/2010 Robertson
7,766,421 B2 8/2010 Lawson
7,871,280 B2 1/2011 Henriott
7,918,308 B2 4/2011 Cohen
7,963,612 B2 6/2011 Nelson
7,982,436 B2 7/2011 Randall
8,061,864 B2 11/2011 Metcalf et al.
8,132,856 B2 3/2012 Wilson et al.
8,228,026 B2 7/2012 Johnson et al.
8,421,407 B2 4/2013 Johnson
8,668,045 B2 3/2014 Cohen
8,783,778 B2 7/2014 Nelson et al.
8,935,985 B2 1/2015 Hjelm
9,004,585 B1 * 4/2015 Pidgornyy ..... A47C 13/005 297/130 X
9,010,851 B2 4/2015 LaPointe
9,095,209 B2 8/2015 Mirth et al.
9,124,308 B2 9/2015 Metcalf
9,277,826 B2 3/2016 Nelson et al.
10,123,621 B2 * 11/2018 Nelson ..... A47C 1/0347
10,143,307 B2 * 12/2018 Nelson ..... A47C 13/005
12,089,744 B2 * 9/2024 Zhao ..... A47D 13/066
2001/0020810 A1 9/2001 Kennedy
2002/0158492 A1 10/2002 Ko et al.
2003/0025366 A1 2/2003 Armando
2003/0139693 A1 7/2003 Swift
2004/0004383 A1 1/2004 Laurent
2004/0026998 A1 2/2004 Henriott et al.
2004/0041452 A1 3/2004 Williams
2004/0061943 A1 4/2004 Bosch et al.
2004/0095000 A1 5/2004 Durling
2005/0053252 A1 3/2005 Cohen
2005/0146179 A1 * 7/2005 Murphy ..... A47C 1/124 297/248
2005/0253430 A1 * 11/2005 George ..... A47C 1/124 297/233
2006/0036201 A1 2/2006 Cohen
2006/0061148 A1 3/2006 Pollard et al.
2006/0076813 A1 4/2006 Mohn et al.
2008/0012404 A1 1/2008 Dewert
2008/0150329 A1 6/2008 Lawson
2008/0231089 A1 * 9/2008 LaPointe ..... A47C 13/005 297/83
2008/0262657 A1 10/2008 Howell et al.
2009/0072782 A1 3/2009 Randall
2009/0096255 A1 4/2009 Robertson
2009/0212638 A1 8/2009 Johnson
2009/0212639 A1 8/2009 Johnson
2009/0212737 A1 8/2009 Johnson et al.
2009/0250982 A1 10/2009 Cohen
2010/0290215 A1 11/2010 Metcalf et al.
2010/0320819 A1 12/2010 Cohen et al.
2011/0012403 A1 1/2011 Wilson et al.
2011/0109211 A1 5/2011 Kirkeby et al.
2011/0110075 A1 5/2011 Smith
2011/0298340 A1 12/2011 Nelson et al.
2012/0026724 A1 2/2012 Metcalf et al.
2012/0051579 A1 3/2012 Cohen
2012/0200129 A1 8/2012 Wilson, Jr.
2012/0286557 A1 11/2012 Hoffman et al.
2013/0199421 A1 8/2013 Hjelm
2013/0207478 A1 8/2013 Metcalf et al.
2013/0234481 A1 9/2013 Johnson
2014/0010387 A1 1/2014 Cohen
2014/0197666 A1 7/2014 Koch
2014/0285140 A1 9/2014 Jung
2015/0069965 A1 3/2015 Verschueren
2015/0076881 A1 3/2015 LaPointe
2015/0076891 A1 3/2015 LaPointe et al.
2016/0174715 A1 6/2016 Nelson et al.
2017/0143122 A1 5/2017 Nelson et al.
2017/0149181 A1 5/2017 Nelson et al.
2017/0150264 A1 5/2017 Nelson et al.
2018/0000244 A1 1/2018 Nelson et al.
2018/0041354 A1 2/2018 Nelson et al.
2020/0323352 A1 * 10/2020 Rach ..... A47C 13/005
2021/0289941 A1 * 9/2021 Brandtner ..... A47C 7/52
2022/0078555 A1 * 3/2022 Nelson ..... H04R 5/023

(56) References Cited

U.S. PATENT DOCUMENTS

| | | | | |
|---|---|---|---|---|
| 2023/0209262 | A1* | 6/2023 | Nelson | A47C 7/727 381/301 |
| 2023/0217170 | A1* | 7/2023 | Nelson | H04S 7/307 381/301 |
| 2024/0423374 | A1* | 12/2024 | Nelson | A47C 1/0352 |

FOREIGN PATENT DOCUMENTS

| | | | | | |
|---|---|---|---|---|---|
| CN | 202553058 | U | | 11/2012 | |
| CN | 202698449 | U | | 1/2013 | |
| CN | 201452358 | U | | 4/2013 | |
| CN | 202907151 | U | | 4/2013 | |
| CN | 202981088 | U | | 6/2013 | |
| CN | 203563950 | U | | 4/2014 | |
| CN | 203609079 | U | | 5/2014 | |
| CN | 206306893 | U | | 7/2017 | |
| GB | 2582213 | A | * | 9/2020 | A47C 1/032 |
| WO | 2009/113319 | A1 | | 9/2009 | |
| WO | 2012/093398 | A2 | | 7/2012 | |
| WO | 2014/072975 | A1 | | 5/2014 | |
| WO | 2017/087224 | A1 | | 5/2017 | |
| WO | 2017/087266 | A1 | | 5/2017 | |
| WO | 2017/087268 | A1 | | 5/2017 | |

OTHER PUBLICATIONS http://homefurniturecomponents.com, A foundation of comfort, printed on Oct. 4, 2016, 1 page.
http://homefurniturecomponents.com, EasyCliner+, printed on Oct. 21, 2016, 1 page.
http://homefurniturecomponents.com, InSpira Lounging Ingenuity video link Features and Benefits of InSpira, printed on Oct. 21, 2016, 1 page. (Best Just Got Better).
http://homefurniturecomponents.com, InSpira Lounging Ingenuity video link Features and Benefits of InSpira, printed on Oct. 21, 2016, 1 page. (Inspira Coming Soon!).
http://homefurniturecomponents.com, Omega Wall Hugger, printed on Oct. 21, 2016, 1 page.
Page from archive.org for www.romag.com available, on information and belief, at least as early as Jan. 31, 2016, 1 page.
Page from archive.org for www.romag.com available, on information and belief, at least as early as Jun. 10, 2016, 1 page.
Page from archive.org for www.romag.com available, on information and belief, at least as early as Oct. 17, 2015, 1 page.
Pages from http://www.recliner-handles.com, available, on information and belief, at least as early as Nov. 1, 2016, 3 pages.
Pages from https://web.archive.org/web/20160604194805/http://www.recliner-handles.com , available, on information and belief, at least as early as Jun. 4, 2016, 6 pages.
Pictures of Recliner Mechanism, dated Oct. 12, 2016, 3 pages.
The Wall Street Journal newspaper article entitled, "Wireless Charging Everywhere," dated Dec. 30, 2015.
U.S. Appl. No. 13/869,600, filed Dec. 15, 2015, Office Action.
U.S. Appl. No. 15/342,800, filed Aug. 1, 2018, Notice of Allowance.
U.S. Appl. No. 15/342,800, filed Aug. 6, 2018, Corrected Notice of Allowability.
U.S. Appl. No. 15/342,800, filed Mar. 16, 2018, Office Action.
U.S. Appl. No. 15/342,800, filed Nov. 14, 2018, Issue Notification.
U.S. Appl. No. 15/667,967, filed Jul. 10, 2018, Notice of Allowance.
U.S. Appl. No. 15/667,967, filed Mar. 30, 2018, Notice of Allowance.
U.S. Appl. No. 15/667,967, filed Oct. 24, 2018, Issue Notification.
U.S. Appl. No. 60/778,761, entitled Power Delivery Surface Power Supply Safety, dated Mar. 3, 2006 (59 pages).
www.HomeFurnitureComponents.com, 300ez One-Motor Lift Mechanism, printed on Oct. 21, 2016, 1 page.
www.HomeFurnitureComponents.com, 350ez Recliner Mechanism, printed on Oct. 21, 2016, 1 page.
www.HomeFurnitureComponents.com, 350ez Series Recliner Mechanism, printed on Oct. 21, 2016, 1 page.
www.HomeFurnitureComponents.com, InSpira Lounging Ingenuity video screen shots, printed on Oct. 21, 2016, 10 pages.
www.HomeFurnitureComponents.com, InSpira Lounging Ingenuity, printed on Oct. 20, 2016, 1 page.
International Search Report and Written Opinion mailed Jan. 21, 2025 for PCT Application No. PCT/US2024/045817.

* cited by examiner

MODULAR FURNITURE AND RECLINING ASSEMBLIES

CROSS REFERENCE TO RELATED APPLICATIONS

The present application claims the benefit of U.S. Provisional Patent Application Ser. No. 63/362,809, filed on Apr. 11, 2022, the disclosure of which is incorporated by reference in its entirety.

BACKGROUND

Technical Field

This disclosure generally relates to furniture systems, modular furniture and reclining assemblies.

Related Technology

Modular furniture is advantageous in part because it enables a variety of different furniture configurations to be created using a limited number of parts and because in manufacturing and design, only a limited number of designs are needed, simplifying the manufacturing and supply process. Modular furniture is therefore both efficient, convenient and valuable. It is also important that modular furniture be comfortable so that users will want to sit and remain seated in a sofa configuration, for example, or in a chair or other furniture system.

Traditional furniture has evolved into a variety of different furniture configurations that enable the user to sit comfortably in a variety of different seated positions. For example, traditional furniture features extensive numbers of pieces in order to create a large couch, or a sectional seating configuration in which a number of people can enjoy sitting together to engage in an activity or to watch television or a movie together as a group or family, for example. Recliners, for example, can be used to move from a sitting position to a reclining position in order to further relax the muscles of the back and/or neck. Typical recliners, however, often have a bulky, mechanized appearance that is not aesthetically pleasing or contiguous with the appearance of neighboring furniture pieces. It is often possible to immediately identify which piece is a recliner, often yielding an unpleasant and non-unified appearance.

Furthermore, many traditional recliners included in sectional couches cannot be positioned closely against a back wall because the backrest of the recliner section will often need space behind it in order to recline. This requires the placement of the entire sectional couch system to be sufficiently far away from such a wall to allow for the recliner section to recline. This may reduce the usable space within a room and/or leave undesired spaces between the furniture and such a wall.

Many traditional recliners included in sectional couches simultaneously recline the back support piece and extend the footrest of the recliner. It may be impossible to recline only the back support piece or extend only the footrest with traditional recliners. Additionally, the footrest of traditional recliners typically only provides support to the calves or legs of a user and does not allow a user to comfortably place the soles of their feet on the footrest, where the footrest would provide an appropriately inclined surface to comfortably accommodate such placement of the soles of the user's feet.

For those consumers who do not have the space to accommodate or cannot afford many pieces of furniture, it is also desirable to have furniture which can provide multiple functions, or which can be reconfigured. For example, a couch with a relatively deep and soft seating surface can be desirable when lounging, watching television, or listening to music. In contrast, a couch with a relatively shallow seating surface is often more desirable when sitting upright while in conversation with others. Further, different shapes, sizes, and footprint configurations of furniture may be desired depending on the space which the furniture is to fill, such as a large living room, a small office space, or a home theater setting.

It would be an advantage in the art to provide improved recliner systems, compatible for use with modular furniture systems.

SUMMARY

Disclosed are furniture systems including at least one reclining assembly configured to be selectively coupled to a modular furniture assembly that comprises a base providing a seating surface and an upright member. The reclining assembly includes a housing, a footrest assembly, and a reclining mechanism configured to selectively move the footrest assembly and/or a seat of the base with respect to the housing. The reclining mechanism can be configured to be selectively mountable within the housing (e.g., entirely within the housing), and the reclining mechanism can be selectively orientable within the housing, between at least two different orientations. For example, the reclining mechanism can be selectively oriented within the housing in a "deep" configuration as well as in a "shallow" configuration, allowing the reclining assembly to provide a reclining function in either a "deep" or "shallow" configuration, as selected by the user. In an embodiment, the footrest assembly includes a rotatable footrest panel.

In an embodiment, a reclining assembly includes a base comprising a housing and a footrest assembly where the footrest assembly includes a rotatable footrest panel. The reclining assembly also includes a reclining mechanism mounted within the housing and coupled to the rotatable footrest panel at an attachment point, where the rotatable footrest panel is configured to rotate about the attachment point between at least forward and rearwardly rotated positions relative to a generally horizontal footrest panel position. A backrest panel can be provided, coupled to the base. The ability to rotate the footrest panel in a rearward direction, in addition to forward rotation, allows the footrest to provide an inclined footrest surface against which the user can place the soles of their feet, in an inclined orientation, oriented back towards the seated user. Such functionality of the footrest panel can be particularly advantageous.

In an embodiment, a furniture system is provided that includes a reclining assembly configured to be selectively coupled to a modular furniture assembly comprising a base and an upright member that can be selectively coupled together, the reclining assembly including a housing, a footrest assembly, and a reclining mechanism configured to selectively move the footrest assembly and/or a seat of the base with respect to the housing. The reclining mechanism can be mounted within the housing, and the footrest assembly can include a rotatable footrest panel. The footrest assembly can accommodate both forward and rearward rotation of the panel, as described in other embodiments.

In an embodiment, the furniture system includes a reclining assembly configured to be selectively coupled to a modular furniture assembly comprising a base and an upright member that can be selectively coupled together, the reclining assembly including a housing, a footrest assembly, and a reclining mechanism configured to selectively move the footrest assembly and/or a seat base with respect to the housing. The reclining mechanism can be mounted within the housing, and the reclining mechanism can be configured to selectively extend a footrest assembly out of the deep side or the shallow side of the housing (e.g., where the housing is a non-square rectangle, so as to allow a user to select either a "deep" orientation or a "shallow" orientation for seating, and reclining).

In an embodiment, the furniture system includes a reclining assembly configured to be selectively coupled to a modular furniture assembly comprising a base and an upright member that can be selectively coupled together, wherein the base and upright member each include feet, wherein at least a portion of the coupling is achieved with a shoe coupler, including holes into which the feet of the base and upright member are received, so as to couple the base to the upright member (e.g., which serves as an armrest and/or backrest). The reclining assembly is interchangeable with a standard modular furniture assembly (e.g., by interchanging a standard base with the reclining assembly), so that such a reclining assembly can "drop into" the same shoes that would have held the standard base and/or upright member in such a modular furniture assembly. The reclining assembly can include a housing, a footrest assembly, and a reclining mechanism configured to selectively move the footrest assembly and/or a seat base with respect to the housing. The reclining mechanism can be mounted within the housing, and the reclining mechanism can be configured to selectively extend a footrest assembly out of the housing (e.g., out a deep or shallow side of such housing). In an embodiment, such a configuration can allow a user to transition the reclining assembly between a deep and shallow configuration, while allowing extension of the footrest assembly, and/or reclining of the seat base with whatever dimension (deep or shallow) is positioned to be the front edge of the seat base. For example, the foot spacing of feet on the upright member and standard modular seating base can match the foot spacing on the reclining assembly seating base, allowing such interchangeability to occur.

In any of various embodiments, the reclining assembly is configured to seamlessly integrate and couple to the modular furniture assembly, having a footprint that substantially fits within the geometric specifications of the footprint of the modular furniture assembly. The reclining assembly has a general appearance that is substantially similar to the modular furniture assembly when the reclining assembly is in an un-reclined, compressed position, thereby providing an aesthetically pleasing, unified appearance. This allows a user to install a reclining assembly in any desired seating positions where reclining is desired, while installing modular furniture assembly seating positions (e.g., made up of a base providing a seating surface and one or more upright members providing armrests and/or backrests) in other seating positions, where all such seating positions can be coupled together, to form any of a wide variety of sectional seating configurations. Any given seating position can be swapped out, and interchanged with a reclining assembly (e.g., by dropping the feet of the reclining assembly base into the shoe couplers of the previous standard modular furniture assembly seating position).

As a result, in the compressed position, the reclining assemblies substantially appear to be another (identical) piece of the modular furniture assembly, rather than a more bulky recliner placed next to a modular furniture assembly seating position. The base of the reclining assembly (which houses the reclining mechanism) can have the same or substantially the same footprint and dimensions as a corresponding base of the modular furniture assembly. Thus, a coherent, unified couch design and configuration can be created when the reclining assembly is mounted adjacent a modular furniture assembly of the furniture system. In some embodiments, the reclining assembly appears to be another portion of the modular furniture assembly, as opposed to appearing to be a more bulky mechanized recliner, with an appearance different from the adjacent standard modular furniture assembly which does not recline. The collective reclining assembly and modular furniture assembly thus form an aesthetically pleasing and unified, coherent furniture system where the reclining assembly portion does not stand out awkwardly as a typical recliner and does not have an unpleasant appearance of a typical recliner incongruously placed onto the end of a furniture system.

In an embodiment, the reclining mechanism can fit entirely within the base of the reclining assembly, which base is identical or substantially identical to a non-recliner, standard seating base of the associated modular furniture assembly. This is advantageous as it can allow one to provide for reclining seating locations within a given modular furniture assembly, while minimizing the number of different SKUs needed. For example, a reclining base can simply be provided, coupleable to standard bases, where all armrests and backrests are provided by the same standard upright members coupleable to the various bases (standard bases as well as reclining bases). In other words, no portion of the reclining mechanism need be housed within any of the adjacent upright members, but the entire reclining mechanism is housed entirely within the base of the reclining assembly.

In an embodiment, a furniture system includes a reclining assembly comprising (i) a housing, (ii) a footrest assembly, and (iii) a reclining mechanism configured to selectively move the footrest assembly and/or a seat with respect to the housing, wherein the reclining mechanism is mounted within the housing, and the footrest assembly comprises a rotatable (e.g., both forward and backward) footrest panel.

In an embodiment, a headrest for use with a furniture system is provided, where the headrest is detachable from the furniture system, or is provided separately from the furniture system, and where the headrest includes electronic or other functional components (e.g., speakers or other sound, heating, cooling, massage, or lights).

In an embodiment, a reclining furniture system includes a reclining assembly comprising a seat having a width and depth of different dimensions (e.g., non-square rectangular seat), where the furniture system is configured to allow a user to orient the width or the depth of the seat to form a front edge of the seat, wherein a footrest assembly selectively extends from the front edge of the seat, wherein the reclining assembly includes a reclining mechanism housed within the seat, the reclining assembly being configured to selectively recline the seat with respect to a remainder of the furniture system in either the orientation where the width of the seat forms the front edge of the seat (e.g., a "shallow" configuration) or the depth of the seat forms the front edge of the seat (e.g., a "deep configuration").

In an embodiment a reclining furniture system is provided, including a reclining assembly comprising a seat, wherein the reclining assembly includes a reclining mechanism housed entirely within a footprint of the seat, the reclining assembly being configured to selectively recline the seat with respect to a remainder of the furniture system. For example, such a system can be fully and seamlessly compatible with a modular furniture system that includes one or more bases providing a seating surface, and one or more upright members which provide armrests and/or backrests, when coupled to the bases. The seat of the reclining assembly can have identical or substantially identical dimensions to the non-recliner base of the standard modular furniture system, and can similarly couple to the upright members, to provide armrests and/or backrests. The reclining assembly can thus be configured as a fully interchangeable SKU, relative to the standard base, where the entire reclining mechanism is fully housed within the seat "base" of the reclining assembly, without any portion of the reclining mechanism needing to be housed within the upright members. This minimizes the number of SKUs required for such a system, while providing full compatibility with an existing standard modular furniture system.

In an embodiment, a reclining furniture assembly comprises a reclining assembly comprising a seat, wherein the reclining assembly includes a reclining mechanism housed within the seat, the reclining assembly being configured to selectively recline the seat with respect to a static upright member that is positioned as a backrest, wherein the reclining mechanism comprises a rotating gear that engages against a gear rack, a backrest angle reclining as the seat is pushed forward by the reclining mechanism, the reclining mechanism further including a back support member and/or back support panel (separate from the static upright member that serves as the backrest) having a bottom edge that is pivotally coupled to a back of the seat, wherein a top of the back support member or panel slides up or down, adjacent the upright member that is the backrest, wherein as the seat reclines forward, the bottom of the back support member or panel also moves forward with the seat, and a top of the back support member or panel slides down.

A similar embodiment of a reclining furniture assembly comprises a reclining assembly comprising a seat, wherein the reclining assembly includes a reclining mechanism housed within the seat, the reclining assembly being configured to selectively recline the seat with respect to a static upright member that is positioned as a backrest, wherein the reclining mechanism comprises a rotating gear that engages against a gear rack, a backrest angle reclining as the seat is pushed forward by the reclining mechanism, the reclining mechanism further including a back support member and/or back support panel (separate from the static upright member that serves as the backrest) having a bottom edge that is coupled to a back of the seat, which back support member or panel engages with a back support panel that is pulled outward as the back support member or panel is pulled forward with the seat during the reclining extension. Such a panel can provide a backrest support against which the user can rest or recline. The top of the panel can be hingedly attached to a static backrest upright member, so that the angle between the top hinge point and the bottom of the panel is extended as the bottom of the panel is pulled forward by the back support member or panel (e.g., bracket), attached to the seat. Upon the reverse movement of the seat, the angle between the panel and the static backrest upright member is reduced or closed, as the seat is driven back to its standard un-reclined position.

In an embodiment, a reclining furniture system includes a reclining assembly configured to be selectively coupled to a modular furniture assembly comprising a base providing a seating surface and an upright member that can be selectively coupled together, wherein the modular furniture assembly is such that the seat base has a length (x) and a width (y), and the upright member has a length (x') and a width (z), wherein the seat base and the upright member have a defined spatial relationship, where the length (x) of the seat base is substantially equal to the length (x') of the upright member, and the length (x) of the seat base is substantially equal to the sum of the width (y) of the seat base and the width (z) of the upright member (i.e., $x=x'=y+z$). The reclining assembly comprises (i) a housing, (ii) a footrest assembly and (iii) a reclining mechanism housed entirely within a seat base of the reclining assembly, the reclining mechanism being configured to selectively move the footrest assembly and/or the seat base of the reclining assembly with respect to a remainder of the furniture system. In an embodiment, the seat base within which the reclining mechanism is housed has substantially the same dimensions as the base of the modular furniture assembly that the reclining assembly is selectively coupleable to.

In an embodiment, a reclining assembly includes a carriage of the base, comprising a pivot point defining an axis of rotation, a plurality of tracks, wherein a size and shape of the plurality of tracks is defined by the pivot point, a plurality of brackets each having a set of top dowels or other protrusions that engage and/or communicate with the plurality of tracks and a set of bottom dowels or other protrusions, wherein the plurality of brackets includes a pair of side brackets and a backrest bracket, and a backrest panel attached to the backrest bracket; and a static base portion comprising a plurality of arced tracks, wherein the set of bottom dowels or other protrusions of the plurality of brackets engage and/or communicate with the plurality of arced tracks, and wherein a size and shape of the plurality of arced tracks is also defined by the pivot point of the carriage.

In an embodiment, a reclining assembly includes a carriage of a base comprising a pivot point defining an axis of rotation, a plurality of tracks, wherein a size and shape of the plurality of tracks is defined by the pivot point, a plurality of brackets each having a set of top dowels or other protrusions that engage and/or communicate with the plurality of tracks and a set of bottom dowels or other protrusions, wherein the plurality of brackets includes a pair of side brackets and a backrest bracket, a backrest panel attached to the backrest bracket, and a reclining mechanism. The reclining assembly further includes a static base portion comprising a plurality of arced tracks, wherein the set of bottom dowels or other protrusions of the plurality of brackets engage and/or communicate with the plurality of arced tracks, and wherein a size and shape of the plurality of arced tracks is also defined by the pivot point of the carriage.

In some embodiments, the modular furniture assembly includes (i) a base member for providing a seating surface for a user; and (ii) an upright member configured to be used as a backrest and/or an armrest. Such modular furniture assemblies are highly advantageous, particularly in the dimensions which have a ratio of $x=x'=y+z$ wherein x is the length of the base, x' is the length of a upright member and wherein y is the width of the base and z is the width (thickness) of the upright member. This $x=x'=y+z$ relationship enables a variety of different furniture configurations to be formed, using only the components of the base and the upright member, as described in the following U.S. Patents, each of which is incorporated herein by reference in its entirety: U.S. Pat. Nos. 7,213,885; 7,419,220; 7,547,073; 7,963,612; 8,783,778; 9,277,826; 10,143,307; 10,154,733; 10,806,261; 10,123,621; 10,123,623; and 11,253,073.

In an embodiment, the reclining assembly of the present disclosure enables reclining in a system that employs the $x=x'=y+z$ design ratio, and/or is seamlessly compatible with a modular furniture assembly that employs such a design ratio. Reclining assemblies as described herein could of course also be used with other design ratios, whether used in modular furniture systems, or otherwise. For example, the present reclining assemblies could also be used with a modular furniture system design ratio where x=y+2z, as described in U.S. Publication No. 2022/0000266, herein incorporated by reference in its entirety. In some embodiments, the reclining assembly includes a base framework assembly configured to be mounted on a support surface (e.g., a floor) and a backrest member mounted on and/or coupled to the base framework assembly. The base includes at least a two-piece framework, which in an embodiment, has a length x, a width y, where x=y+z, and is capable of an extended, reclined dimension a (dimension in the shallow seat configuration) or b (dimension in the deep seat configuration), wherein the framework is a rectangular framework and wherein a=y+z+extension of the footrest panel; b=x+z+extension of the footrest panel; and b is greater than a. The framework includes (i) a housing, which rests on the support surface or floor, and (ii) a footrest assembly. In some embodiments, the housing comprises four panels: a first pair of static panels and a second pair of panels, where each panel of the second pair is configured to be static and/or dynamic. For example, in some embodiments, a first panel (e.g., corresponding to the x dimension, when oriented in the shallow seat configuration) of the second pair is configured to act as the footrest panel while the second panel of the second pair is configured to be a static panel of the housing. In some embodiments, the second panel (e.g., corresponding to the y dimension when oriented in the deep seat configuration) of the second pair is configured to act as the footrest panel while the first panel of the second pair is configured to be a static panel of the housing.

The base further comprises a reclining mechanism housed within the housing and operatively coupled to the footrest assembly, the reclining mechanism selectively moving the footrest assembly with respect to the housing. In some embodiments, the backrest member is also coupled to the reclining mechanism. The recliner framework remains or substantially remains within the x=x'=y+z footprint in the compressed position and at least a portion of the footrest assembly moves out of the x=x'=y+z footprint in the extended position, where x is the length of the base; x' is the length of an upright member; y is the width of the base and z is the width (or thickness) of the upright member.

In some embodiments, the footrest assembly can include at least one rotatable footrest panel that is attached and/or coupled to the reclining mechanism. The footrest panel can be configured to rotate with respect to the base (and, therefore, with respect to the housing of the base framework). In some embodiments, the footrest panel is configured to rotate back towards the user, with a negative rotation, so as to provide an inclined surface on which the user can place the soles of their feet. Such a configuration can be particularly comfortable for a relatively shorter user. In some embodiments, the footrest panel is configured to rotate forward, away from the user, with a positive rotation (e.g., allowing resting of the calves of the user against the declined, forwardly rotated surface). In some embodiments, the footrest panel is capable of both types of rotation (both negative and positive), allowing the user to select the rotation they desire. In some embodiments, the rotatable footrest panel is detachable from the reclining mechanism and can be engaged with the housing, to be hidden from view, or otherwise disguised.

In some embodiments, the reclining mechanism includes a gas spring actuator and/or a lock. The lock can be incorporated in the gas spring actuator or can be an additional, separate component. The reclining mechanism can be configured to be rotated within the housing, enabling at least two reclining arrangements or orientations for the reclining assembly. The at least two reclining arrangements or orientations include a reclining shallow seating arrangement or orientation and a reclining deep seating arrangement or orientation. While a gas spring or linear actuator can be used, other embodiments, including a rotating gear and a gear rack, can provide additional benefits, as described herein (e.g., significantly greater footrest extension while housing the actuator mechanism within a given compact footprint).

In some embodiments, the furniture system can include embedded electronic or other functional components, such as induction or other chargers, speakers, subwoofers, electrical hubs, haptic feedback elements (e.g., eccentric rotating mass actuators), and/or combinations thereof. Examples of such embedded components are described in the following U.S. Patents, each of which is incorporated herein by reference in its entirety: U.S. Pat. Nos. 10,236,643; 10,212,519; 10,979,241; 11,172,301; 11,178,487; 10,972,838; and 11,178,486. In some embodiments, the furniture system includes a controller to control the reclining mechanism. The controller can be a wired remote controller, a wireless remote controller, buttons on a portion of the reclining assembly and/or a software application on a mobile device (e.g., a cell phone), for example. The software application can be configured for voice control and/or activation of the reclining mechanism. The software application can also be configured to control any such embedded electronic or other functional components.

Beneficially, disclosed furniture systems enable a coherent, unified couch design and configuration that can be created when the reclining assembly is mounted adjacent a modular furniture assembly of the furniture system (which can simply include standard, non-reclining bases, and upright members). In other words, the reclining assembly is beneficially stealthily incorporated into the overall furniture system. Additionally, disclosed furniture systems employ a reclining assembly that is configured to recline with "zero-wall clearance," meaning the reclining assembly can be placed up against, or in close proximity to, a back wall or other support and still allow a user to experience a full range of reclining. Disclosed furniture systems also beneficially include a rotatable footrest panel, which is configured to be rotated away from or toward the reclining assembly and a user. The rotatable footrest panel enables a more ergonomic seating experience for the user, as a user can now rotate the footrest panel to accommodate either the user's calves or legs, or soles of their feet at the user's discretion. Further, the rotatable footrest panel enables a more ergonomic seating experience for users of all sizes and heights.

Also beneficially, the disclosed furniture systems include a reclining mechanism that is selectively mountable and orientable within the reclining assembly. Such selective mountability and orientation enable a user to configure the reclining assembly in at least two seating arrangements or orientations, further enabling a flexible, adaptable ergonomic experience for the user.

One particular benefit of the present reclining assemblies is that the present systems are far easier to take home, or move, once purchased. In addition, because the components of the system are modular, where conventional recliners are one piece (which piece is very heavy, and bulky), the present systems are modular, providing the reclining base separate from the upright member of the furniture assembly. In an embodiment, the reclining mechanism could be provided separately from the reclining base, as well. In any case, each component by itself is far easier to move and handle, such that the system can be moved and assembled even by a single person, which is simply not practical with a conventional recliner.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

BRIEF DESCRIPTION OF THE DRAWINGS

Various objects, features, characteristics, and advantages of the invention will become apparent and more readily appreciated from the following description of the embodiments, taken in conjunction with the accompanying drawings and the appended claims, all of which form a part of this specification. In the Drawings, like reference numerals may be utilized to designate corresponding or similar parts in the various Figures, and the various elements depicted are not necessarily drawn to scale.

DETAILED DESCRIPTION

Figure 1A:
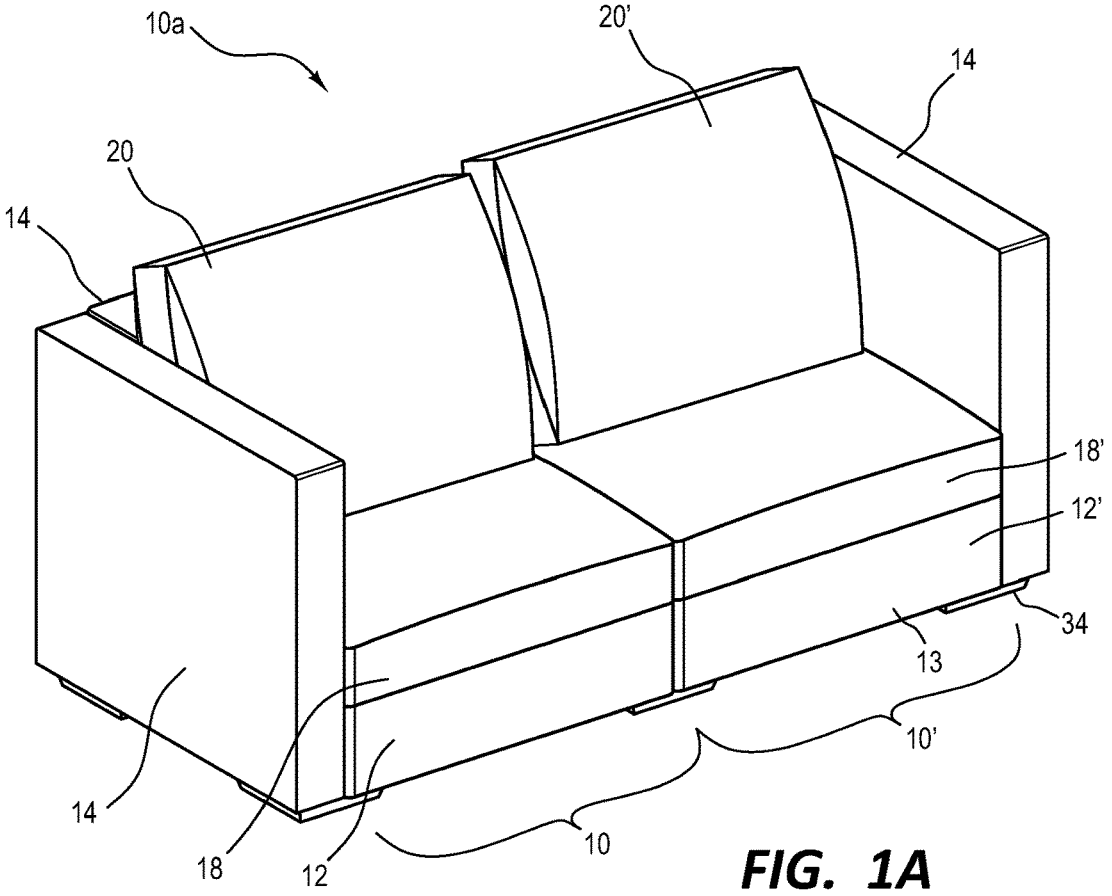
FIG. 1A is an isometric or perspective view of a furniture system of the present disclosure in the form of a sofa with a reclining assembly shown in a compressed (non-reclined) position and having an appearance similar to the adjacent modular furniture assembly, which is selectively coupled to the reclining assembly (i.e., one seat reclines, while the other does not).

Disclosed are furniture systems including at least one reclining assembly, configured for selective coupling to a modular furniture assembly including a base and upright member that are coupleable together, to form the modular furniture assembly. The reclining assembly includes a housing, a footrest assembly, and a reclining mechanism configured to selectively move the footrest assembly and/or a seat base with respect to the housing. The reclining mechanism can be configured to be selectively mountable within the housing, and the reclining mechanism can be selectively orientable within the housing, between at least two different orientations (e.g., a deep seat configuration and a shallow seat configuration). In an embodiment, the footrest assembly includes a rotatable footrest panel.

Another embodiment is directed to a reclining assembly including a base with a housing and a footrest assembly, where the footrest assembly includes a rotatable footrest panel. The reclining assembly also includes a reclining mechanism mounted within the housing, coupled to the footrest assembly, where the rotatable footrest panel is configured to rotate between at least forwardly and rearwardly rotated positions relative to a generally horizontal footrest panel position.

Another embodiment is directed to a furniture system including a reclining assembly that can be selectively coupled to a modular furniture assembly that includes a base and an upright member. Such a reclining assembly includes a housing, a footrest assembly, and a reclining mechanism configured to selectively move the footrest assembly and/or a seat base with respect to the housing. The reclining mechanism can be configured to be selectively mountable within the housing, and the footrest assembly includes a rotatable footrest panel (e.g., rotatable in both a forward and rearward direction).

Another embodiment is directed to a furniture system including a reclining assembly that can be selectively coupled to a modular furniture assembly that includes a base and an upright member. Such a reclining assembly includes a housing, a footrest assembly, and a reclining mechanism configured to selectively move the footrest assembly and/or a seat base with respect to the housing. The reclining mechanism can be configured to be selectively mountable within the housing, and the reclining mechanism can be configured to selectively extend a footrest assembly out of a deep side or a shallow side of the housing.

Another embodiment is directed to a reclining furniture system including a reclining assembly including a seat having a width and a depth of different dimensions (e.g., a non-square, rectangular seat). The furniture system is configured to allow a user to orient the width or depth of the seat to form a front edge of the seat, wherein a footrest assembly selectively extends from the front edge of the seat, where the reclining assembly includes a reclining mechanism housed within the seat, the reclining assembly being configured to selectively recline the seat with respect to a remainder of the furniture system in either the orientation where the width of the seat forms the front edge of the seat or the depth of the seat forms the front edge of the seat. For example, the seat width may be 35 inches, and the seat depth 29 inches. This allows the system to be configured to allow reclining such that either the 35 inch width forms the front edge (out of which the reclining foot panel extends) or that the 29 inch depth forms the front edge (out of which the reclining foot panel extends). The user can select which orientation they wish to set the system to, and this selection can be changed by the user, when desired.

Another embodiment is directed to a reclining furniture system including a reclining assembly with a seat, where the reclining assembly includes a reclining mechanism housed entirely within a footprint of the seat, the reclining assembly being configured to selectively recline the seat with respect to a remainder of the furniture system.

Another embodiment is directed to a reclining furniture system including a reclining assembly having a seat, wherein the reclining assembly includes a reclining mechanism housed within the seat, the reclining assembly being configured to selectively recline the seat with respect to a static upright member that serves as a backrest. The reclining mechanism includes a rotating gear that engages against a gear rack, where a backrest angle reclines as the seat is pushed forward by the reclining mechanism. The reclining mechanism further includes a back support member or panel having a bottom edge that is pivotally coupled to a back of the seat, wherein a top of the back support member or panel slides up or down, adjacent the upright member that serves as the backrest. As the seat reclines forward, the bottom of the back support member or panel also moves forward with the seat, and a top of the back support member or panel slides down.

Another embodiment is directed to a reclining furniture system including a reclining assembly that is selectively coupleable to a modular furniture assembly, where the modular furniture assembly includes a seat base and an upright member that can be selectively coupled together. The modular furniture assembly is such that the seat base has a length (x) and a width (y), and the upright member has a length (x') and a width (z). The seat base and upright member have a defined spatial relationship where the length (x) is substantially equal to the length (x') of the upright member, and the length (x) of the seat base is substantially equal to the sum of the width (y) of the seat base plus the width (z) of the upright member. The reclining assembly includes a housing, a footrest assembly, and a reclining mechanism that is housed entirely within the seat base of the reclining assembly. The reclining mechanism is configured to selectively move the footrest assembly and/or the seat base of the reclining assembly with respect to a stationary portion (e.g., remainder) of the furniture system.

Another embodiment is directed to a reclining assembly that can accomplish one or more of the various characteristics described for any such embodiments. For example, such a reclining assembly can include a carriage that includes a pivot point defining an axis of rotation, a plurality of tracks, where a size and shape of the tracks is defined by the pivot point. A plurality of brackets are provided, each having a set of top dowels or other protrusions that engage or communicate with the tracks and a set of bottom dowels or other protrusions, where the brackets include a pair of side brackets and a back support bracket. A back support panel is attached to the back support bracket. A static lower base member is also provided, for coupling to the carriage, where the static lower base member includes a plurality of arced tracks. The bottom dowels or other protrusions of the side brackets and back support bracket engage or communicate with the arced tracks, to allow rotation (e.g., 90° rotation) of the carriage over the static base. Such a configuration allows rotation of the carriage from a deep seat configuration, to a shallow seat configuration, and vice versa. The size and shape of the arced tracks is defined by the pivot point of the carriage, so as to allow accomplishment of the desired 90° rotation, between deep seat and shallow seat configurations.

Another embodiment is directed to a reclining assembly including a carriage having a pivot point defining an axis of rotation, a plurality of tracks in the carriage, where a size and shape of the tracks is defined by the pivot point. The carriage also includes a plurality of brackets, where each bracket includes one or more top dowels or other protrusions that engage or communicate with the tracks. The brackets also include bottom dowels or other protrusions that engage or communicate with arced tracks of a static lower base member. The brackets include a pair of side brackets, and a back support bracket. Such brackets can be L-shaped, so one leg of the bracket can be sandwiched between the upper and lower base members associated with the rotating carriage, and the other leg can extend substantially vertically to provide an attachment point for the side panels (e.g., kick panels) of the housing. A back support panel is attached to the back support bracket. The carriage further includes a reclining mechanism. The size and shape (e.g., length, radius of curvature, etc.) of the arced tracks is defined by the pivot point of the carriage, to ensure the desired rotation of the carriage from a shallow seat configuration, to a deep seat configuration.

In an embodiment, the rotatable footrest panel is configured to selectively rotate forwardly or rearwardly relative to a generally horizontal footrest panel position, allowing a user to rotate the footrest for reception of either the user's calves (e.g., when rotated forward), or the users soles of the feet (when rotated rearward).

In an embodiment, the reclining mechanism is configured to be rotatable within the housing, so as to allow a user to selectively extend a footrest assembly out of the deep side or out of the shallow side of the housing. The described carriage and static lower base member is one mechanism for accomplishing such. Other possible mechanisms for accomplishing such are of course possible, as will be apparent to those of skill in the art.

The reclining assembly is configured to seamlessly integrate and couple to an existing modular furniture assembly, having a footprint in a compressed position that substantially fits within the geometric specifications of the footprint associated with the modular furniture assembly. The reclining assembly has a general appearance that is substantially identical to the modular furniture assembly (formed from base(s) and upright member(s)) when the reclining assembly is in the un-reclined, compressed position, thereby providing an aesthetically pleasing, unified appearance. The reclining assembly can be modular in the same way that the modular furniture assembly is modular. For example, a user can purchase any number of desired standard bases or seats, and any number of reclining bases or seats, and a corresponding number of upright members (to provide armrests and/or backrests), by coupling such components in a wide variety of different configurations. Any of the reclining bases or seats can be interchanged with any of the standard bases or seats, as they have the same footprint dimensions.

For example, such a modular furniture assembly can be configured to attach bases and upright members using a system of feet, and shoe couplers that couple a foot of a base to a foot of an upright member (or a foot of a base, to a foot of another base). For example, such shoe couplers can include holes into which the feet of the base and upright member are received, so as to couple the base to the upright member together. The reclining base is interchangeable with a standard base by interchanging the two, so that such a reclining base can "drop into" the same shoes that would have held the standard base and/or upright member in such a modular furniture assembly. For example, the foot spacing of feet on the upright member and standard modular seating base can match the foot spacing on the reclining base, allowing such interchangeability to occur.

In addition, because the reclining mechanism is entirely housed within the reclining base (not split between the base and upright member), the same upright members can be used for coupling to a reclining base, as a standard base. Such minimizes the need for additional SKUs, while providing additional functionality.

As a result, in the un-reclined, compressed position, the reclining assemblies substantially appear to be another identical piece of the modular furniture assembly, rather than a bulky recliner placed next to a modular furniture assembly. Thus, a coherent, unified couch design and configuration can be created when the reclining assembly is mounted adjacent a standard modular furniture assembly of the furniture system. In some embodiments, the reclining assembly appears to be just another standard modular furniture assembly, identical to the other modular furniture assembly segments of the overall furniture system, as opposed to appearing to be a bulky mechanized recliner. The collective reclining assembly and modular furniture assembly thus form an aesthetically pleasing and unified, coherent furniture system which does not awkwardly stand out as a typical recliner often does, and does not have an unpleasant appearance of a typical recliner incongruously placed onto the end of a furniture system.

In some embodiments, the modular furniture assembly includes (i) a base member providing a seating surface for a user; and (ii) an upright member configured to be used as a backrest and/or an armrest. Such modular furniture assemblies are highly advantageous, particularly in the dimensions which have a ratio of $x=x'=y+z$ wherein x is the length of the base, x' is the length of an upright member and wherein y is the width of the base and z is the width (thickness) of the upright member. This $x=x'=y+z$ relationship enables a variety of different furniture configurations to be formed, using only the components of the base and the upright member, as mentioned in Applicant's patents and applications already incorporated herein by reference.

In an embodiment, the reclining assembly of the present disclosure enables reclining in a system that employs a ratio that meets the $x=x'=y+z$ ratio. The present reclining assemblies also provide an assembly that is seamlessly compatible with modular furniture assemblies that employ such a ratio. In some embodiments, the reclining assembly includes a base that, in some embodiments, is configured to be mounted on a support surface (e.g., floor) and a back support panel coupled to the base. A standard upright member can also be coupled to the base, behind the back support panel, as any standard backrest of the modular furniture system would be. In some embodiments, the reclining base includes at least a two-piece framework, which in an embodiment, has a length x, a width y, where x=y+z, and is capable of an extended, reclined dimension a (dimension of the "depth" of the seat in the shallow seat configuration; the front edge of the seat in such a configuration is x) or b (dimension of the "depth" of the seat in the deep seat configuration; the front edge of the seat in such a configuration is y), wherein the framework is a rectangular or generally rectangular framework and wherein a=y+z+extension of the footrest panel; b=x+z+extension of the footrest panel; and b is greater than a. Because x=y+z, the difference between widths a and b is thus a distance of z (the difference between x and y). In an embodiment, this can be about 6 inches. For example, in an embodiment, the seat can be configured such that x is about 35 inches and y is about 29 inches.

The framework can include (i) a housing, which rests on the floor and (ii) a footrest assembly. The housing can include four panels (e.g., removable "kick" panels) and a seat base, where the back support panel is coupled to the seat base. A standard stationary upright member can also be coupled to the seat base, behind the back support panel, providing the same esthetics as a standard modular furniture assembly. The base further comprises a reclining mechanism housed within the base housing and coupled to the footrest assembly, the reclining mechanism selectively moving the seat and/or the footrest assembly with respect to the stationary portions of the housing. The reclining mechanism is also coupled to the seat base and, thereby, also coupled to any provided back support panel.

By substantially retaining the footprint x=y+z, the recliner assembly has a similar or identical footprint to the x=x'=y+z footprint of the modular furniture assembly adjacent to which the reclining assembly is placed, and to which it is coupled. Such coupling can be in an identical manner to how two standard modular furniture assembly segments are coupled to one another. Also, by being configured to have a similar or identical geometric appearance as the modular furniture assembly, the reclining assembly thus appears to be just another modular furniture assembly, not a bulky, awkward recliner.

The reclining assembly can be used in a variety of different locations within the furniture system, such as on the side of a standard modular furniture assembly, between standard modular furniture assemblies, or a variety of different locations, any of which can be employed within a small, medium or large assembly of furniture. The recliner assembly also has "kick" panels that hide the reclining mechanism hidden within the housing of the reclining base, making the reclining assembly more aesthetically appealing.

In another embodiment, the furniture assembly comprises a furniture system, comprising: (A) a modular furniture assembly comprising a base and an upright member that can be selectively coupled to each other; and (B) a reclining assembly configured to be selectively coupled to the modular furniture assembly, wherein the reclining assembly is configured to be mounted adjacent to the modular furniture assembly such that the reclining assembly can be selectively coupled to the modular furniture assembly to form a sofa or couch, wherein the reclining assembly comprises: (1) a base configured to be mounted on a support surface, the base comprising: (i) a housing; and (ii) a footrest assembly that moves with respect to the housing, and wherein the reclining assembly has at least two seating configurations—a shallow configuration with a depth a that equals y+z+ extension of a rotatable footrest panel; and a deep seat configuration with a depth b that equals x+z+ extension of a rotatable footrest panel, where the dimension b is greater than the dimension a.

In some embodiments, the footrest assembly includes at least one rotatable footrest panel that is attached to the reclining mechanism. The rotatable footrest panel is configured to rotate with respect to the base (and, therefore, with respect to the housing). In some embodiments, the rotatable footrest panel is configured to negatively rotate back towards the user, forming an inclined plane, enabling the user to place the soles of their feet on the inclined plane provided by the rotatable footrest panel. In some embodiments, the rotatable footrest panel is configured to positively rotate forward, away from the user, enabling support of the user's calves. In some embodiments, the footrest panel is detachable from the reclining mechanism and engages with the housing. In an embodiment, the rotatable footrest panel forms part of the housing of the base (e.g., a panel thereof), which is movable as described.

In some embodiments, the reclining mechanism includes a gas spring actuator and/or a lock. The lock can be incorporated in the gas spring actuator or can be an additional component. The reclining mechanism can be configured to rotate within the housing, enabling reclining from at least two seating arrangements or orientations of the base. The at least two seating arrangements or orientations for which reclining are available can include a shallow seating arrangement or orientation and a deep seating arrangement or orientation. The reclining mechanism can rotate within the housing of the base, between two different positions, to accommodate reclining in whatever seating arrangement orientation the user selects.

In some embodiments, the reclining mechanism includes a rotating gear that engages against a gear rack, rather than a linear actuator or a gas spring actuator. For example, the gear and gear rack can operate to push the seat forward, where a back support associated with the reclining seat defines a back angle. The back support angle can be defined by a bottom edge of the back support member or panel that is pivotally attached to the back of the seat frame. The top of the back support slides up or down, adjacent a static standard upright member or back wall. As the seat frame moves forward, the bottom of the back support moves forward and the top of the back support slides down. This motion greatly simplifies the mechanism required, allowing for use of a simple gear and rack. Such a gear and rack can also be used to drive the footrest forward, and up toward its deployed configuration. The gear and rack mechanism allows for far greater travel in a smaller mechanism than a conventional linear actuator, typically found in a recliner.

In some embodiments, the furniture system includes embedded electronic or other functional components, such as induction or other chargers, speakers, subwoofers, electrical consoles, heating and/or cooling elements, massage elements, haptic feedback elements (e.g., eccentric rotating mass actuators), and/or combinations thereof. In some embodiments, the furniture system includes a controller to control the reclining mechanism. The controller can be a wired remote controller, a wireless remote controller, buttons on a portion of the reclining assembly and/or a software application on a mobile device (e.g., a cell phone), for example. The software application can be configured for voice control and/or activation of the reclining mechanism. The software application can also be configured to control the embedded electronic or other functional components.

Modular Furniture Assemblies

Figure 1B:
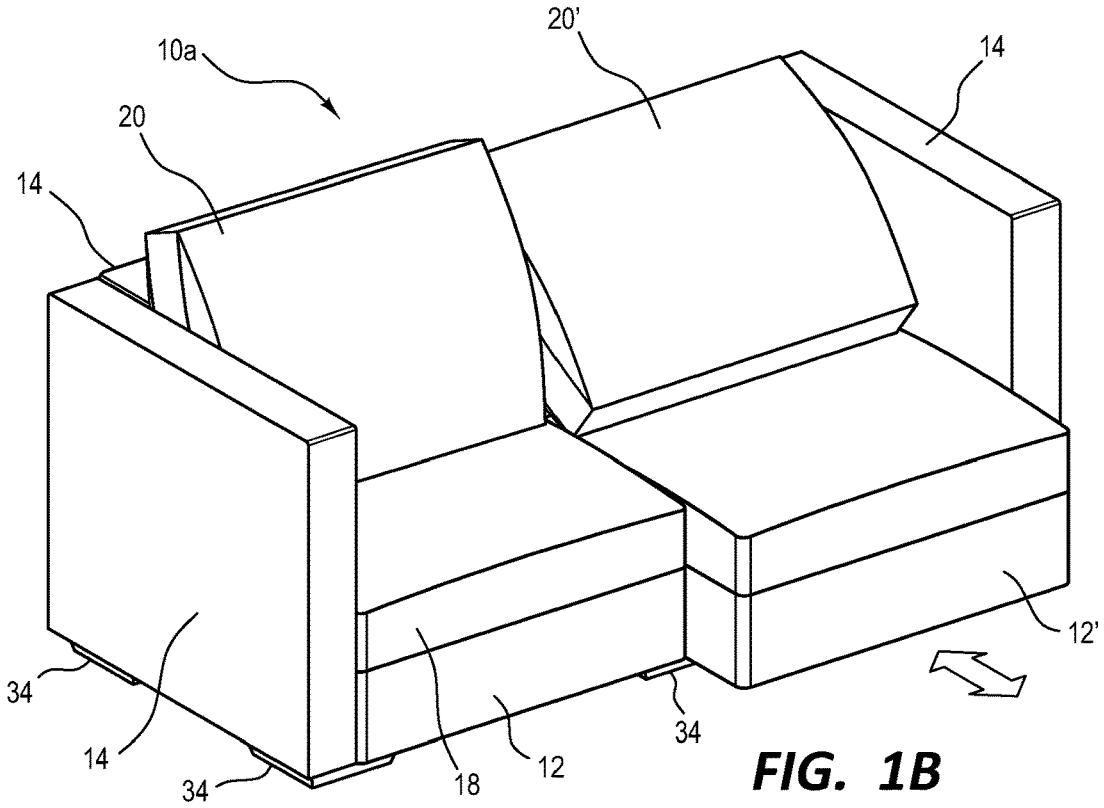
FIG. 1B is an isometric or perspective view of the furniture system of FIG. 1A with the reclining assembly shown in an extended, reclined position.

FIG. 1A is a perspective view of a furniture system 10*a* of the present invention with a reclining assembly 10' shown in a compressed (un-reclined) position. FIG. 1B is a perspective view of the furniture system of FIG. 1A with the reclining assembly 10' shown in an extended, reclined position.

As shown in FIGS. 1A-1B, the furniture system 10*a* is a sofa comprised of: (i) a standard (non-reclining) modular furniture assembly 10; and (ii) a reclining assembly 10' positioned adjacent the modular furniture assembly 10 and selectively coupled thereto in a unified, aesthetically pleasing manner such that the reclining assembly 10' generally has the appearance of any other standard modular furniture assembly, rather than a bulky, awkward mechanized recliner.

The modular furniture assembly 10 of FIGS. 1A-1B and FIGS. 2A-2B is comprised of: (i) a base member 12 providing a seating surface to a user; and (ii) an upright member 14 configured to be used as a backrest and/or an armrest. Such modular furniture assemblies are highly advantageous, particularly those having a design ratio of x=x'=y+z wherein x is the length of the base, x' is the length of the upright member and wherein y equals the width of the base and z equals the width (thickness) of the upright member. This x=x'=y+z relationship enables a variety of different furniture configurations to be formed, using only the components of the base and the upright member. Base member 12 is selectively coupled to upright member 14 and/or other bases, and interacts with upright member 14 and such additional bases to be usable to form a wide variety of modular furniture assemblies as described in various of Applicant's patents, already incorporated by reference.

As shown in FIGS. 1A-2B, modular furniture assembly 10 further includes a seat cushioning member 18 mounted on base member 12 and a back cushioning member 20 mounted adjacent an upright member 14. Upright member 14 is selectively coupled to base member 12 by coupler 15 and one or more foot couplers 34. Additional couplers 15 and foot couplers 34 can be used to connect additional bases and/or upright members 14 to one or more bases 12, e.g., with upright members 14 serving as backrests or armrests as shown in FIG. 1B, which also shows an upright member 14 coupled to reclining assembly 10' as an armrest. An additional upright member 14 can be coupled behind the reclining base 12' of reclining assembly 10', behind back cushioning member 20', as will be apparent.

Figure 2A:
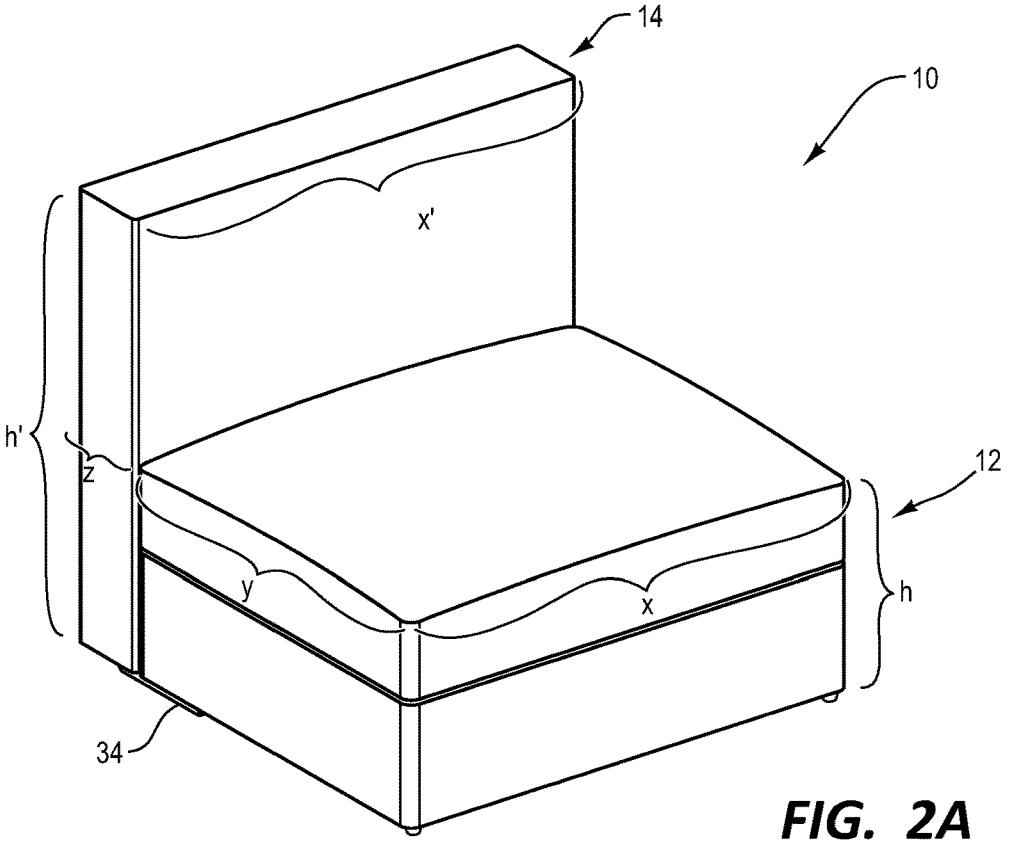
FIG. 2A is an isometric or perspective view of the standard non-reclining modular furniture assembly portion of the furniture assembly of FIG. 1A.
Figure 2B:
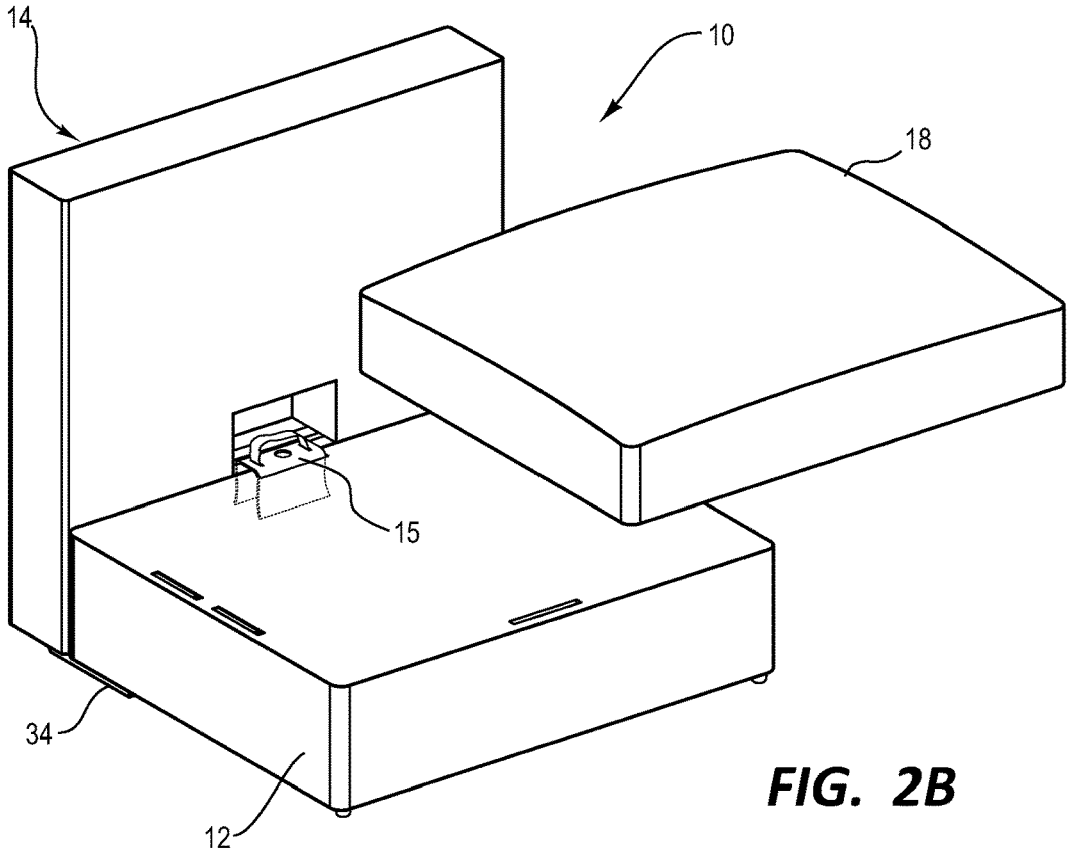
FIG. 2B is an exploded view of the modular furniture assembly of FIG. 2A.

In the embodiment of FIGS. 2A and 2B as described Applicant's patents already incorporated by reference, the length x of base 12 is substantially equal to the length x' of upright member 14, each of which are substantially equal to the width y of base 12 plus the width (thickness) z of upright member 14, such that x=x'=y+z. This design ratio of x=x'=y+z enables a variety of different furniture configurations to be formed and is an efficient configuration for a furniture system. By way of example, in an embodiment, x is about 35 inches, y is about 29 inches, and z is about 6 inches. It will be apparent that other values within the same ratio are of course also possible.

Seat cushion 18 can be selectively attached to base 12, e.g., through the use of a hook and loop attachment mechanism such as VELCRO. Other attachment mechanisms are of course also possible.

Also as shown in FIGS. 1A-1B and as further shown in FIGS. 3A-3D, reclining assembly 10' is comprised of a base 12' configured to be mounted on a support surface (e.g., floor). Base 12' includes a footrest assembly 13 (FIG. 4) and a seat cushion 18', that is mounted on a seat base 26 of the housing (which is part of the base 12'), upon which a back cushion 20' is mounted. A back support panel 22 is mounted on and/or coupled to the seat base 26, as discussed in further detail below.

The reclining assembly 10' is configured to have a footprint that substantially fits within the geometric specifications of the footprint of the standard modular furniture assembly 10, when compressed, and has a similar overall aesthetic appearance. Thus, as shown in FIG. 1A, reclining assembly 10' appears to be another standard modular furniture assembly 10 and does not have bulky, awkward looking mechanized parts visible to a user. As shown in FIG. 1A, the reclining assembly 10' has a general appearance that is similar to the modular furniture assembly 10 when the reclining assembly 10' is in the un-reclined position. In some embodiments, in the compressed, un-reclined position, the reclining assembly 10' occupies approximately or exactly the same footprint as the footprint occupied by modular furniture assembly 10. In some embodiments, in the compressed, un-reclined position, the reclining assembly 10' occupies approximately or exactly the same footprint as the footprint occupied by modular furniture assembly 10. The reclining assembly 10' appears to be another modular furniture assembly 10 rather than having a bulky, awkward looking appearing with visible mechanized parts.

Thus, as shown in FIG. 1A, the combination of the modular furniture assembly 10 and the reclining assembly 10' generates a unified, aesthetically pleasing looking couch, which looks like two modular furniture assemblies mounted next to each other, rather than appearing to have an awkward bulky, mechanized recliner mounted next to a modular furniture assembly. Thus, as shown in FIG. 1A, a coherent, unified couch design and configuration can be created when the reclining assembly 10' is mounted adjacent a modular furniture assembly 10 of the furniture system 10*a*.

Reclining Assemblies and Mechanisms

Figure 3A:
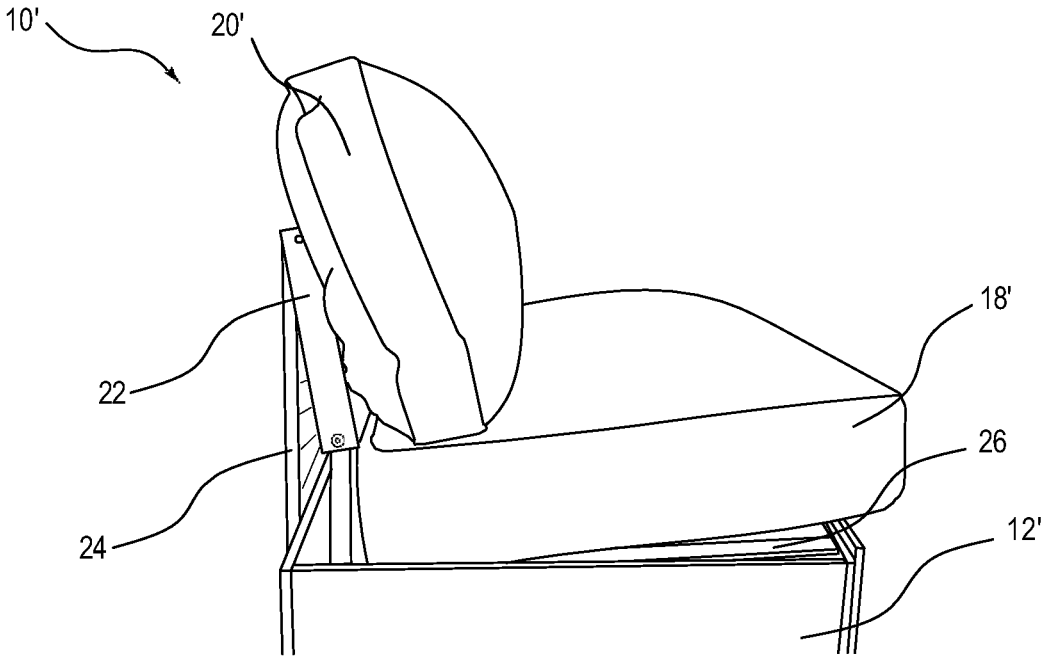
FIGS. 3A-3D illustrate an example of a reclining assembly of the present disclosure.
Figure 3B:
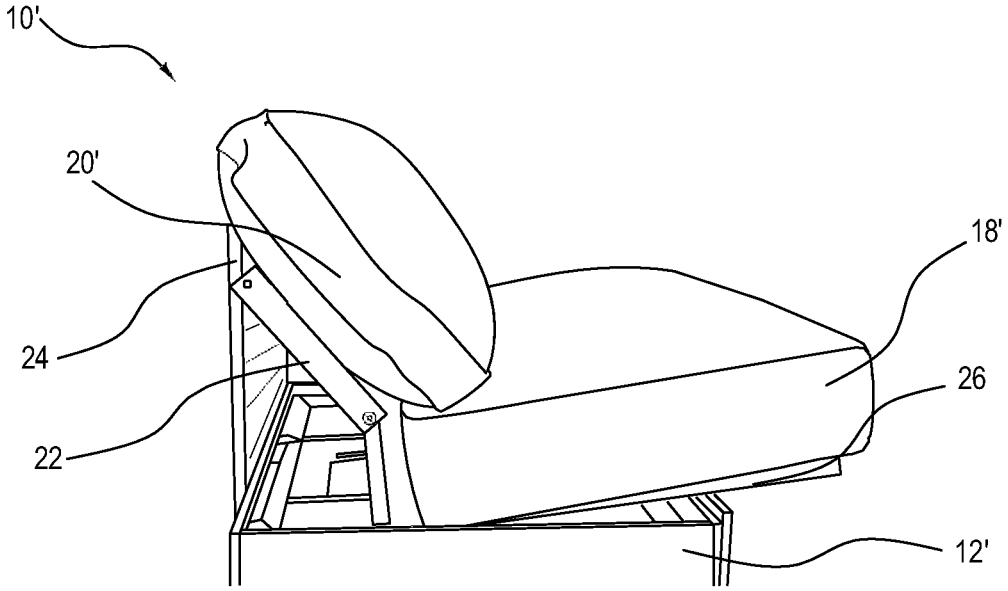
Figure 3C:
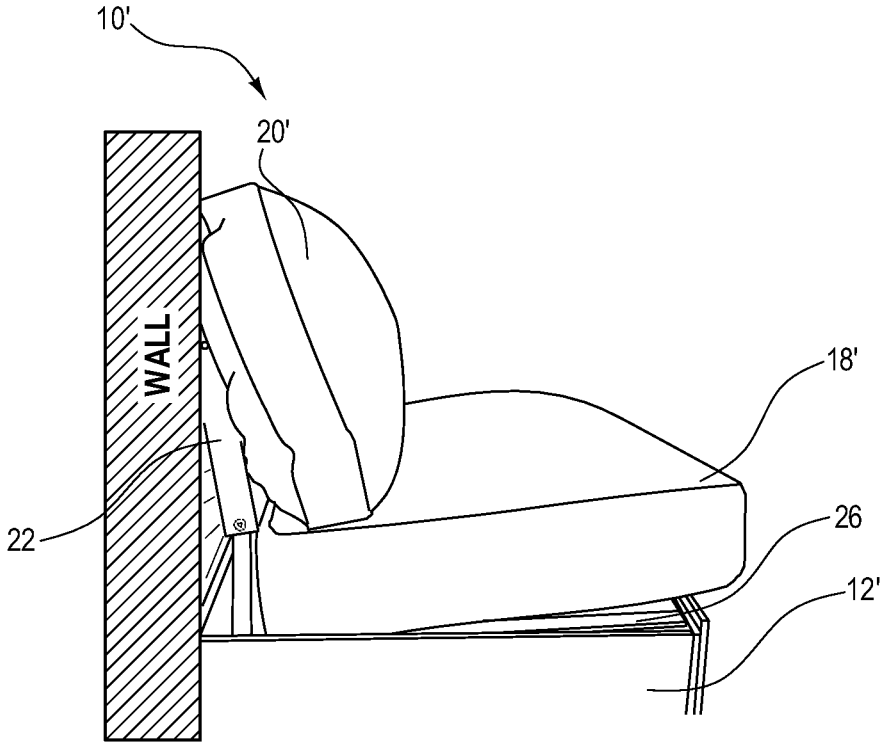
Figure 3D:
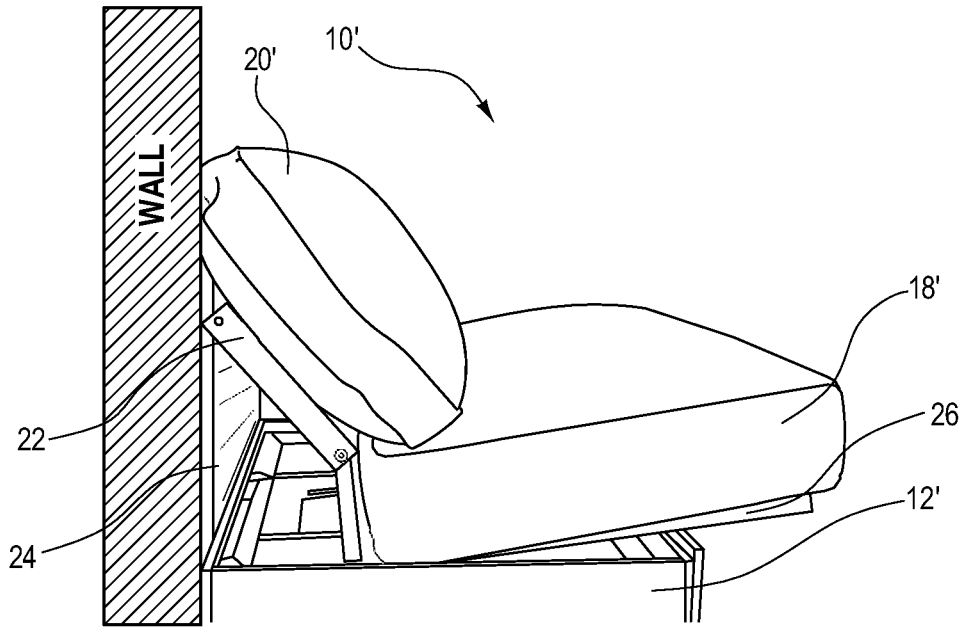

FIGS. 3A-3D illustrate an example of the reclining assembly of the present disclosure. FIG. 3A is a side view of reclining assembly 10' in a compressed position with the back cushion 20' resting against back support panel 22. FIG. 3B is a side view of the reclining assembly 10' in an extended, reclined position. FIGS. 3C-3D illustrate the reclining assemblies 10' of FIGS. 3A-3B, respectively, against a wall with zero-wall clearance. As illustrated in FIGS. 3A-3D, the reclining assembly 10' includes (i) a base 12' (which includes the housing, the seat base 26 and the footrest assembly); (ii) a seat cushion 18'; (iii) a back cushion 20'; and (iv) a back support panel 22. One or more upright members 14 can be coupled to reclining base 12' in the same way they could be coupled to a standard base 12 (e.g., as an armrest, or backrest).

The seat base 26 is connected to the reclining mechanism. The reclining mechanism is configured to slightly incline the seat base 26 simultaneously to reclining and extending the seat base 26. In some embodiments, the seat base 26 is inclined at approximately 5° to 20° (such as 6°, 7°, 8°, 9°, 10°, 11°, 12°, 13°, 14°, 15° or within a range defined by any two of the foregoing values) with respect to the horizontal. Beneficially, inclining the seat base 26 provides a more comfortable seating experience for the user. Inclining beyond approximately 20°, 15°, or perhaps even 12° can result in placement of an outside edge of the seat cushion 18' too high above the floor (or other support surface), resulting in an uncomfortable seating position, particularly for long periods of time. Thus, in an embodiment, the incline provided by the reclining mechanism provides an incline of from 5° to 15°, or 6° to 12° or 7° to 10°.

The back support panel 22 is coupled to the seat base 26, such that when the reclining mechanism extends and reclines the seat base 26, the back support panel 22 also moves (e.g., is pulled along). The back support panel 22 is configured to recline at an angle of approximately 20° to 45° relative to the vertical, such as 22°, 25°, 27°, 30°, 32°, 35°, 37°, 40°, 42° or an angle within a range defined by any two of the foregoing values. In some embodiments, the back support panel 22 is configured to recline at a greater angle, e.g., even as much as approximately 90° (i.e., a horizontal, lay-flat configuration), particularly where accompanied by a headrest.

As the seat cushion 18' is mounted on the seat base 26, movement of the seat base 26 similarly moves the seat cushion 18'. In some embodiments, the back support panel 22 is selectively couplable to the seat base 26. In some embodiments, the back support panel 22 is permanently attached to the seat base 26. The back cushion 20' is mounted on the back support panel 22, such that movement of the back support panel 22 similarly moves the back cushion 20'. As shown in FIGS. 3B and 3D, a top edge of the back support panel 22 slides generally vertically up and down against a support 24, while a bottom edge of the back support panel 22 slides generally horizontally with the seat base 26. In an embodiment, the support 24 can be substantially vertical. To enable the vertical sliding motion of the back support panel, the back support panel 22 can include a roller or a series of rollers that facilitate the movement. A slide plate can be provided on support 24, for durability and wear resistance.

Additionally, and/or alternatively, the back support panel 22 can be configured to slide along a surface of the support 24, which can be or include an upright member 14. In some embodiments, the seat cushion 18' includes an accommodation cutout configured to accommodate the back support panel 22. If the seat cushion 18' includes such an accommodation cutout, the seat cushion 18' for the shallow seating configuration can be different than the seat cushion 18' for the deep configuration. In both the shallow and deep seating configurations, the back support panel 22 is located in approximately the same area on the seat base 26, such that simple rotation of the seat cushion 18' can be performed when transitioning from a shallow seat configuration to a deep seat configuration.

The back cushion 20' can include a pocket to receive the back support panel 22 and hide it from view. The back cushion 20' can thus be coupled to panel 22. FIGS. 3C and 3D illustrate the vertical sliding movement of the back support panel 22 (and, thus, the back cushion 20') when the reclining assembly 10' is up against a vertical surface, such as a wall. The back support panel 22 can slide vertically down the wall rather than hinging backward and running into the wall. This configuration enables a user of the furniture system to place the furniture system in smaller rooms and/or spaces than would normally accommodate a reclining chair or sofa, as the movement during recline occurs in the forward direction, rather than rearward. This configuration also enables a "zero-wall clearance," meaning a reclining assembly of the furniture system can be placed directly up against a wall (or within 6 inches, 4 inches, 3 inches, or 2 inches thereof) and still allow a user to experience a full range of reclining. For example, a user can experience a range of reclining from 5° to 55° (compared to the fully upright position of the seat and backrest) while the furniture system is still positioned up against a wall.

Figure 4:
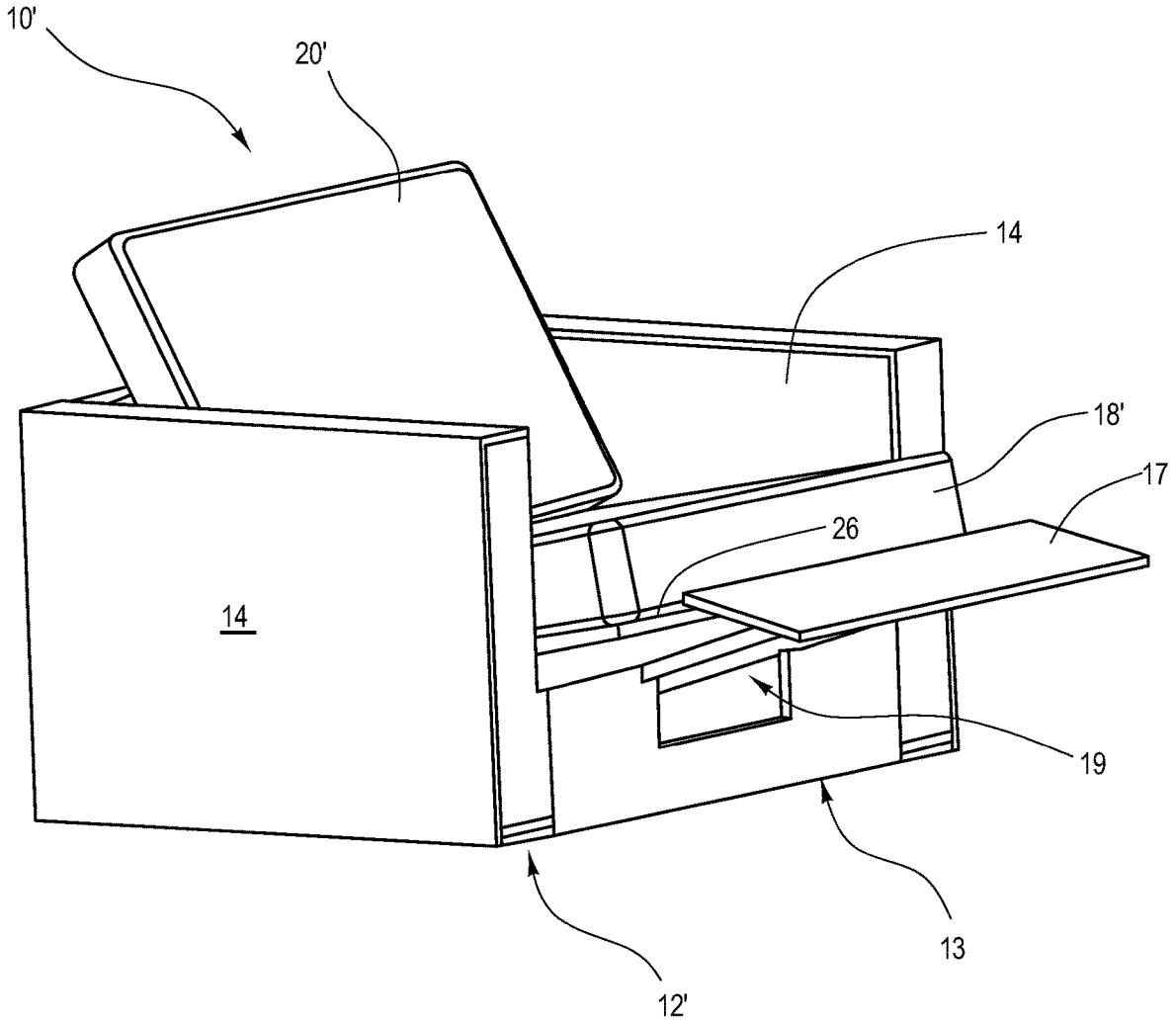
FIG. 4 illustrates a front isometric or perspective view of a reclining assembly of the present disclosure, in a fully reclined position, with the footrest panel extended.

FIG. 4 illustrates a front perspective view of a reclining assembly of the present disclosure. The illustrated reclining assembly 10' includes at least one upright member 14 configured to be used as an armrest (two upright members 14 are illustrated coupled to the respective sides), a back cushion 20', a seat cushion 18', a seat base 26, a reclining base 12', a footrest assembly 13 and a cutout 19. An additional standard upright member 14 can be coupled at the back of reclining base 12', adjacent the back support panel 22 and back pillow 20'. Such additional upright member can couple to reclining base 12' in the same way such an upright member couples to a standard base 12, to provide a backrest. While a cutout 19 within the kick panel of the base 12' is shown, it will be appreciated that in another embodiment, no such cutout is provided. For example, the entire or substantially entire kick panel of the base can extend with the footrest assembly 13. The illustrated footrest assembly 13 includes a rotatable footrest panel 17, illustrated in the extended position. The reclining mechanism can enable extension and/or reclining of the rotatable footrest panel 17 independent from extending and/or reclining the seat cushion 18' and seat base 26.

Figure 5A:
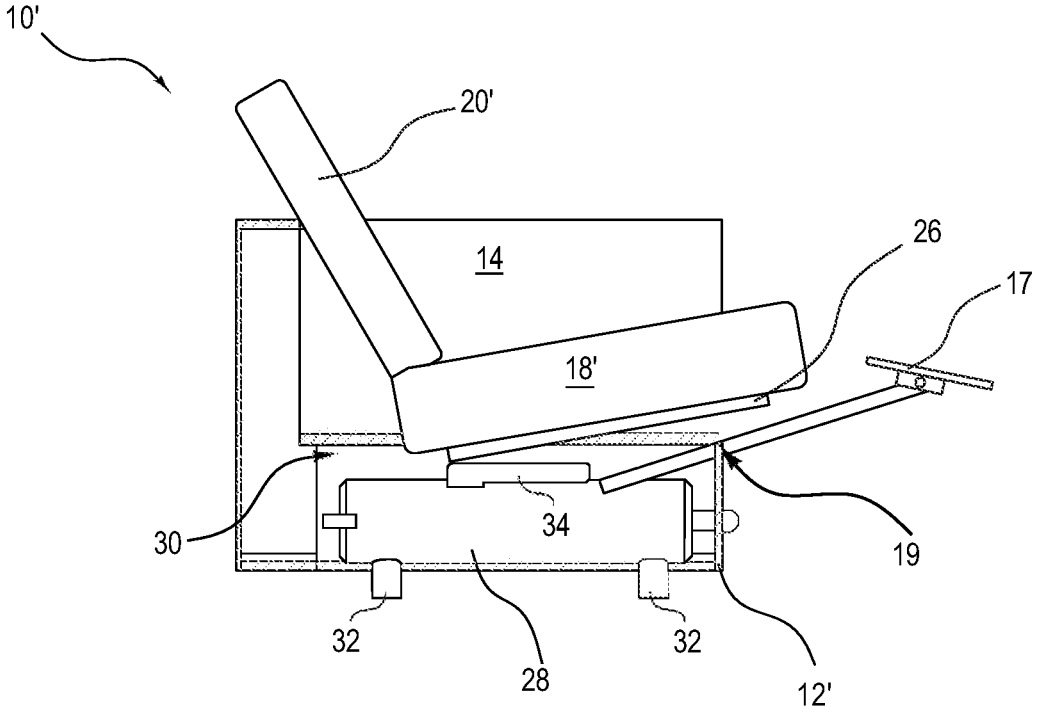
FIG. 5A illustrates a schematic side view of a reclining assembly of the present disclosure and FIG. 5B illustrates a rear isometric or perspective schematic view of the reclining assembly.
Figure 5B:
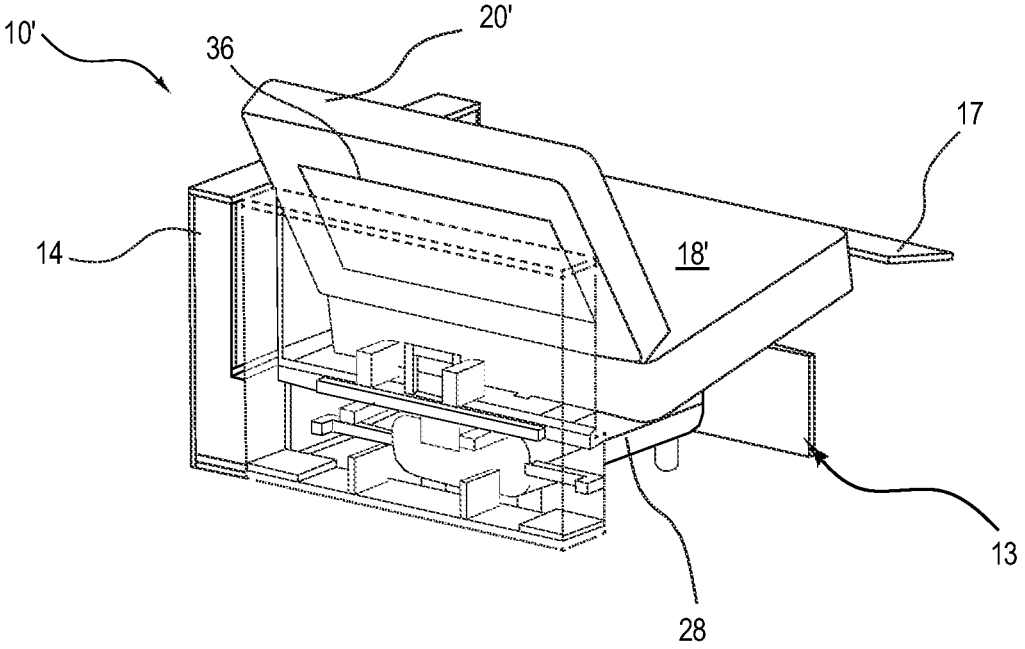

FIG. 5A illustrates a schematic side, cross-sectional view of a reclining assembly 10' of the present disclosure and FIG. 5B illustrates a schematic back perspective view of the reclining assembly 10'. FIG. 5A illustrates a reclining assembly 10' including at least one upright member 14 positioned and coupled an armrest, a back cushion 20', a seat cushion 18', a seat base 26, a footrest assembly 13 including the rotatable footrest panel 17, cutout 19 and a reclining mechanism 28. The reclining mechanism 28 is housed within the housing 30 of the reclining base 12'. The reclining mechanism 28 is configured to be selectively mountable and/or selectively orientable within the housing 30, to allow the reclining base 12' to be transitioned from providing reclining in a shallow seat configuration, to providing reclining in a deep seat configuration.

In some embodiments, the reclining mechanism 28 includes at least one, such as two or three, reclining mechanisms contained within the reclining mechanism 28. In some embodiments, the disclosed reclining mechanism can include one or more linear actuators, mechanically and/or electrically driven. In another embodiment, a gear rack and a rotating gear are used. Use of a gear rack and rotating gear advantageously allows for significantly more travel in a smaller mechanism as compared to a linear actuator. In any case, by way of example, the reclining mechanism 28 can have a first reclining mechanism that is coupled to the rotatable footrest panel 17. The first reclining mechanism can be configured to extend (and, thereby "recline") the rotatable footrest panel 17. For example, the first reclining mechanism can include a linear actuator or gas spring and can extend through the cutout 19 when extending the rotatable footrest panel 17. Alternatively, the first reclining mechanism that extends the footrest panel can employ a gear rack and a rotating gear. In any case, the first reclining mechanism can be a mechanical and/or electrical linear actuator, gear and gear rack, or other mechanism that causes the rotatable footrest panel 17 to extend. Though the rotatable footrest panel 17 is illustrated at an angled position, it should be understood that upon initial extension or deployment of the rotatable footrest panel 17, the rotatable footrest panel 17 will likely be horizontally oriented, e.g., parallel with, for example, the floor. As discussed more fully below, the rotatable footrest panel 17 can be configured to rotate about the attachment point of where the rotatable footrest panel 17 couples and attaches to the reclining mechanism 28 (e.g., the first reclining mechanism of the overall reclining mechanism 28).

In some embodiments, the reclining mechanism 28 includes a second reclining mechanism coupled to the seat base 26. The second reclining mechanism can be separate from the first reclining mechanism and can be configured to forwardly extend (and, thereby "recline") the seat base 26, to which the seat cushion 18' is mounted. The second reclining mechanism can also cause the seat base 26 to incline simultaneously while reclining or extending. In some embodiments, as the reclining mechanism 28 (or the second reclining mechanism thereof) extends the seat base 26, the back cushion 20' (attached to the back support panel 22, which is coupled to the seat base 26) moves with the seat base 26. That is, as the reclining mechanism 28 extends and slides the seat base 26 forward and toward the rotatable footrest panel 17, the back support panel 22, and thereby back cushion 18', vertically slides downward to also be in a reclining position. The second reclining mechanism can similarly include a gear rack and rotating gear, a linear actuator, gas spring, etc. Use of a gear rack and rotating gear provides advantages of increased travel in a smaller mechanism, as noted. The reclining mechanism 28 can also include a third reclining mechanism to control the rotation of the rotatable footrest panel 17 as the rotatable footrest panel 17 is being extended by the first reclining mechanism.

As shown in FIG. 5B, the reclining mechanism 28 is housed within the housing 30, which is part of base 12'. In an embodiment, when the rotatable footrest panel 17 is extended, a portion of the footrest assembly conceals the reclining mechanism 28 from view. FIGS. 5A and 5B illustrate a metal-to-floor configuration, where feet of the reclining mechanism 28 extend through the housing and the base to contact the support surface, for example, the floor.

Figure 6:
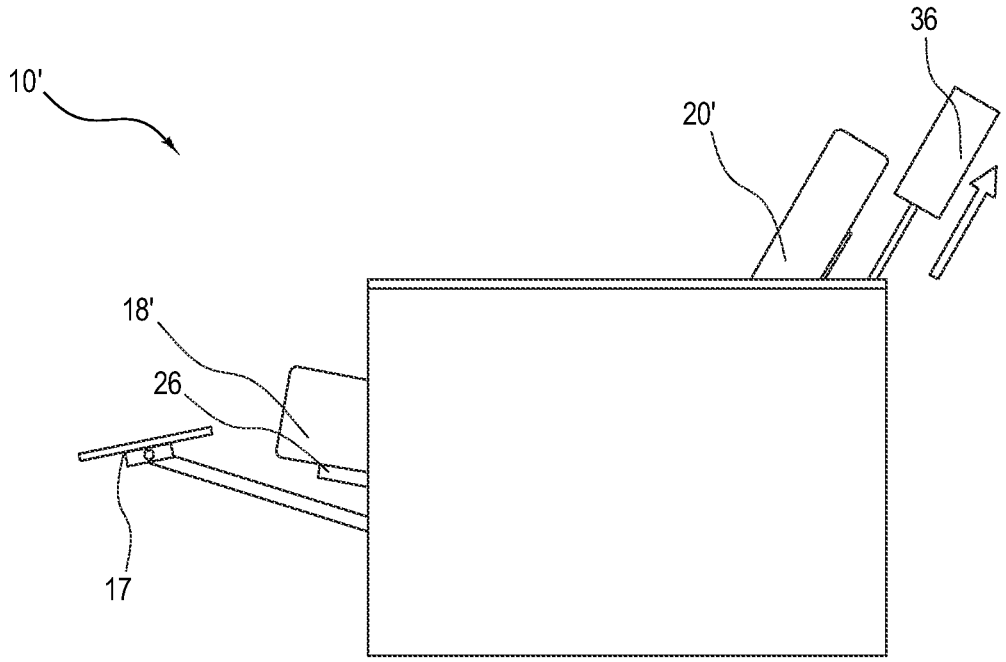
FIG. 6 illustrates another example of a reclining assembly of the present disclosure, with a footrest panel extended, and a headrest deployed.

FIG. 6 schematically illustrates another example of a reclining assembly of the present disclosure. As illustrated, the reclining assembly 10' includes at least one upright member 14 shown positioned for use as an armrest, a back cushion 20', a seat cushion 18', a seat base 26, a rotatable footrest panel 17 and a headrest 36. In some embodiments, the headrest 36 is coupled to the back cushion 20' and/or back support panel 22. In some embodiments, the headrest 36 is configured to telescope or otherwise deploy from a concealed position to an extended position. In some embodiments, reclining the seat cushion 18' (and, thereby, the back cushion 20') causes the headrest 36 to deploy into the extended position. In some embodiments, extension and deployment of the headrest 36 is controlled separately from the seat cushion 18' and/or the rotatable footrest panel 17. For example, this can allow the user to deploy the headrest, whether the seat 18' is reclined or not, or whether the footrest assembly is extended or not. In some embodiments, when the headrest 36 is in the concealed position, the headrest 36 is invisible to a user.

In some embodiments, the headrest 36 is a separate and removable component configured to be placed on an additional upright member 14, coupled and placed as a backrest. The headrest 36 can have a length that is equal to or shorter than the length of the upright member 14. A height of the separate and removable headrest 36 can be within a range of 5 to 10 inches, such as 6 inches, 7 inches, 8 inches, 9 inches or a height within a range defined by any two of the foregoing values. In some embodiments, the separate and removable headrest 36 is coupled or attached to the additional upright member 14 via hook-and-loop fasteners (e.g., VELCRO), snaps, detents, or other appropriate connections. In some embodiments, the separate and removable headrest 36 is simply placed on the additional upright member 14, without necessarily coupling thereto.

Figure 7:
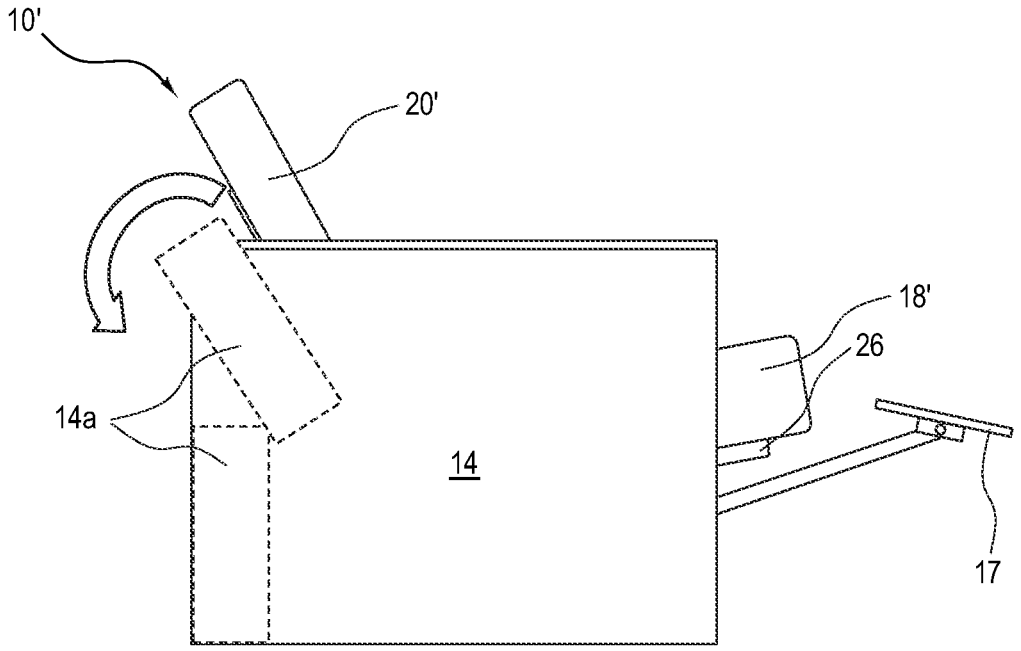
FIG. 7 illustrates another example of a reclining assembly of the present disclosure.

FIG. 7 illustrates another example of a reclining assembly of the present disclosure. As illustrated, the reclining assembly 10' includes at least one upright member 14 coupled and place for use as an armrest, a back cushion 20', a seat cushion 18', a seat base 26 and a rotatable footrest panel 17. In some embodiments, a portion 14*a* of the upright member is configured to pivot along with movement of the back cushion 20'. In some embodiments, the portion 14*a* of the upright member that pivots is the same as back support panel 22 (see FIGS. 3A-3D). In some embodiments, the portion 14*a* of the upright member 14 that pivots is not the same as backrest panel 22. Pivoting of the portion of the upright member 14*a* enables the reclining assembly 10' to recline when placed up against a vertical obstacle surface, such as a wall, with "zero-wall clearance," as defined above. While various embodiments that provide unique functionality within a backrest upright member are described, it will be appreciated that it can be advantageous that any functionality be provided separately from the upright member, to reduce the number of SKUs needed in such a recliner furniture system. For example, advantageously, a user can simply purchase a reclining base, and a plurality of upright members, without the need to purchase any specialized upright member for use with the reclining base.

Figure 8A:
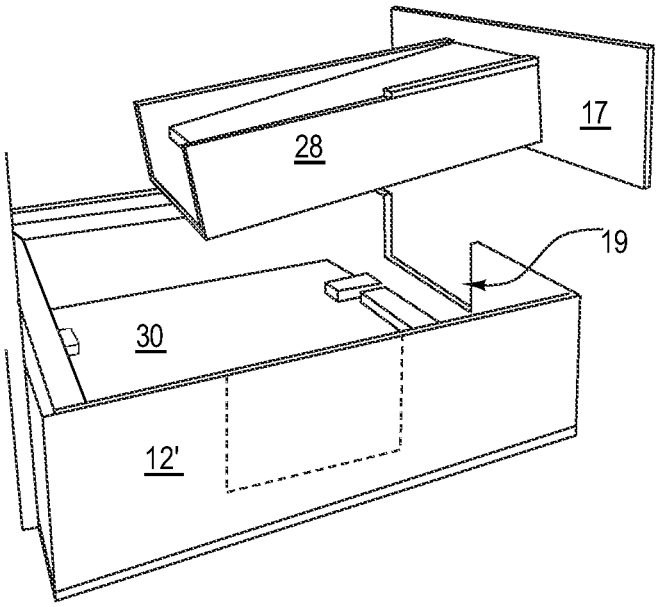
FIGS. 8A-8B illustrate isometric or perspective views of an exemplary reclining mechanism of the present disclosure.
Figure 8B:
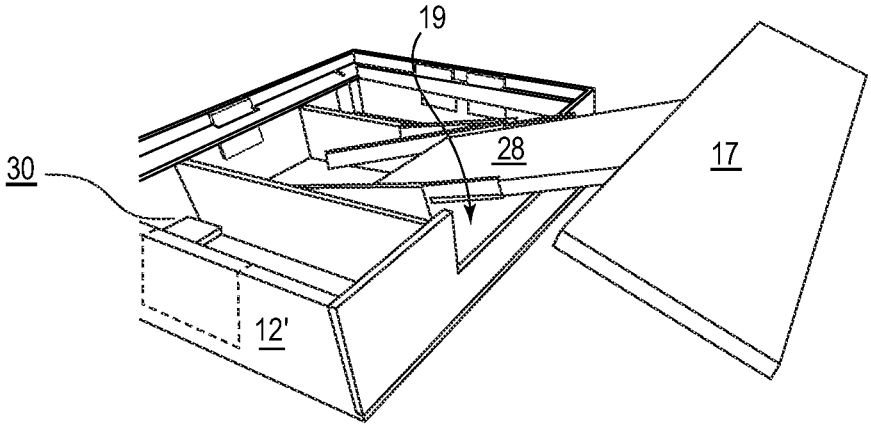

FIG. 8A illustrates an exploded schematic perspective view of the reclining mechanism in a non-reclined position and FIG. 8B illustrates a perspective view of the reclining mechanism in the reclined and extended position. FIG. 8A shows the rotatable footrest panel 17 coupled to the reclining mechanism 28 and in a horizontal orientation. When in the un-reclined position, the rotatable footrest panel 17 is configured to hide and visually conceal the cutout 19 and the reclining mechanism 28. The reclining mechanism 28 is housed within housing 30 of base 12'. Another cutout, illustrated in phantom, can be provided on another portion of the base 12' and filled with a removable panel, depicted by the phantom lines. The removable panel can be moved from one cutout to another and reattached when the reclining mechanism 28 is moved between the shallow seat configuration and the deep seat configuration. The removable panel can be retained in place using a locking mechanism, such as hook and loop fasteners, clips, latches, etc.

FIG. 8B shows the reclining mechanism 28 in an extended and reclined position. At least a portion of the reclining mechanism 28 can extend through the cutout 19. For example, in some embodiments, a first reclining mechanism is coupled to the rotatable footrest panel 17 and extends through the cutout 19 when in the reclined positioned. As shown in FIG. 8B, the rotatable footrest panel has been rotated slightly forward, with a leading edge rotating away from the reclining mechanism 28. The various possible and selectable rotations of the rotatable footrest panel 17 are discussed more fully below.

Figure 9A:
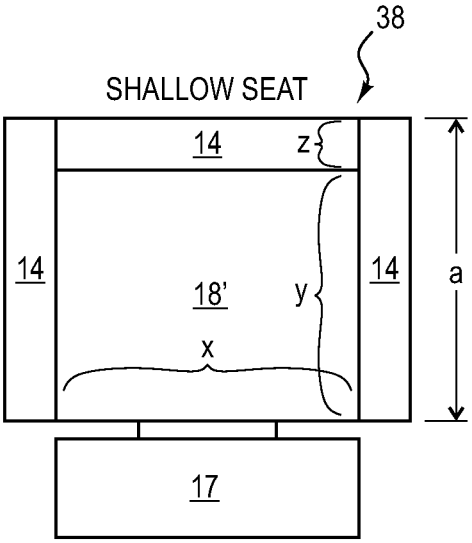
FIGS. 9A-9D illustrate shallow and deep seat configurations of the reclining assembly.

FIGS. 9A-9D illustrate shallow and deep seat configurations of the reclining assembly. FIG. 9A illustrates a shallow configuration 38 of the reclining assembly 10', which includes a seat cushion 18', upright members 14, which act as arm and backrests, and a rotatable footrest panel 17. The shallow configuration 38 has a reclined depth dimension a, including the rotatable footrest panel 17. The base of the reclining assembly (which includes a two-piece framework) still retains the dimension of length x and width y, where x=y+z; the reclined depth dimension a of the base, when extended, equals y+z+ extension of footrest panel 17.

Figure 9B:
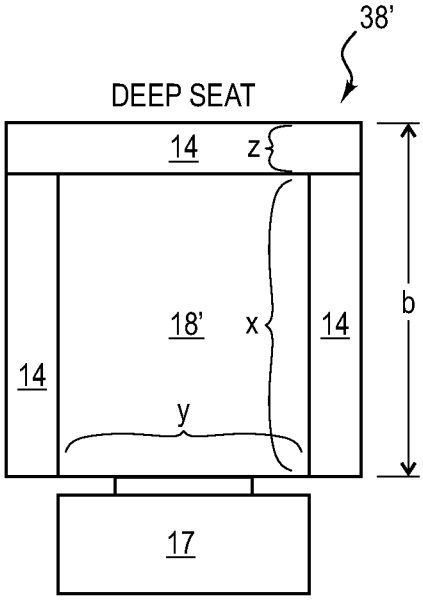

FIG. 9B illustrates a deep configuration 38' of the reclining assembly 10', which includes the same seat cushion 18', upright members 14, and rotatable footrest panel 17. In the deep configuration, a specially dimensioned upright member 14 can be used. The deep configuration 38' has a reclined depth dimension b, including the rotatable footrest panel 17. The distance b is equal to the length of the base x plus the width z (thickness) of the upright member 14, plus the extension provided by footrest panel 17. The dimension b of the deep configuration 38' is greater than the dimension a of the shallow configuration 38. The distance a is equal to the width of the base 12' y plus the width z (thickness) of the upright member 14, plus the extension provided by footrest panel 17. Because x=y+z, the difference between distances a and b is thus a distance of z (the difference between x and y). In an embodiment, this is about 6 inches. The seat cushion 18' of the deep configuration 38' can be the same seat cushion 18' of the shallow configuration 38 that has been rotated approximately 90°. In the deep seat configuration, the upright member 14 serving in the backrest position can be narrower than the other upright members 14. The base of the reclining assembly (which includes the two-piece framework) still retains the dimension of length x, where x=y+z; the reclined dimension b of the base, when extended, equals x+z+ extension of footrest panel 17 and the reclined dimension a, when extended, equals y+z+ extension of footrest panel 17, where b is greater than a, as shown.

The reclining mechanism 28 (see FIGS. 9C and 9D) can be selectively mounted within the housing of the reclining base 12' in a manner that accounts for the approximately 6-inch difference between the shallow and deep seating configurations 38, 38'. For example, in the deep seating configuration, the reclining mechanism is indexed approximately 6 inches closer to or toward the rotatable footrest panel 17. Various mechanisms for accomplishing and accommodating the transition from deep to shallow configuration are possible, examples of which are described herein.

Figure 9C:
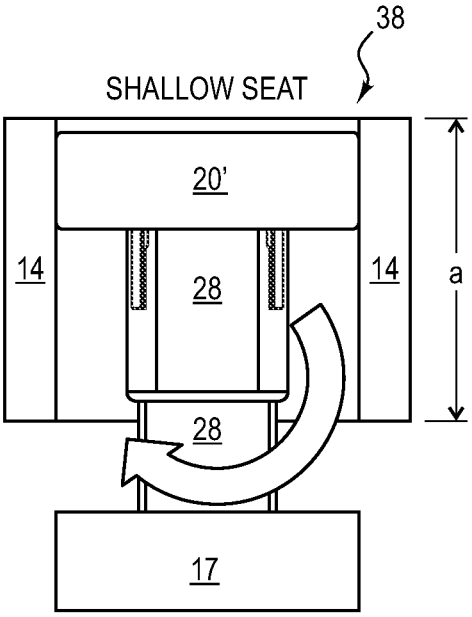
Figure 9D:
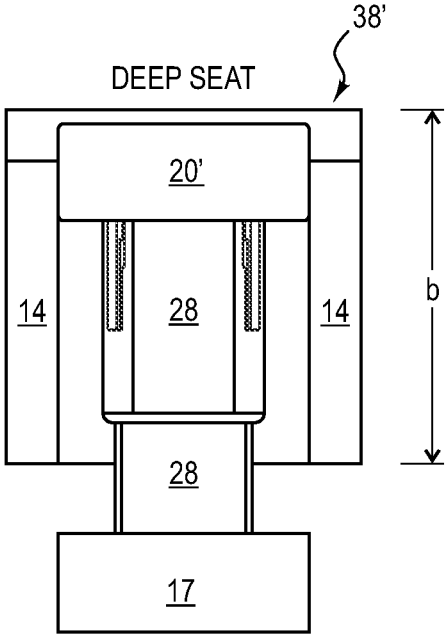
Figure 18:
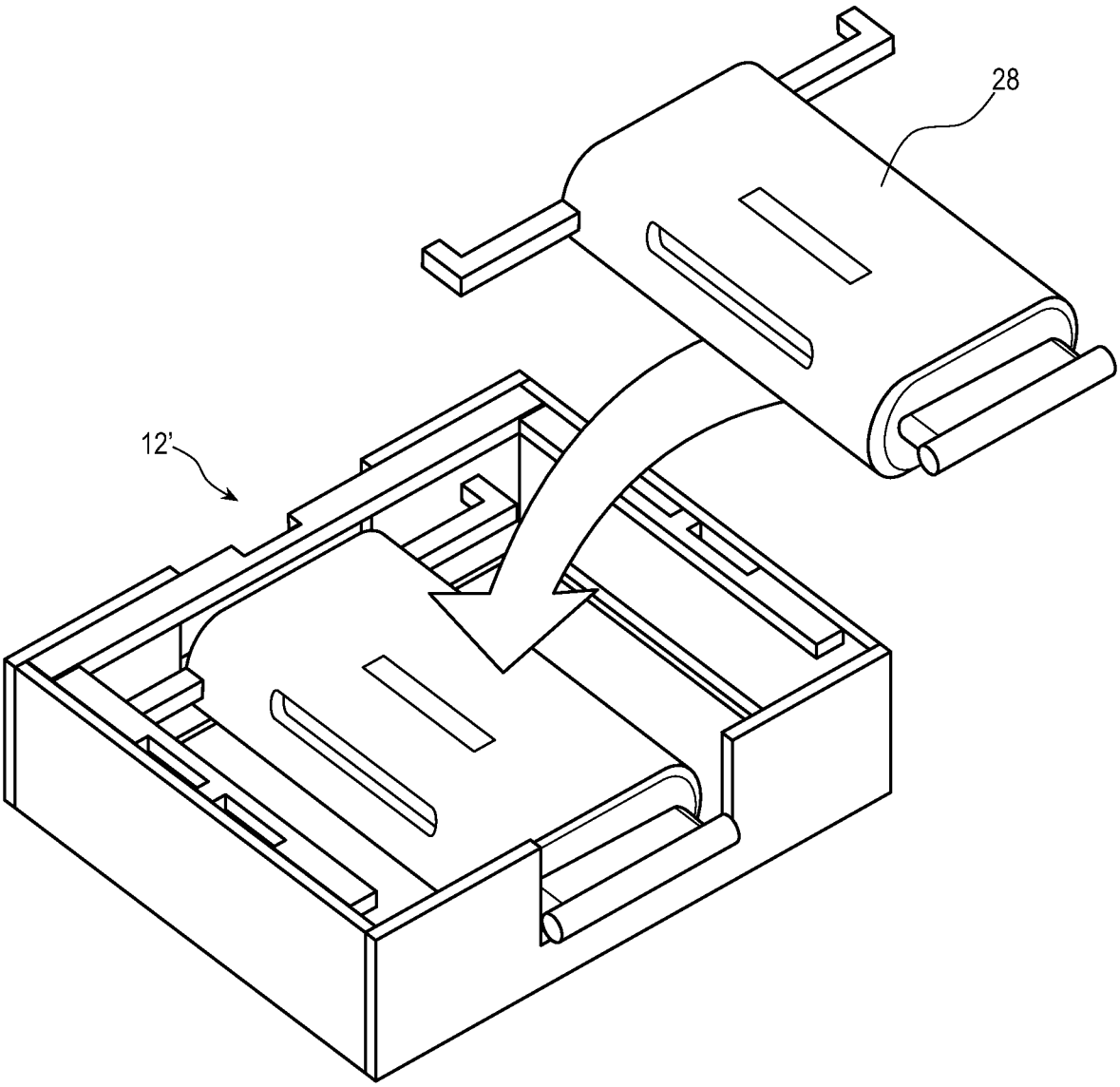
FIG. 18 schematically illustrates how a reclining mechanism can be selectively insertable and removable from a reclining base.

FIG. 9C is a schematic view showing some of the internal components of the shallow configuration 38, illustrating the reclining mechanism 28 mounted within the housing of the reclining assembly. FIG. 9D is a schematic view of the deep configuration 38', illustrating the reclining mechanism 28 mounted within the housing of the reclining assembly. To switch between the shallow or deep configurations 38, 38', the reclining mechanism 28 is detached or uncoupled relative to the housing, rotated approximately 90° and remounted or recoupled relative to the housing. FIG. 18 illustrates an example of a mechanism 28 which can be selectively removable from the housing, which can allow for rotation, and recoupling of the mechanism 28 in a different orientation. The seat cushion 18' (and/or the entire base 12' itself and/or seat base 26) can physically be rotated 90° when switching between the shallow and deep configurations 38, 38'. The back support panel 22 can be selectively coupled to the seat base 26, such that when the seat base 26 is rotated 90°, the back support panel 22 is also rotated 90°. Additionally, and/or alternatively, the back support panel 22 can be detached from the seat base 26 and re-attached to the seat base 26 after seat base 26 has been rotated 90°. As illustrated, the back support panel 22 is hidden from view by back cushion 20'.

In both configurations, a portion of the reclining mechanism 28 can be configured to extend through the cutout 19, thereby extending the rotatable footrest panel 17. The reclining mechanism 28 is selectively mountable within the housing, enabling the rotation of approximately 90°. The reclining mechanism 28 is also selectively orientable within the housing, enabling the rotation of approximately 90°. In other words, the reclining mechanism can be oriented towards one of the longer sides (defined by length x), or towards one of the shorter sides (defined by width y), with the footrest panel 17 being extended out of whichever side the reclining mechanism is oriented towards.

In some embodiments, the housing includes four "kick" panels: a first pair of static panels and a second pair of panels, where each panel of the second pair is configured to be static and/or dynamic. For example, in some embodiments, a first panel of the second pair is configured to act as the footrest panel 17 while the second panel of the second pair is configured to be a static panel of the housing. In some embodiments, the second panel of the second pair is configured to act as the footrest panel 17 while the first panel of the second pair is configured to be a static panel of the housing. When either the first or second panel of the second pair is acting as the static panel of the housing, the first and/or second panel of the second pair can engage with the housing or a bracket thereof via latches, cam locks, a clamp, slidable rails or any other suitable engagement mechanism.

In some embodiments, the footrest assembly 13 includes two rotatable footrest panels 17, where each rotatable footrest panel is either the first or second panel of the second pair. In some embodiments, the first panel of the second pair corresponds to the rotatable footrest panel 17 for the shallow seating configuration 38 and is associated with or defined by length x. In some embodiments, the second panel of the second pair corresponds to the rotatable footrest panel 17 for the deep seating configuration 38 and is associated with or defined by width y.

Figure 10:
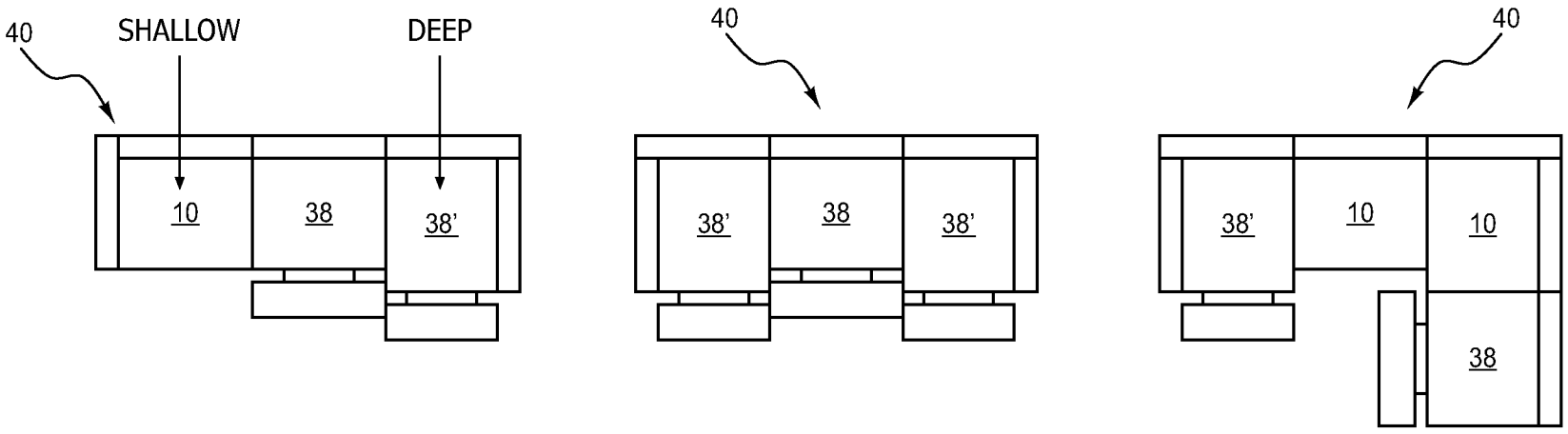
FIG. 10 schematically illustrates various arrangements of a furniture system of the present disclosure, where some reclining assemblies are oriented in the deep seat configuration, while others are oriented in the shallow seat configuration.

FIG. 10 illustrates various arrangements of a furniture system of the present disclosure. As illustrated, the shallow and deep configurations 38, 38' are capable of being placed directly next to each other in a furniture system of the present disclosure, as shown in furniture systems 40, 42, and 44. Arrangement 42 is shown as including a shallow configuration 38 flanked on each side by a deep configuration 38'. Arrangement 44 is shown as including one or more standard modular furniture assemblies flanked by a shallow and/or deep configuration reclining 38, 38'. It will be appreciated that the modular furniture assemblies that are not recliner-enabled can themselves be rotated into the deep or shallow seating configuration, as desired. In some embodiments, the disclosed furniture systems include a reclining assembly, such as a shallow or deep configuration 38, 38', configured to be coupled to a modular furniture assembly.

In some embodiments, the disclosed furniture systems include a standard modular furniture assembly and a reclining assembly (i.e., a seating position that is not recliner-enabled, and a seating position that is recliner enabled). In other embodiments, all of the sections in the furniture system can be reclining assembly seating sections. The reclining assembly includes a base configured to be mounted on a support surface and a backrest (upright member) mounted on the base. In some embodiments, the base is at least a two-piece framework that includes (a) a housing, which rests on the floor or other support surface and (b) a footrest assembly. The base further comprises a reclining mechanism housed within the housing and operatively coupled to the footrest assembly and/or the seat base, the reclining mechanism selectively moving the footrest assembly and/or seat base with respect to the housing.

The reclining mechanism can attach to a bottom and/or sides of the housing. In some embodiments, the reclining mechanism attaches to the bottom of the housing with a latch or anchor mechanism. The reclining mechanism can be configured to snap in and/or out of the housing via a latch or anchor mechanism. In some embodiments, the housing includes linkages, snaps and/or latches that properly align the reclining mechanism with respect to one or more of the housing, the footrest panel and/or the seat base to accommodate either the shallow or deep seating configurations. The placement of the linkages, snaps and/or latches beneficially enables easy switching between the two seating configurations, as a user simply detaches and rotates the reclining mechanism from one linkage, snap or latch and attaches the reclining mechanism to another linkage, snap or latch. The bottom of the housing can rest on a support surface, such as the floor of a living room or other room where the furniture assembly is located. This type of attachment can be referred to as a "wood-to-floor" configuration, where the base of the reclining assembly is in direct or indirect contact (e.g., through feet) with the floor or other support surface.

In some embodiments, the reclining mechanism includes feet that extend through or are attachable to the bottom of the housing to rest on a support surface, such as the floor of a living room or other room where the furniture assembly is located. In some embodiments, the housing defines holes or cavities configured to receive the feet of the reclining mechanism. To accommodate both the shallow and deep seating configurations, the housing can define two sets of holes or cavities. The two sets of holes or cavities are arranged such that placing the reclining mechanism in one set or the other properly aligns the reclining mechanism with respect to the footrest panel and the seat base to accommodate either the shallow or deep seating configuration.

The placement of the two sets of holes or cavities beneficially enables easy switching between the two seating configurations as a user simply detaches and rotates the reclining mechanism from one set and attaches the reclining mechanism to the other set of holes or cavities. The two sets of holes or cavities are sized and shaped to accommodate and receive feet of the reclining mechanism. This type of attachment can be referred to as a "metal-to-floor" configuration, where the reclining mechanism itself is in contact with the bottom of the housing, or even the floor or other support surface. The reclining mechanism can still have a snap or other connection to the bottom and/or sides of the housing to minimize displacement of the reclining mechanism relative to the housing during a reclining operation.

Figure 11:
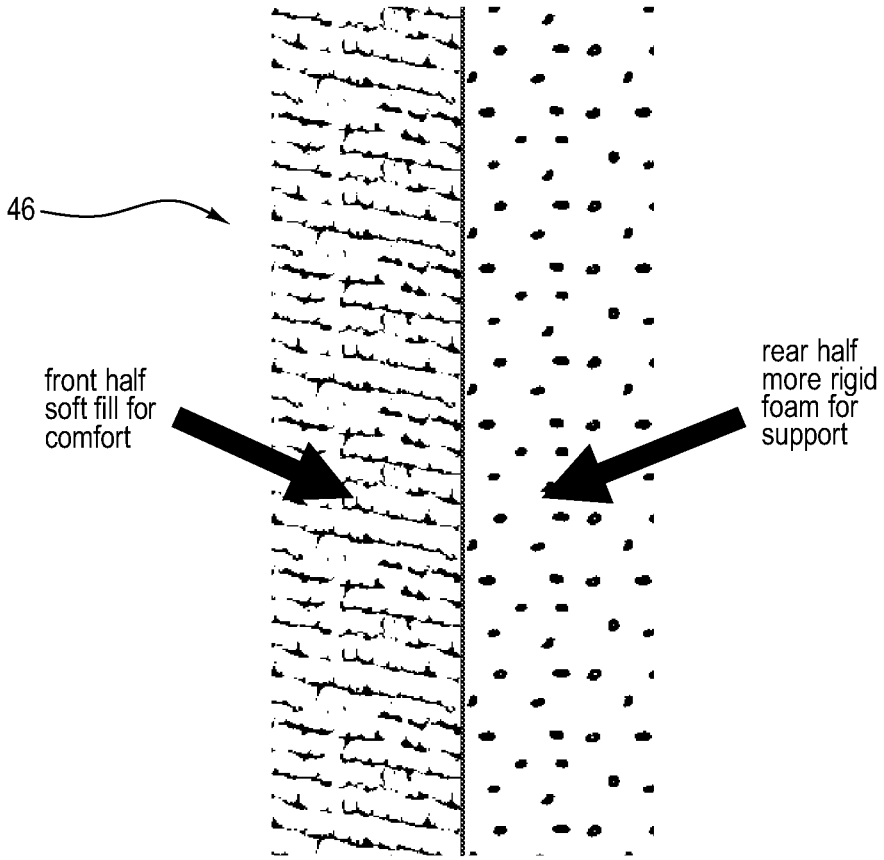
FIG. 11 illustrates a cross-sectional view through an exemplary backrest pillow of the present disclosure.

FIG. 11 illustrates one embodiment of a back pillow 46. The pillow 46 can be coupled to back cushion 20' or can itself be back cushion 20'. The pillow 46 can have one or more filler components. In some embodiments, a first portion of the pillow 46 is constructed from a softer foam or fill and is configured to be plush and relatively squishy. A second portion of the pillow 46 can be constructed from a harder foam or fill and is configured to be stiffer and relatively hard, providing additional structure and support to a user, or components that can interact therewith.

Figure 12:
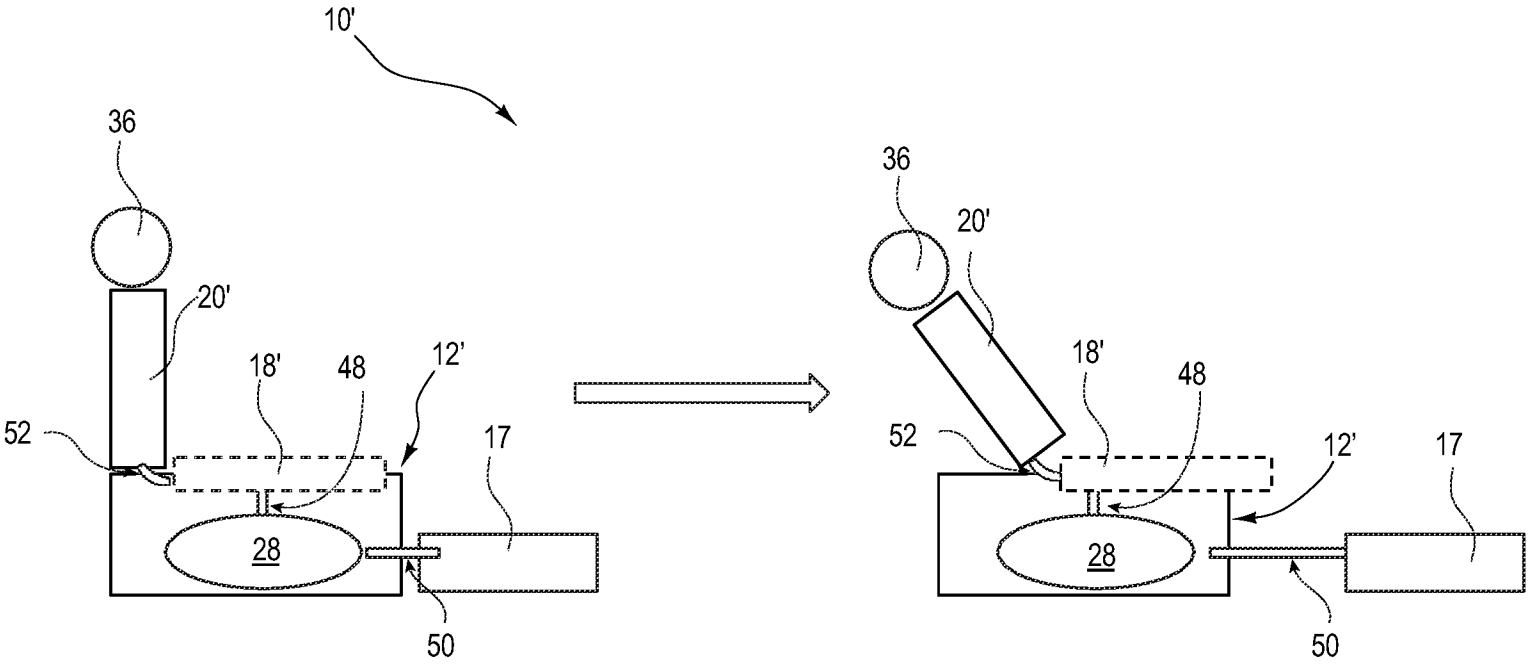
FIG. 12 schematically illustrates a transition of an exemplary reclining assembly from an upright orientation to a reclined orientation.

FIG. 12 illustrates transition of the reclining assembly from a non-reclined, compressed position to a reclined, extended position. Reclining assembly 10' includes a reclining mechanism 28 within reclining base 12', a back cushion 20', a seat cushion 18', a rotatable footrest panel 17 and a headrest 36. The seat base 26 is not illustrated for simplicity, though it can include materials to support the seat cushion 18' over the housing of the reclining base 12'. For example, the seat base 26 can include slats, springs, webbing, Italian webbing and/or other appropriate support materials to support the seat cushion 18'. Also illustrated are couplings 48, 50 and 52. Coupling 52 couples the back cushion 20' to the seat cushion 18'. Additionally, and/or alternatively, coupling 52 couples the backrest panel 22 to the seat base 26. Coupling 48 couples the reclining mechanism 28 to the seat cushion 18' and/or seat base 26 and coupling 50 couples the reclining mechanism 28 to the rotatable footrest panel 17.

In some embodiments, couplings 48 and 50 correspond to a second and first reclining mechanism, respectively, discussed more fully elsewhere herein. In some embodiments, the coupling 48 will be a different length in the shallow versus the deep seating configuration. The different lengths of the coupling 48 will accommodate coupling the reclining mechanism to the seat base 26 (or seat cushion 18') in both the shallow and deep seating configurations. As shown, when the seat cushion 18' is reclined or extended forward, coupling 52 enables the back cushion 20' to move with (and, therefore, recline with) the seat cushion 18'. Additionally, and/or alternatively, the coupling 52 enables the back support panel 22 to move with the seat base 26. The headrest 36 can be a telescoping or other deployable headrest, such as that described with respect to FIG. 6.

Figure 16A:
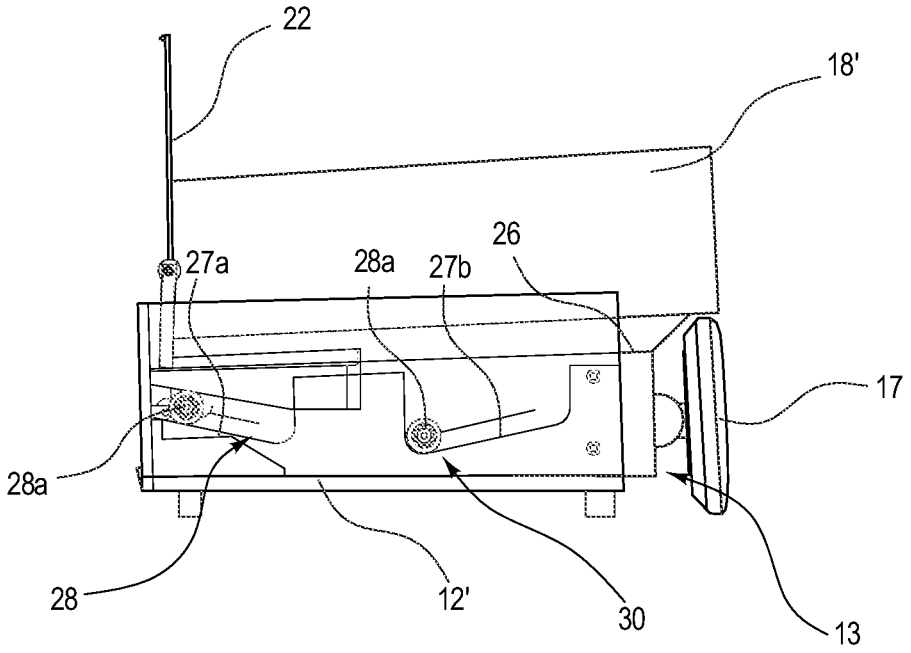
FIGS. 16A-16B illustrate schematic cross-sectional or side views of another embodiment of the reclining assembly in compressed (FIG. 16A) and extended (FIG. 16B) configurations.
Figure 16B:
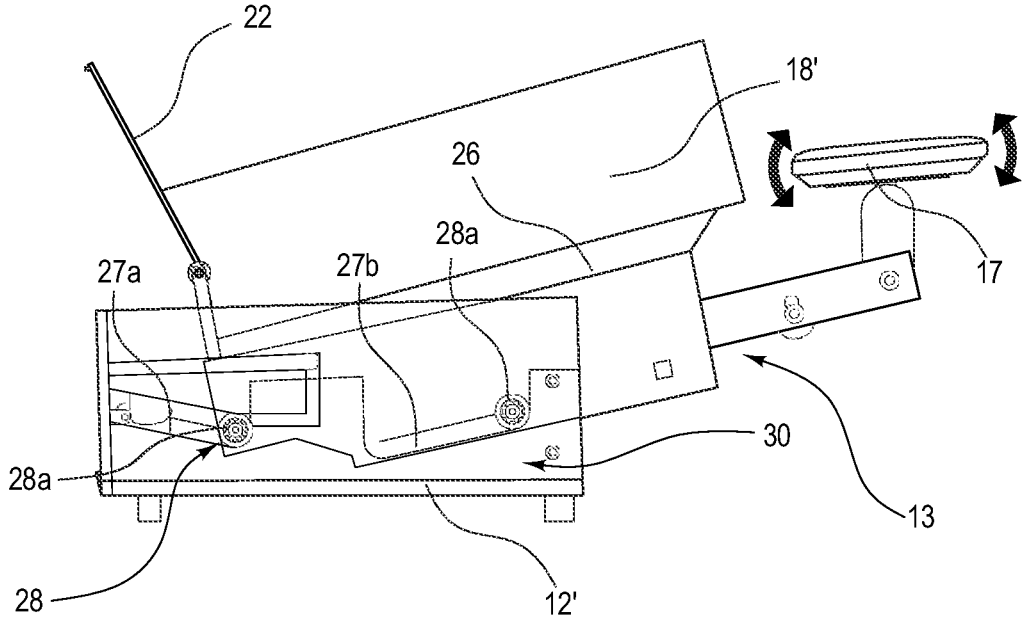

FIGS. 16A-16B illustrate cross-sectional side views of another embodiment of an exemplary reclining assembly. The illustrated reclining assembly includes a base 12' (including housing 30), a reclining mechanism 28, a seat cushion 18', a seat base 26, a back support panel 22, a footrest assembly 13 and a rotatable footrest panel 17. The seat base 26 can include materials to support the seat cushion 18'. For example, the seat base 26 can include slats, springs, webbing, Italian webbing and/or other appropriate support materials to support the seat cushion 18'.

In some embodiments, the reclining mechanism comprises rollers 28*a* and ramps 27*a*, 27*b*. The reclining mechanism 28 includes two opposing pairs of rollers 28*a* connected to the seat base 26 and configured to roll within opposing pairs of ramps 27*a* and 27*b*, also part of the reclining mechanism. The ramps are angled such that reclining the seat base 26 simultaneously inclines the seat base 26 upward, for example at an angle of approximately 5° to 15° or 10° to 15° with respect to horizontal. A rear opposing pair of ramps 27*a* can be angled downward with respect to the horizontal and a front opposing pair of ramps 27*b* can be angled upward with respect to the horizontal. The angle of incline and decline of such ramps can be similar in magnitude, but opposite from one another, for example, from 5° to 20°, or from 10° to 15°. The footrest assembly 13 can be coupled to the reclining mechanism via sled rails or any other desired mechanism that moves with the rollers.

Figure 13A:
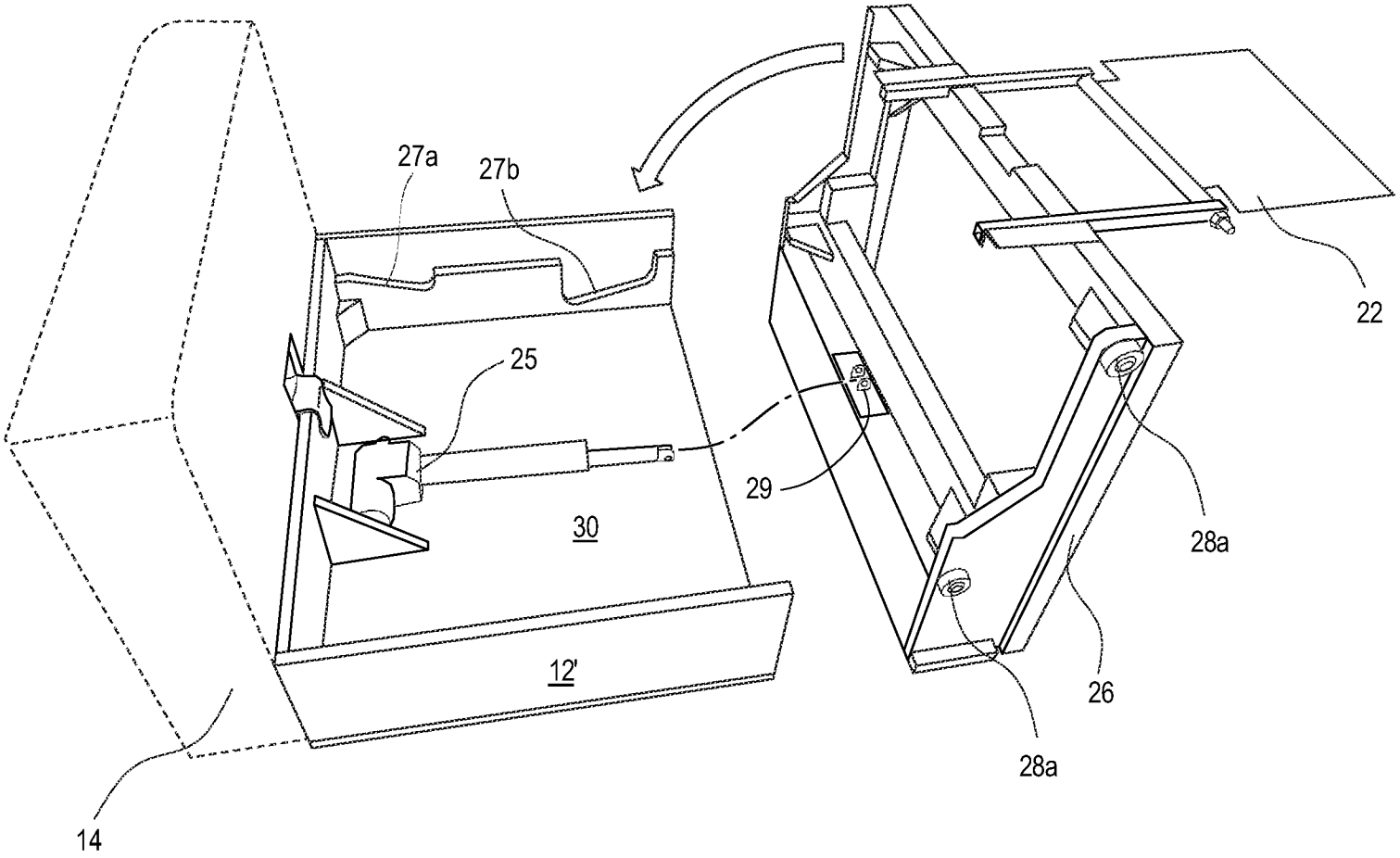
FIG. 13A illustrates an isometric or perspective view of an exemplary two-part housing and reclining mechanism, attached to a static standard upright member positioned as a backrest.
Figure 13B:
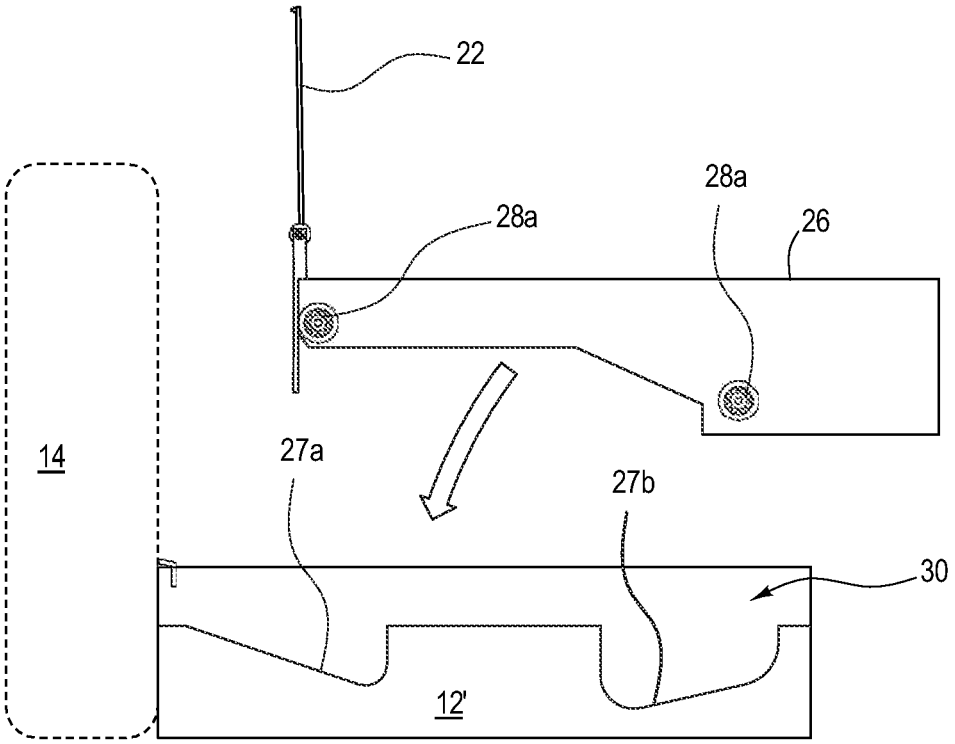
FIG. 13B illustrates an exploded side view of the two-part housing and reclining mechanism of FIG. 13A.
Figure 13C:
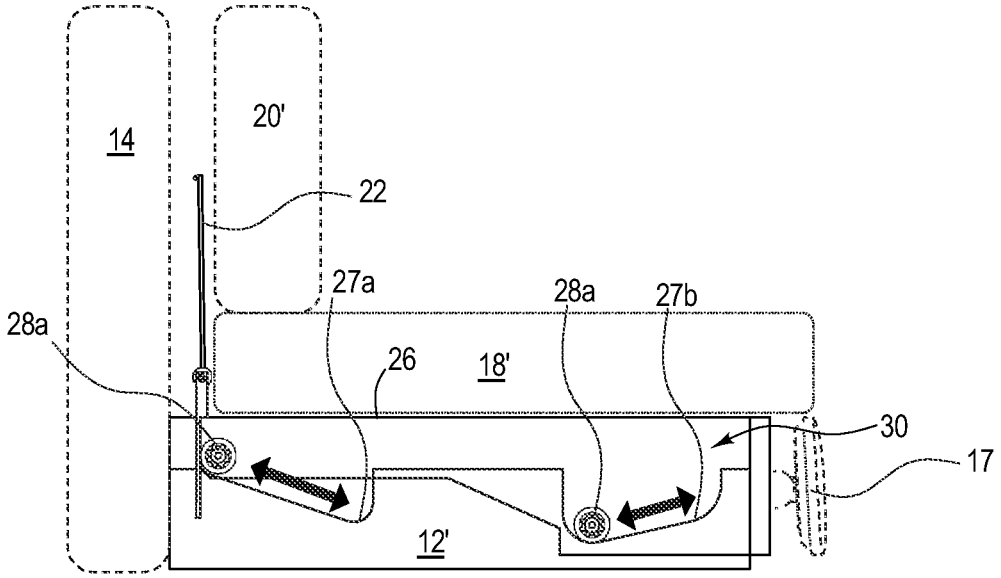
FIG. 13C illustrates a side view of the two-part housing and reclining mechanism shown in FIG. 13B, with the movable carriage portion of the housing and mechanism engaged over the static portion of the housing and mechanism.

FIG. 13A illustrates a perspective view of the same exemplary two-part housing and reclining mechanism, attached to a standard upright member 14. FIG. 13B illustrates side views of the movable portion of the reclining mechanism and the stationary housing portion. FIG. 13C illustrates a schematic side view of the reclining mechanism received into the housing, with the upper and lower portions of the mechanism coupled together.

Referring to FIGS. 13A-13C, the two-part housing and reclining mechanism includes a base 12' (which includes housing 30) and a seat base 26 (to which a back support panel 22 is mounted and/or coupled). The seat base 26 can include materials to support the seat cushion 18'. For example, the seat base can include slats, springs, webbing, Italian webbing and/or other appropriate support materials to support the seat cushion 18'. The housing 30 can entirely house and hide the reclining mechanism 28. Specifically, the housing 30 includes ramps 27*a*, 27*b* and an actuating mechanism 25. The ramps 27*a*, 27*b* include two pairs of opposing ramps—a front pair and a back pair of ramps. Only one half of the opposing pairs of ramps 27*a*, 27*b* are visible in FIGS. 13A-13C. It will be appreciated that the inclined ramps 27*b* and declined ramps 27*a* are provided on both sides of the housing. As illustrated, the base 12' (including housing 30) is coupled to a standard upright member 14, acting as a backrest.

The seat base 26 is provided as part of a movable reclining portion of the housing 30, which is positioned over the static non-reclining portion of the housing 30. Rollers 28*a* are provided on the movable portion, as shown. Similar to the ramps 27 and 27*b*, the rollers 28*a* includes two pairs of opposing rollers—a front pair and a back pair. Only one half of the opposing pairs of rollers 28*a* are illustrated in FIGS. 13A-13C—a front roller and a back roller. It is to be understood that complementary front and back rollers, respectively, are on an opposing panel of the movable reclining portion of the housing that includes seat base 26.

The movable reclining portion of the housing including the seat base 26, and the rollers 28*a*, are configured to be received by the static lower portion of base 12', as shown in FIGS. 13B and 13C. The two opposing pairs of rollers 28*a* are of a size, shape and orientation to rest on the ramps 27*a*, 27*b*. The relationship between the rollers 28*a* and the ramps 27*a*, 27*b* permits the rollers 28*a* to roll and translate over the ramps 27*a*, 27*b*. For example, the arrows in FIG. 13C illustrate the permitted translational movement of the rollers 28*a* over ramps 27*a*, 27*b*.

Each ramp 27*a*, 27*b* of the two opposing pairs of ramps has a slope, defining either an incline (ramp 27*b*) or a decline (ramp 27*a*). As illustrated, the front pair of ramps 27*b* has an inclined slope and the back pair of ramps 27*a* has a declined slope. Such incline and/or decline enables inclining of the seat base 26 when the seat base 26 is extended and reclined. Inclining the seat base 26 provides an ergonomic and comfort benefit to the user, as described herein.

The back support panel 22 can be configured to rest against upright member 14. As illustrated in FIG. 13C, a back cushion 20' can be placed over the back support panel 22, hiding it from view of the user. In some embodiments, back cushion 20' includes a pocket to receive the back support panel 22. A seat cushion 18' can be placed or coupled to the seat base 26. A rotatable footrest panel 17 is coupled to the base 12' and/or housing 30 and/or seat base 26. In some embodiments, the rotatable footrest panel 17 includes a pair of sled rails that are configured to be received by two opposing spaces or channels between an inside surface of the base 12' (which would correspond to an inside surface of a panel of housing 30) and an outside surface of the seat base 26. The inside surface of the base 12' can be the same surface where ramps 27*a*, 27*b* are located. Such space can be sized exactly to fit and receive the sled rails with a friction fit, for example.

The actuating mechanism 25 can attach to the seat base 26 at attachment point 29 (FIG. 13A). The actuating mechanism 25 can pivotally attach to the seat base 26 at attachment point 29. The actuating mechanism 25 can be electrically and/or mechanically driven. Actuating the actuating mechanism 25 in one direction causes the seat base 26 to extend and recline, which causes the back support panel 22 (coupled to the seat base 26) to slide or roll down, relative to upright member 14. Actuating the actuating mechanism 25, and extending the seat base 26 causes the rollers 28*a* to rotate and translationally move along the ramps 27*a*, 27*b*. While a gas spring or linear actuator 25 is shown, it will be apparent that a gear rack and rotating gear arrangement can alternatively be used, as described elsewhere herein.

Because the ramps 27*a*, 27*b* provide a slope (either an incline or decline), the seat base 26 slightly inclines as the rollers 28*a* translate forward along the ramps 27*a*, 27*b*. The slope of the ramps 27*a*, 27*b* influences the height of incline of the seat base 26. As the rollers 28*a* and the actuating mechanism 25 extend the seat base 26, the rotatable footrest panel 17 passively extends a corresponding amount. A user sitting on the seat base 26 (and seat cushion 18') can mechanically cause the rotatable footrest panel 17 to fully extend by placing their feet on the rotatable footrest panel 17 and applying a forward force.

Actuating the actuating mechanism 25 in another direction causes the seat base 26 to retract and compress. Such retraction causes the back support panel 22 to slide up relative to upright member 14. Such retraction also causes the rollers 28*a* to rotate and translate backward along the ramps 27*a*, 27*b*. The seat base 26 will be returned to a substantially horizontal level position and the rotatable footrest panel 17 will also retract, returning to a flush position with the base 12'.

Footrest

Disclosed are furniture systems including one or more reclining assemblies, where the reclining assembly includes a housing and a footrest assembly. In some embodiments, the reclining assembly of the footrest assembly includes one or more rotatable footrest panels. The discussion below regarding the rotatable footrest panel is from the perspective of a single rotatable footrest panel, though it is to be understood in light of the present disclosure that more than one rotatable footrest panel can be included in order to enable switching between shallow and deep configurations (discussed elsewhere herein). For example, as each reclining assembly can be switched from a deep seat configuration for reclining, to a shallow seat configuration for reclining, and vice versa, each reclining assembly can include footrest panels that are selectively deployable and rotatable, with the footrest panel used in the deep seat configuration being associated with the shorter "y" dimensioned side of the base, and the footrest panel used in the shallow seat configuration being associated with the longer "x" dimensioned side of the base. The rotatable footrest panel is configured to be flush with the base when the reclining assembly is in the compressed position and the rotatable footrest panel has not been deployed. In some embodiments, edges of the rotatable footrest panel are beveled and configured to be flush with the base (see, for example, FIG. 16A).

Figure 14:
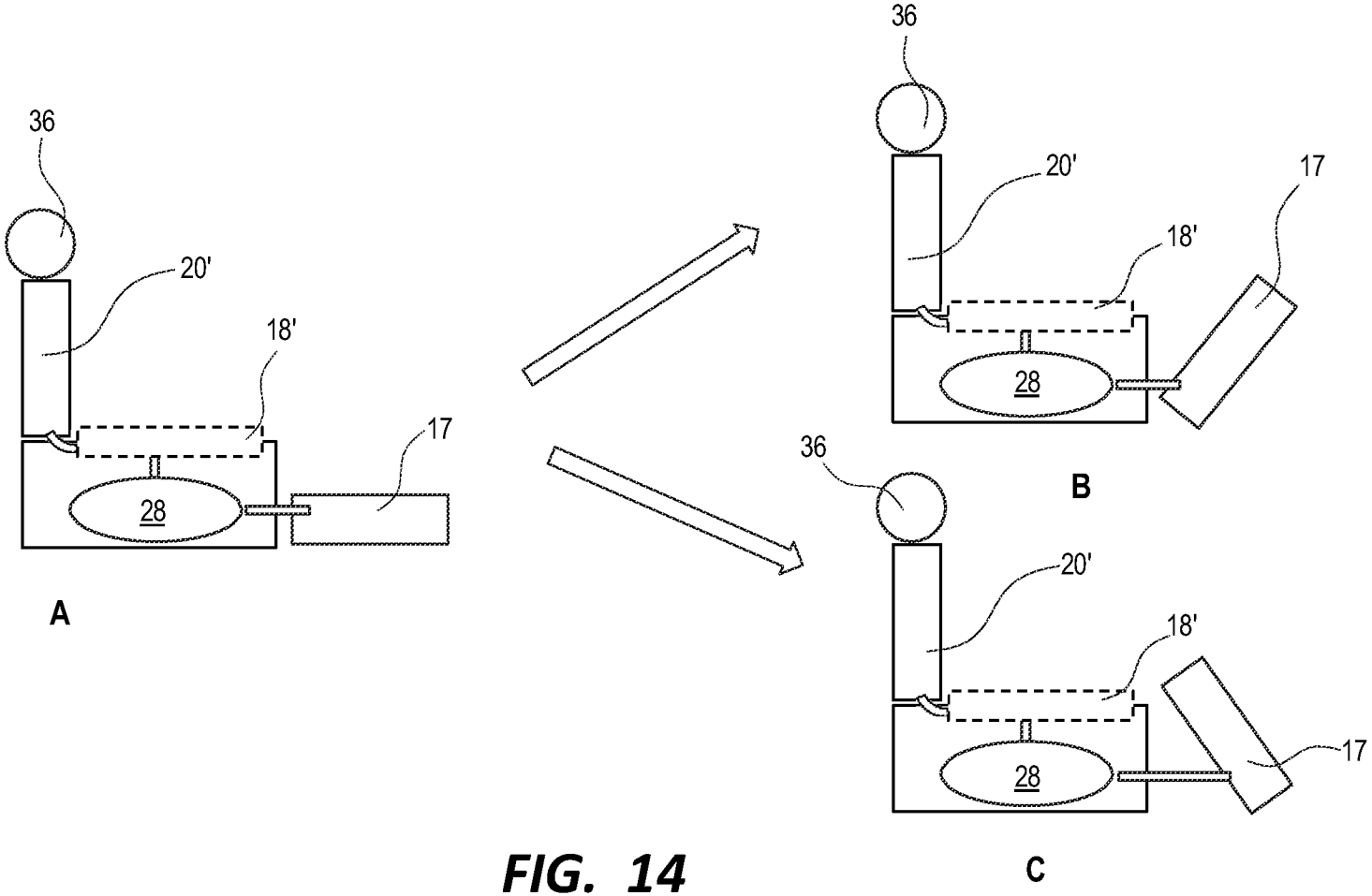
FIG. 14 schematically illustrates a reclining assembly showing deployment of a rotatable footrest so as to provide an inclined, or declined footrest panel upper surface.

FIG. 14 illustrates a reclining assembly having a rotatable footrest (additional or alternate rotatably footrest being illustrated in FIGS. 15A-17E). As illustrated, the rotatable footrest panel 17 is coupled to the reclining mechanism 28. The rotatable footrest panel 17 couples to the reclining mechanism 28 at substantially a central midpoint of the rotatable footrest panel 17. In another embodiment, coupling can be away from the central portion of the panel 17, e.g., towards the ends/sides thereof (e.g., two coupling points, equally spaced apart from such a central midpoint). As shown in FIG. 12 (discussed above), the rotatable footrest panel 17 extends away from the reclining assembly 28 in the reclined position and can be in a generally horizontal orientation upon deployment, relative to the floor. When in the reclined position, the rotatable footrest panel 17 is configured to selectively rotate about the attachment point where the rotatable footrest panel 17 couples to the reclining mechanism 28.

Figure 17A:
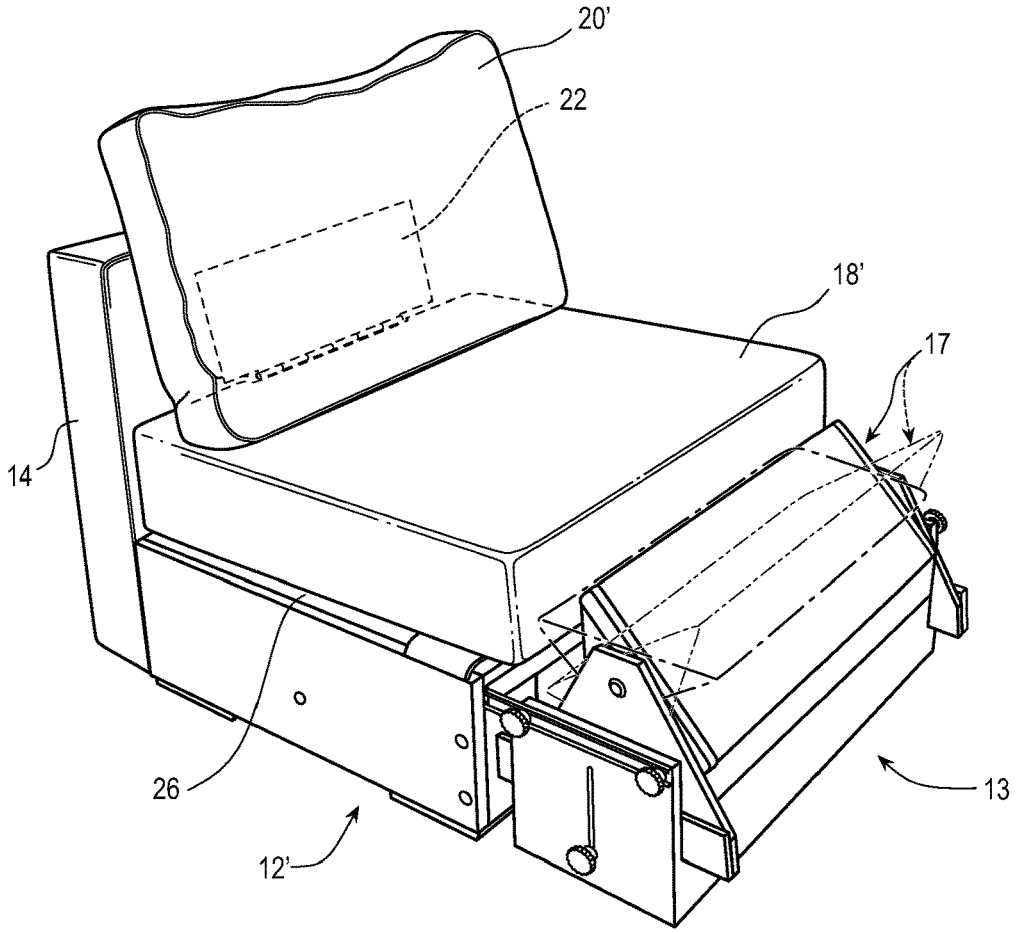
FIGS. 17A-17B illustrate isometric or perspective and exploded views of another embodiment of the reclining assembly illustrating how the footrest assembly can couple into the remainder of the reclining assembly using slide rails.
Figure 17B:
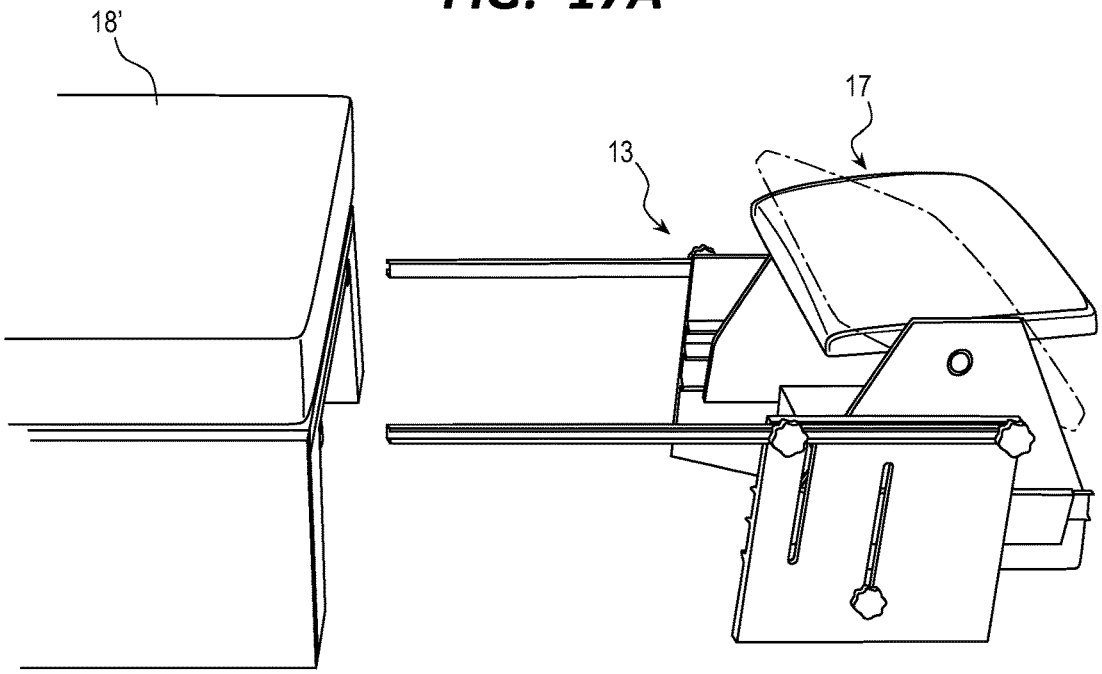
Figure 17C:
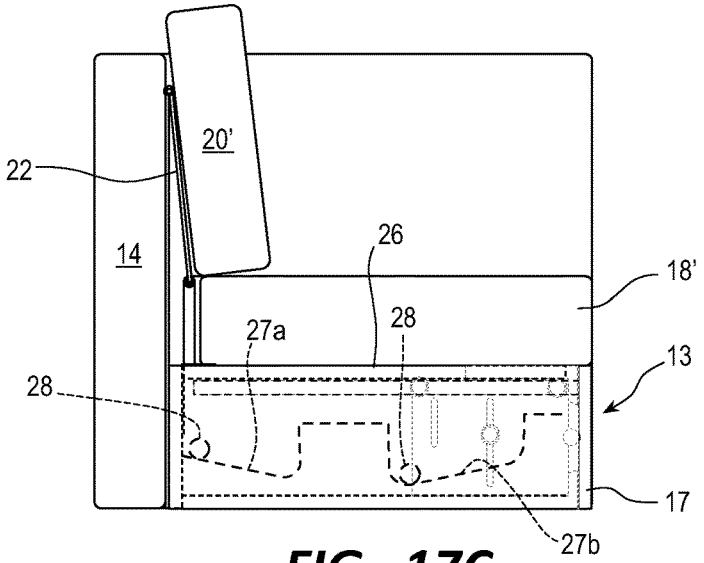
FIGS. 17C-17E illustrate side views of the embodiment of FIGS. 17A-17B, showing the footrest assembly removed (FIG. 17C), showing the footrest assembly not fully extended, and the seat not fully reclined (FIG. 17D), and showing the seat fully extended, and the footrest assembly fully extended (FIG. 17E).
Figure 17D:
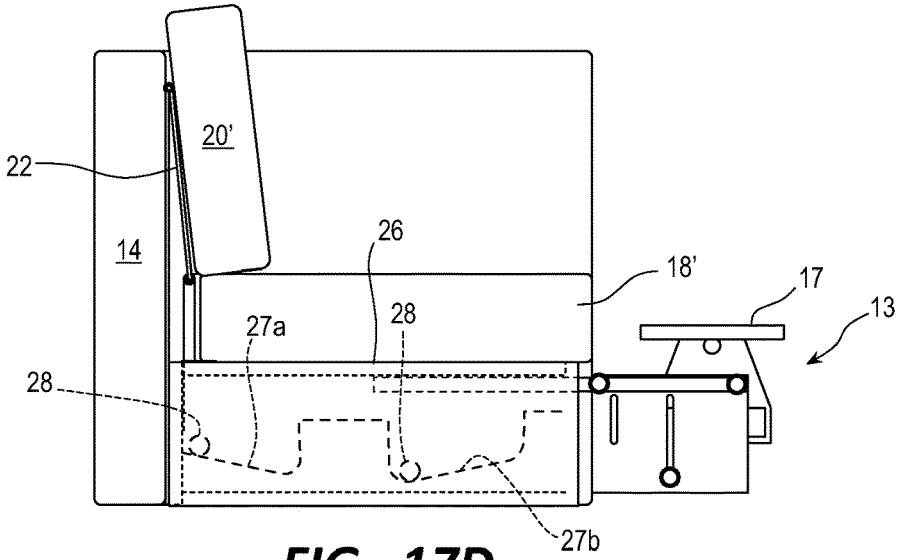
Figure 17E:
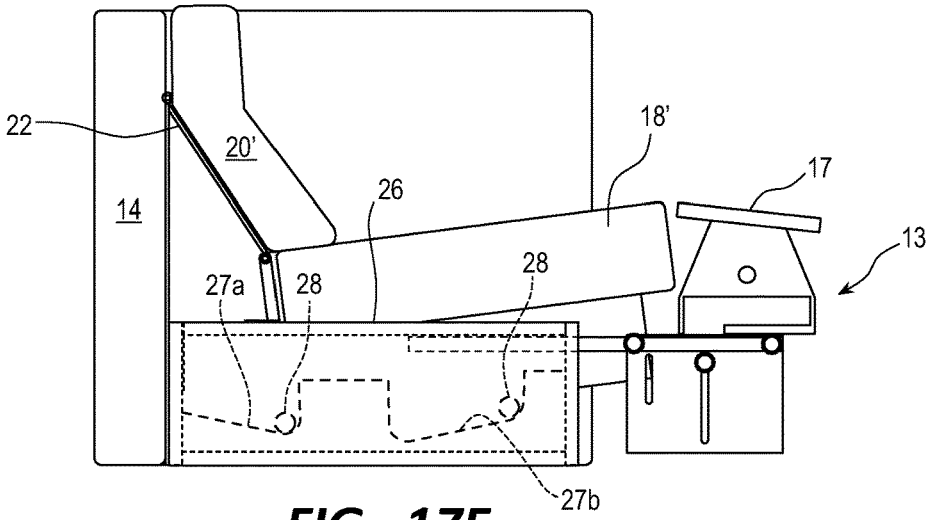

The reclining mechanism 28 can couple to the rotatable footrest panel 17 or assembly 13 via a clamp, snaps or clips, cam locks or another appropriate connection mechanism. Additionally, and/or alternatively, the rotatable footrest panel 17 or assembly 13 couples to the reclining mechanism 28 and/or housing 30 via sled rails or other structure (e.g., gear racks and rotating gears) that permit extension, as shown in FIGS. 17A-17B. Similar sled rail connections are illustrated and described in Applicant's U.S. Pat. No. 10,123,621, already incorporated herein by reference. Use of gear racks and rotating gears as described in other embodiments provides benefits of significantly more travel within a smaller mechanism, as compared to alternatives.

The rotatable footrest panel 17 of assembly 13 is configured to selectively rotate both away from and toward the reclining assembly, as selected by a user. As shown in configuration C of FIG. 14, the rotatable footrest panel 17 can be positively or forwardly rotated (clockwise) by approximately 30°, or 45° (relative to horizontal). The rotatable footrest panel can be configured to forwardly rotate clockwise within a range of 15° to 80°, such as 15°, 20°, 30°, 45°, 50°, 55°, 60°, 65°, 70°, 75°, 80° or within a range defined by any two of the foregoing values. Rotating the footrest panel 17 clockwise as shown in configuration C beneficially enables a user to place their extended calves or legs on the rotatable footrest panel, thereby enabling even greater relaxation.

As shown in configuration B of FIG. 14, the rotatable footrest panel 17 is negatively rotated (counterclockwise) toward the seated user by approximately 30° or 45° (relative to horizontal). The rotatable footrest panel can be configured to rotate counterclockwise within a range of 15° to 80°, such as 15°, 20°, 30°, 45°, 50°, 55°, 60°, 65°, 70°, 75°, 80°, or within any range defined by any two of the foregoing values. Rotating the footrest panel toward seated user as shown in configuration B beneficially enables a user to place the soles of their feet on the footrest panel 17, with knees bent up. This beneficially enables the user to more comfortably use, for example, a laptop while sitting in the reclined position of the reclining assembly. The reclining assembly can advantageously be capable of providing both such configurations (B and C), as selected by the user.

In some embodiments, the rotatable footrest panel 17 includes foam padding to provide additional comfort. In some embodiments, the rotatable footrest panel 17 includes a heating element configured to heat the rotatable footrest panel and provide warmth to a user's feet or calves. In some embodiments, the rotatable footrest panel 17 includes a cooling element configured to cool the rotatable footrest panel. In some embodiments, the rotatable footrest panel 17 includes a massaging element. In some embodiments, the electrical components for providing power to the heating, cooling and/or massaging elements are housed within the housing of the reclining assembly. In some embodiments, the heating, cooling and/or massaging elements can be controlled by a controller.

In some embodiments, the rotatable footrest panel 17 is removably coupled to the reclining mechanism. For example, the rotatable footrest panel 17 can be removed when switching between shallow and deep configurations of the reclining assembly. For example, the rotatable footrest panel 17 or assembly 13 can be coupled to the reclining mechanism via one or more of snaps, clips, hook-and-loop fasteners, detents, sled rails, gears, gear rails, or combinations thereof, or any of a wide variety of other couplers that will be apparent to those of skill in the art, in light of the present disclosure. When detached from the reclining mechanism, the rotatable footrest panel 17 can be stored and concealed in or on the housing of the reclining assembly. Additionally, and/or alternatively, the rotatable footrest panel 17 engages with the housing to become a static panel of the housing (e.g., when changing from deep to shallow configurations or vice versa) and a previously static panel of the housing becomes a dynamic rotatable footrest panel 17. The appropriate footrest panel 17 corresponding to the desired configuration can simply be attached to the reclining mechanism, when use of such is desired.

In some embodiments, the rotatable footrest panel 17 is biased toward a home, generally horizontal position, when deployed. When the rotatable footrest panel 17 is rotated either away from or toward the user as described in conjunction with FIG. 14, a user can place their feet or calves, respectively, on the footrest panel and maintain the desired angle of rotation. When the user removes their feet or calves, the footrest panel can "spring" back to the home, horizontal position. It will be understood that in other configurations the rotatable footrest panel can be biased towards a home, generally vertical or intermediate position when deployed, and when moved away from that home position, it can return to the home position following removal of a force applied by the user.

Gas Spring+Lock

In some embodiments, the reclining mechanism of the reclining assembly includes a locking mechanism. In some embodiments, the locking mechanism is entirely or partially incorporated into the reclining mechanism. In some embodiments, the locking mechanism is controlled by a controller, discussed more fully below.

Figure 15A:
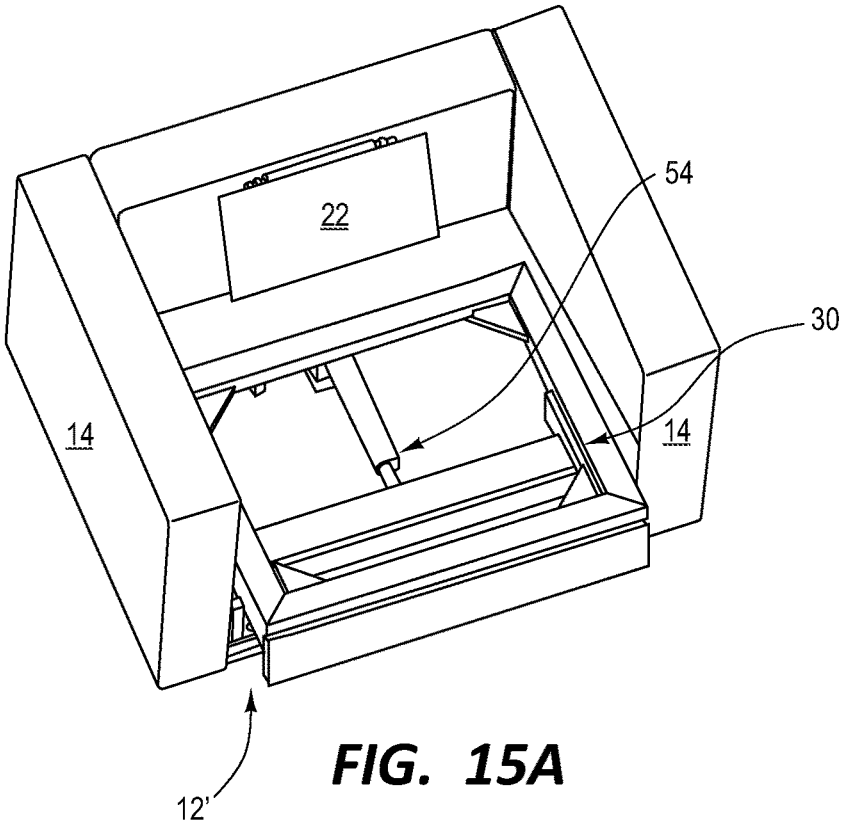
FIGS. 15A-15B illustrate isometric or perspective views of an exemplary reclining assembly.
Figure 15B:
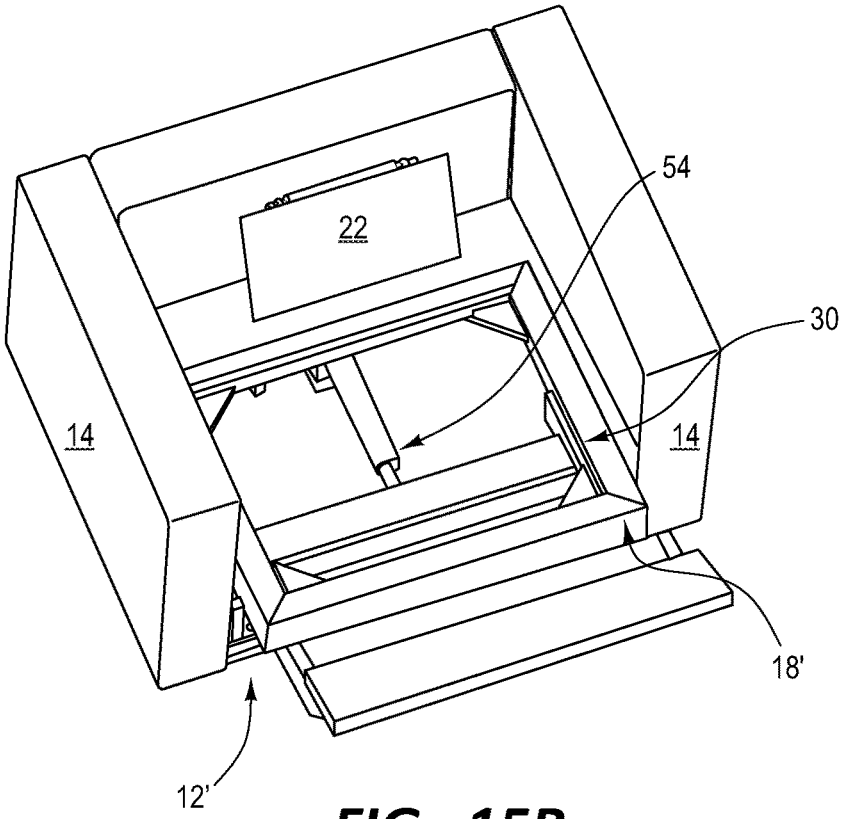
Figure 15C:
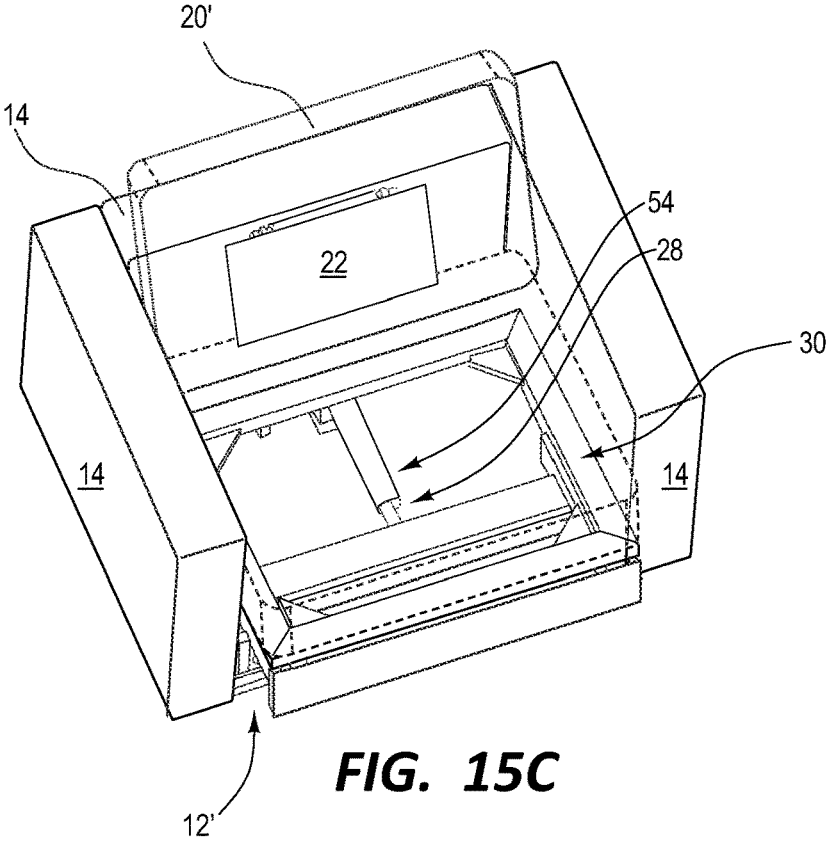
FIGS. 15C-15D illustrate isometric or perspective views of the reclining assembly that correspond to the views of FIGS. 15A-15B, but with a back pillow and a seat cushion shown in phantom in FIGS. 15C-15D.
Figure 15D:
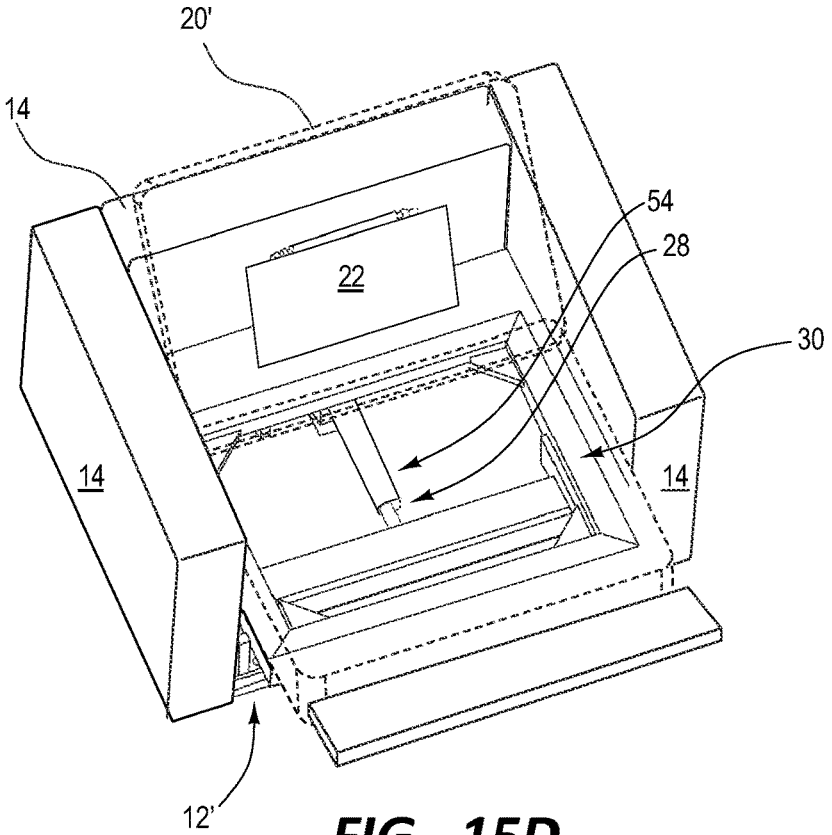

FIGS. 15A-15D illustrate a reclining assembly of the present disclosure including a locking mechanism, where the seat cushion is either removed (FIGS. 15A-15B) or illustrated in phantom (FIGS. 15C-15D). FIGS. 15A and 15C illustrate a compressed, un-reclined position while FIGS. 15B and 15D illustrate an extended, reclined position. When the seat and back cushions 18', 20' are present, the locking and/or reclining mechanisms are hidden from view. As illustrated, the reclining assembly 10' includes upright members 14, back cushion 20', reclining base 12' with associated back support panel 22, a seat cushion 18', a housing 30, reclining mechanism 28, and a locking mechanism 54. As illustrated, the locking mechanism 54 is incorporated into the reclining mechanism 28. When in the extended, reclined positions (FIGS. 15B and 15D), the back support panel 22 is at a lower position on the upright member 14 relative to when in the compressed position. Such lower position is a result of the back support panel 22 vertically sliding along the upright member 14, which can be facilitated by, for example, rollers or a series of rollers.

The actual seat pan of seat base 26 is not illustrated for clarity and simplicity. In some embodiments, the locking mechanism 54 is part of an electrically driven linear actuator, a gas spring, or a gear rack and rotating gear, etc. Such actuators enable the reclining assembly to have infinite adjustability (as a practical matter) along a range of motion provided by the linear actuator, gas spring, or gear rack. In some embodiments, the locking mechanism 54 can be part of a mechanical actuator, and electrical actuator, an electromechanical actuator, a hydraulic actuator, a pneumatic actuator, combinations thereof and modifications thereto.

In some embodiments, the locking mechanism 54 enables a user to lock in a degree of recline. For example, a user can lock the reclining assembly within a range of 0° to 55° of recline, where 0° of recline is the non-reclined position of the reclining assembly. 55° or other recline value can refer to the change in angle between the panel 22 in the reclined position, as compared to the un-reclined position, relative to the seat base 26. The user can lock the reclining assembly at 5°, 15°, 20°, 25°, 30°, 35°, 40°, 45°, 50° or 55° of recline or to a value within a range defined by any two of the foregoing values. In some embodiments, the locking mechanism 54 enables binary reclining-either the reclining assembly is in the reclined position or the non-reclined position. The locking mechanism 54 can lock reclining of the seat cushion (and seat base), the footrest assembly (and the rotatable footrest panel) or both.

Embodiments Including a Rotatable Carriage, a Gear Rack and Rotating Gear

Figure 19:
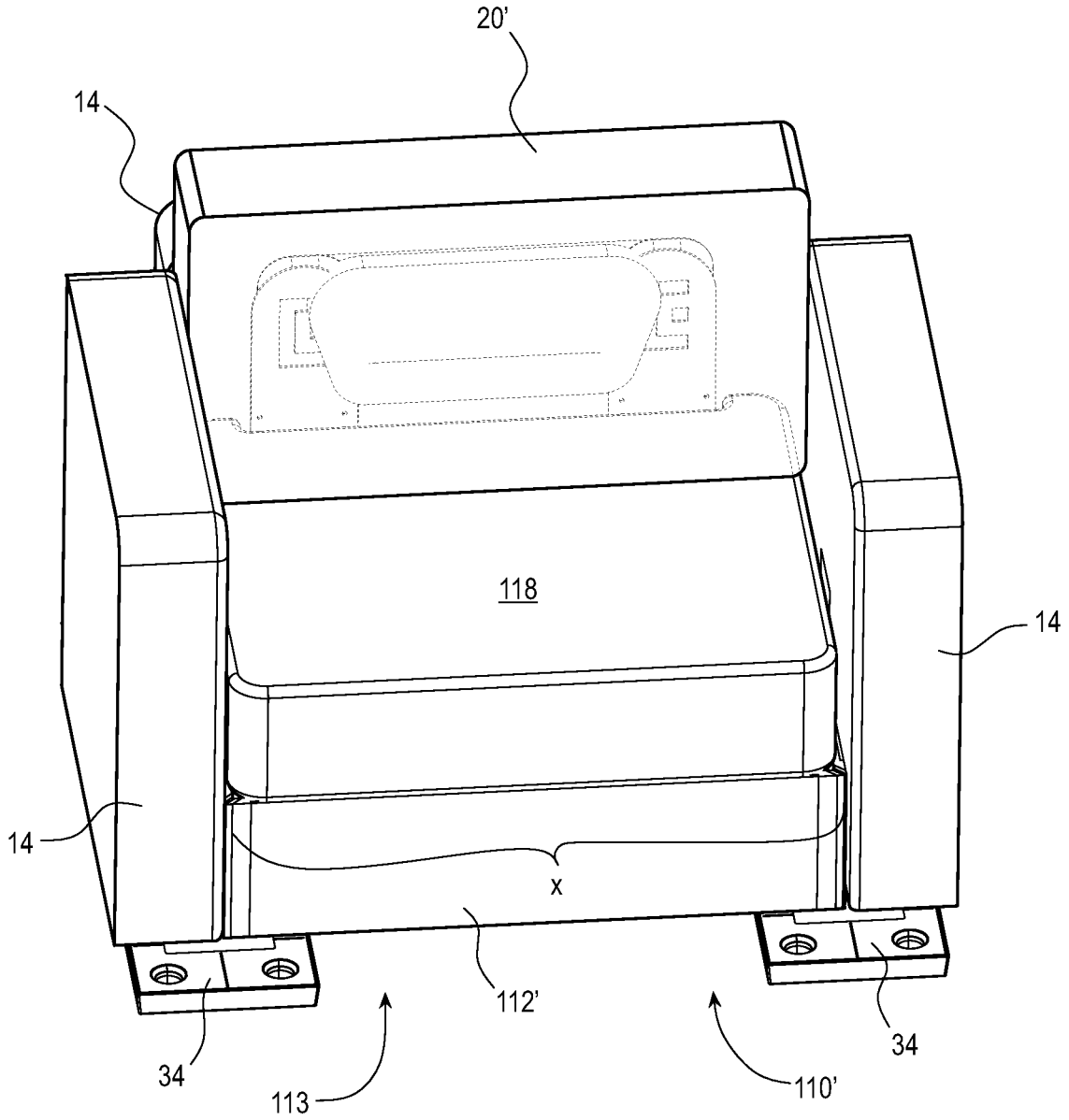
FIG. 19 illustrates an isometric view of another exemplary reclining assembly, in a shallow seat configuration.

The remaining Figures beginning with FIG. 19 illustrate another reclining assembly 110' that includes a base 112' providing a seating surface. The length (x) and width or depth (y) of the seating surface or base 112' can be of different dimensions (e.g., a non-square rectangle). The furniture system and reclining assembly 110' is configured to allow the user to orient the length (x) or width or depth (y) of the seat to form a front edge of the seat (i.e., 90° rotation between the two configurations). The reclining assembly further includes a footrest assembly 113 that selectively extends from the front edge of the seat. In FIG. 19, the front edge is shown as the length (x), while in FIG. 20, the front edge is shown as the width or depth (y) (i.e., the seat has been rotated 90°. The reclining assembly 110' includes a reclining mechanism 128 housed within the base 112'. As shown in the Figures, the reclining mechanism can be entirely housed and hidden within base 112'. The reclining mechanism is configured to selectively recline the seating surface of the base with respect to a remaining portion of the furniture system in either the deep or shallow seat configurations. In the shallow configuration, the length (x) forms the front edge of the base, while in the deep configuration, the width or depth (y) forms the front edge of the base. As described with respect to previous embodiments, the reclining mechanism can act to push the seat forward, and somewhat upward, rather than reclining the static backrest upright member 14. A back support bracket 164*c* can be provided with back pillow 20', which back support bracket can provide a reclined surface for pillow 20' as the seat is pulled forward. A top edge of a panel associated with the back support bracket can be configured to slide down or at least relative to the backrest upright member 14.

As shown in FIG. 19, a seat cushion 118 is positioned over base 112', while standard upright members 14 are coupled to reclining base 112' so as to serve as armrests and a backrest, as shown. A back cushion 20' is provided as shown, which can couple with a back support panel and back support bracket, as described in previous embodiments. Coupling shoes 34 can aid in coupling the feet of the base 112' to the feet of the upright member. As shown in FIG. 19, the reclining base can appear substantially identical to any standard base 12 that does not provide reclining functionality, and can be coupled thereto, in the same way that a standard base 12 could be coupled and integrated into any desired modular furniture assembly of bases 12 and upright members 14. As noted elsewhere herein, the reclining base 112' can be configured with feet, or other coupling mechanisms, that allow such a reclining base to simply drop into place, adjacent to a standard non-reclining base, replacing what could otherwise be just another non-reclining base, with a reclining base. For example, placement of the feet on the underside of the reclining base 112' can be positioned and spaced apart to similarly couple into coupling shoes 34. Other coupling mechanisms are of course also possible, whereby such a reclining base can be simply dropped into place adjacent a standard base, replacing such a standard base with a reclining base.

Figure 20:
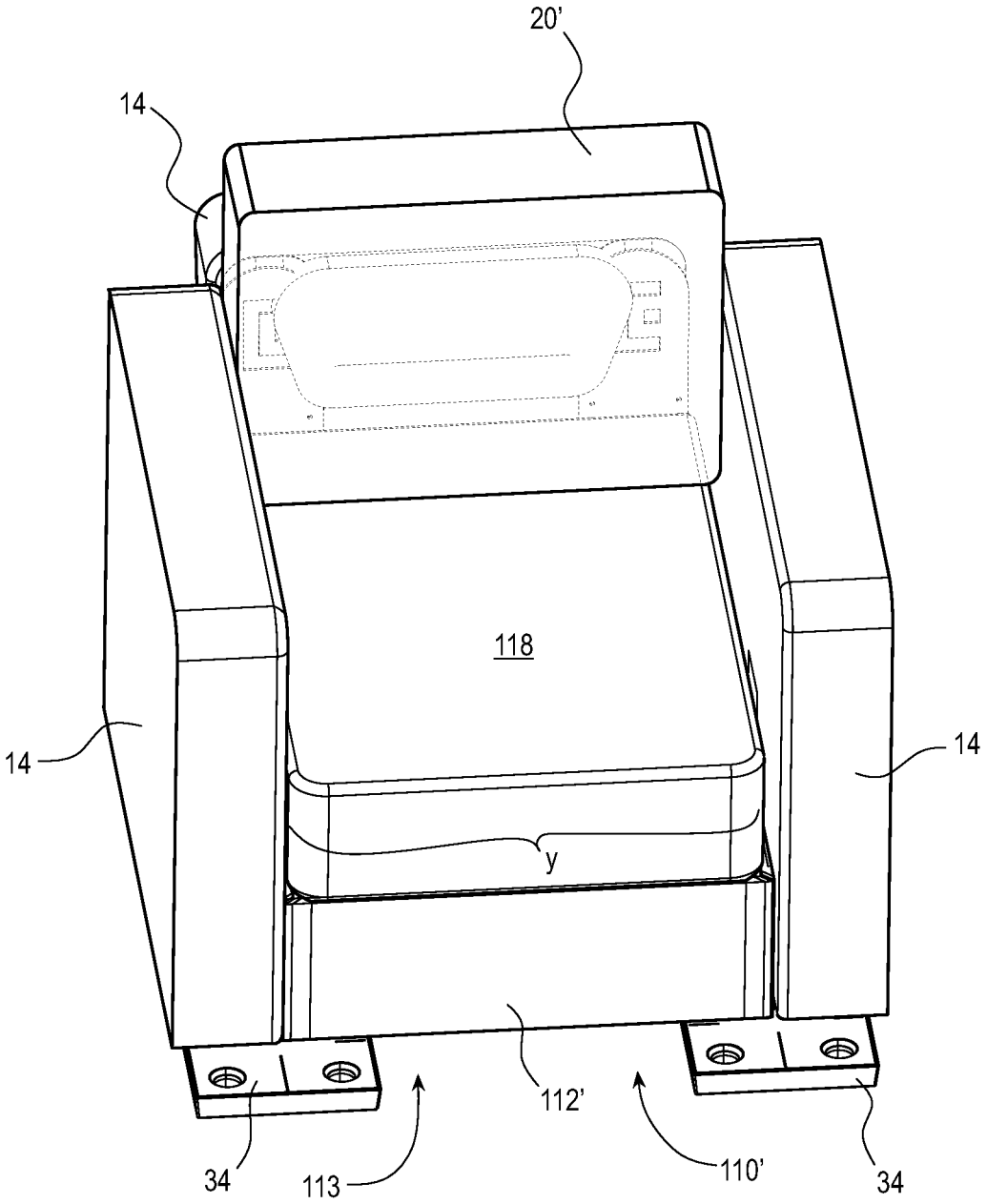
FIG. 20 illustrates a isometric view of the reclining assembly of FIG. 19, in a deep seat configuration.
Figure 21A:
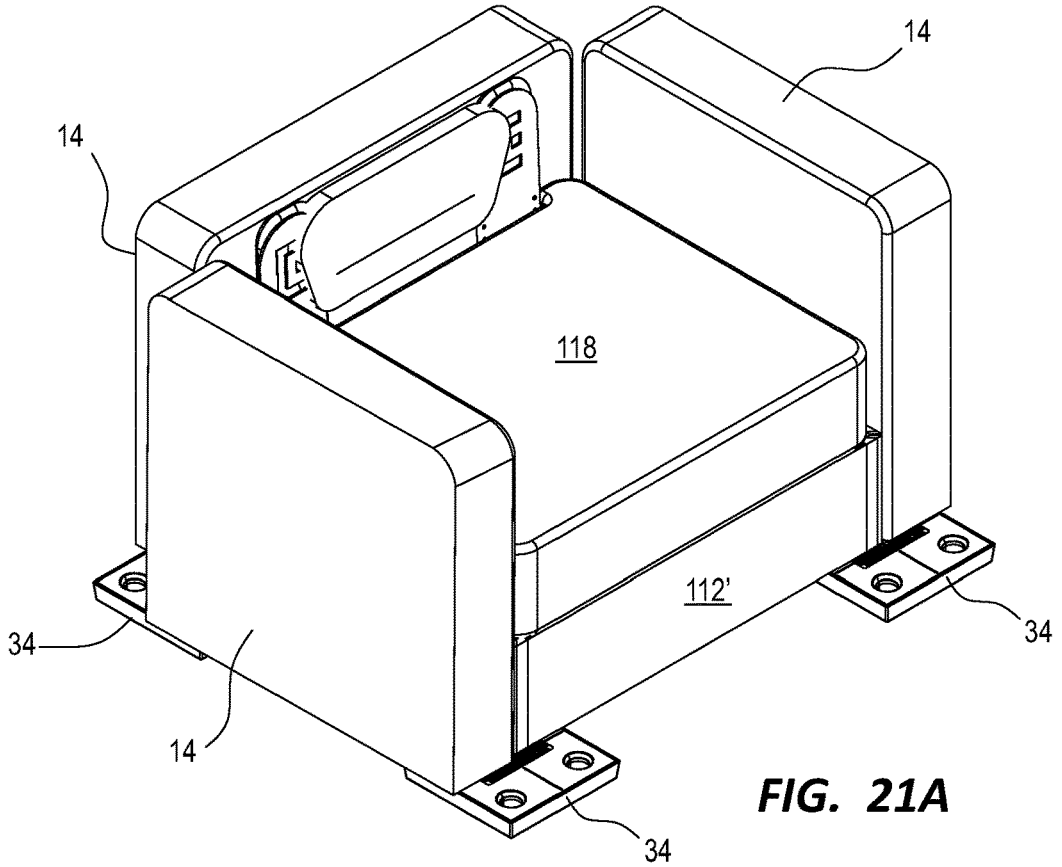
FIG. 21A illustrates a isometric view of the reclining assembly of FIG. 19.
Figure 21B:
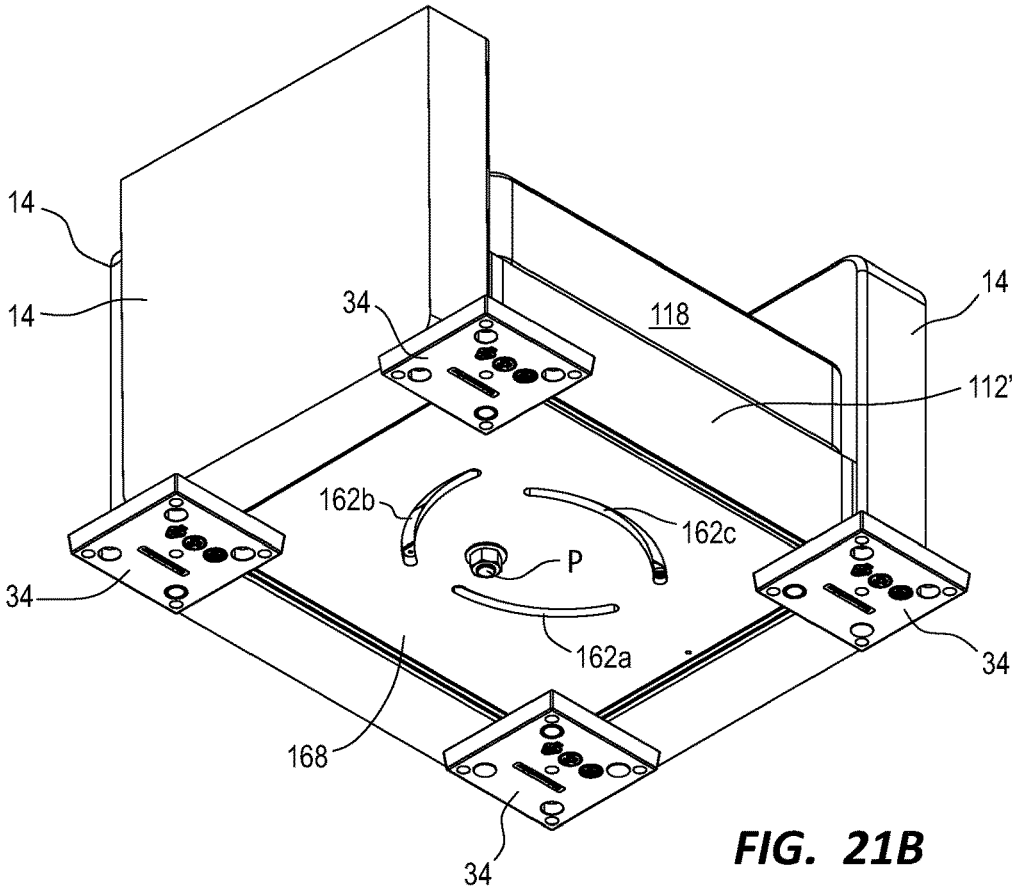
FIG. 21B illustrates a bottom isometric view of the reclining assembly.
Figure 23:
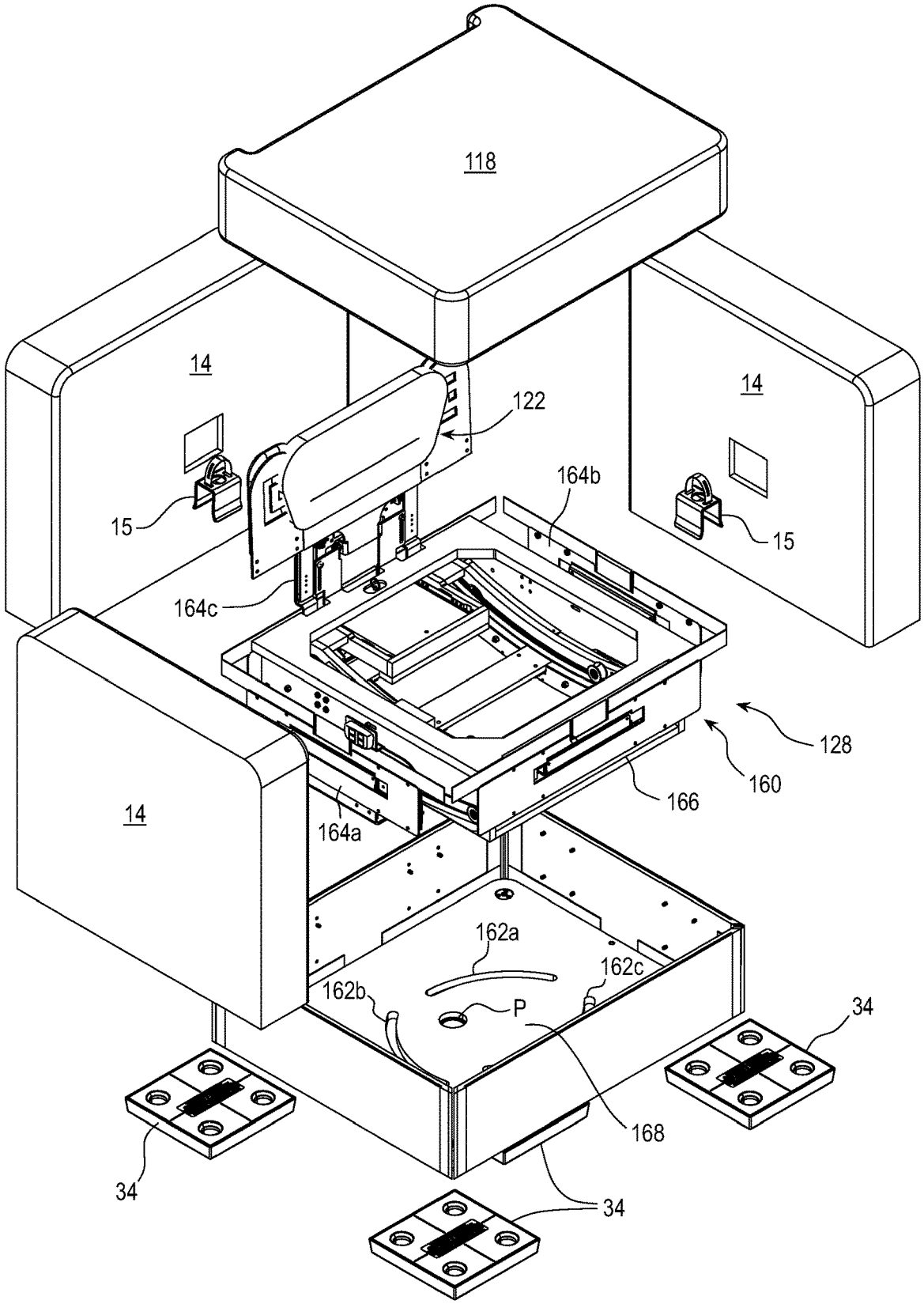
FIG. 23 illustrates an exploded view of the reclining assembly of FIG. 19, illustrating the various internal components of the reclining mechanism.
Figure 24:
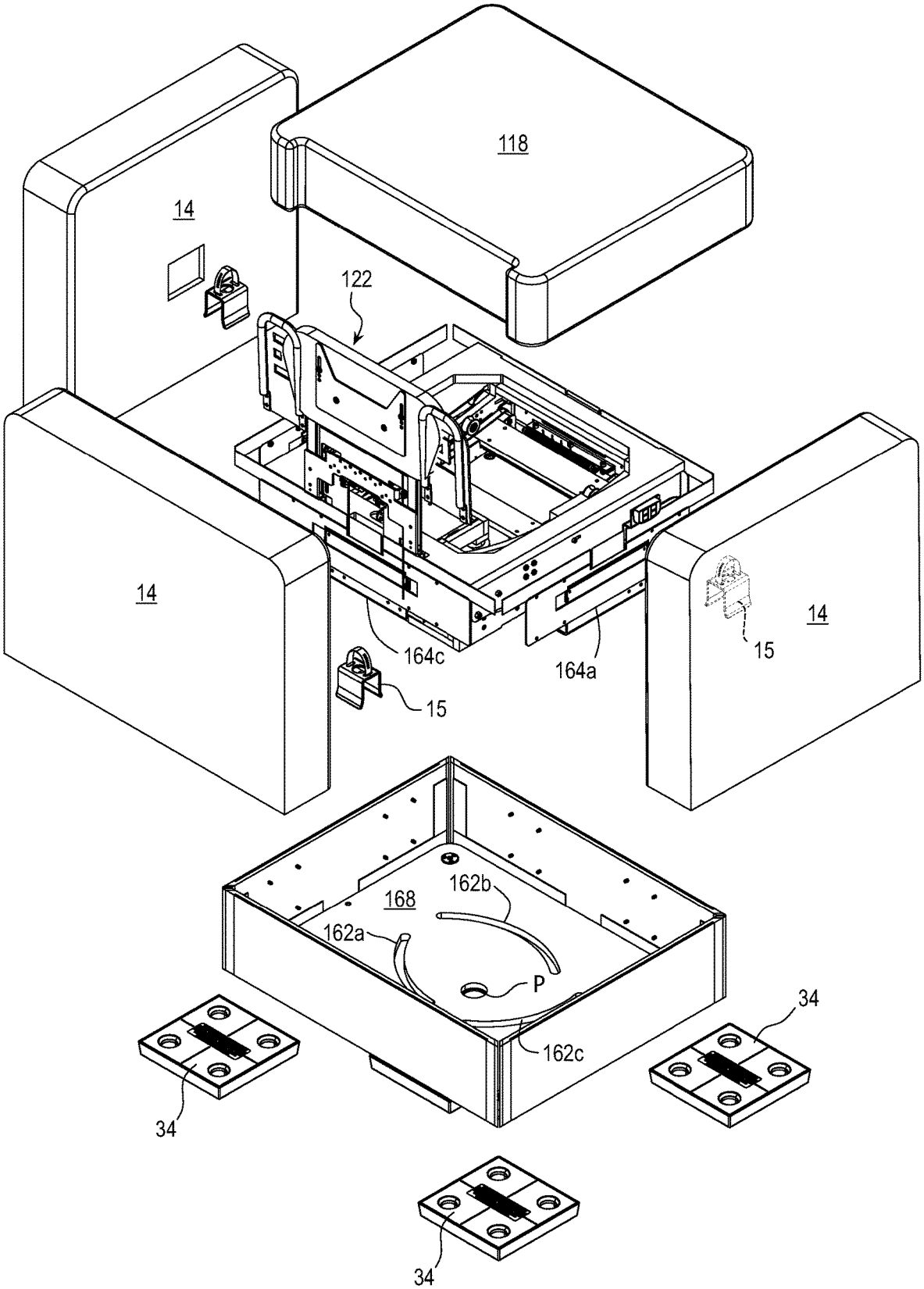
FIG. 24 illustrates an exploded view of the reclining assembly of FIG. 20, illustrating the various internal components of the reclining mechanism, with the seat and reclining assembly oriented in the deep seat configuration.
Figure 25A:
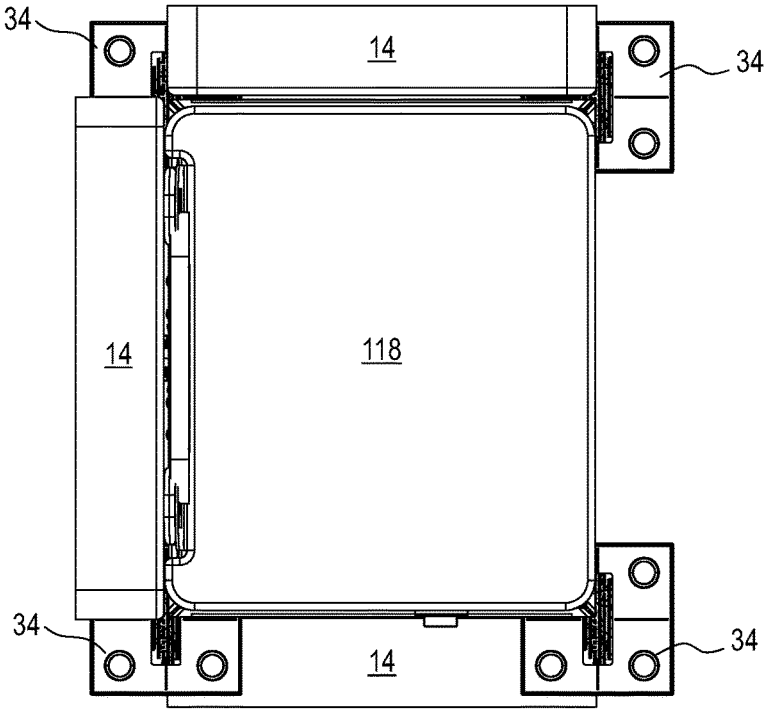
FIG. 25A illustrates a top plan view of the reclining assembly of FIGS. 19-20.
Figure 25B:
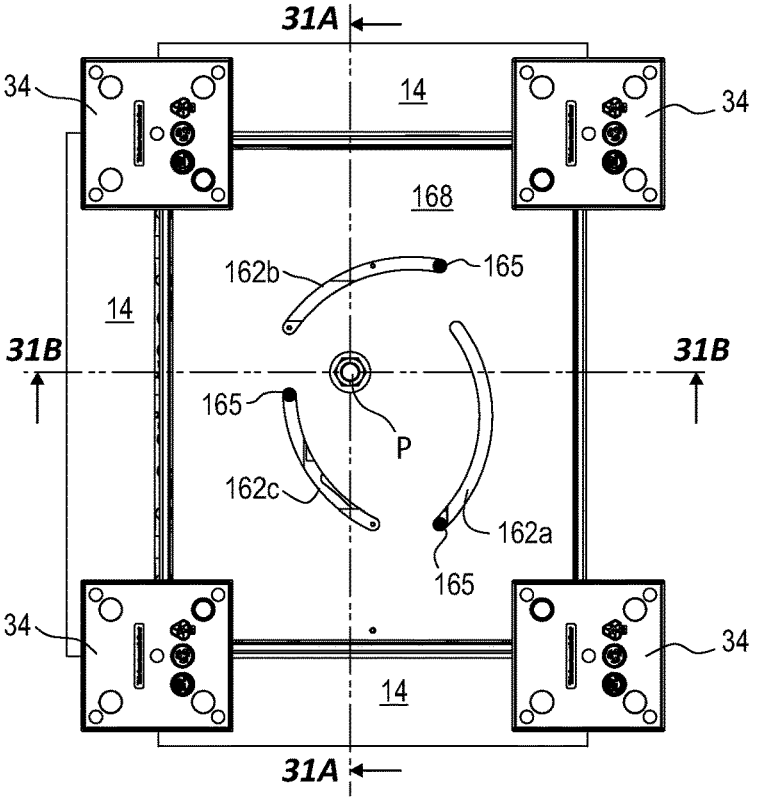
FIG. 25B illustrates a bottom plan view of the reclining assembly of FIGS. 19-20.
Figure 26A:
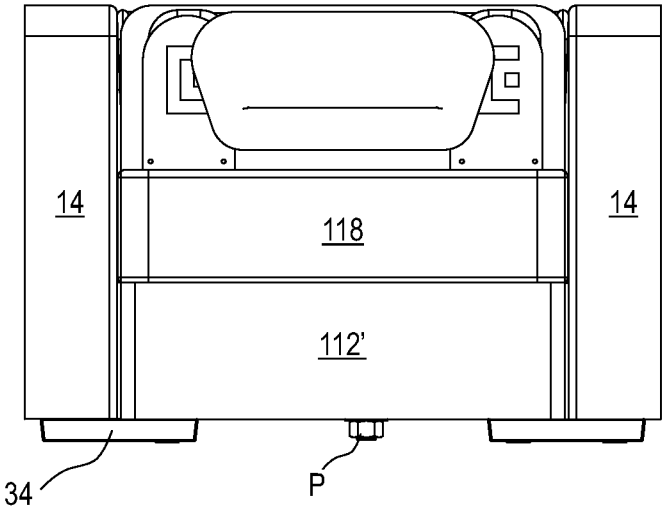
FIG. 26A illustrates a front view of the reclining assembly of FIGS. 19-20, with the reclining assembly in the deep seat configuration.
Figure 26B:
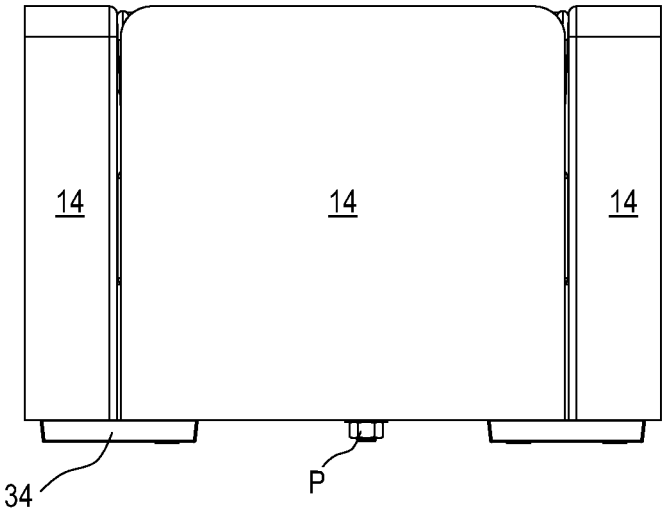
FIG. 26B illustrates a rear view of the reclining assembly of FIGS. 19-20, with the reclining assembly in the deep seat configuration.
Figure 27A:
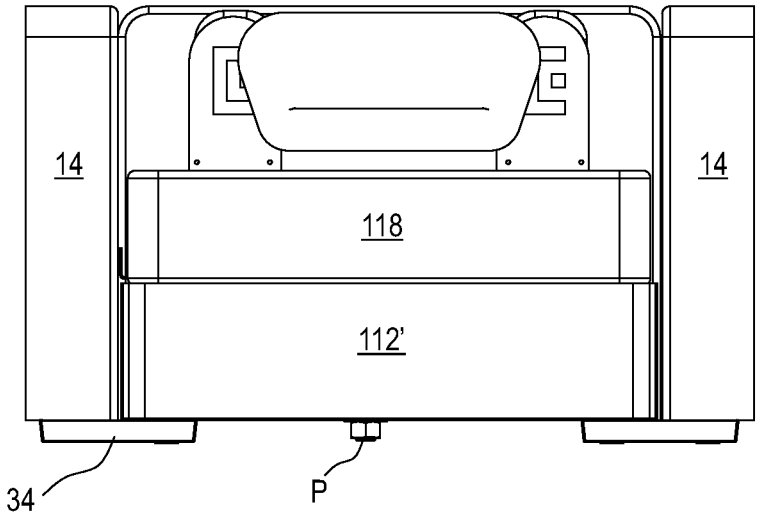
FIG. 27A illustrates a front view of the reclining assembly of FIGS. 19-20, with the reclining assembly in the shallow seat configuration.
Figure 27B:
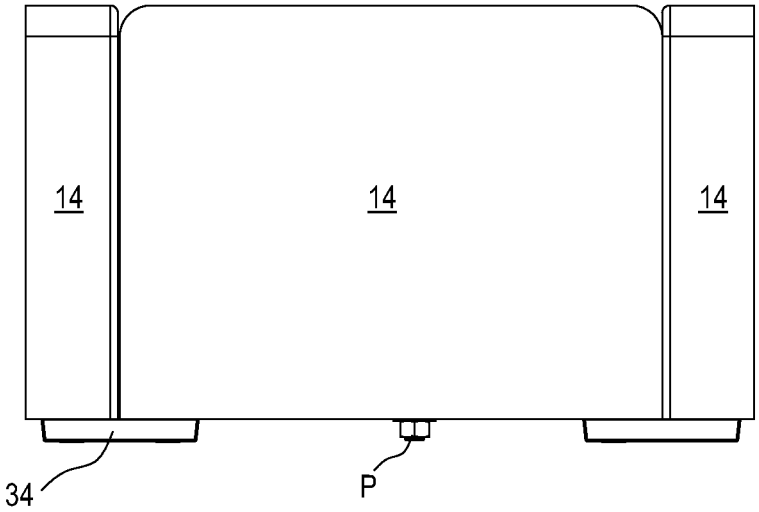
FIG. 27B illustrates a rear view of the reclining assembly of FIGS. 19-20, with the reclining assembly in the shallow seat configuration.

As shown in the Figures that follow FIGS. 19-20, e.g., the exploded view of FIG. 23 and those that follow, an exemplary carriage mechanism for achieving rotation of the reclining assembly from a shallow to a deep configuration is shown, as is a mechanism including gear racks and rotating gears driven by a gear motor, that provide for selective reclining motion of the seat base, and selective extension of the footrest assembly from the housing. It will be appreciated that various other mechanisms are of course also possible for achieving the reclining motion and footrest extension as well as the deep to shallow transition. For example, a linear actuator, a gas spring, a series of mechanical linkages or other system could be used. The provided reclining mechanism is configured to advance the seat of base 112' forward, and slightly upward, as described previously.

Figure 22A:
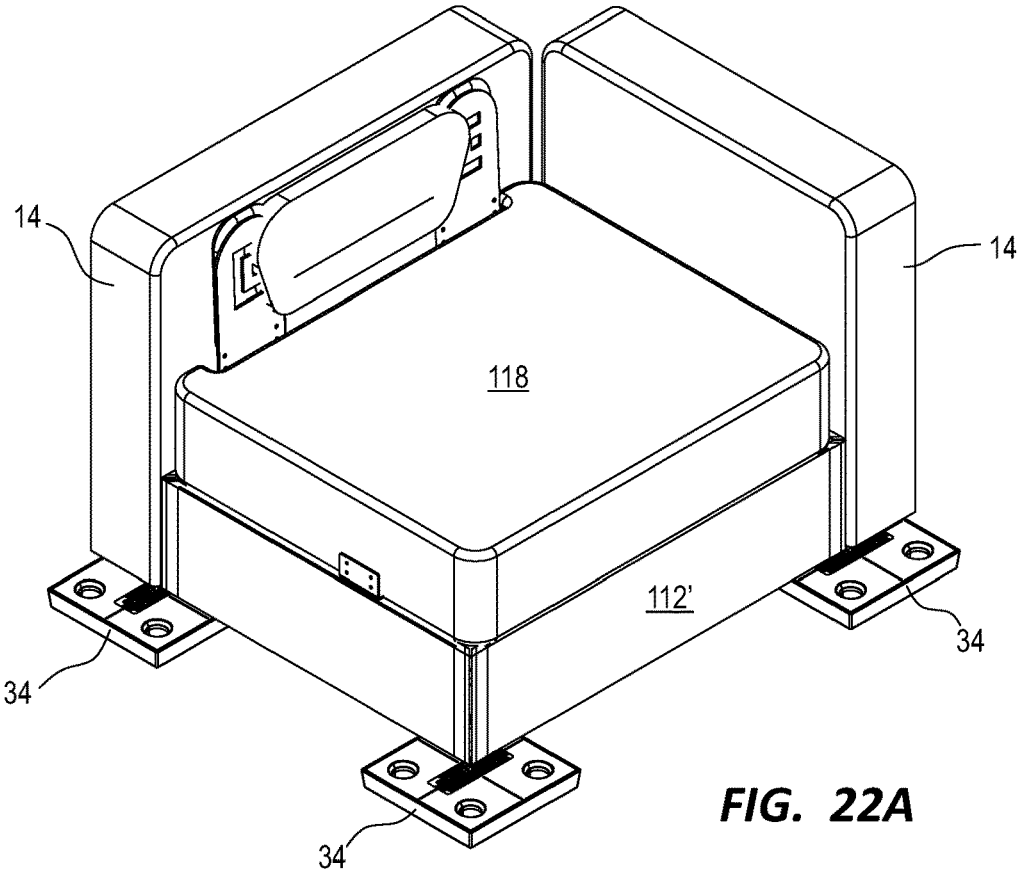
FIG. 22A-22B illustrate top and bottom isometric views, respectively of the reclining assembly of FIG. 19, with one of the upright members serving as an armrest removed.
Figure 22B:
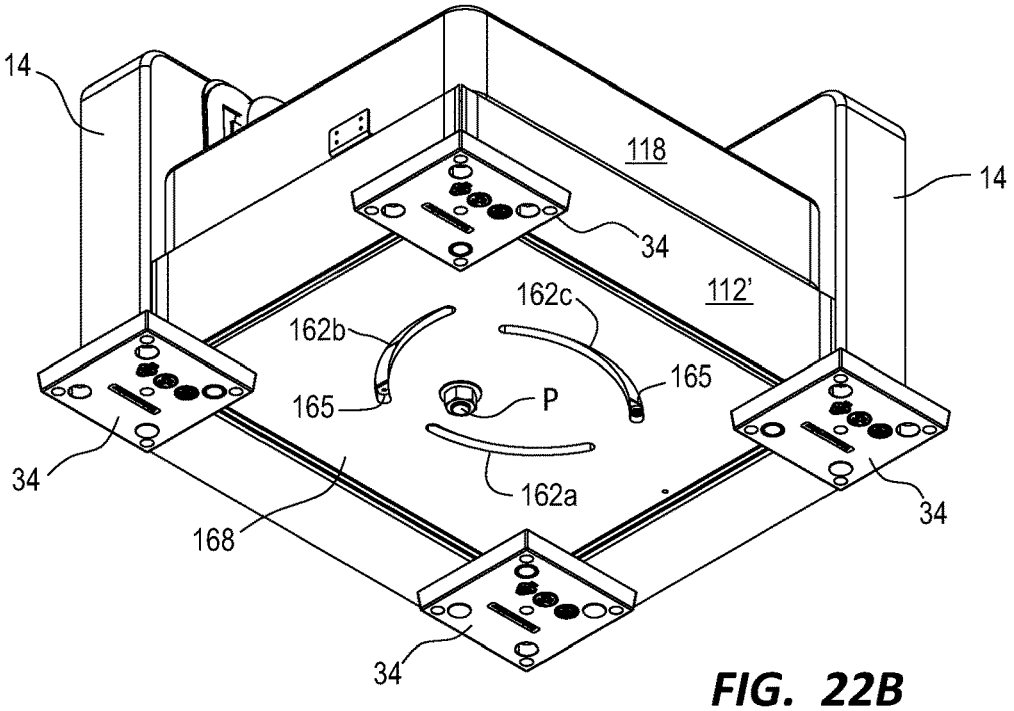
Figure 38A:
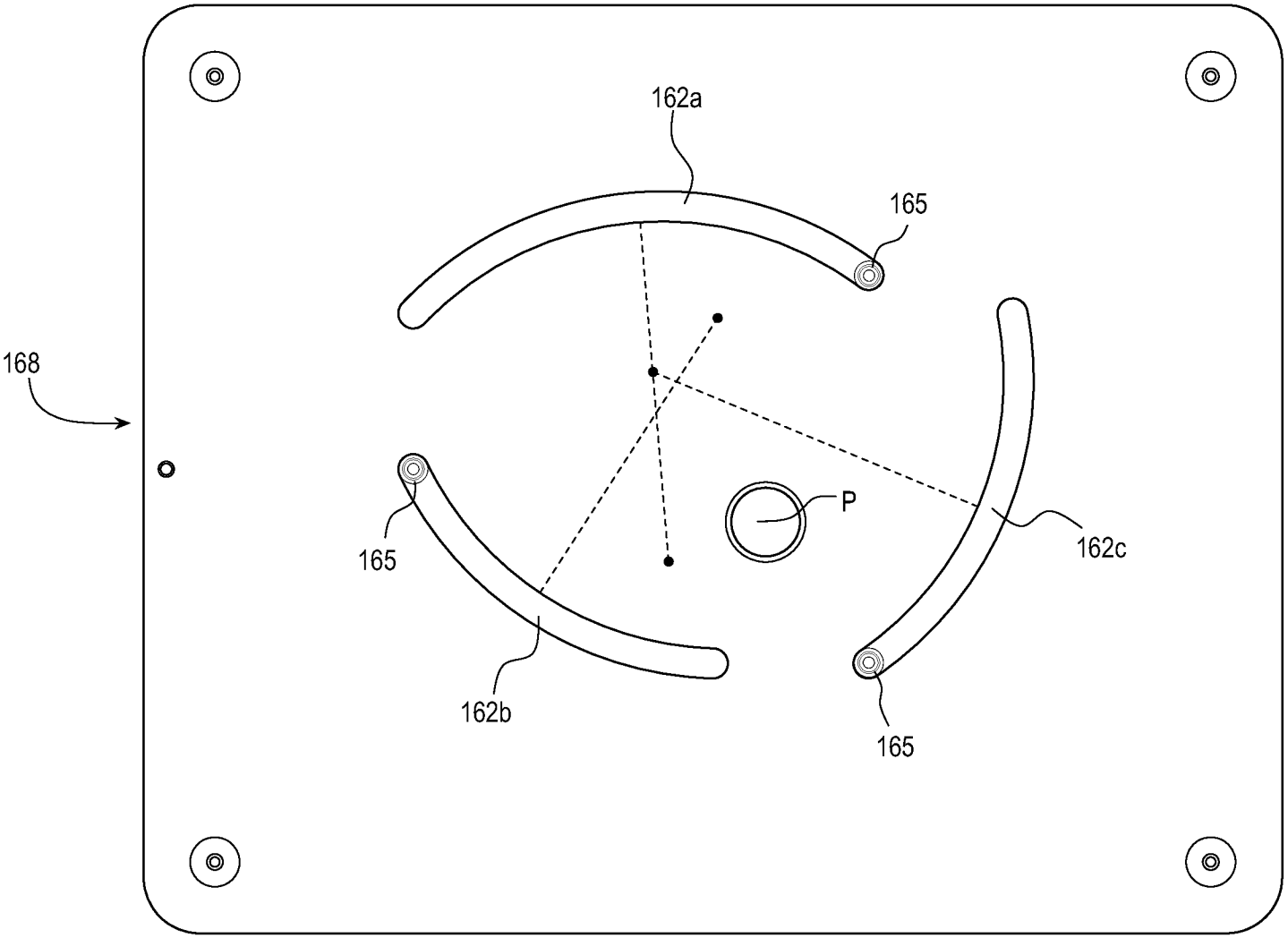
FIGS. 38A-38B illustrate the static lower base plate member associated with the carriage, including arced tracks within which the dowels ride, to transition the base from a shallow to a deep seat configuration.
Figure 38B:
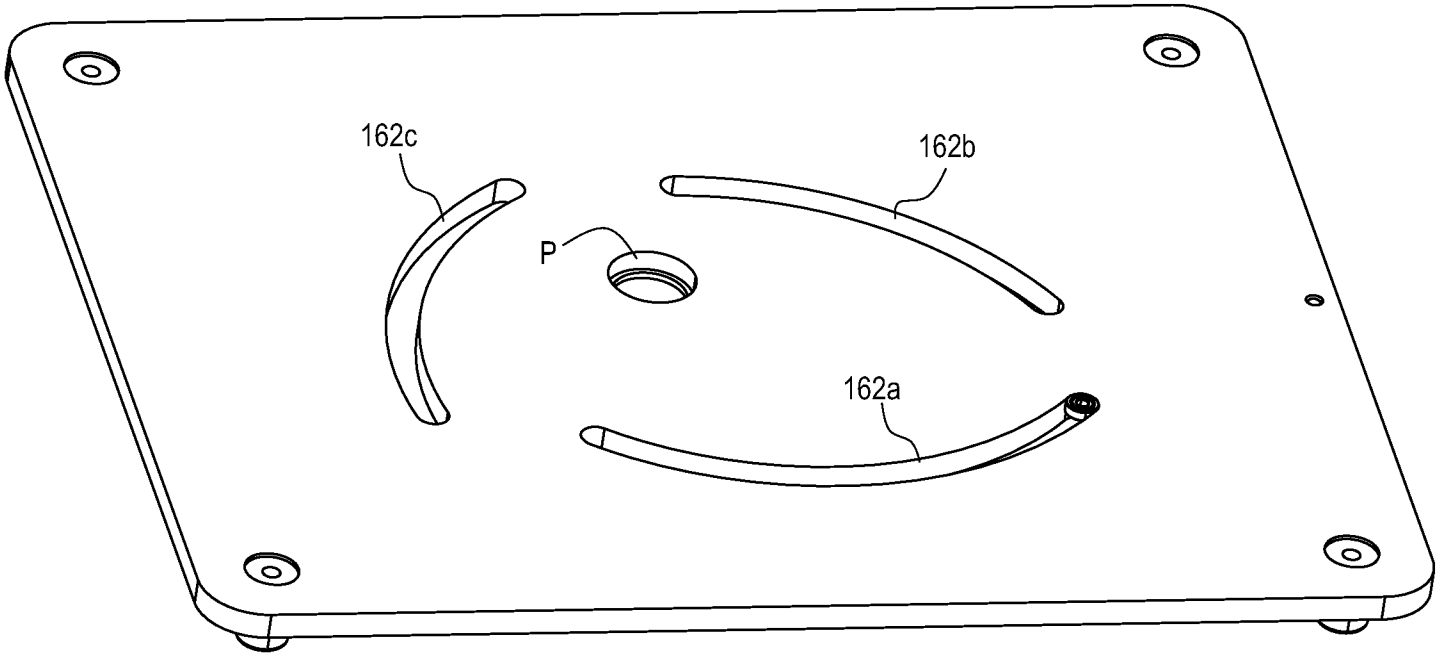

In the illustrated configuration, the base 112' of the reclining assembly includes a carriage 160 (FIG. 23) that includes a pivot point or pivot axis defining an axis of rotation P about which the carriage 160 is rotatable, to allow transitioning from the shallow to the deep seat configuration. The carriage 160 includes a lower base member 168 having a plurality of tracks 162*a*-162*c* and an upper base member 166 including additional tracks 162*d*-162*f*. Both sets of tracks are perhaps best shown in FIGS. 37A-37B and 39A-39C. The size and shape (e.g., radius of curvature, arc length, spacing, center point, etc.) of the tracks are defined by the pivot point associated with axis P, and the desired rotation to be achieved. As shown in FIG. 22B, the location of the pivot point P is not symmetrically located within carriage 160, nor are the arced tracks 162*a*-162*c* in lower base member 168 located symmetrically about pivot point P. Each arced track 162*a*, 162*b*, and 162*c* includes its own center point, (see FIG. 38A) that is similarly off center, nor centered on point P, as determined by the rotation to be achieved. By way of example, such tracks 162*a*-162*c* can have an identical or substantially identical radius of curvature, but positioned about different centers, with different arc lengths as shown. The positioning, location, and other characteristics of the tracks is dictated by the rotation that is to be achieved, when transitioning from a shallow to deep seat configuration.

Figure 28:
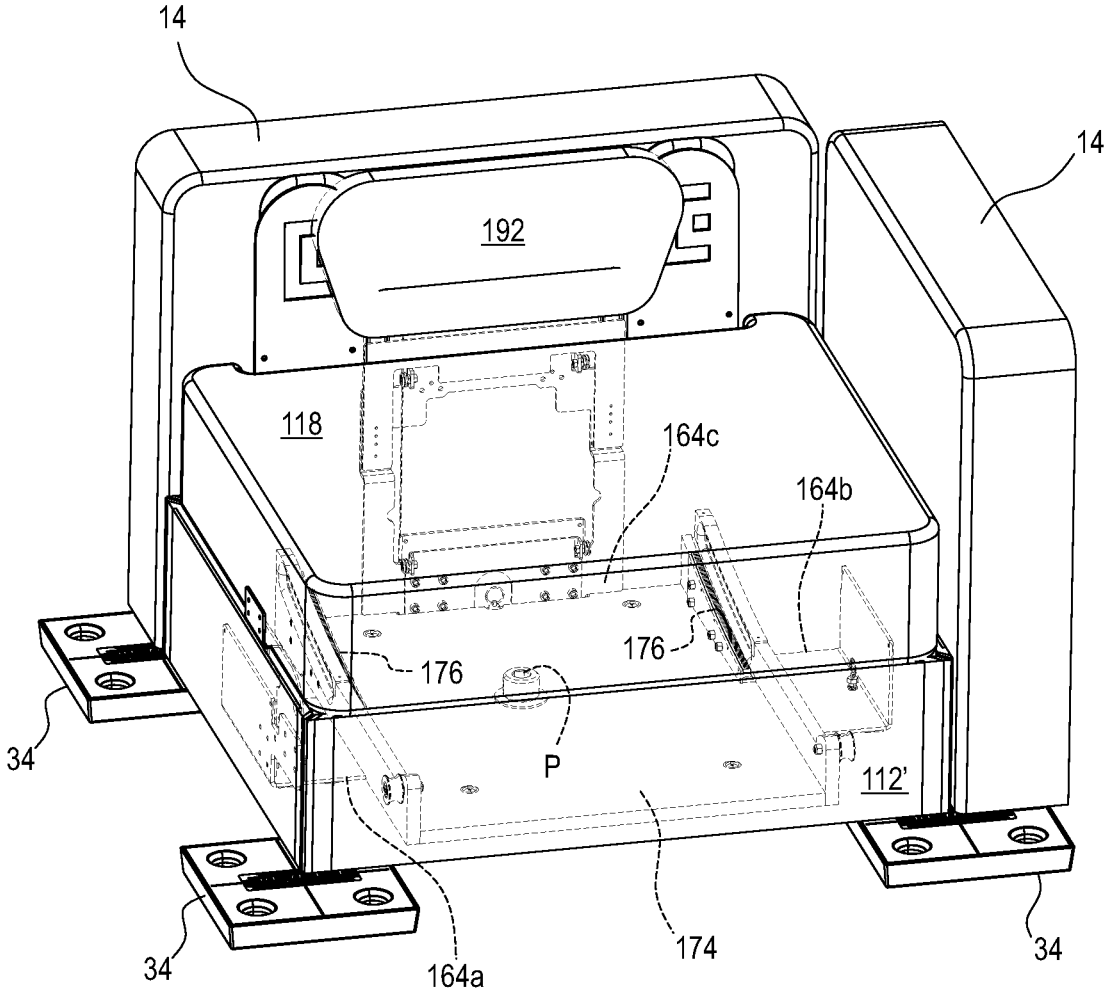
FIG. 28 illustrates a phantom view into the reclining assembly of FIGS. 19-20, with the reclining assembly in the shallow seat configuration.
Figure 29A:
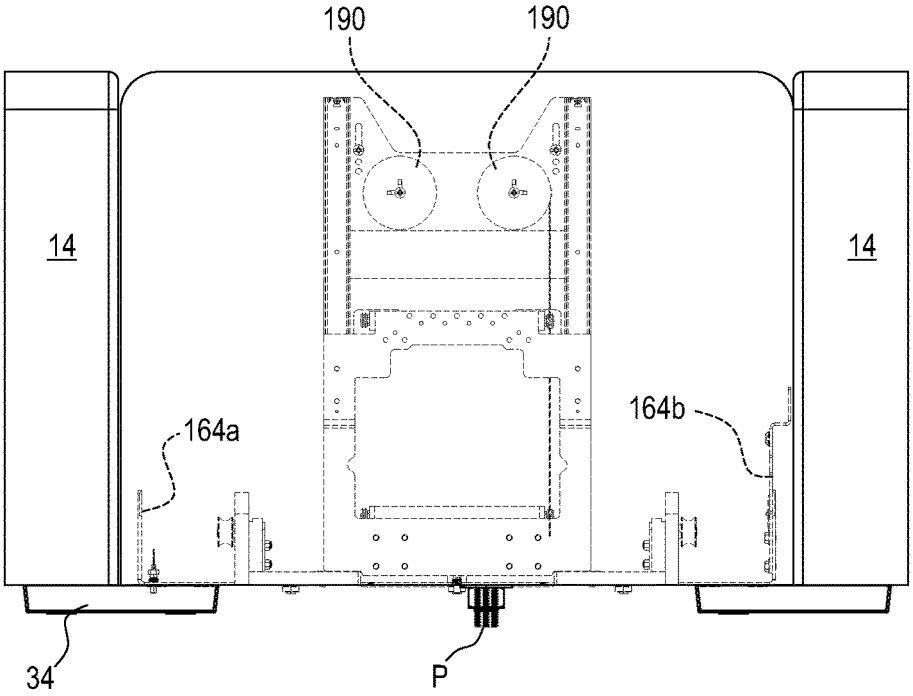
FIG. 29A illustrates a rear phantom view into the reclining assembly of FIG. 28.
Figure 29B:
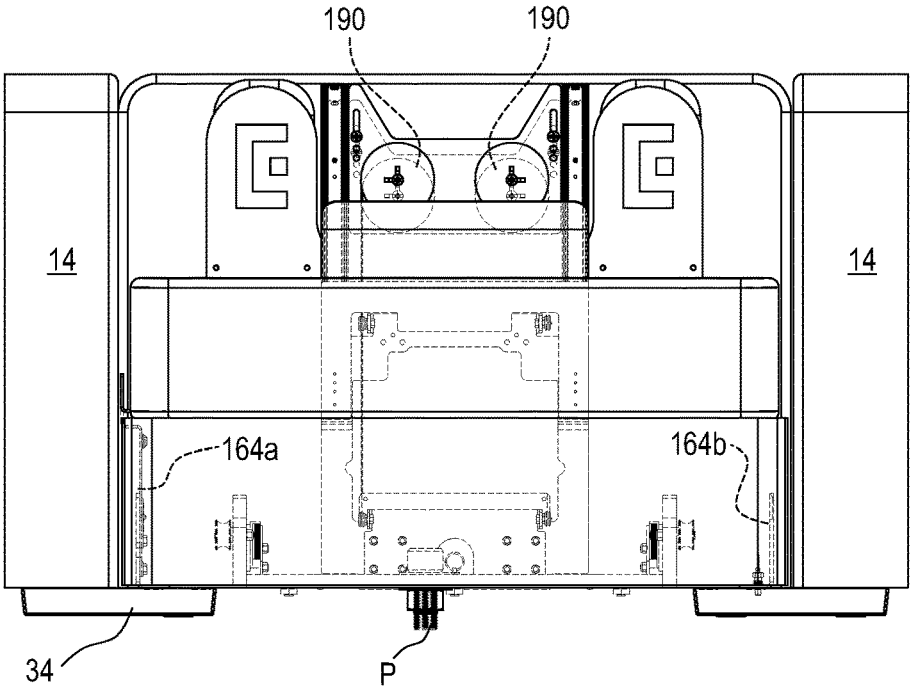
FIG. 29B illustrates a front phantom view of the reclining assembly of FIG. 28.

The carriage 160 also includes a pair of side brackets 164*a* and 164*b*, and a back support member bracket 164*c* (e.g., see FIGS. 23 and 28). Each bracket 164*a*-164*c* can be L-shaped, with one leg sandwiched between the upper and lower base members 166, 168, and also includes a set of top protrusions (e.g., dowels) 163 extending upwardly from such sandwiched leg that engage or communicate with corresponding tracks of the upper tracks 162*d*-162*f*. Each bracket 164*a*-164*c* also includes a set of bottom protrusions (e.g., dowels) 165 extending downwardly from the sandwiched leg that engage or communicate with corresponding tracks of lower tracks 162*a*-162*c*.

Figure 39A:
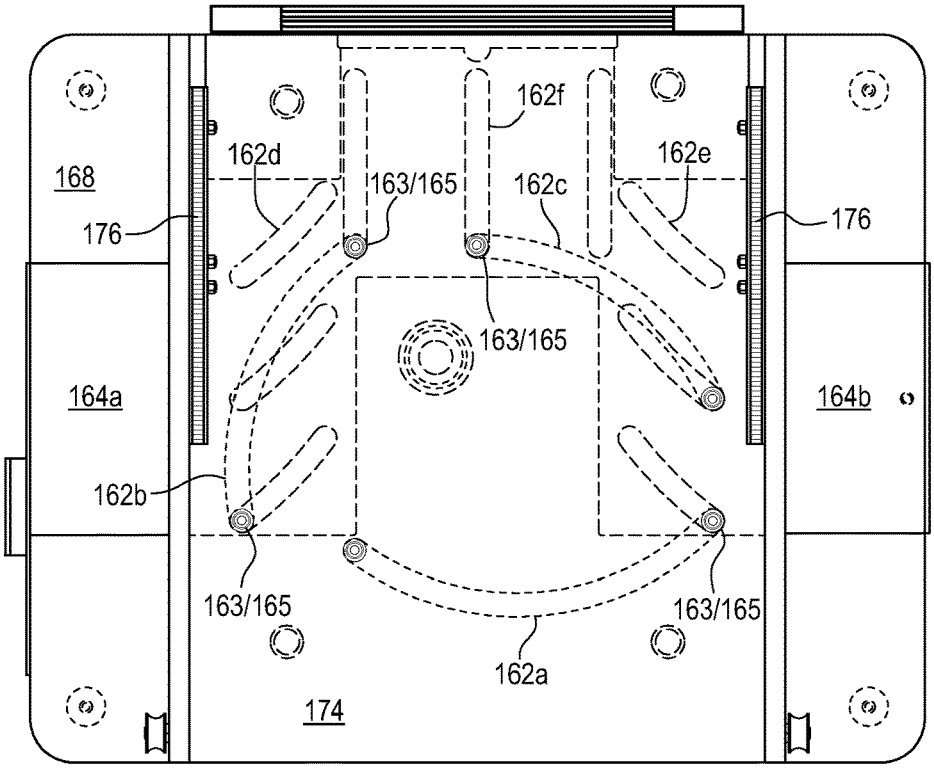
FIG. 39A illustrates the lower carriage portion with the geared racks, and associated upper base member with arced and linear tracks, in position over the static lower base member with arced tracks, shown in the shallow seat configuration.
Figure 39B:
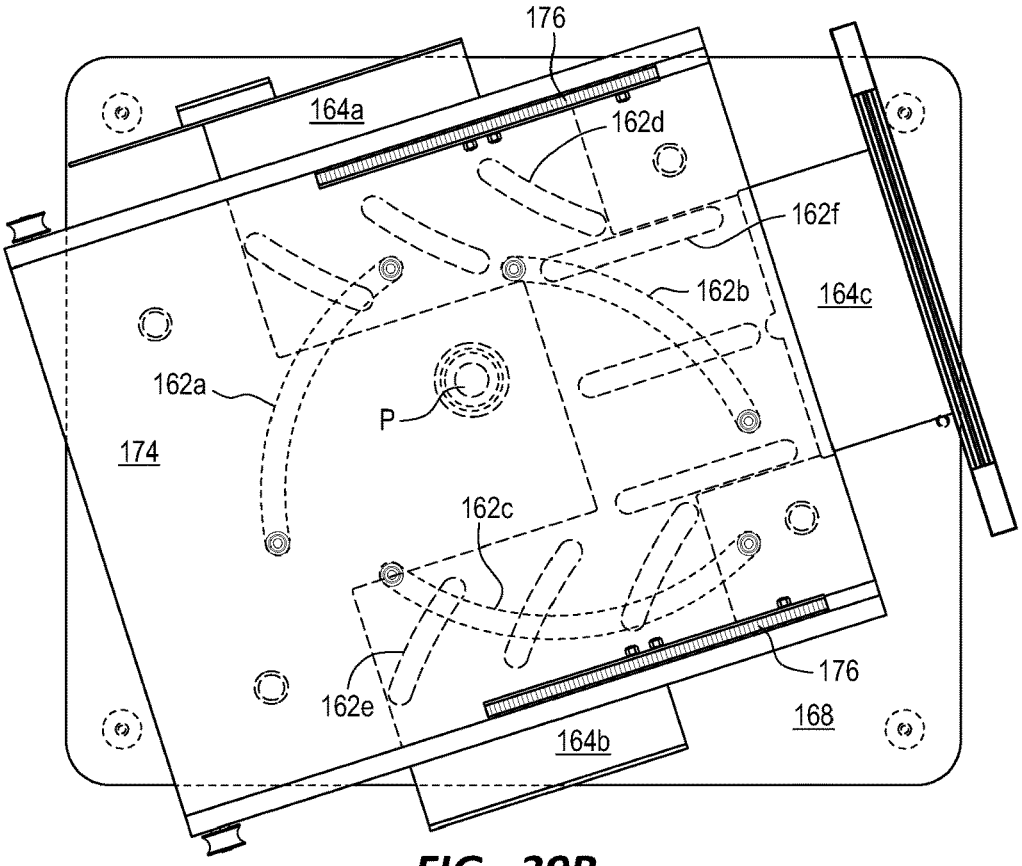
FIG. 39B illustrates the lower carriage portion and upper base member with arced and linear tracks in position over the static lower base member, with the upper base member and lower carriage portion riding thereon partially rotated over the static lower base member, in transition between shallow and deep seat configurations.
Figure 39C:
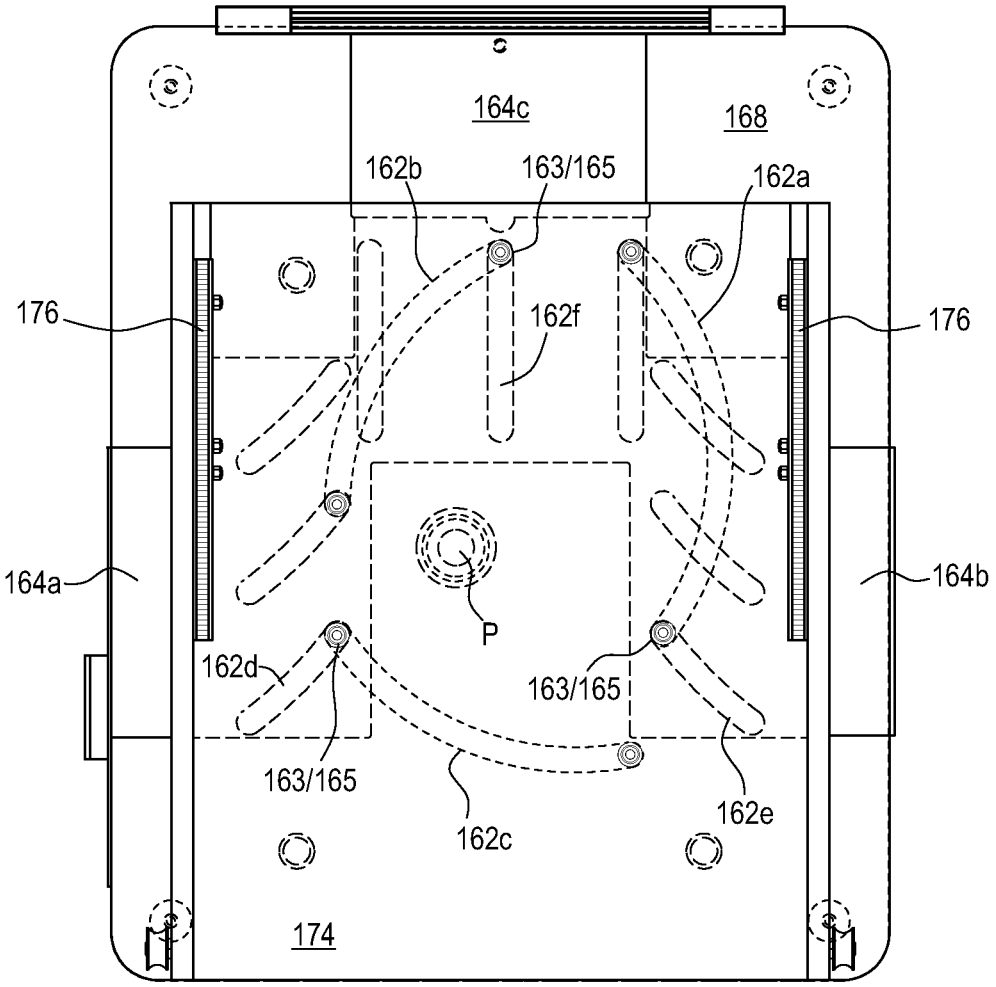
FIG. 39C illustrates the lower carriage portion and upper base member with arced and linear tracks in position over the static lower base member with arced tracks, shown fully transitioned to the deep seat configuration.
Figure 40:
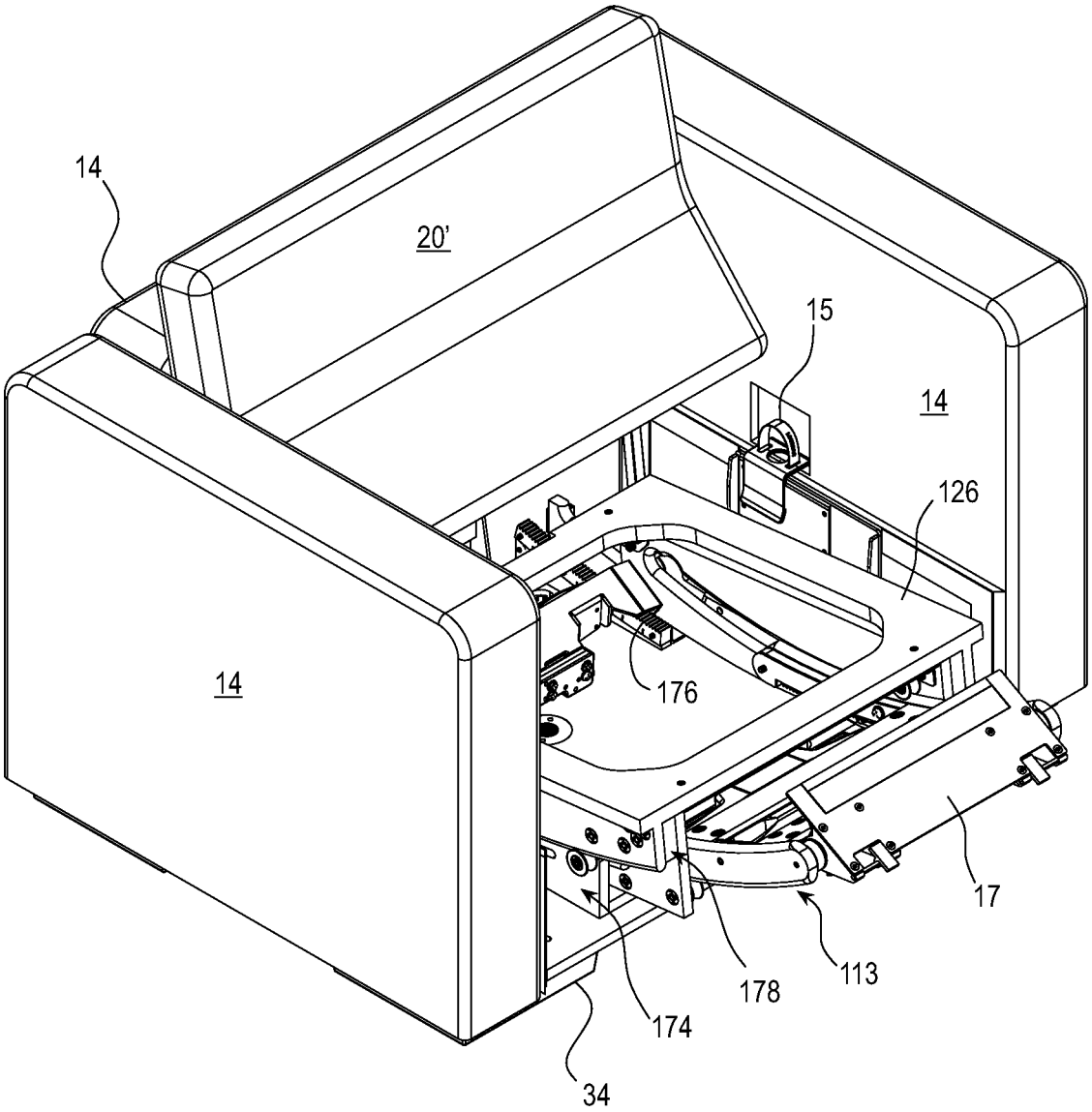
FIG. 40 illustrates a side perspective or isometric cut-away or phantom view of the carriage of the reclining base, with seat base and the footrest assembly extended.
Figure 41A:
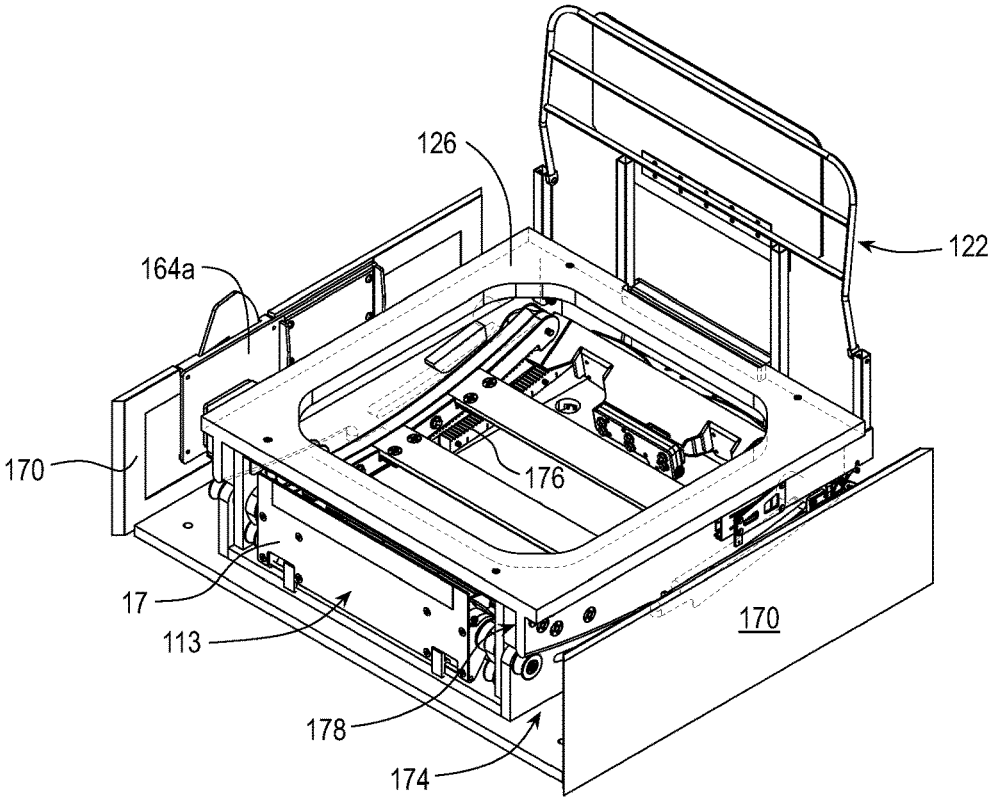
FIG. 41A illustrates in cut-away or phantom view, the carriage and footrest assembly in the compressed, non-extended position.
Figure 41B:
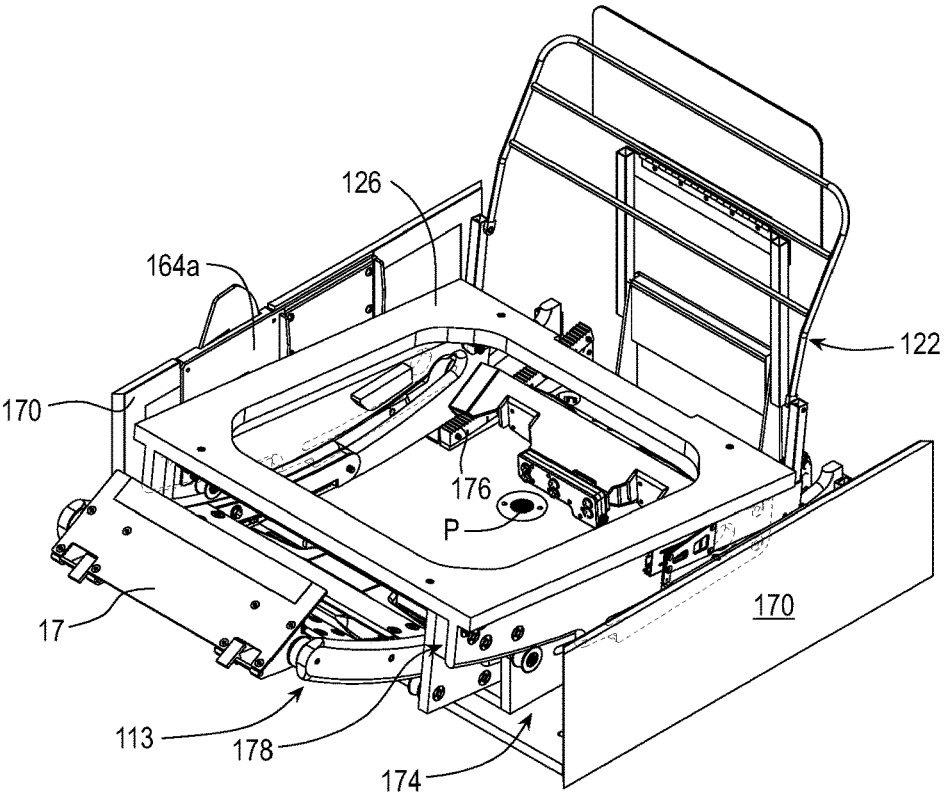
FIG. 41B illustrates in cut-away or phantom view, the carriage and footrest assembly where both have been partially extended.
Figure 41C:
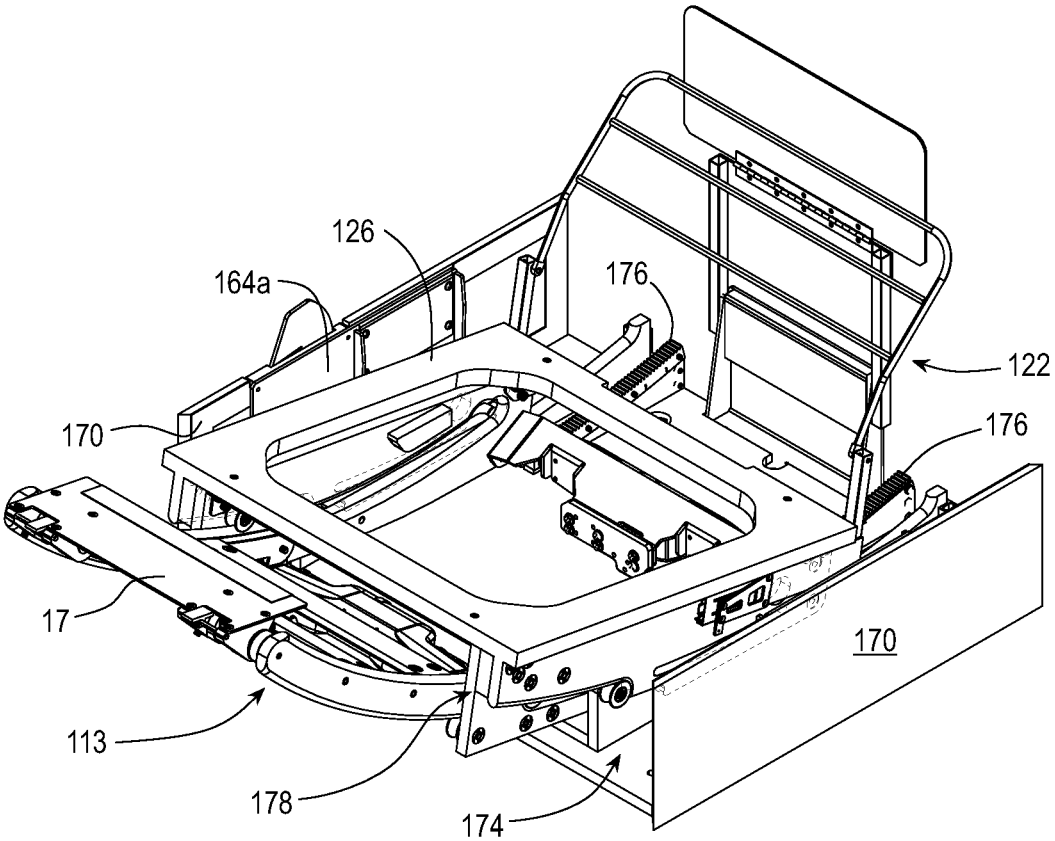
FIG. 41C illustrates in cut-away or phantom view, the carriage and footrest assembly where both have been further or fully extended.

FIGS. 39A-39C may best illustrate the alignment of the upper and lower tracks, and the engagement of the top and bottom protrusions 163, 165 within such tracks. The protrusions of the brackets are effectively sandwiched between the upper and lower base members 166, 168, each with their respective tracks within which the dowels or other protrusions ride, to guide rotation of the carriage, during transition from the shallow to deep seat configuration, or vice versa. The lower tracks are arced tracks 162*a*-162*c*, with a constant radius of curvature as shown in several of the figures, for example, FIGS. 22B and 23. The upper tracks also include arced tracks associated with the sides of the carriage (e.g., tracks 162*d* and 162*e*), while linear tracks 162*f* are provided, associated with the back support panel bracket 122. The various tracks are sized and shaped (e.g., placement, spacing, arc length, radius of curvature, etc.) as defined by the pivot point of the carriage, and the desired rotation to ensure that the desired rotation occurs, when the dowels or other protrusions ride within the corresponding tracks, both above and below each of the respective brackets.

The upper tracks 162*d*-162*f* can be provided within upper base member 166, while the lower tracks 162*a*-162*c* are provided within static lower base member 168. The system of tracks within such bases, with the brackets sandwiched therebetween, allow for transition of the base from a shallow configuration to a deep seat configuration, and vice versa, through a simple 90° rotation of the upper base member 166 relative to the lower base member 168. During such rotation the dowels or other protrusions 163, 165 of the respective brackets 164*a*-164*c* ride within the tracks 162*a*-162*f*, so as to adjust the location of the outside edge of the un-sandwiched leg of the L-shaped brackets 164*a* and 164*b* to the appropriate locations. In particular, this allows the width and length dimensions defined by the seat to change, as the rotation of the carriage occurs. For example, pushing the bracket out, in order to transition a given edge from a smaller dimension (e.g., 29 inches) to a larger dimension (e.g., 35 inches), and pulling the bracket in, when transitioning from the larger dimension (e.g., 35 inches) to the smaller dimension (e.g., 29 inches) when transitioning in the reverse manner.

FIGS. 39A-39C illustrate the relationship between such tracks, brackets, and dowels or other protrusions in the shallow seat configuration (FIG. 39A) and in the deep seat configuration (FIG. 39C). The riding of the dowels or other protrusions 163, 165 within the tracks forces the brackets to assume the proper location, e.g., defining a seat width of 29 inches in a deep seat configuration, and 35 inches in a shallow seat configuration, while assuming a seat depth of 29 inches in the shallow seat configuration and a 35 inch seat depth in the deep seat configuration. By way of example, in the initial shallow configuration, the pair of side brackets can be spaced so as to extend outwardly about 11-14 inches from the upper (or lower) base members of the carriage. In the rotated deep seat configuration, the pair of side brackets can be closer in, e.g., about 7-10 inches from the upper (or lower) base members of the carriage. Of course the foregoing values are merely exemplary, and it will be appreciated that other values could alternatively be used, depending on the desired seat geometry and dimensions.

Figure 58:
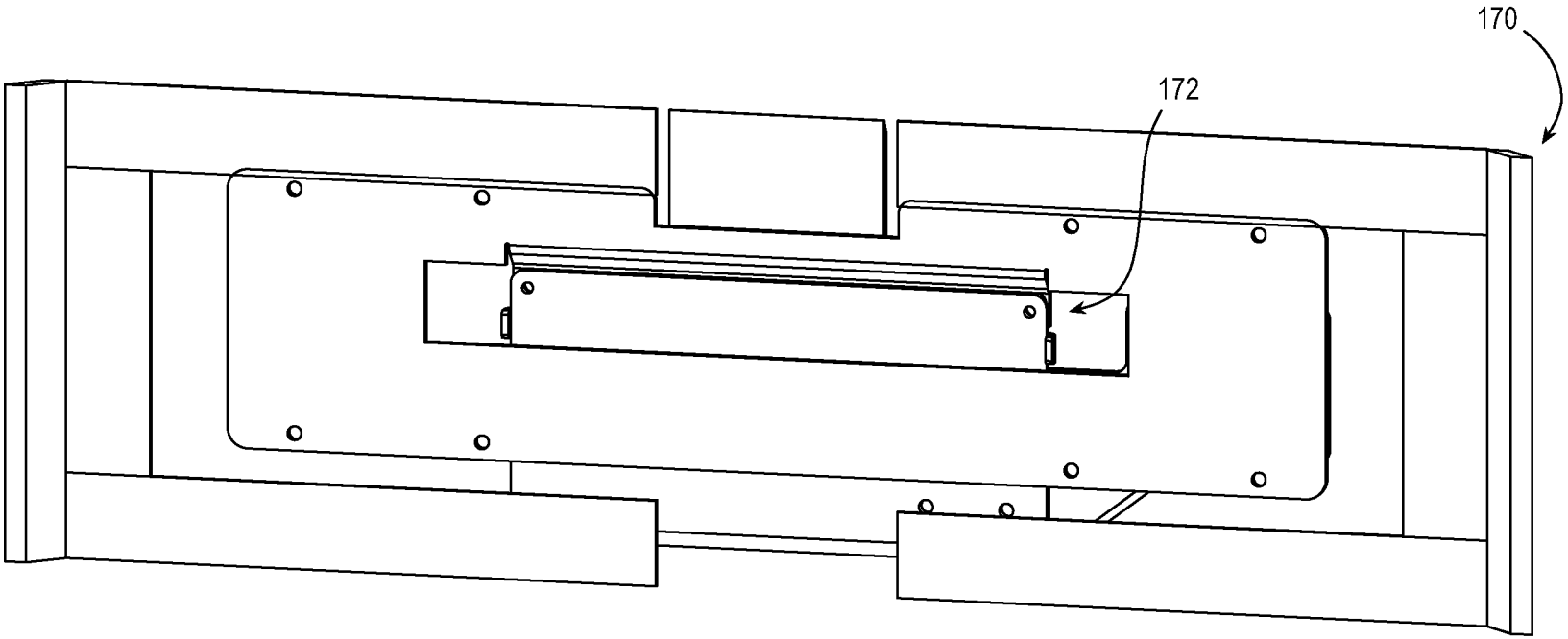
FIG. 58 illustrates an exemplary kick panel, for attachment to a bracket.
Figure 59A:
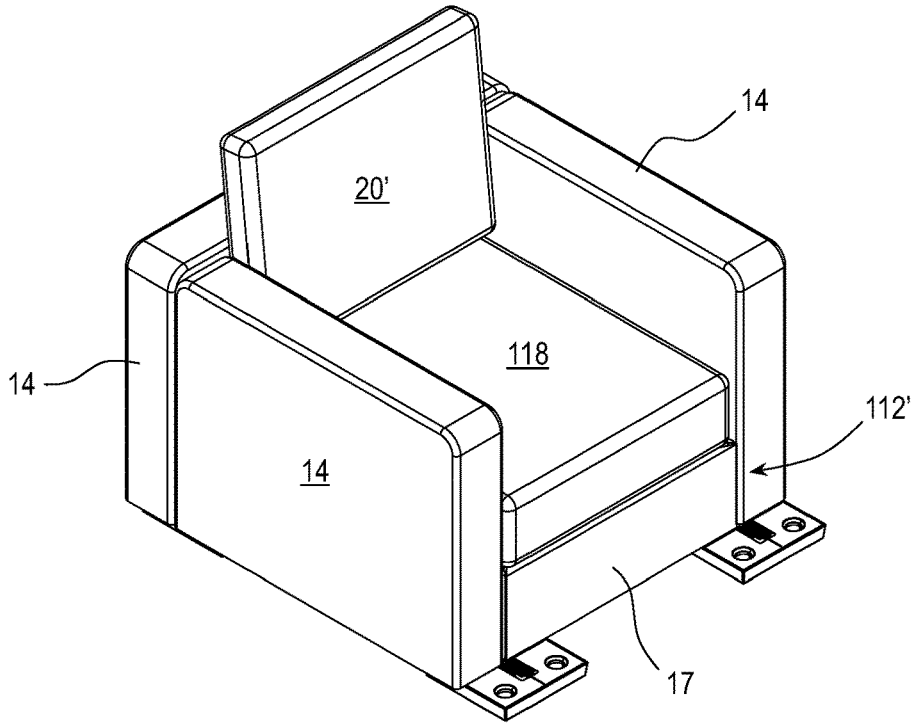
FIG. 59A illustrates the furniture assembly in a deep seat configuration, including the recliner assembly positioned as the base of the illustrated furniture assembly.
Figure 59B:
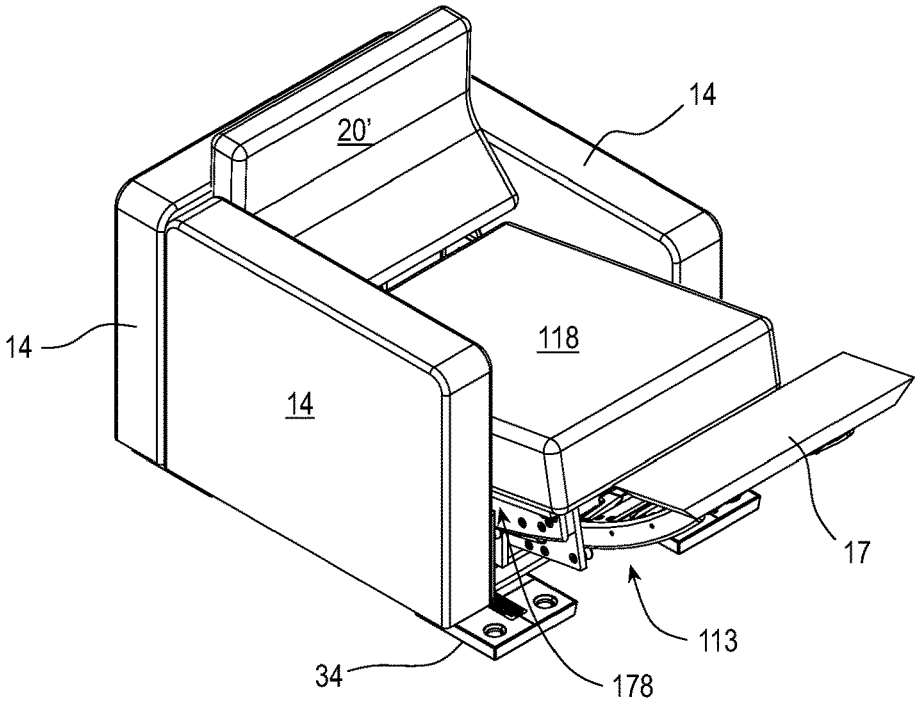
FIG. 59B illustrates the reclining furniture assembly of FIG. 59A, with the seat reclined forward and up, and the footrest extended.
Figure 60A:
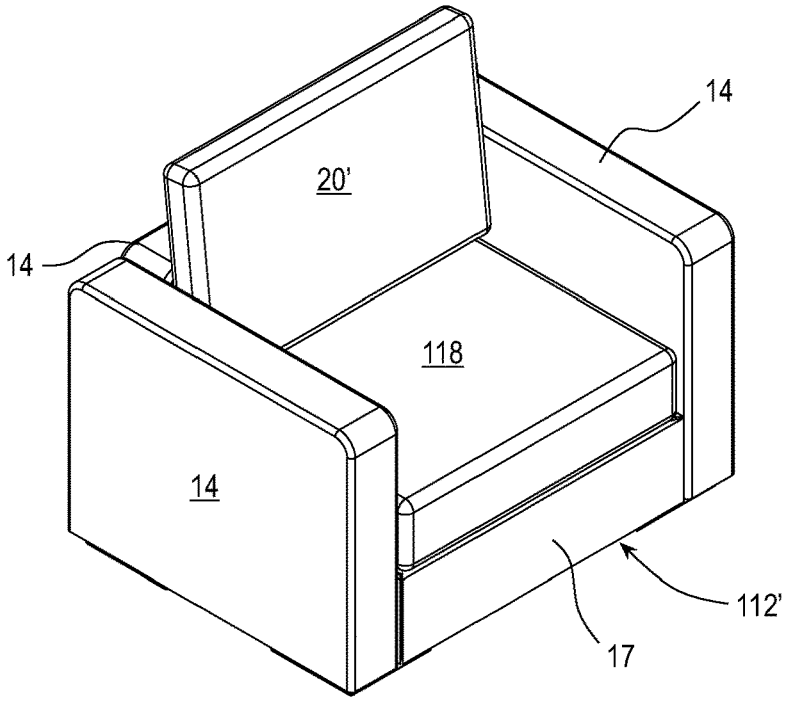
FIG. 60A illustrates the furniture assembly in a shallow seat configuration, including the recliner assembly positioned as the base of the illustrated furniture assembly.
Figure 60B:
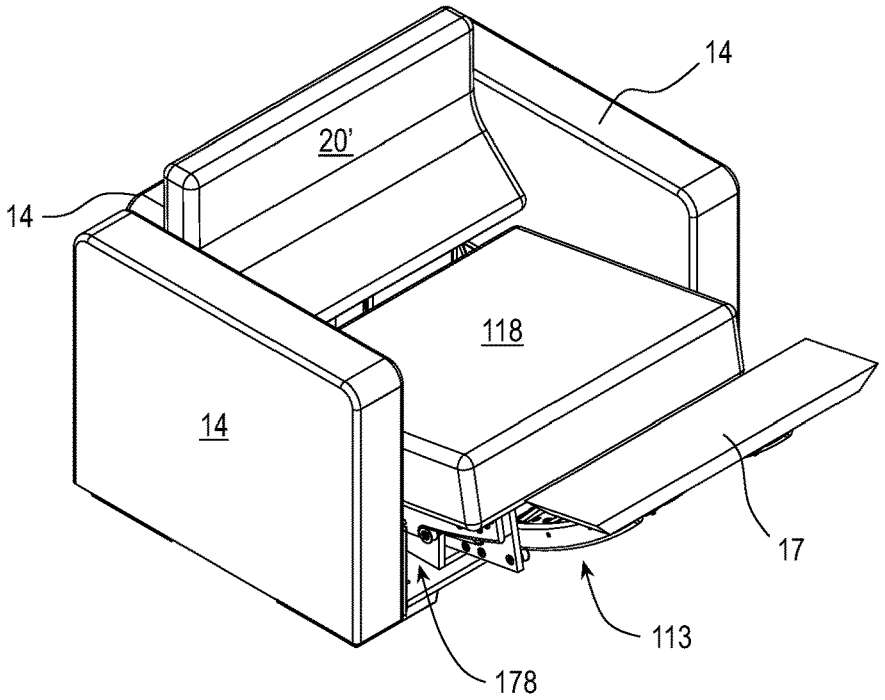
FIG. 60B illustrates the reclining furniture assembly of FIG. 60A, with the seat reclined forward and up, and the footrest extended.

Kick panels 170 for the reclining base 112' can be attached to the un-sandwiched vertically extending leg of the side brackets 164*a*, 164*b*, while a back support panel 122 is attached to the back support bracket 164*c*. Such kick panels 170 can include a receiving pocket 172, e.g., such as shown in FIG. 58, within which a top of the corresponding bracket is inserted, positioning the appropriate kick panels 170 in the proper position over the reclining base 112'.

Once the carriage has been rotated to a desired orientation (e.g., deep seat or shallow seat configuration), a stop, pin, or other locking mechanism can be engaged, to ensure that that carriage is held in that position, until the user unlocks the carriage, for rotating to the other seating orientation.

In addition to the transition provided by the carriage 160, the illustrated reclining assembly includes a reclining mechanism that relies on rotating gears 180, that ride along a gear rack 176 in order to achieve the desired reclining action, and a similar arrangement of rotating gears 182 and gear racks 186, to provide extension of the footrest assembly 113. For example, the reclining mechanism includes a rotating gear 180 that engages against a gear rack 176, where a backrest angle (e.g., defined by back support panel 122 and/or pillow 20') reclines as the seat is pushed forward by the reclining mechanism. The reclining mechanism includes a back support member or panel having a bottom edge that is pivotally coupled to the back of the seat, where the top of the back support member or panel slides down, adjacent the upright member that serves as the backrest. As the seat reclines forward, the bottom of the back support member or panel also moves forward with the seat (e.g., it is pulled forward, due to the attachment to the moving portion of the reclining mechanism). At the same time, in an embodiment, the top of the back support member or panel slides down the vertical face of the upright member, during the reclining extension.

While in an embodiment the back support member or panel includes a bottom edge that is pivotably coupled to the back of the seat, another embodiment can be somewhat differently configured, where the back support member or panel is not necessarily pivotable relative to the back of the seat, but can simply be coupled thereto. The top edge of such back support member or panel can be hinged, where the bottom edge of such a panel is engaged by the back support member or bracket, which pulls the bottom edge of the panel forward (creating a backrest reclining angle) during such movement. The top of the panel can be hingedly attached to a static backrest upright member or other provided structure, so that the angle between the top hinge point and the bottom of the panel is extended as the bottom of the panel is pulled forward by the back support bracket, attached to the seat. Upon the reverse movement of the seat, the angle between the panel and the static backrest upright member is reduced or closed, as the seat is driven back to its standard unreclined position. It will be apparent that a variety of different connections are possible between the reclining base, and any back support member or panel, which provides a reclining, angled face, for support of back pillow 20'.

Figure 30A:
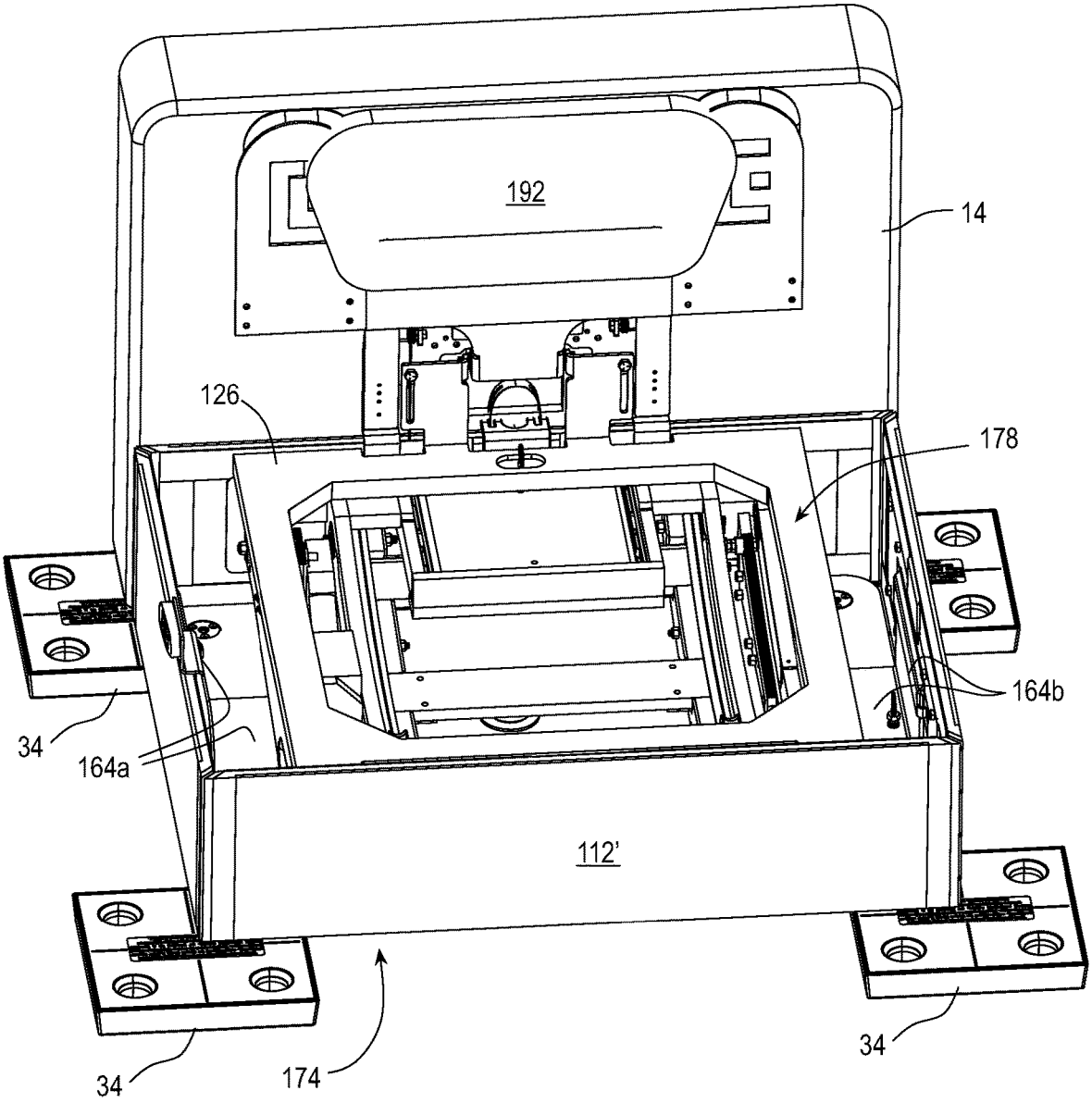
FIG. 30A illustrates a front perspective view of the reclining assembly of FIG. 28 with the upright members serving as armrests removed.
Figure 30B:
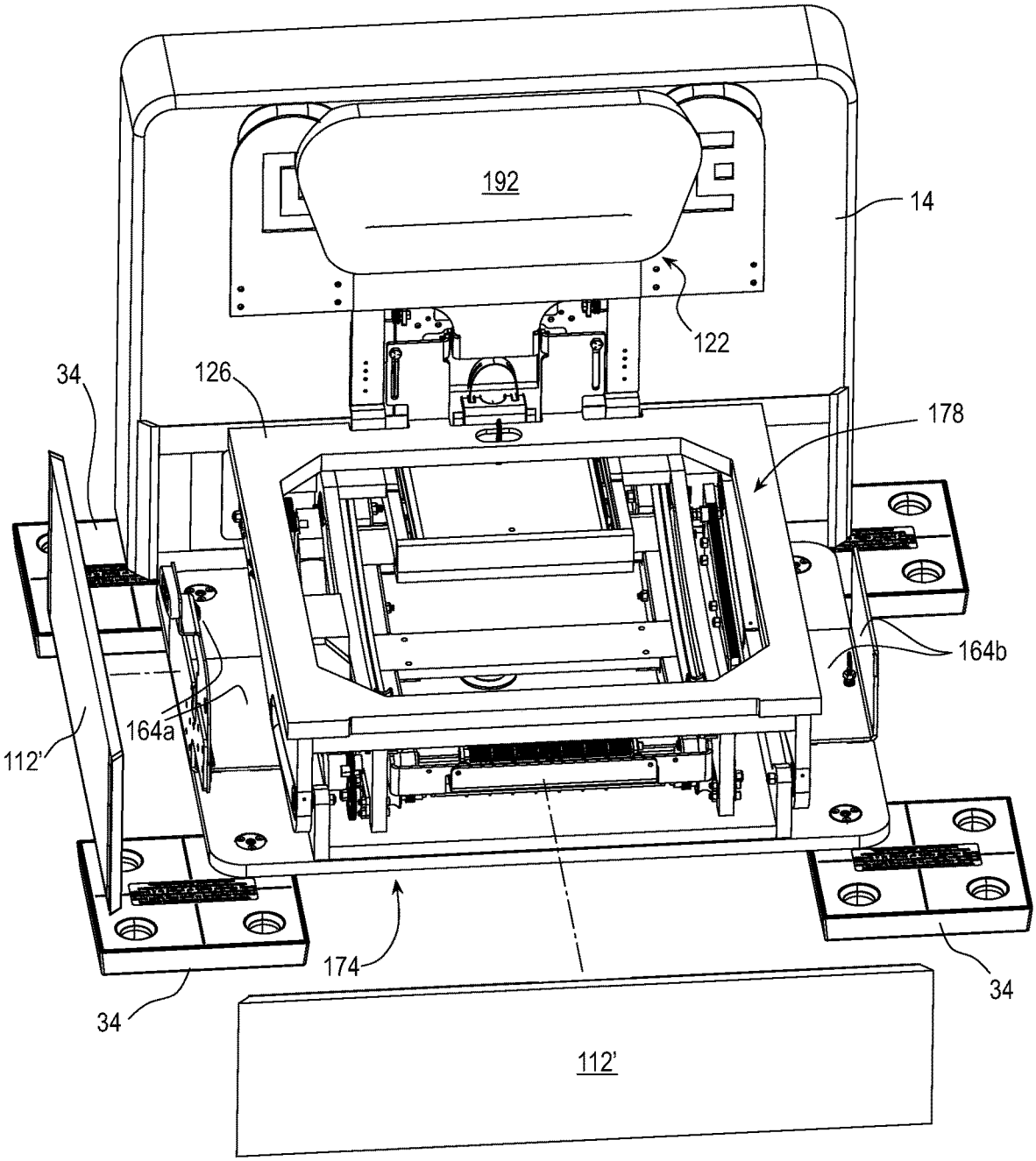
FIG. 30B illustrates a front perspective view of the reclining assembly of FIG. 30A with portions of the housing removed, to better illustrate the internal components.
Figure 30C:
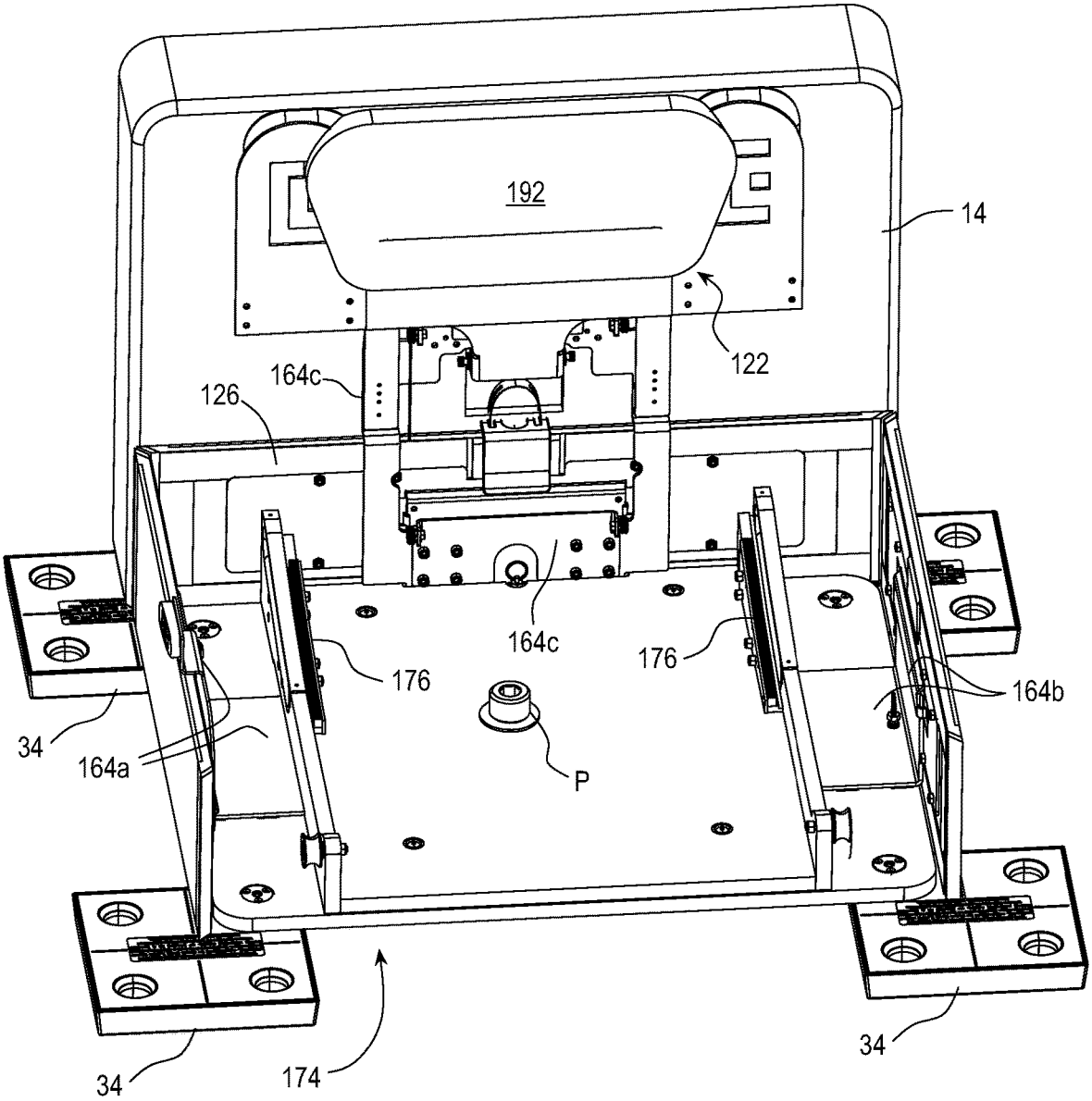
FIG. 30C illustrates a front perspective view of the reclining assembly of FIG. 30B with additional portions of the housing and upper carriage portion removed, to better illustrate the internal components.
Figure 30D:
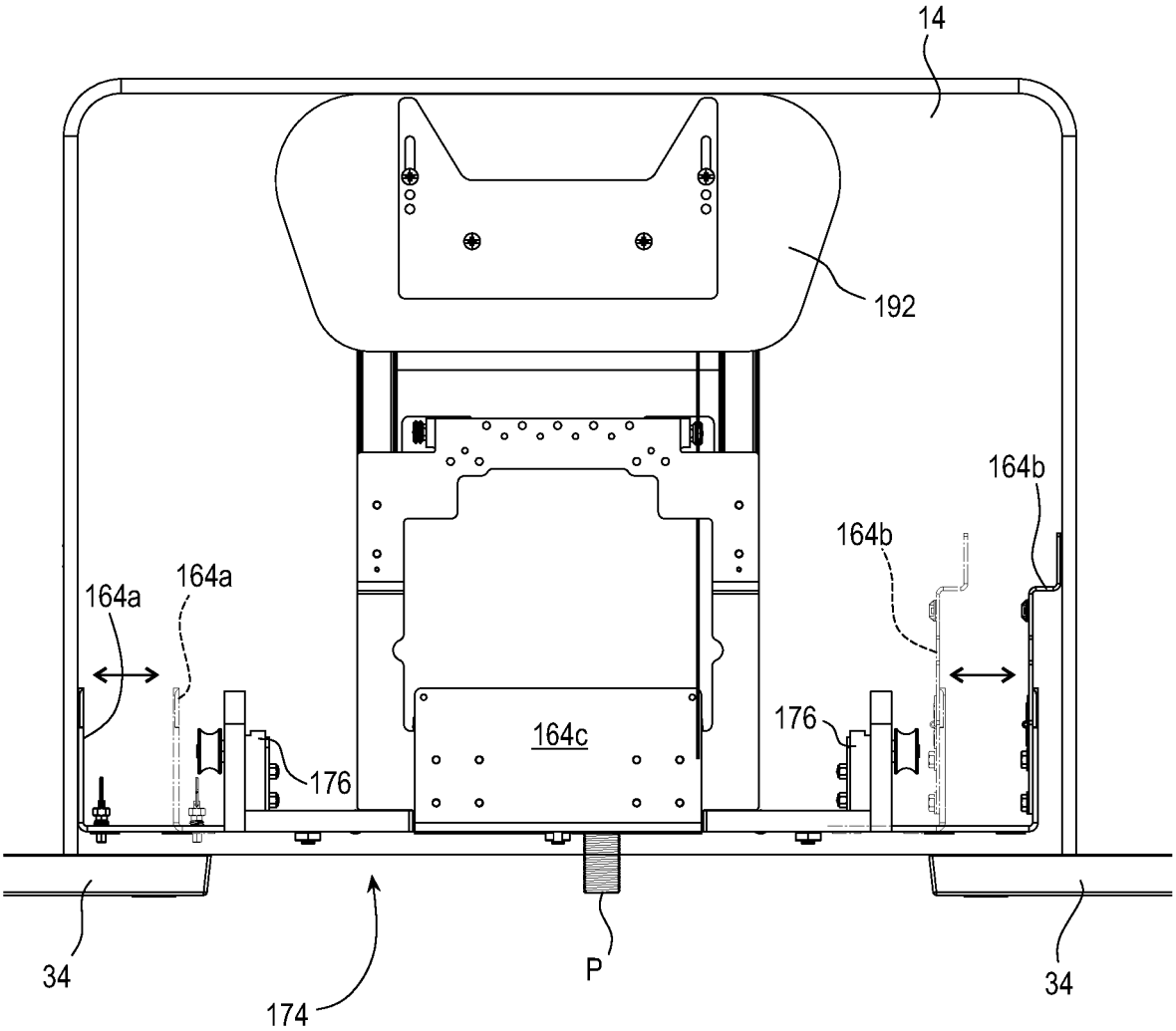
FIG. 30D illustrates a rear phantom view into the reclining assembly of FIG. 30C.
Figure 31A:
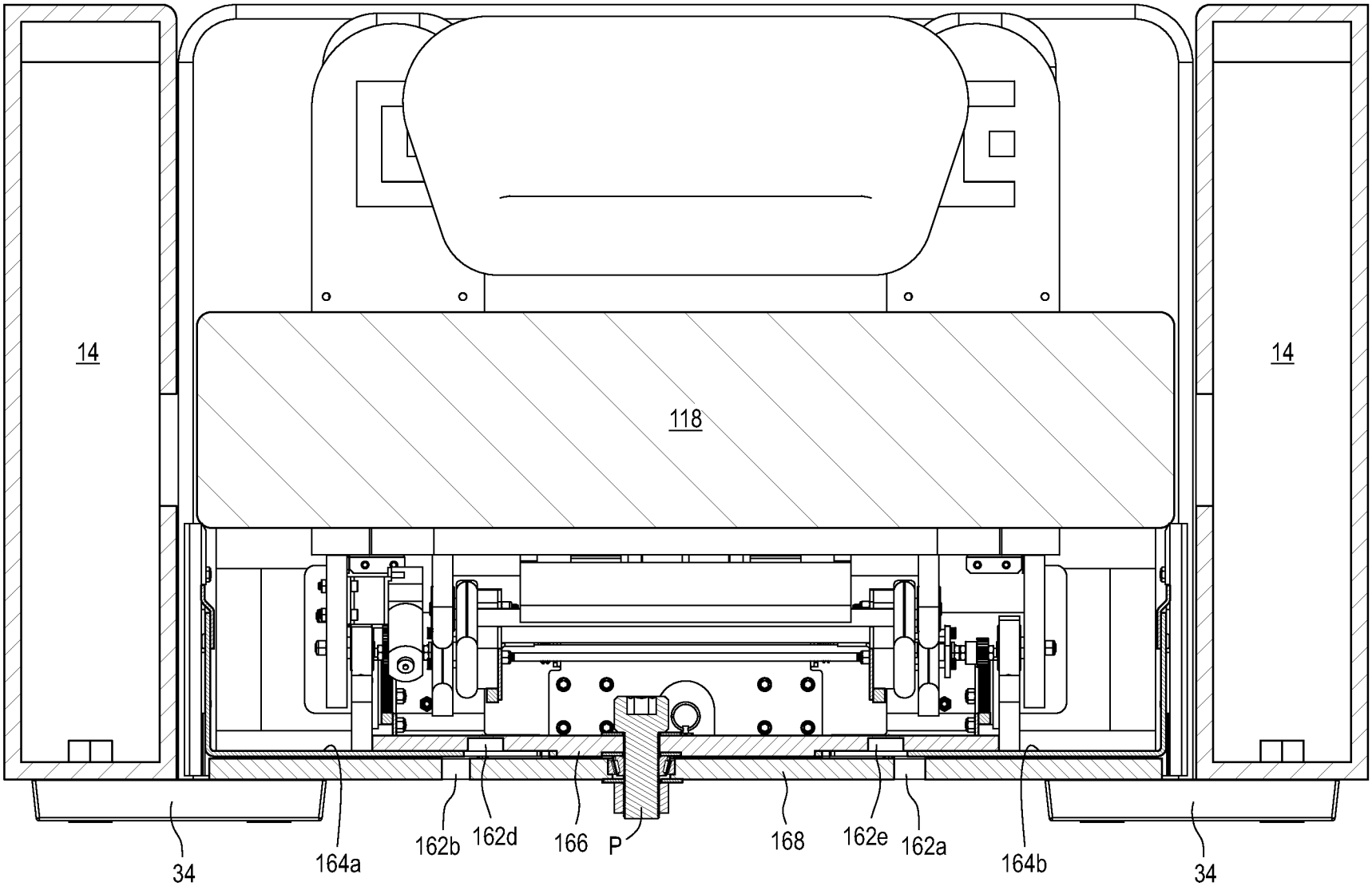
FIG. 31A illustrates a front cut-away view of the reclining assembly of FIGS. 30A-30D.
Figure 31B:
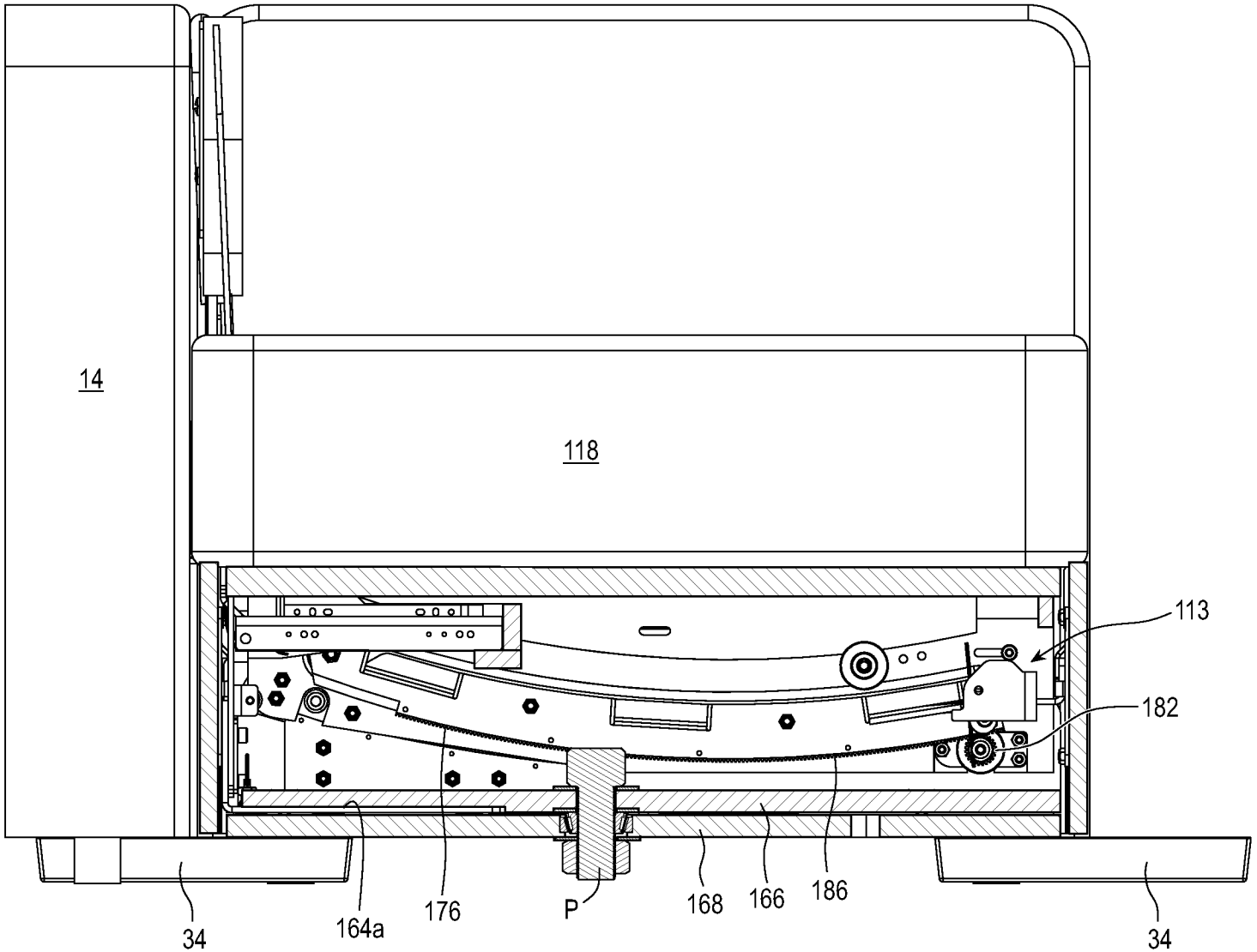
FIG. 31B illustrates a side cut-away view of the reclining assembly of FIG. 31A.
Figure 32:
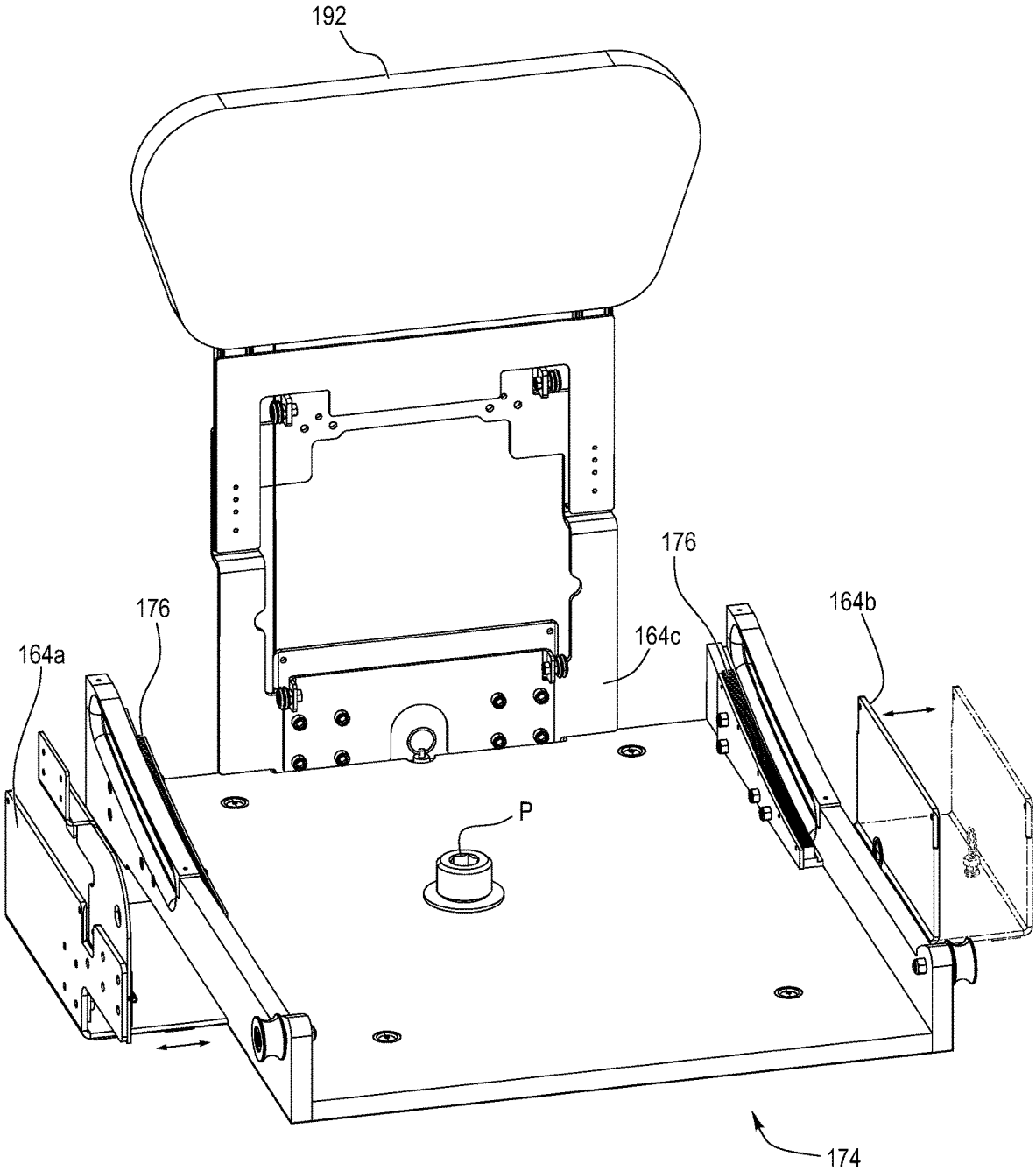
FIG. 32 is an isometric view that illustrates various internal frame components of the lower carriage portion of the reclining assembly.
Figure 33:
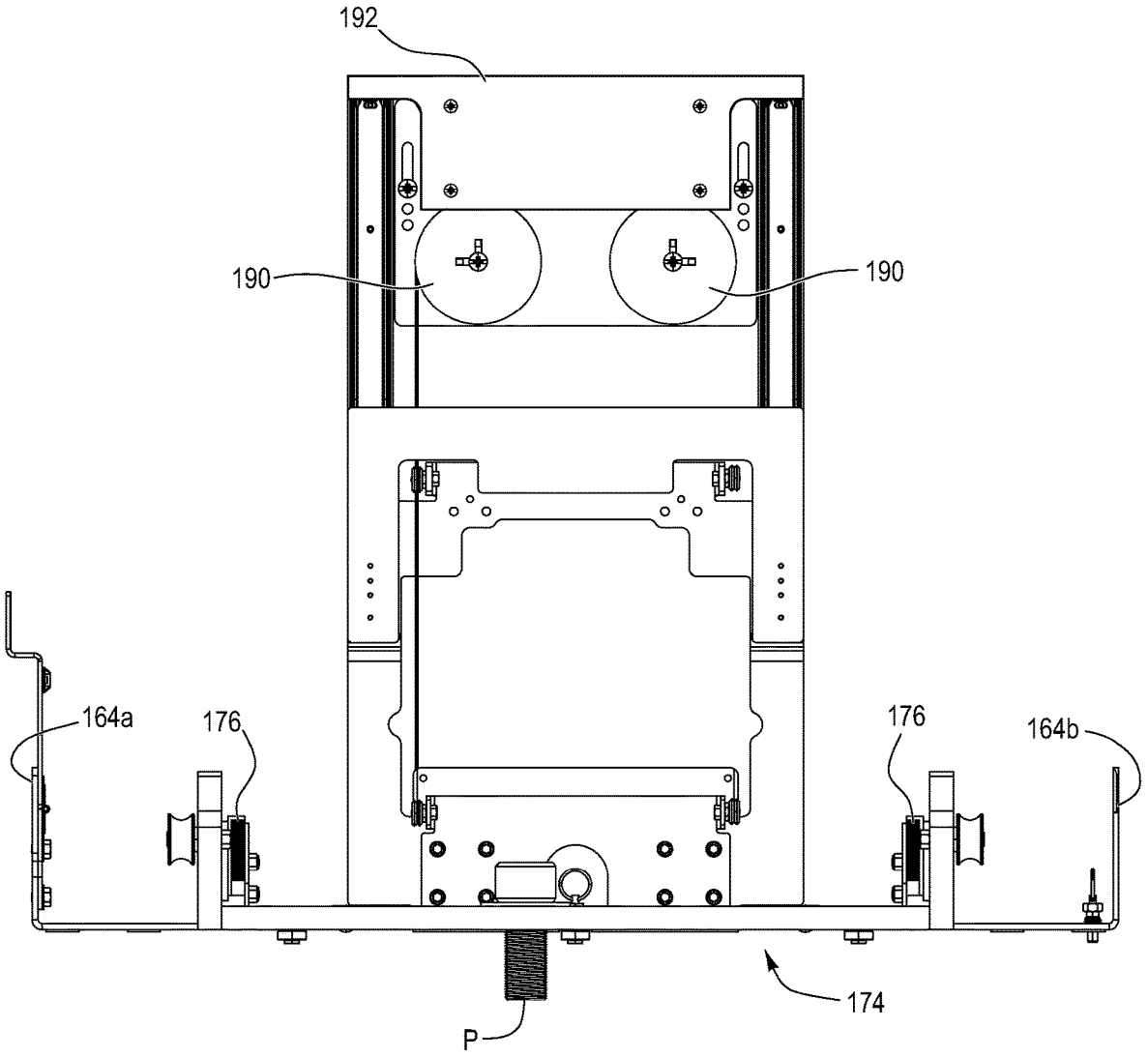
FIG. 33 illustrates a front view of the frame components of the lower carriage portion of the reclining assembly of FIG. 32.
Figure 34:
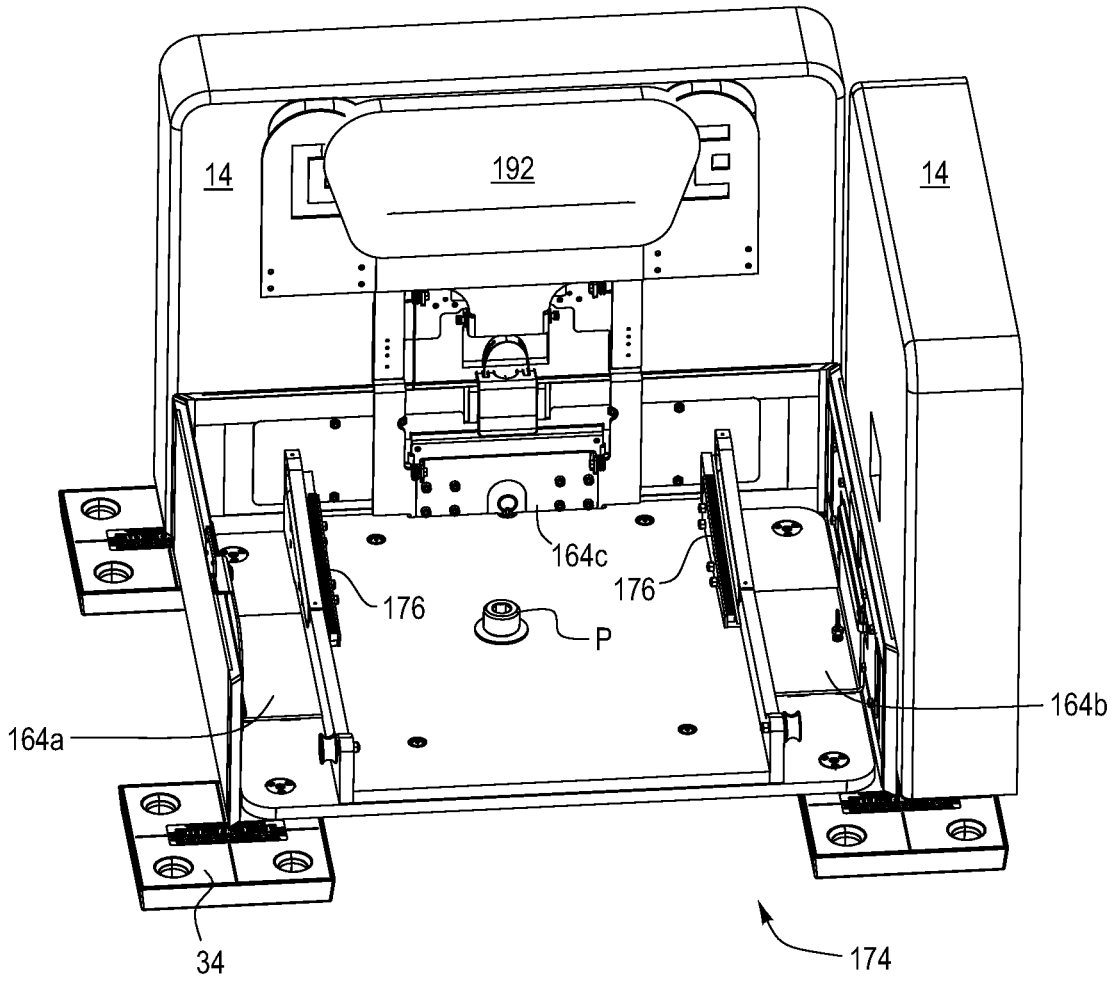
FIG. 34 illustrates an isometric view of the reclining assembly, showing the lower portion thereof.

Similar to the arrangement shown in FIGS. 13A-13C, the carriage 160 includes a lower carriage portion 174, as well as an upper carriage portion 178 that couples to and rides over the lower carriage portion, to achieve the desired reclining movement, as shown in FIGS. 30A-30C. FIG. 30C shows the lower carriage portion 174 alone, while both portions are shown in FIG. 30B. The lower carriage portion 174 including base member 166 includes a pair of gear rails 176 positioned on a declined surface, as perhaps best shown in FIGS. 30C, as well as FIGS. 28 and 32. The two-piece carriage includes an upper carriage portion 178 (e.g., see FIGS. 30B and 35) that sits over the lower carriage portion 174. The two carriage portions can include a locking structure (e.g., locking pin, or other structure) to lock the two portions together. Upper carriage portion 178 includes a seat base 126, on which the seat cushion 118 is supported. Upper carriage portion 178 is selectively movable relative lower carriage portion 174, in a similar manner as shown for the configuration shown in FIGS. 13A-13C.

Figure 35:
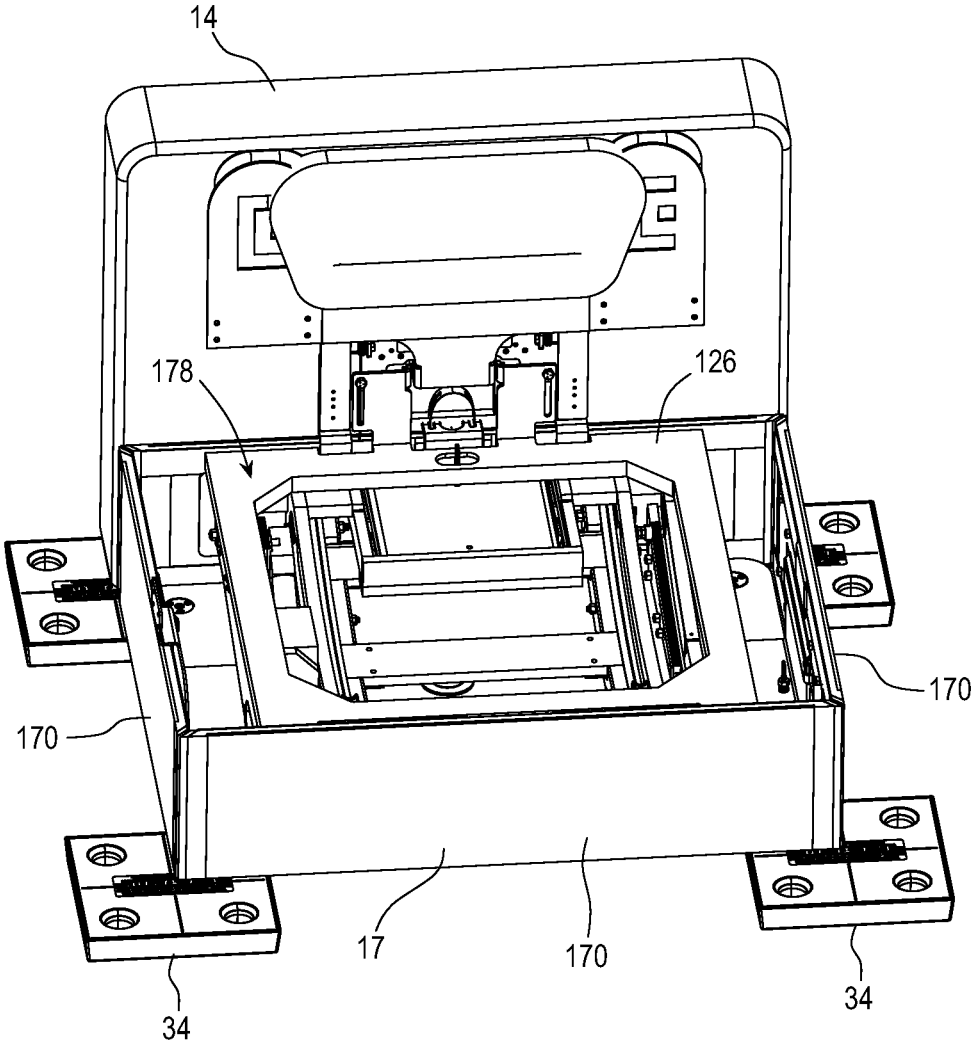
FIG. 35 illustrates an isometric view of the reclining assembly, showing the upper carriage portion engaged over the lower carriage portion, within the generally rectangular housing of the base.

Rather than effecting the reclining motion through use of a linear actuator or gas spring, in the configuration shown in FIGS. 19-60B), e.g., as shown in FIGS. 30B and 35, the forward and slightly upward reclining motion of the seat base 126 is achieved through driving one or more rotating gears 180 (e.g., see FIG. 47) attached to the upper carriage portion 178 so as to be aligned with the gear rails or gear racks 176 of lower portion 174. As shown, the rotating gears 180 can be provided on opposite right and left sides of the upper carriage portion 178, at ends of a shaft or motor 184*a*. A similar arrangement is provided with gear racks 186 and rotating gears 182 on shaft or motor, for extension of the footrest panel 17. The lower carriage portion includes the gear rack 176, while the upper carriage portion 178 includes the gears 180 that ride on rack 176, as well as gear racks 186, and rotating gears 182, that drive the footrest assembly 113 out of the housing.

As noted, use of such an arrangement of rotating gears and corresponding gear racks provides significantly greater linear travel in a smaller reclining mechanism than can be achieved with a typical linear actuator or gas spring. Such an arrangement is particularly useful in extension of the footrest, as there is typically insufficient space within the given geometry of the base to accommodate a 20 inch linear actuator for the footrest. That said, the described gear rack and rotating gear arrangement can accommodate such a 20 inch or more extension of the footrest, while fitting within the available space of the housing of the reclining base.

Figure 36:
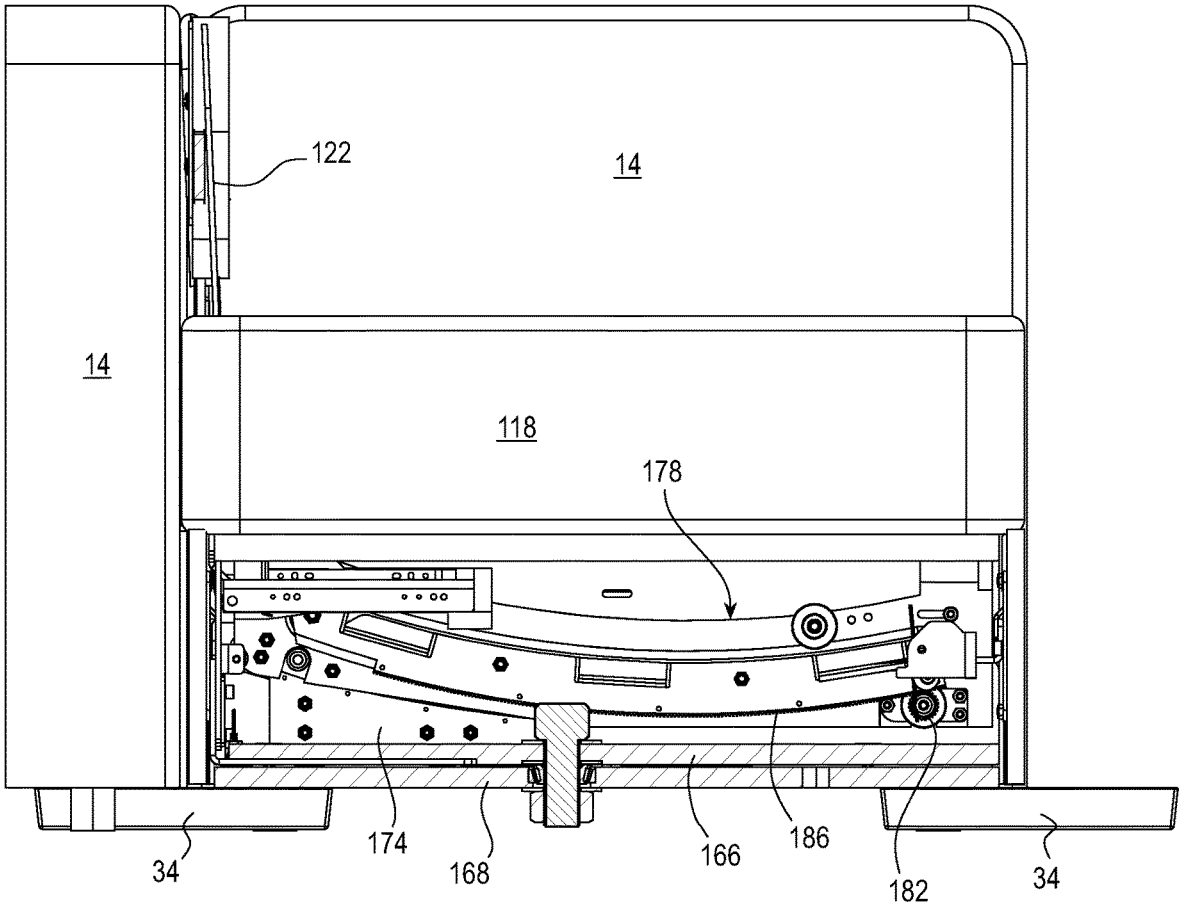
FIG. 36 illustrates a side cut-away view, showing the internal components of the carriage of the reclining assembly.
Figure 37A:
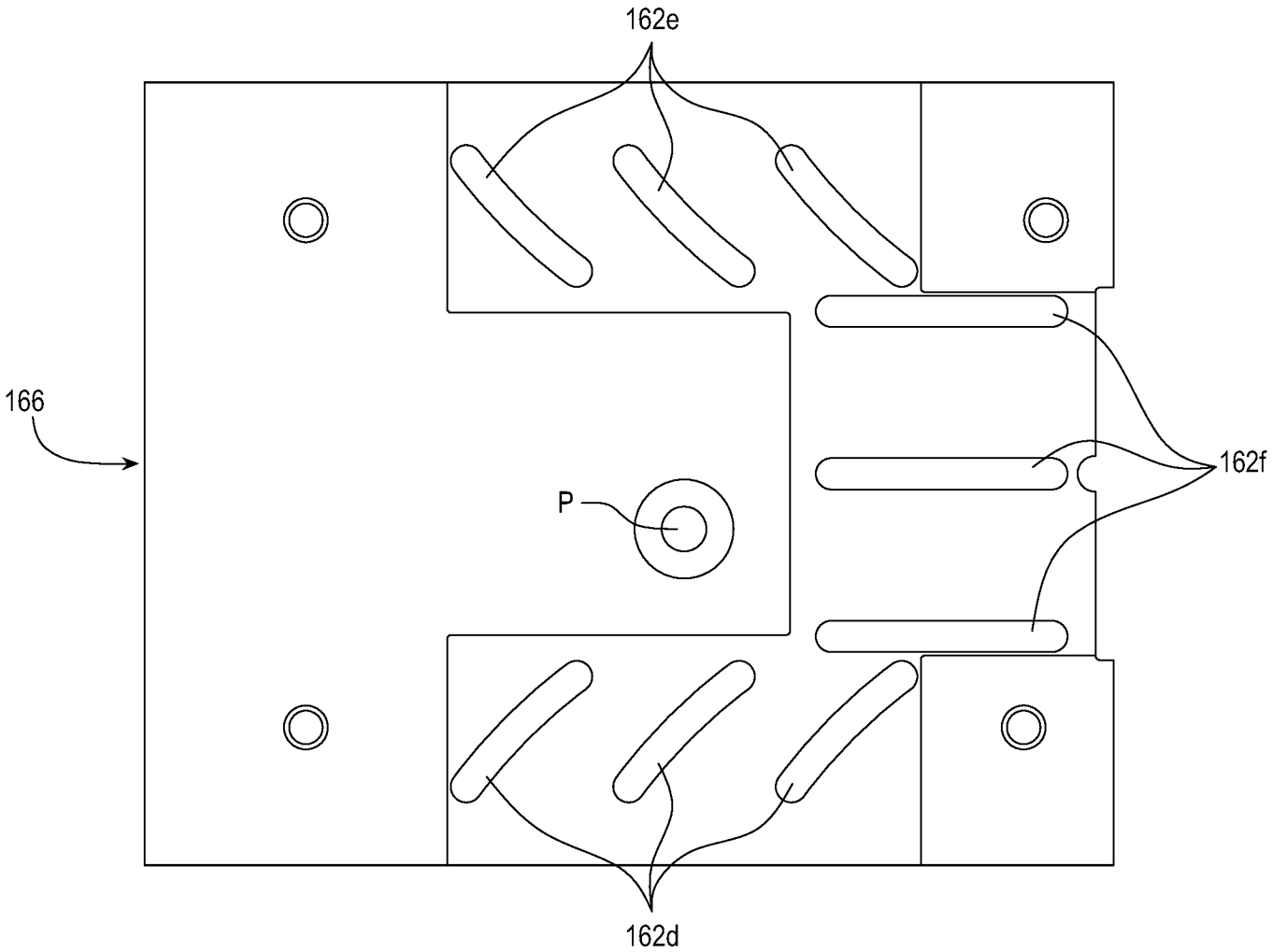
FIG. 37A illustrates a portion of the carriage, including the arced and linear tracks.
Figure 37B:
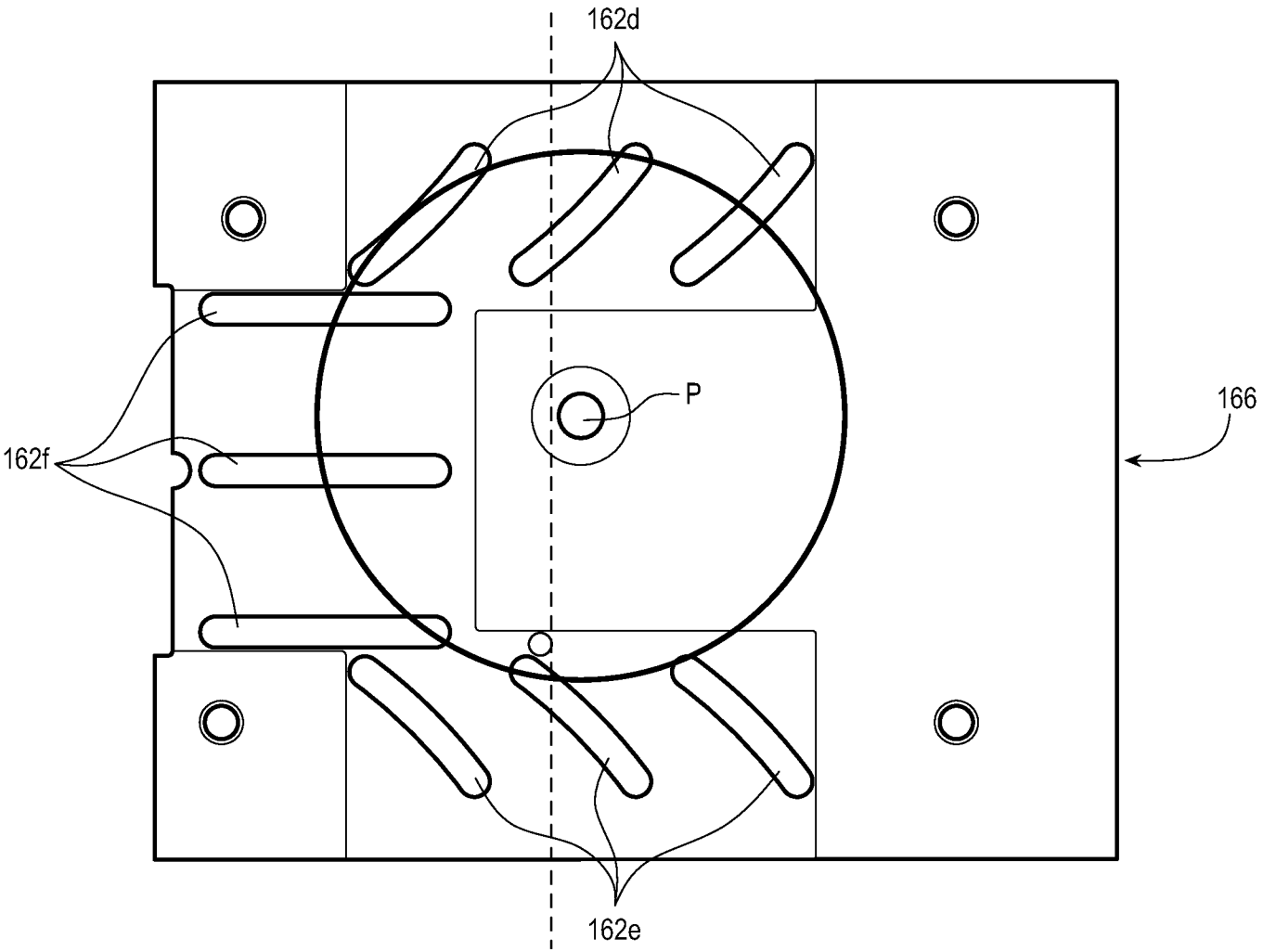
FIG. 37B illustrates alignment and engagement of the upper and lower base members over the pivot point of the carriage.
Figure 45:
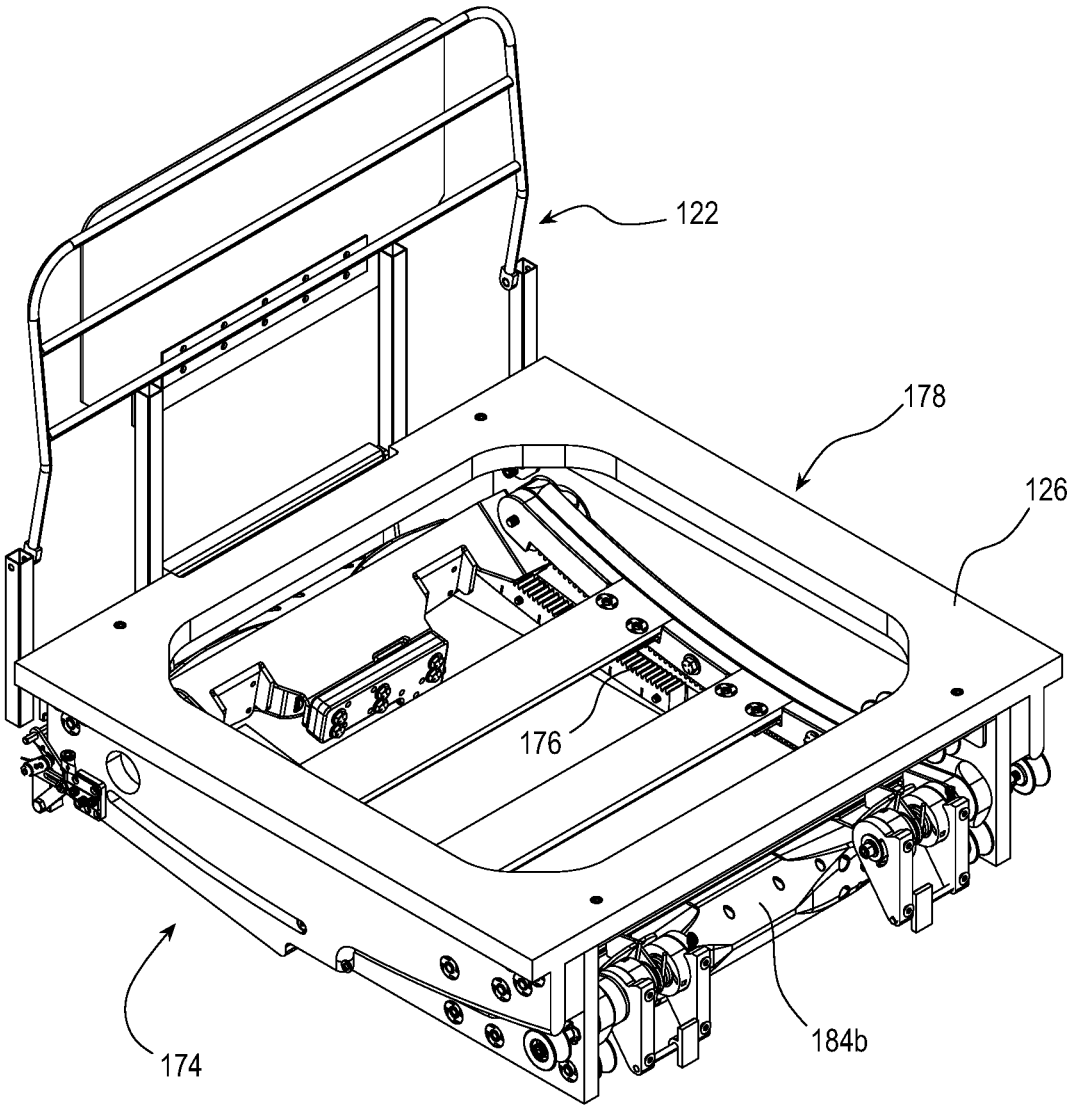
FIGS. 45-47 illustrate various isometric views of the upper portion of the carriage, coupled over the lower base portion of the carriage, each Figure being in the un-reclined position.
Figure 46:
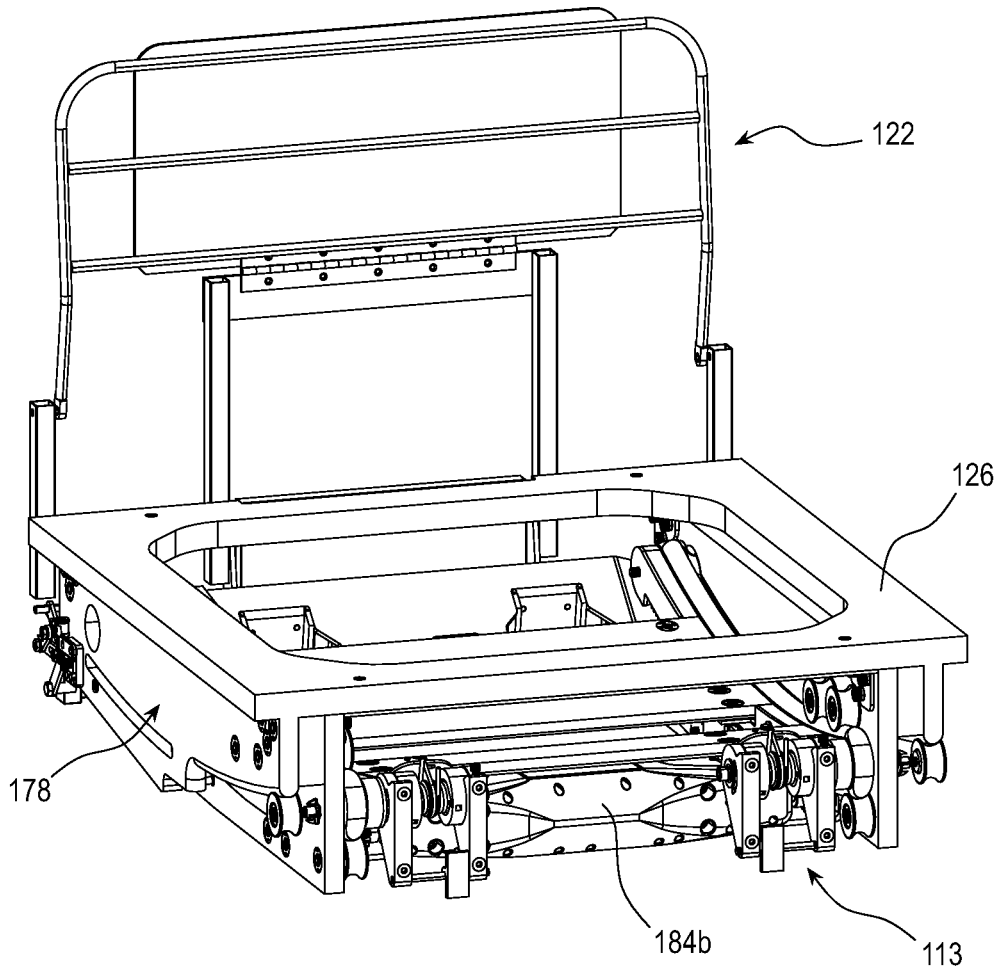
Figure 47:
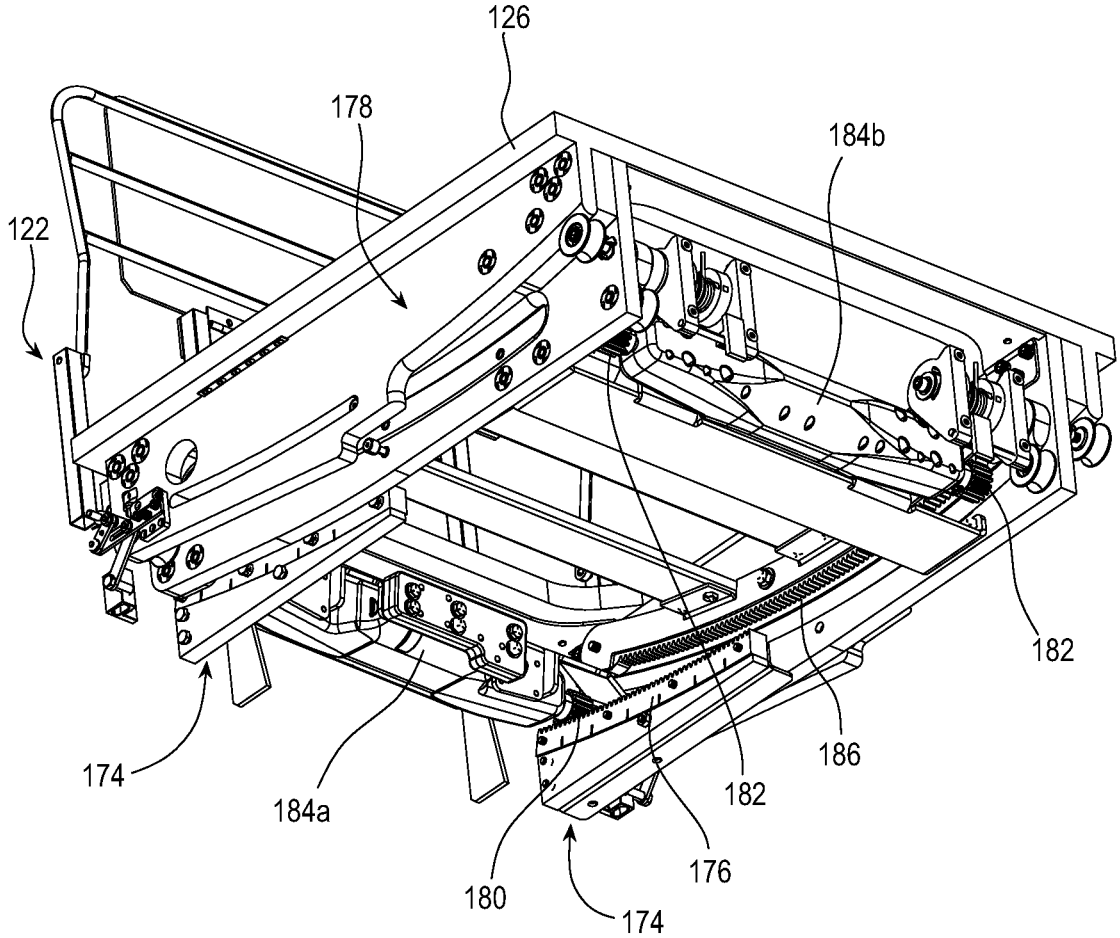
Figure 48:
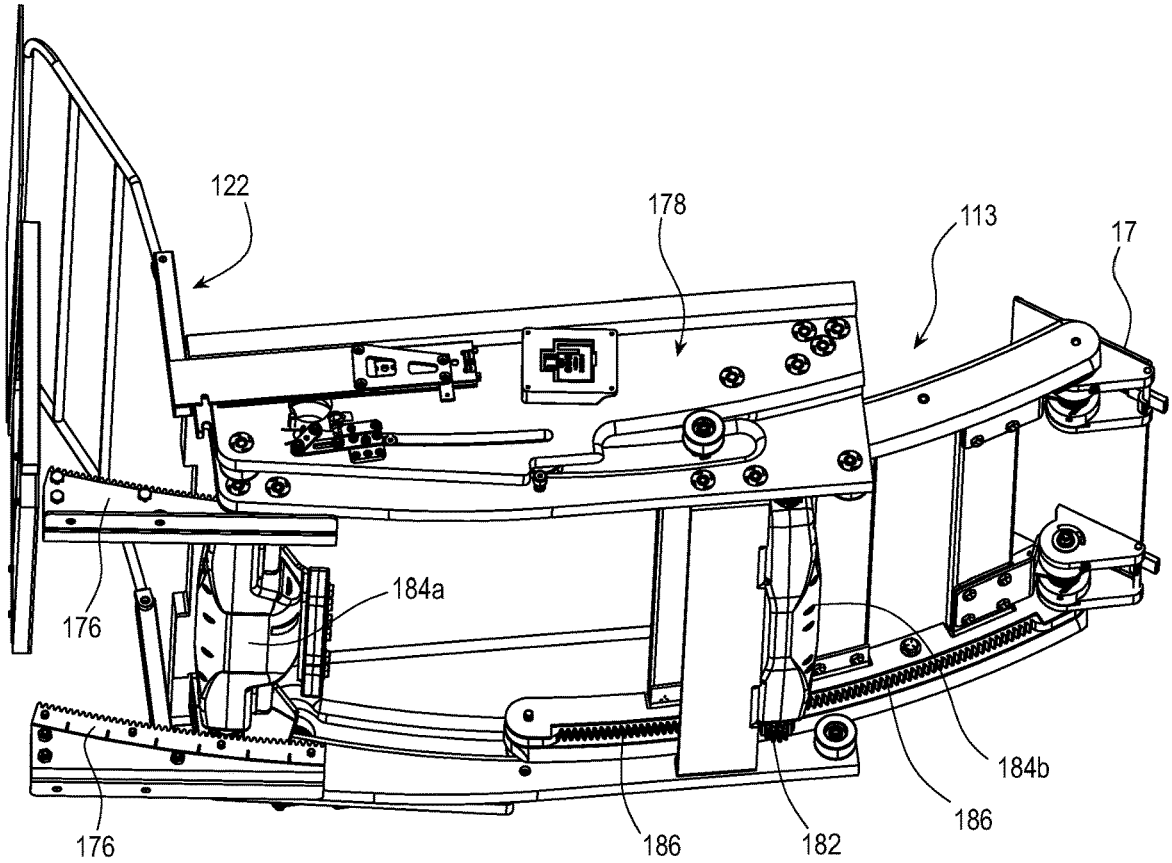
FIG. 48 illustrates an isometric view of the carriage, with the seat base partially reclined forward, and the footrest assembly extended.
Figure 49:
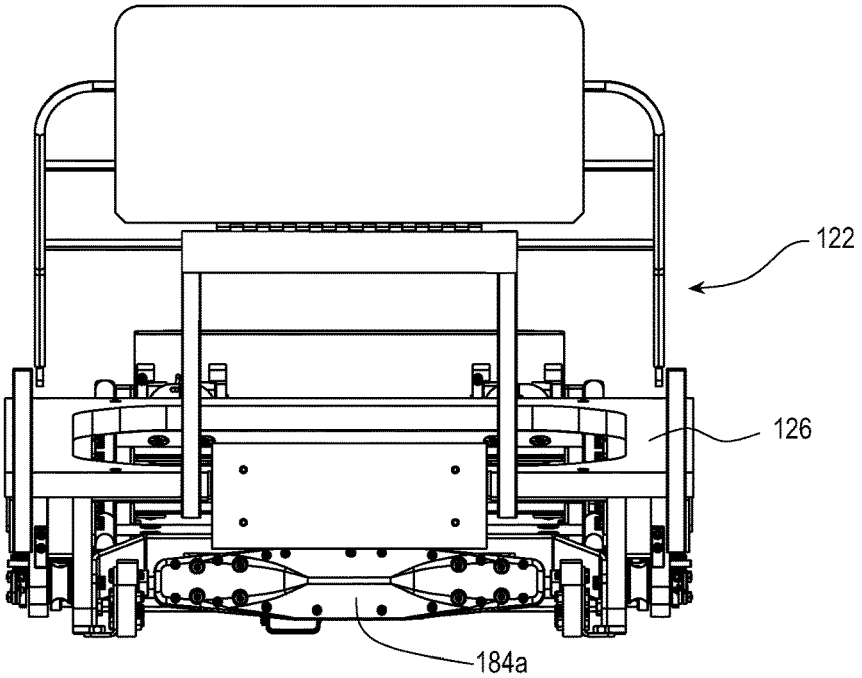
FIG. 49 illustrates a rear view of the reclining assembly of FIG. 48.
Figure 50:
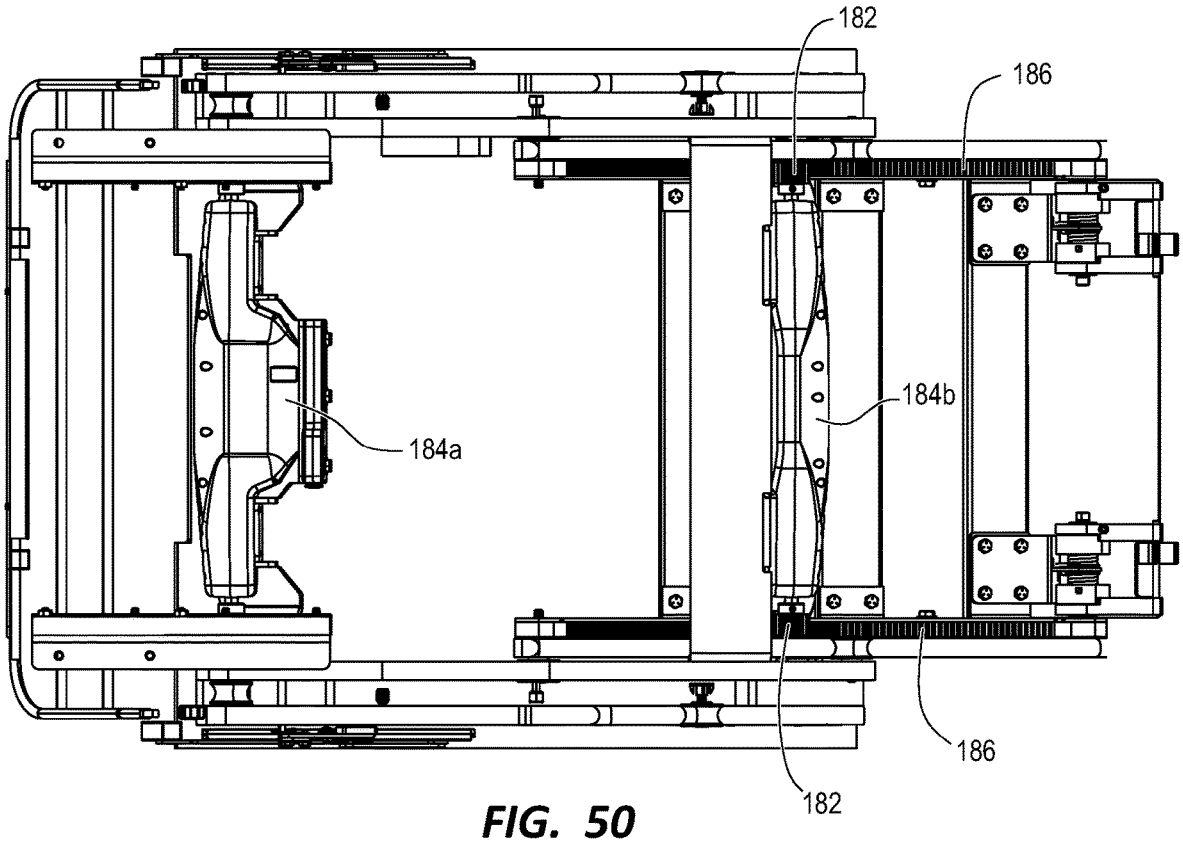
FIG. 50 illustrates a bottom view of the reclining assembly of FIG. 48.
Figure 51:
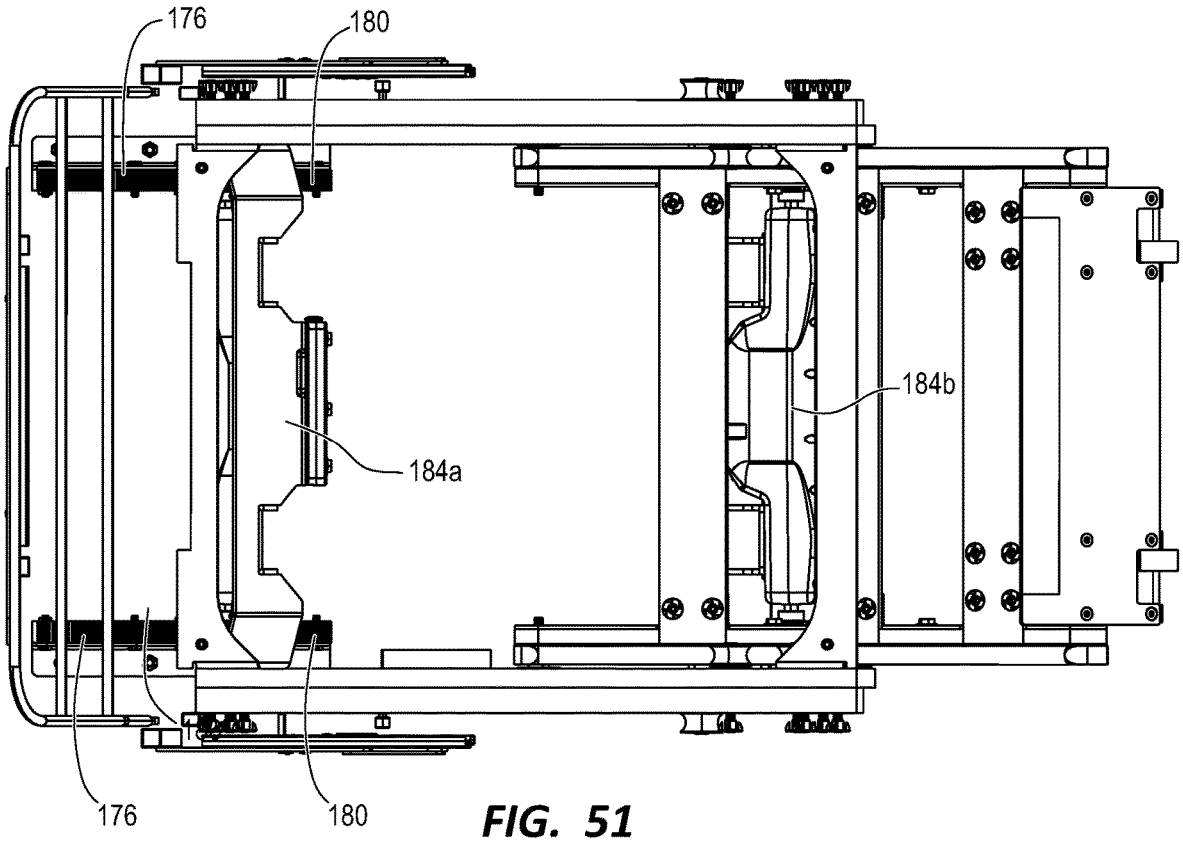
FIG. 51 illustrates a top view of the reclining assembly of FIG. 48.
Figure 52:
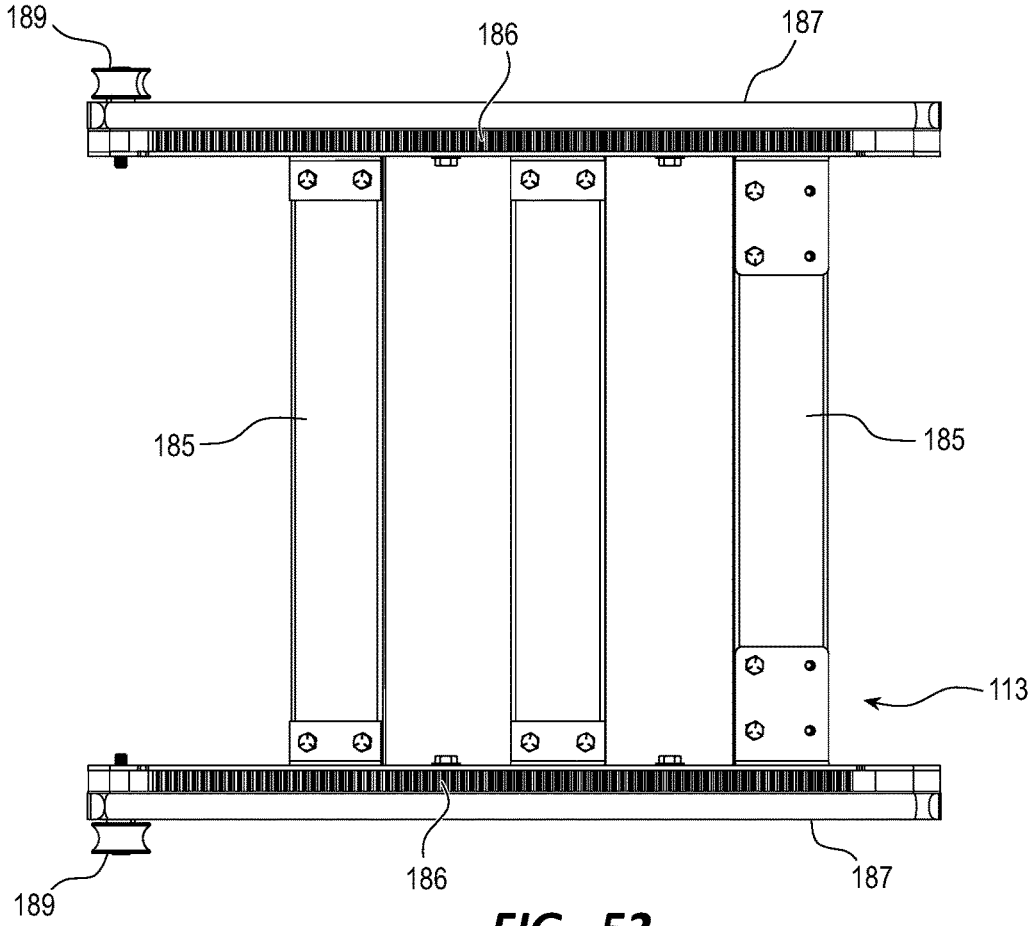
FIGS. 52-53 illustrate the footrest assembly, which is driven out of the carriage or housing using the rotating gears and gear racks.
Figure 53:
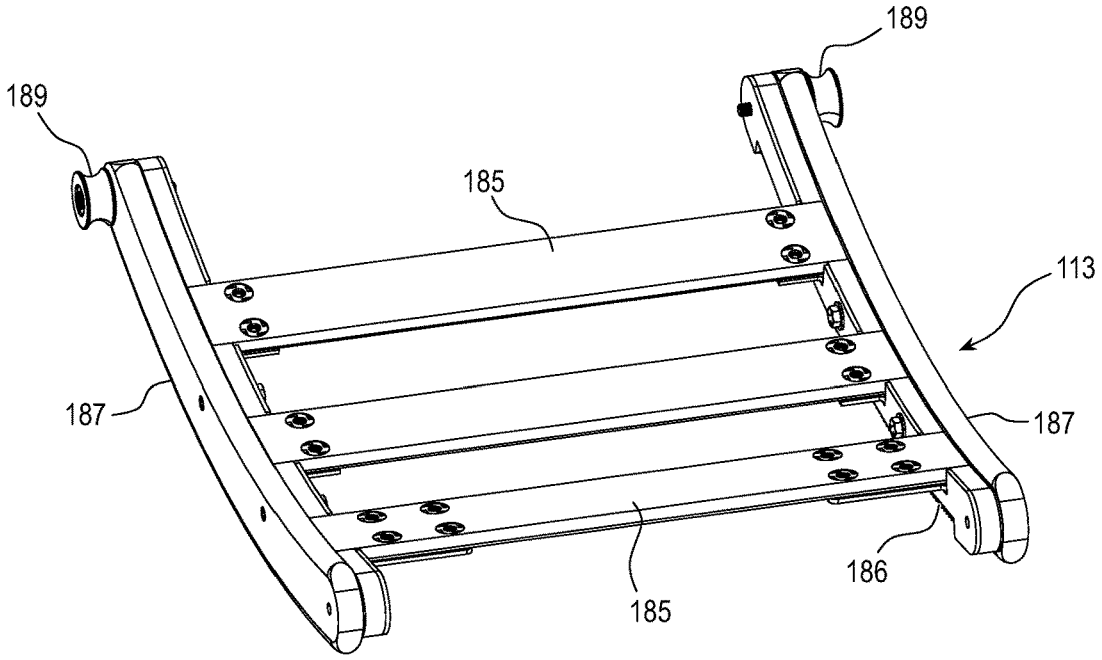

FIG. 36 illustrates a side view, showing the upper carriage portion 178 over lower carriage portion 174, while FIGS. 45-47 perhaps show the upper carriage portion 178 best. FIG. 48 shows the upper carriage portion 178 having been driven forward, relative to the lower carriage portion 174. Upper carriage portion 178 includes a footrest assembly 113 configured to extend footrest panel 17 out from carriage 160. In the illustrated configuration, upper carriage portion 178 includes rotating gears 182, e.g., mounted on shaft or motor 184*b*, where gears 182 engage with gear rack 186 of upper carriage portion 178. Driving of gears 182 (e.g., using motor 184*b*) forces the footrest assembly 113 outward from upper carriage portion 178. FIGS. 48-55C illustrate the portion of the footrest assembly 113 that is driven forward, out the remaining portion of upper carriage portion 178. FIGS. 48 and 50 show the rotating gear 182, engaged with gear rack 186.

Footrest panel 17 can be spring biased to a default position (e.g., near horizontal), but which allows the user to rotate such panel to any of the positions described herein, e.g., to allow placement and resting of the user's calves on the panel (i.e., forward rotation), to allow placement of the user's soles of their feet on the panel (rearward rotation), or any other desired rotation. The spring biasing may aid the panel in maintaining the desired panel angle orientation. As the footrest assembly is retracted into the housing, the spring biasing may be configured to allow the panel to assume the desired vertical orientation, e.g., forming one of the kick panels of the reclining base.

Figure 42A:
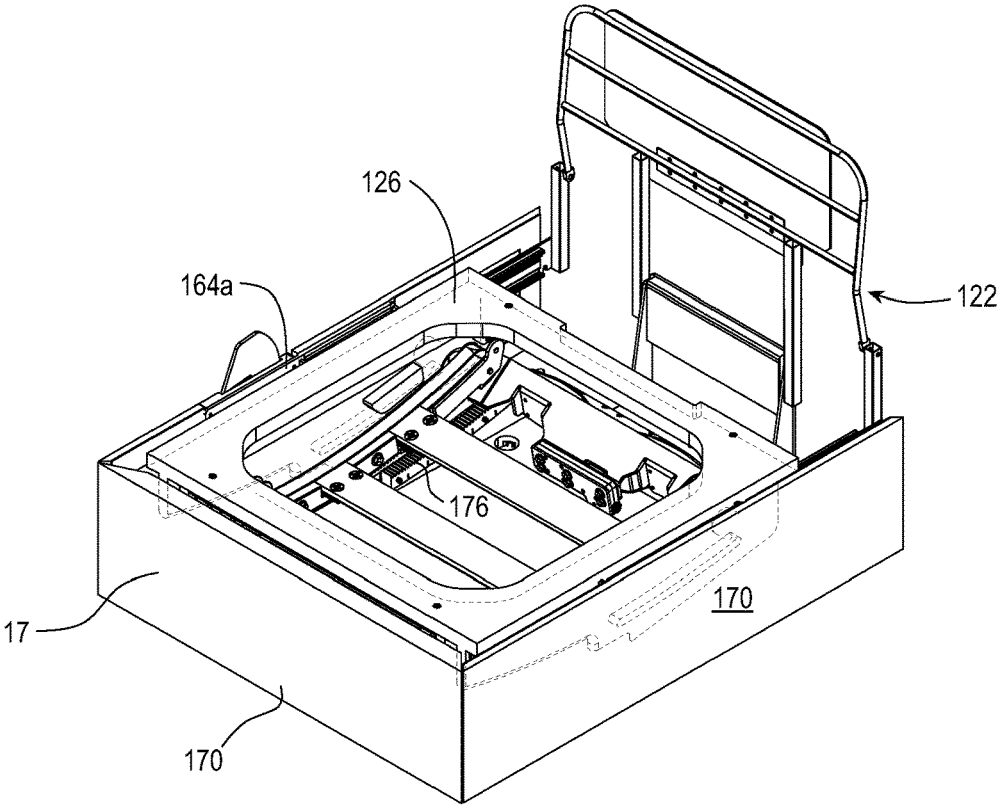
FIGS. 42A-42B illustrate views similar to those of FIGS. 40-41C, but in which the seat has been transitioned from a shallow seat configuration to a deep seat configuration.
Figure 42B:
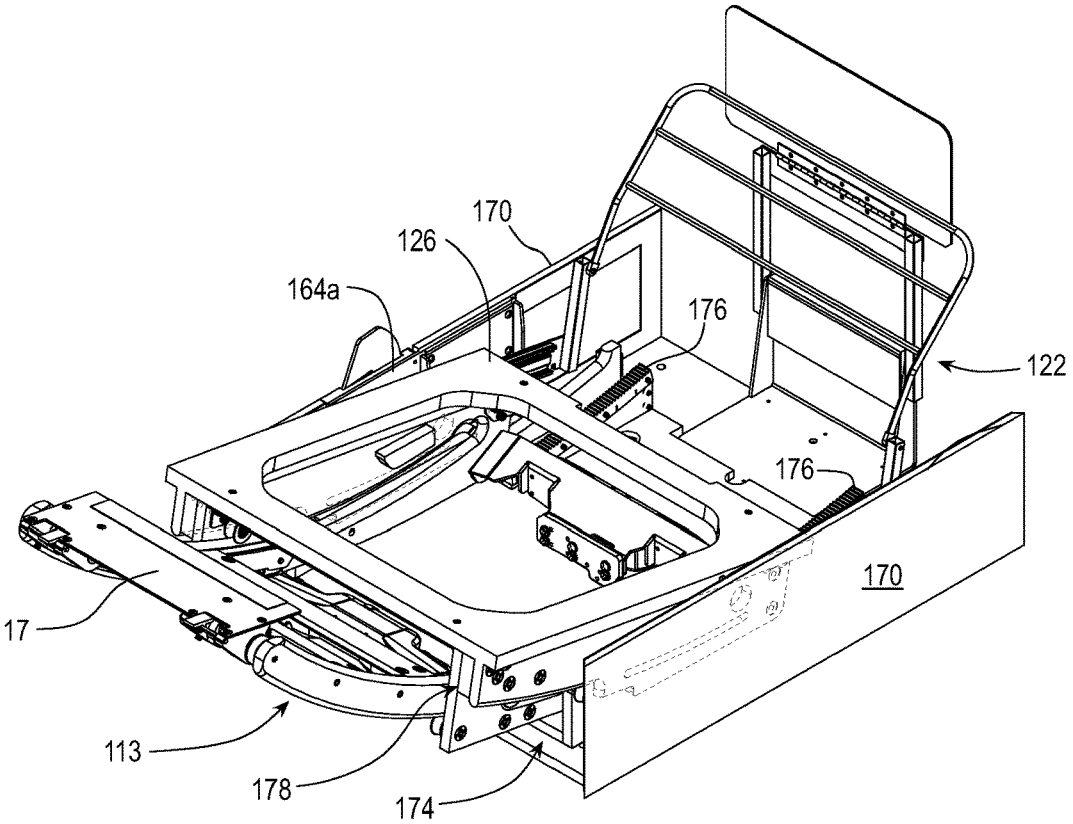

FIGS. 40 and 41A-41C illustrate progressive driving of upper carriage portion 178 forward, along the lower carriage portion 174, as well as driving of the footrest assembly 113 out of the upper carriage portion 178. These Figures show such movements with the reclining base 112' in the shallow seat configuration. FIGS. 42A-42B show similar views, but in a deep seat configuration. For example, FIG. 42A shows the reclining base 112' in a non-reclined configuration, with the upper carriage portion 178 fully compressed, while FIG. 42B shows the upper carriage portion 178 driven forward relative to the lower carriage portion 174, by driving rotating gears 180 along gear racks 176. In FIG. 42B, the footrest assembly 113 has also been driven to its extended position, out of the housing provided by upper carriage portion 178, by driving rotating gears 182 along gear racks 186.

Figure 43A:
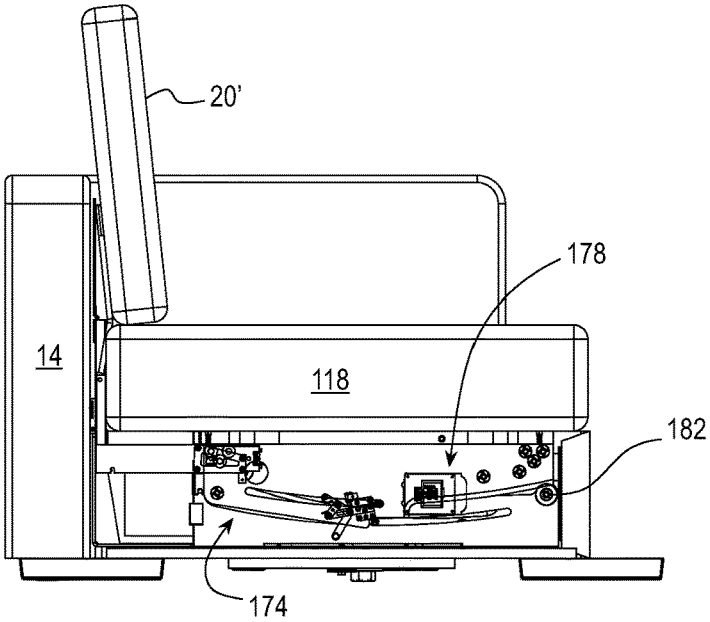
FIGS. 43A-43C illustrate side views of the reclining assembly of FIG. 40, shown in un-reclined, partially reclined, and fully reclined positions, in the shallow seat configuration.
Figure 43B:
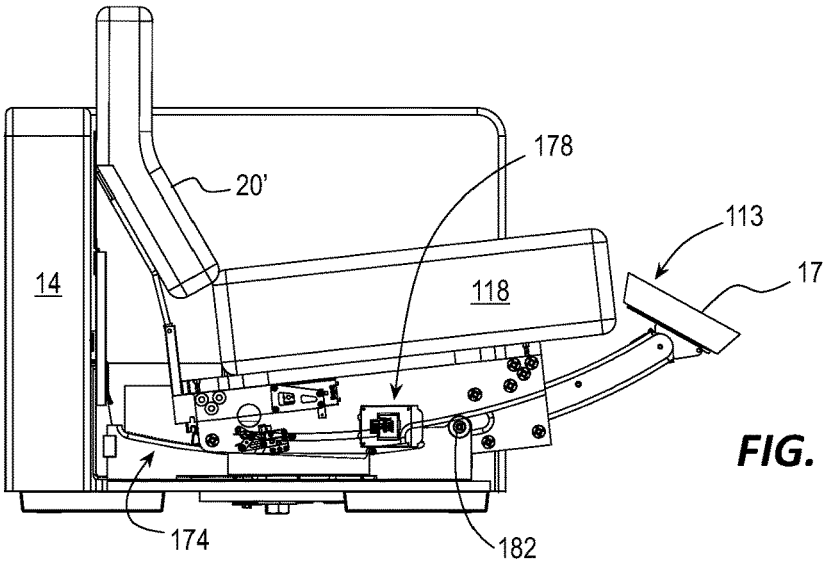
Figure 43C:
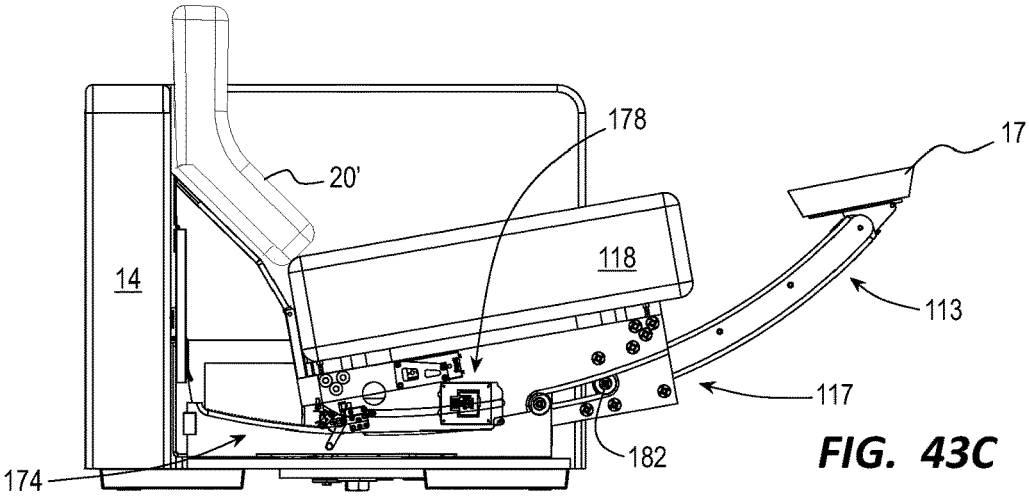
Figure 44A:
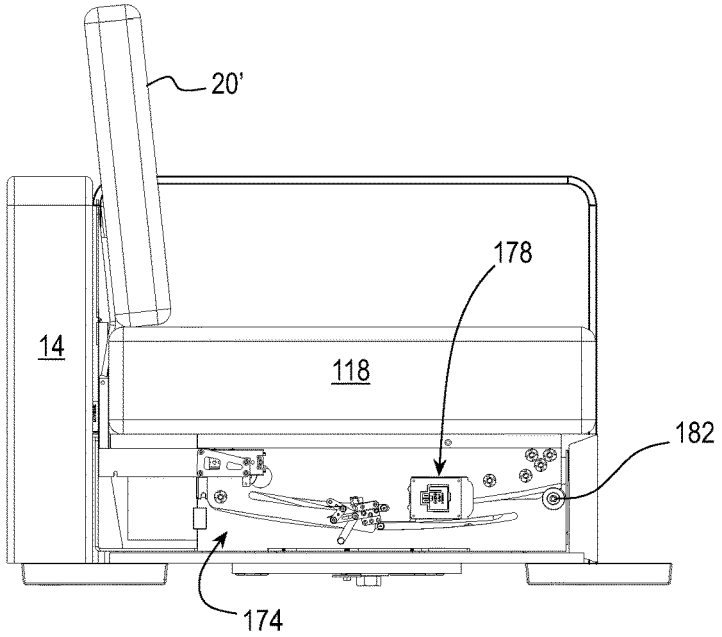
FIGS. 44A-44C illustrate side views of the reclining assembly of FIG. 40, shown in un-reclined, partially reclined, and fully reclined positions, in the deep seat configuration.
Figure 44B:
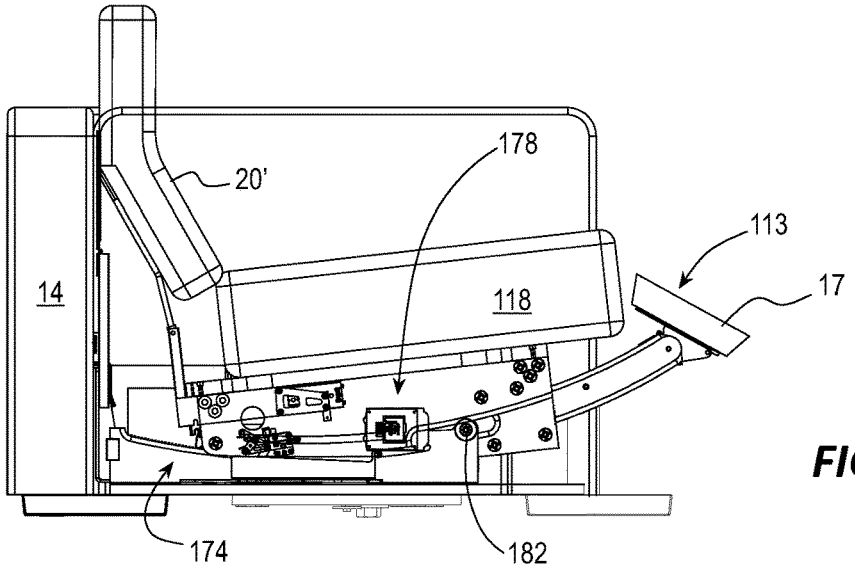
Figure 44C:
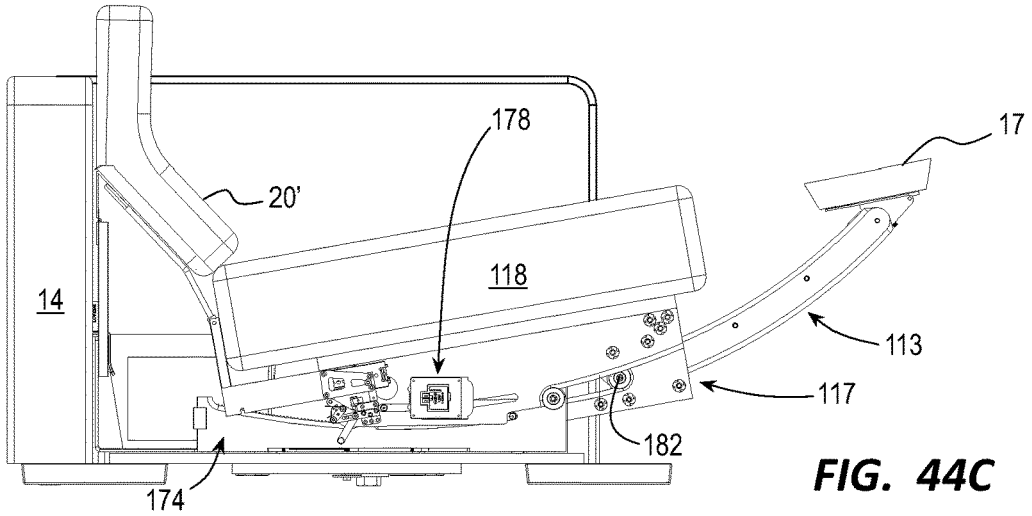

FIGS. 43A-43C illustrate progressive side views of the reclining movement, and footrest extension with the seat in the shallow seat configuration, so as to correspond to FIGS. 40 and 41A-41C. FIGS. 44A-44C are similar to the side views of FIGS. 43A-43C, but with the seat shown rotated to the deep seat configuration. The reclined backrest angle provided by the backrest member or panel 122, providing such a supported angular configuration to the backrest pillow 20' is shown in These figures, as the upper carriage portion 178 and seat base 126 is pulled forward, and a backrest angle is defined by the back support member or panel 122 and/or pillow 20'. For example, in FIGS. 43A and 44A, the angle between the bottom portion of pillow 20' and the seat base 126 is about 90°, while in FIG. 43C or 44C this angle has reclined to perhaps about 30-45°. It will be appreciated that a wide variety of reclined backrest angles are possible. Pillow 20' can of course be flexible, e.g., as shown, to adapt to the angle provided.

As noted, FIGS. 45-51 illustrate various views of the upper carriage portion 176 (although also often showing the gear rack 176 of the lower carriage portion).

Figure 54A:
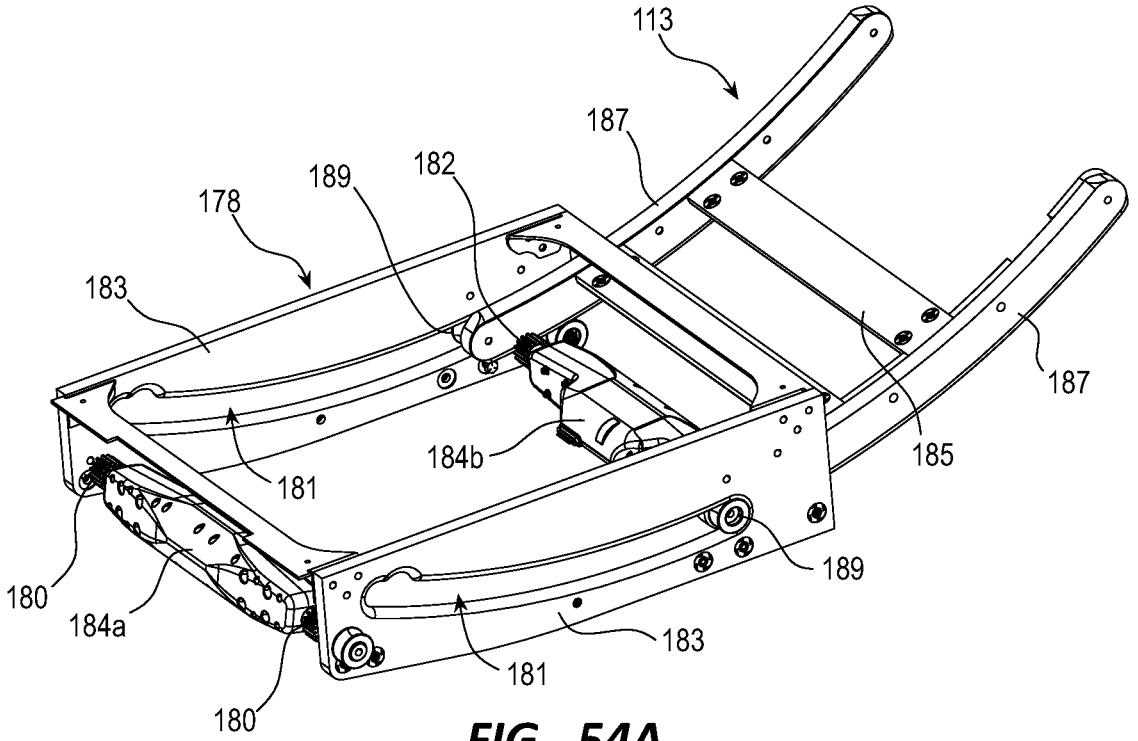
FIGS. 54A-54B illustrate additional views of the upper carriage portion, including the motor and rotating gears that engage with the gear rack of the lower carriage portion to drive the seat recline forward and up, while also illustrating the footrest assembly, with its own gear rack and associated motor and rotating gears for driving the footrest assembly out of the carriage, to its extended position.
Figure 54B:
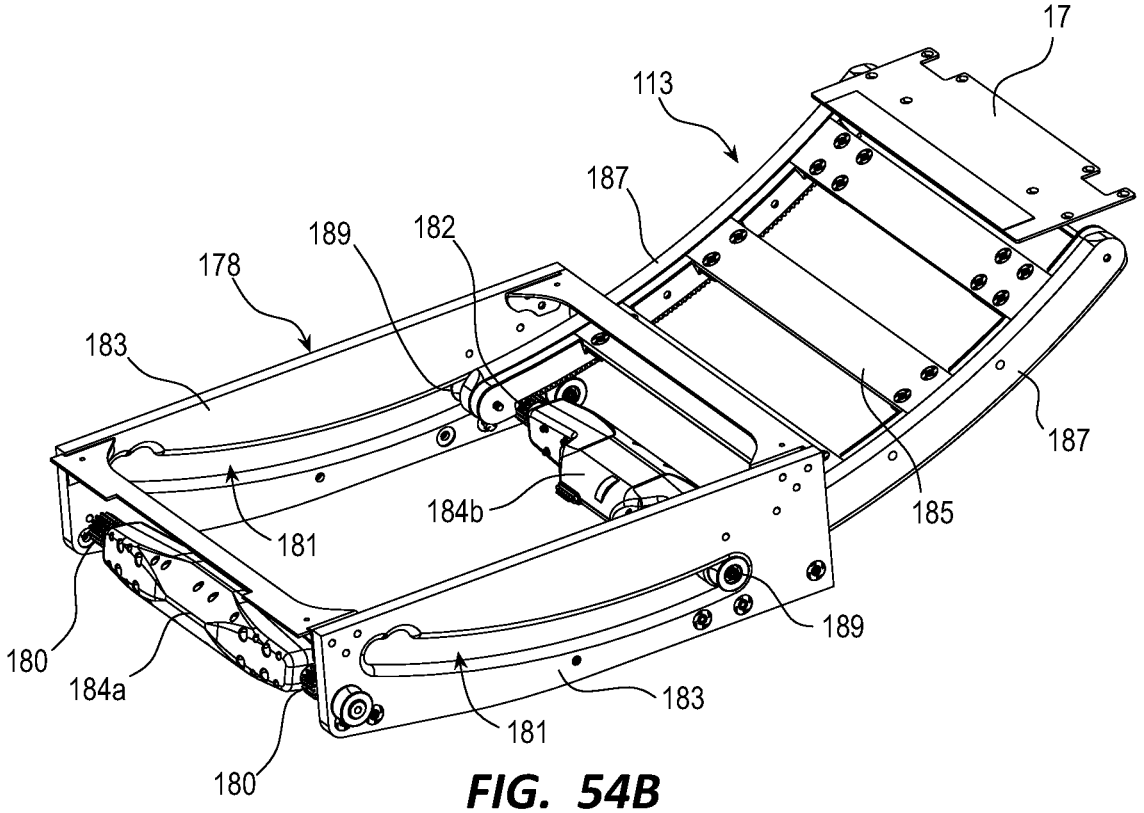
Figure 55A:
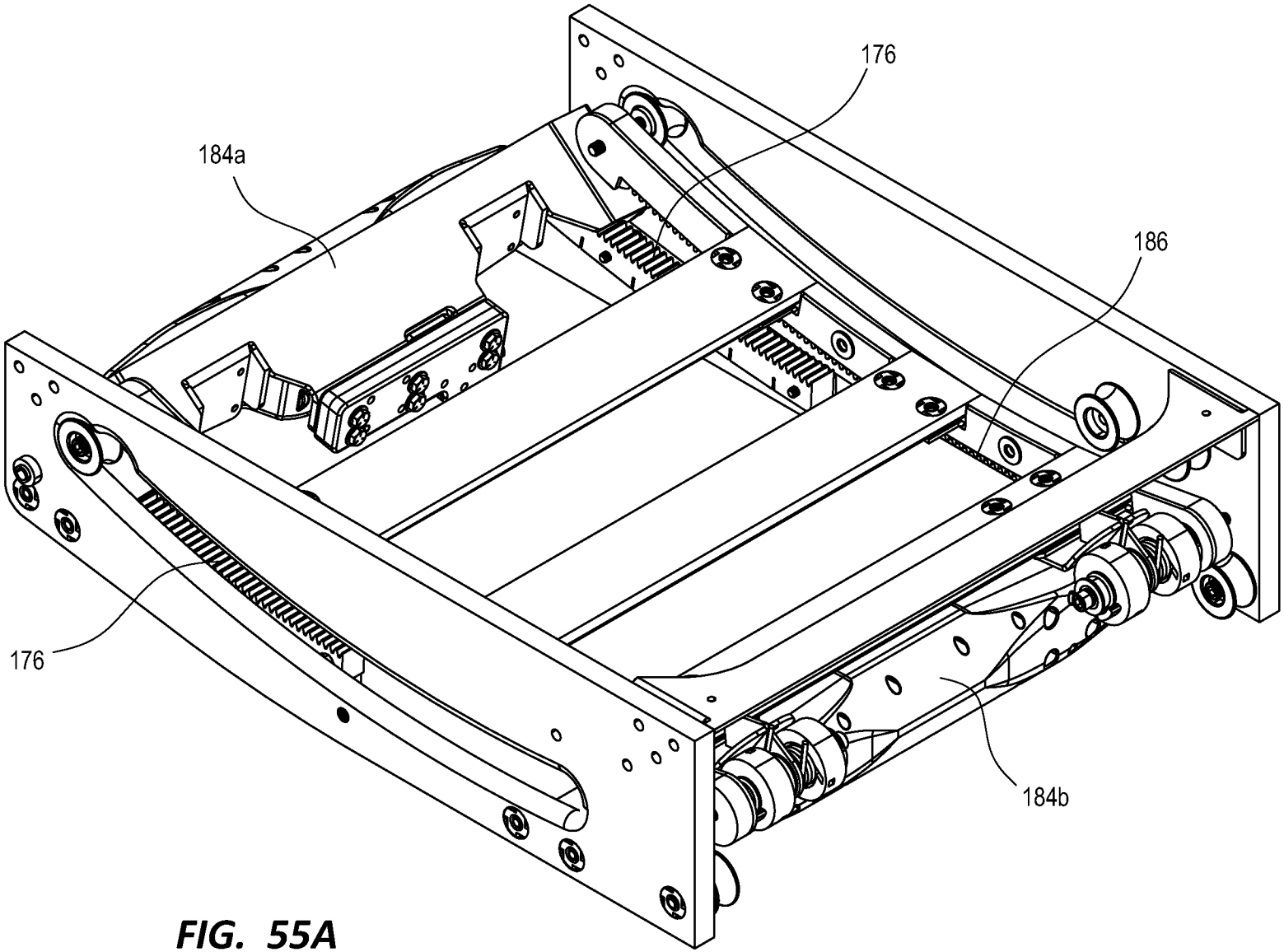
FIG. 55A illustrates the carriage, with the footrest assembly in the compressed position.
Figure 55B:
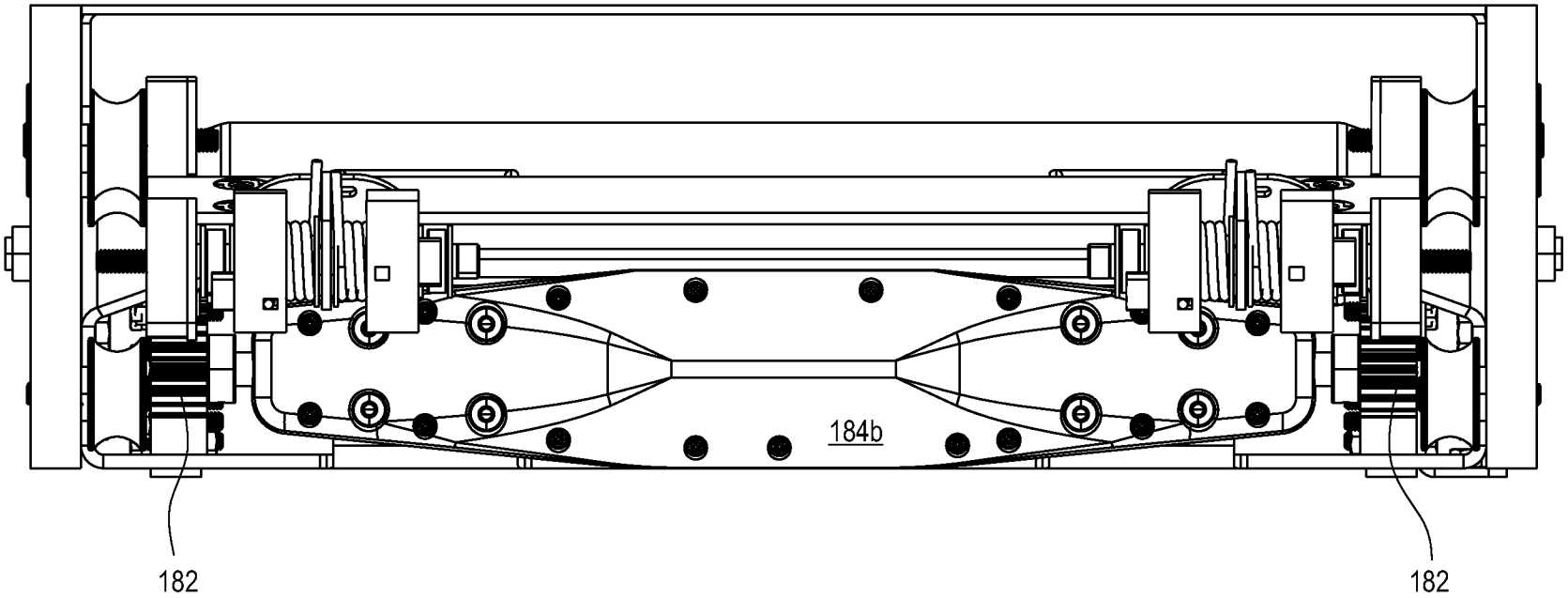
FIG. 55B illustrates a front view of the carriage of FIG. 55A.
Figure 55C:
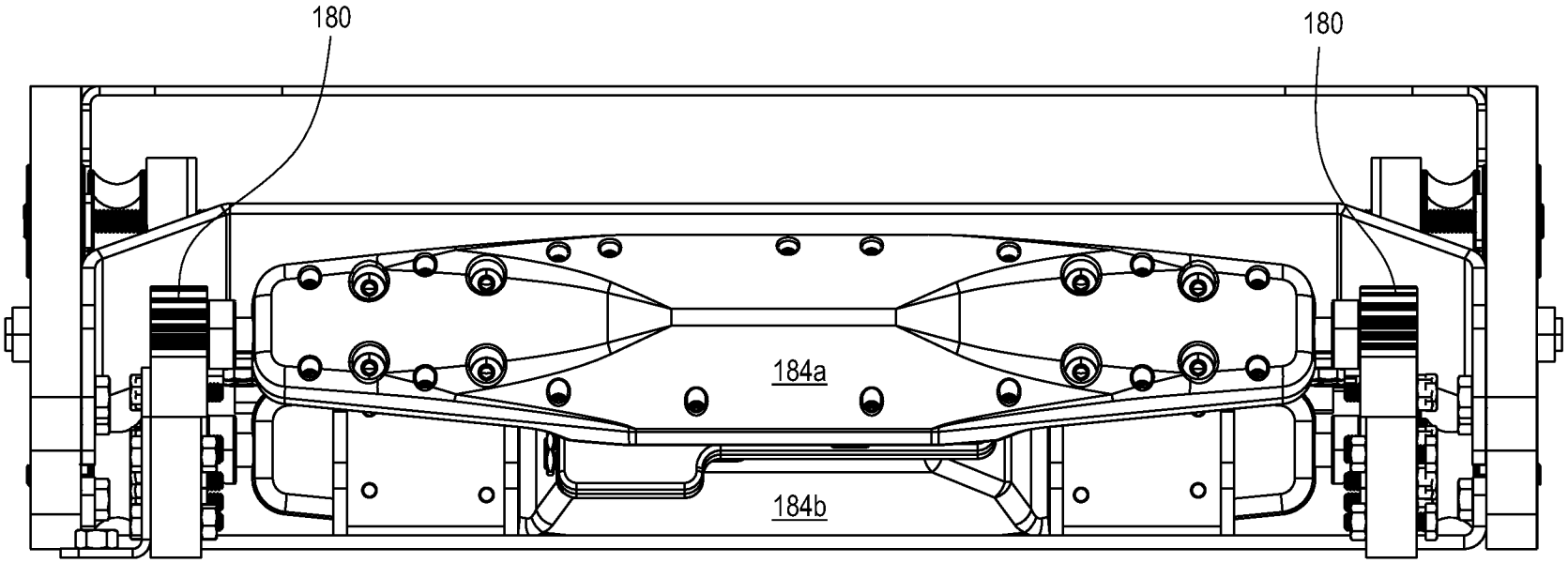
FIG. 55C illustrates a rear view of the carriage of FIG. 55A.
Figure 56:
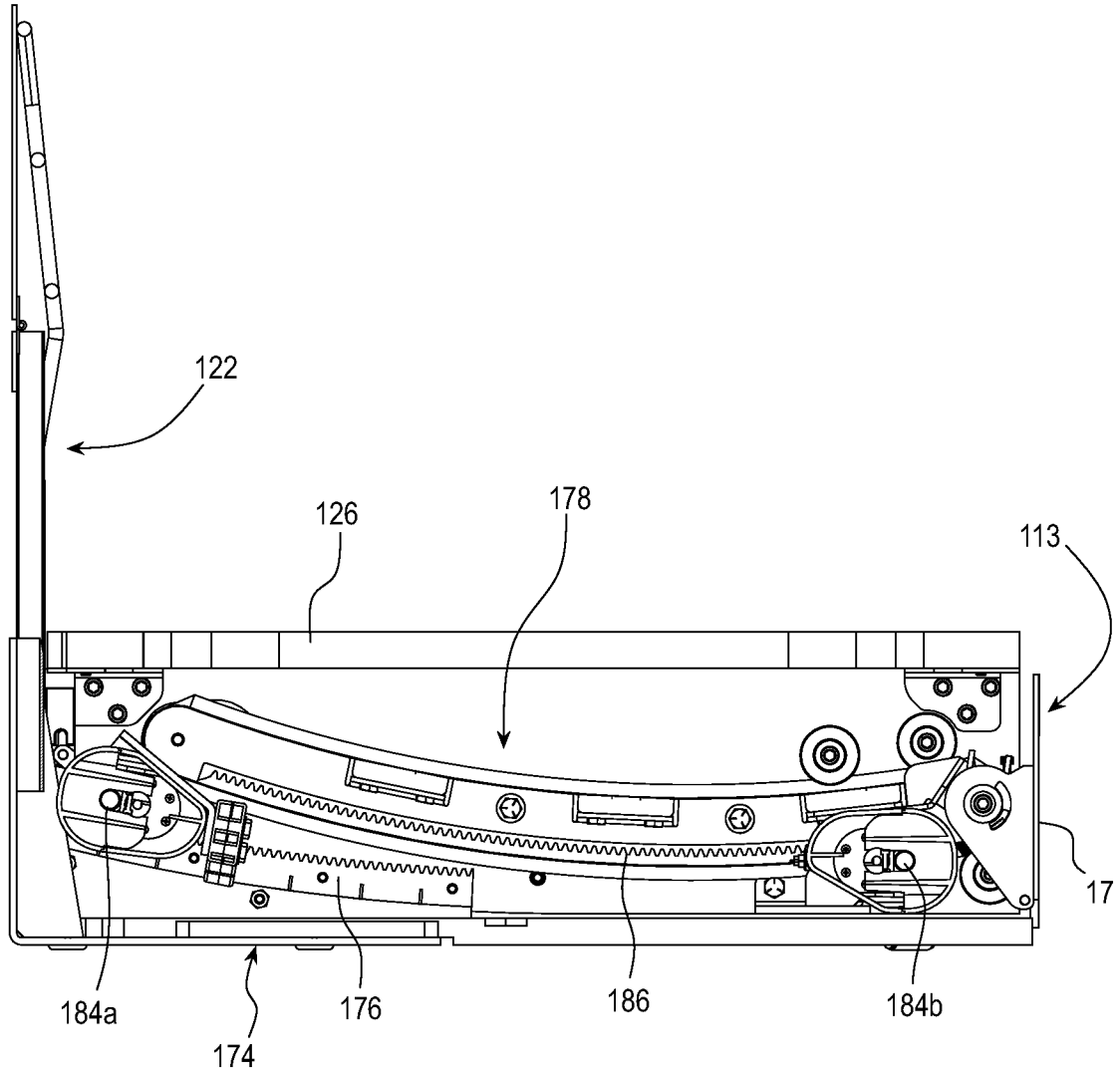
FIG. 56 illustrates a cut-away or phantom view of the reclining assembly, showing the motors with rotating gears, which engage with gear racks to drive the reclining movement for both seat recline and footrest extension.
Figure 57A:
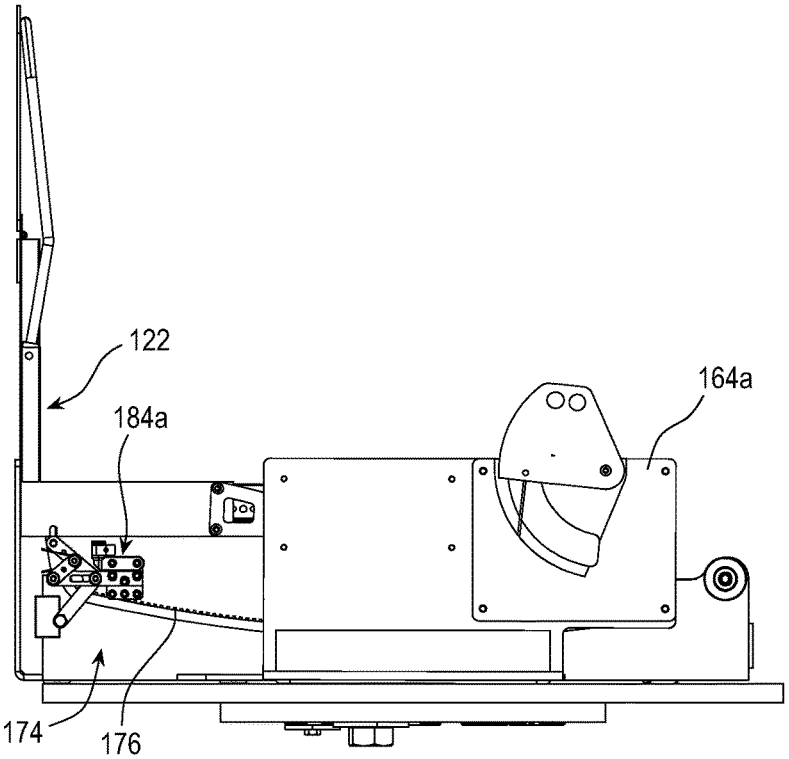
FIG. 57A illustrates a side partial cut-away view of the carriage.
Figure 57B:
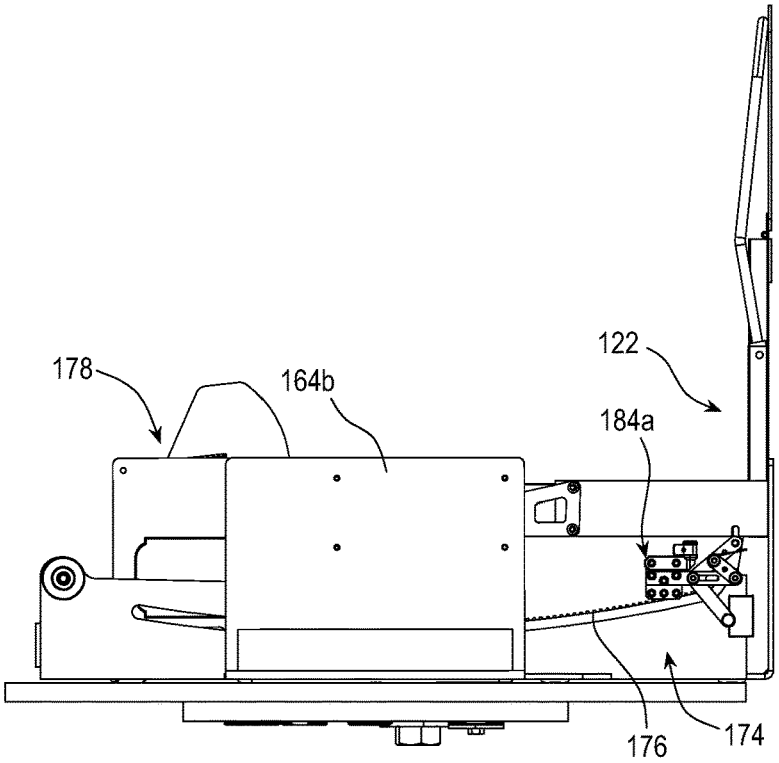
FIG. 57B illustrates an opposite side partial cut-away view of the carriage.

FIGS. 52-54B illustrate the extendable portion of the exemplary footrest assembly, e.g., including gear racks 186 provided on an underside of curved rails 187. Such gear racks 186 are engaged by rotating gears 182, to drive the footrest assembly 113 out of the housing. Cross members 185 can be provided as shown, extending between the curved rails 187. As shown in FIGS. 54A-54B, each curved rail 187 can also include a guide wheel 189, while the upper carriage portion is shown as including side frame members 183, with cut-out guide tracks 181 formed therein. The guide tracks 181 include a curvature that corresponds to the curvature of the curved rails 187. The guide tracks 181 are shown as including an convexly curved interior surface, against which a correspondingly concavely curved surface of the guide wheels 189 rides. Such a system of guide tracks and guide wheels aids in providing a smooth extension of the footrest assembly 113, as it is driven out of the upper carriage portion 178. A wide variety of alternative configurations are of course also possible to achieve the functionality described herein.

Figure 61:
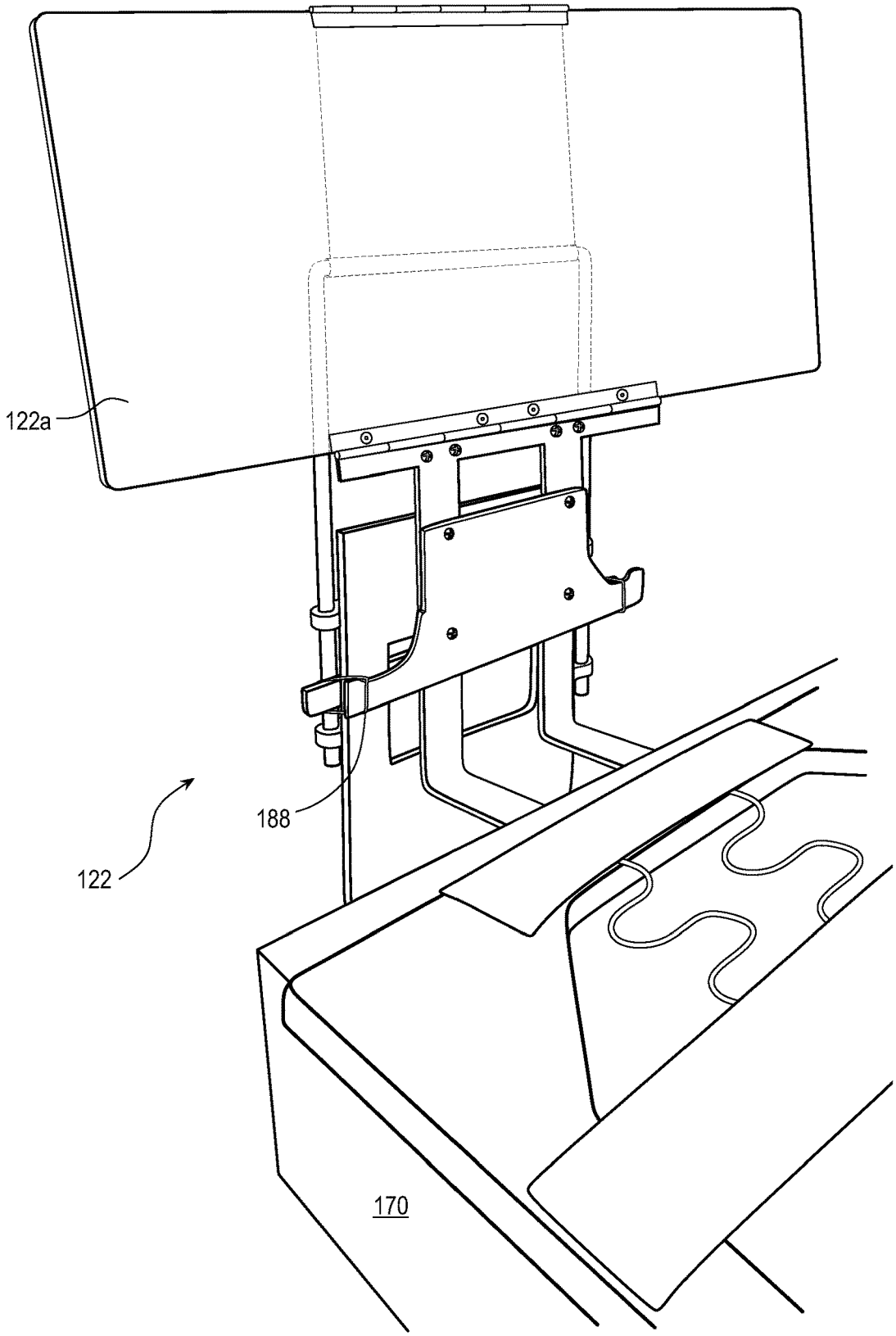
FIGS. 61-62 illustrate an exemplary mechanism for pivotable coupling between the bottom of the back support panel and the back end of the reclining base, which permits the back support panel to span the space or gap between the static backrest upright member and the reclining base.
Figure 62:
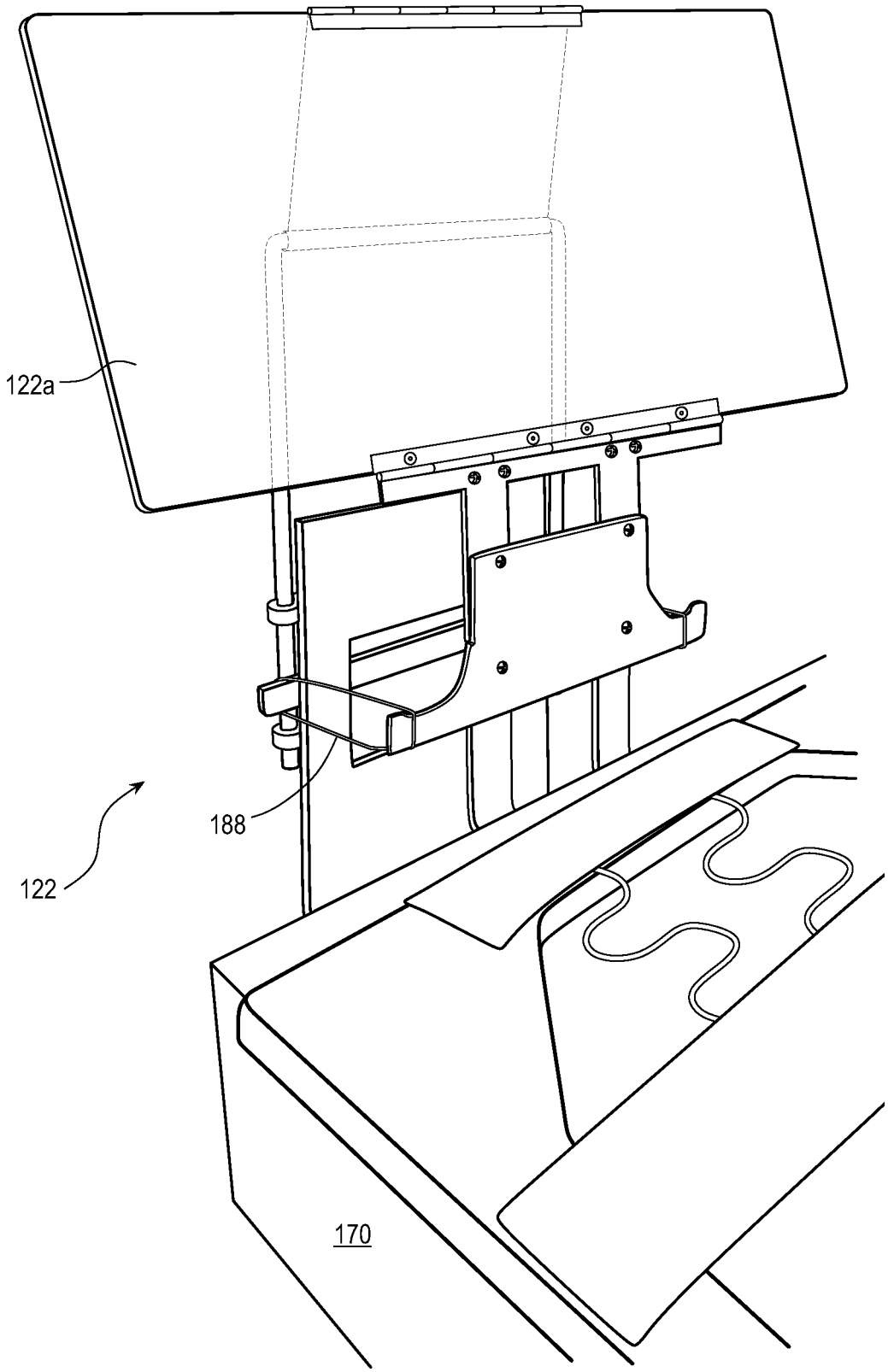

FIGS. 61-62 illustrate an exemplary mechanism for pivotable coupling between the bottom of the back support panel 122 and the back end of the reclining base, which permits the back support panel to span the space or gap between the static backrest upright member 14 and the reclining seat. As shown, a retractable tether or leash member 188 can extend across such gap, where panel 122*a* slides down upright member 114, where the bottom of panel 122*a* can be pivotally attached to the backrest support bracket 122.

Several Figures (e.g., FIGS. 29A-29B and 33) illustrate a cable pulley 190 that can be positioned within a backrest, for deployment of a headrest 192. Possible placement of the cable pulleys (e.g., internal, with back support bracket, or elsewhere) and a hidden deployable headrest 192 are also shown in FIGS. 28, 30A-30D, and 32.

StealthTech

In some embodiments, disclosed furniture systems include embedded electrical or other functional components, such as speakers, induction or other chargers or charging stations, subwoofers, power hubs, haptic feedback devices and/or combinations thereof. Examples of various electrical components that can be embedded are described in various of Applicant's patents and applications, already incorporated by reference, as well as in U.S. patent application Ser. No. 17/349,363 titled "Furniture Console And Methods Of Using The Same" filed on Jun. 16, 2021, the entire contents of which are herein incorporated by reference.

In some embodiments, the reclining assembly includes embedded electrical or other functional components. In some embodiments, the base (which includes the housing) of the reclining assembly houses a subwoofer alongside the reclining mechanism. In some embodiments, the base houses a plurality of subwoofers, where the plurality of subwoofers can be arranged in an array within the base. In some embodiments, the base houses an amplifier. In some embodiments, the base houses a power source to supply power to embedded electronic or other functional components in the reclining assembly. In some embodiments, the base houses components to provide heating and/or cooling capability to the rotatable footrest panel, the seat cushion, the backrest cushion, the headrest, or combinations thereof. In another embodiment, where both sound and the ability to recline are provided in a given overall furniture assembly, the reclining base does not include such embedded speaker components, but such speaker components are included within a non-reclining base (e.g., a seating base or ottoman seat position) of the overall furniture system.

In some embodiments, the seat or seat cushion of the reclining assembly includes at least one electronic or other functional component. For example, the seat or seat cushion of the reclining assembly includes at least one of speakers, a cooling element (such as a cooling pad), a heating element (such as a heating pad), a haptic feedback element, and/or a massaging element. In some embodiments, the at least one electronic or other functional component embedded in the seat or seat cushion receives power from a power source housed in the base.

In some embodiments, the back support cushion of the reclining assembly includes at least one electronic or other functional component. For example, the backrest cushion of the reclining assembly includes at least one of speakers, a cooling element (such as a cooling pad), a heating element (such as a heating pad), a haptic feedback element, and/or a massaging element. In some embodiments, the at least one electronic or other functional component embedded in the backrest cushion receives power from a power source housed in the base.

In some embodiments, the headrest of the reclining assembly includes at least one electronic or other functional component. For example, the headrest of the reclining assembly includes at least one of speakers, a cooling element (such as a cooling pad), a heating element (such as a heating pad), a haptic feedback element, and/or a massaging element. In some embodiments, the headrest includes a left and a right speaker. In some embodiments, the at least one electronic or other functional component embedded in the headrest receives power from a power source housed in the base of the reclining assembly.

In some embodiments, the bases and/or upright members of the disclosed furniture systems include at least one DC input, at least one DC output and at least one electrical outlet, such as a wall outlet or a duplex wall outlet. In some embodiments, the at least one DC input and the at least on DC output enable daisy chaining bases and/or upright members together. For example, the furniture system can include at least one modular furniture assembly, including a base and an upright member, and at least one reclining assembly, including a base and an upright member. Both of the at least one modular furniture and reclining assemblies include a DC input and a DC output in their respective bases. The modular furniture assembly can also include a duplex wall outlet in the base.

In some embodiments, the modular furniture assembly connects to a mains power or other power source via the at least one electrical outlet (for example, a duplex wall outlet) in the base of the modular furniture assembly. In this way, the modular furniture assembly receives power from the mains power or other power source. In some embodiments, a DC input on the base of the reclining assembly daisy chains to the DC output on the base of the modular furniture assembly. Because the modular furniture assembly is receiving power from the mains or other power source, the reclining assembly is also receiving power via the DC input/output connection to the modular furniture assembly.

It should be understood that multiple reclining and/or modular furniture assemblies can be daisy chained together via the DC inputs and outputs, respectively, included in the bases of the reclining and modular furniture assemblies. It should also be understood that the reclining assembly can also include a wall outlet in the base and thereby connect to the mains or other power source rather than the modular furniture assembly connecting to the mains or other power source. Whether the reclining assembly or the modular furniture assembly connects to the mains or other power source does not preclude any arrangement of daisy chaining reclining and/or modular furniture assemblies together.

The bases and upright members of the present invention can include one or more covers (e.g., an inner cover and an outer cover). Such covers have various advantages, such as that the outer covers are conveniently removable so that the user can remove the covers, wash them, and swap them with other covers as desired.

Controllers

In some embodiments, the disclosed furniture systems include a controller. In some embodiments, the reclining mechanism of the reclining assembly is controlled by a hand-held controller, which can be wired or wireless. In some embodiments, a locking mechanism of the reclining mechanism is controlled by the controller. In some embodiments, the reclining mechanism of the reclining assembly is controlled by voice-activated software. For example, a user of the reclining assembly can simply say, "Feet up!" and the reclining mechanism will move the footrest assembly accordingly with respect to the housing. In some embodiments, the voice-activated software is included in a mobile phone application.

In some embodiments, the hand-held controller includes a plurality of buttons. The plurality of buttons can be pre-programmed for different reclining options. For example, a button can be pre-programmed to completely recline the footrest assembly while a second button can be pre-programmed to partially recline the footrest assembly. In some embodiments, the hand-held controller includes buttons programmed to arrive at a certain softness in the back pillow cushion (e.g., where the back pillow cushion includes inflatable air bladders, to allow such adjustment). In some embodiments, the buttons of the hand-held controller are programmed by a user. In some embodiments, the buttons of the hand-held controller are two-stage buttons. For example, a first stage of the button partially reclines the footrest assembly and the second stage of the button fully recline the footrest assembly.

In some embodiments, the hand-held controller includes a plurality of buttons. In some embodiments, the individual buttons of the plurality of buttons differ in size and/or shape from each other, such that a user can control the reclining mechanism by feel without the need to look at the hand-held controller. In some embodiments, the individual buttons of the plurality of buttons include ridges or tactile indicators, enabling the user to control the reclining mechanism by feel. In some embodiments, buttons of the hand-held controller use impulses received from the touch of a user's finger to control the amount of reclining performed by reclining mechanism. In some embodiments, the touch control controller assembly includes motional or capacitive touch capability.

In some embodiments, the hand-held controller includes two buttons, where one button fully reclines both the seat cushion and the footrest assembly and one button fully compresses the seat cushion and footrest assembly. In some embodiments, the hand-held controller includes three buttons, where one button fully reclines both the seat cushion and the footrest assembly, one button fully compresses the seat cushion and footrest assembly, and one button returns the reclining assembly to a home position. In some embodiments, the hand-held controller includes four buttons, where one button fully reclines the seat cushion, one button fully reclines the footrest assembly, one button fully compresses the seat cushion and one button fully compresses the footrest assembly. In some embodiments, the hand-held controller includes five buttons, where one button fully reclines the seat cushion, one button fully reclines the footrest assembly, one button fully compresses the seat cushion, one button fully compresses the footrest assembly and one button returns the reclining assembly to a home position.

In some embodiments, the seat cushion of the reclining assembly includes a cutout or pocket to house the hand-held controller, whether wired or wireless. The cutout or pocket can include an induction or other charger configured to charge a wireless hand-held controller. In some embodiments, the cutout or pocket orients the hand-held controller perpendicular to induction coils embedded in the seat cushion, where the coils charge the hand-held controller. In some embodiments, a charge level of the hand-held controller is continually topped-off to maintain a functioning of the hand-held controller. In some embodiments, the hand-held controller is charged by radio frequency waves.

In some embodiments, the hand-held controller includes a programmable logic board (PLB). The PLB can be enabled to shut off the reclining mechanism upon reaching a threshold amperage or voltage. The PLB can be enabled to shut off the reclining mechanism upon reaching a threshold angle of reclining.

In some embodiments, the reclining mechanism of the reclining assembly is controlled by a touch control controller assembly mounted on a seat cushion. The touch control controller assembly can be mounted between two seat cushions or on a front surface of the seat cushion. The touch control controller assembly includes a plurality of buttons, each configured to perform a different action. For example, the touch control controller assembly includes a button to recline the reclining assembly and a button to move the reclining assembly into a non-reclined position. In some embodiments, the individual buttons of the plurality of buttons differ in size and/or shape from each other, such that a user can control the reclining mechanism by feel without the need to look at the touch control controller assembly. In some embodiments, the individual buttons of the plurality of buttons include ridges or tactile indicators, enabling the user to control the reclining mechanism by feel. In some embodiments, buttons of the touch control controller assembly use impulses received from the touch of a user's finger to control the amount of reclining performed by reclining mechanism. In some embodiments, the touch control controller assembly includes motional or capacitive touch capability.

In some embodiments, the reclining mechanism of the reclining assembly is controlled mechanically, by a lever placed between two reclining assemblies or placed between a reclining assembly and a modular furniture assembly. In some embodiments, the lever is pushed or pulled to cause the reclining mechanism to recline the seat base, the footrest assembly or both. The lever has a compliance or springiness to accommodate forces applied (such as when a user sits on the reclining assembly) without springing free.

While certain embodiments of the present disclosure have been described in detail, with reference to specific configurations, parameters, components, elements, etcetera, the descriptions are illustrative and are not to be construed as limiting the scope of the claimed invention.

Furthermore, it should be understood that for any given element of component of a described embodiment, any of the possible alternatives listed for that element or component may generally be used individually or in combination with one another, unless implicitly or explicitly stated otherwise.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition. At the very least, and not as an attempt to limit the application of the doctrine of equivalents to the scope of the claims, each numerical parameter should be construed in light of the number of reported significant digits and by applying ordinary rounding techniques.

As used herein, the term "between" includes any referenced endpoints. For example, "between 2 and 10" includes both 2 and 10.

Any headings and subheadings used herein are for organizational purposes only and are not meant to be used to limit the scope of the description or the claims.

It will also be noted that, as used in this specification and the appended claims, the singular forms "a," "an" and "the" do not exclude plural referents unless the context clearly dictates otherwise. Thus, for example, an embodiment referencing a singular referent (e.g., "widget") may also include two or more such referents.

It will also be appreciated that embodiments described herein may also include properties and/or features (e.g., ingredients, components, members, elements, parts, and/or portions) described in one or more separate embodiments and are not necessarily limited strictly to the features expressly described for that particular embodiment. Accordingly, the various features of a given embodiment can be combined with and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include such features.

A user having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

Following are some further example embodiments of the invention. These are presented only by way of example and are not intended to limit the scope of the invention in any way. Further, any example embodiment can be combined with one or more of the example embodiments.

Embodiment 1. A furniture system comprising:

a reclining assembly configured to be selectively coupled to a modular furniture assembly comprising a base and an upright member that can be selectively coupled together, the reclining assembly comprising (i) a housing, (ii) a footrest assembly and (iii) a reclining mechanism configured to selectively move the footrest assembly and/or a seat base with respect to the housing, wherein the reclining mechanism is configured to be selectively mountable within the housing, wherein the reclining mechanism is configured to be selectively orientable within the housing, between at least two different orientations.

Embodiment 2. The furniture system of embodiment 1 or any other embodiment, wherein the furniture assembly further comprises the modular furniture assembly, which comprises a base and an upright member that can be selectively coupled together.

Embodiment 3. The furniture system of embodiment 1 or any other embodiment, wherein the footrest assembly comprises a rotatable footrest panel.

Embodiment 4. The furniture system of embodiment 3 or any other embodiment, wherein the rotatable footrest panel is coupled to the reclining mechanism.

Embodiment 5. The furniture system of embodiment 3 or any other embodiment, wherein the rotatable footrest panel is configured to be concealable within the housing.

Embodiment 6. The furniture system of embodiment 1 or any other embodiment, wherein the reclining assembly further comprises:

a base comprising the housing and the footrest assembly;

a backrest panel coupled to the base, wherein the backrest panel supports a backrest pillow at a top edge of the backrest panel; and a seat cushion and a seat base coupled to or positioned over the base.

Embodiment 7. The furniture system of embodiment 6 or any other embodiment, wherein the backrest panel is received into a pocket of the backrest pillow.

Embodiment 8. The furniture system of embodiment 6, or any other embodiment wherein movement of the backrest pillow is supported by a vertical backrest surface, with tilt control of the backrest pillow being driven by a bottom edge of the backrest panel or linkage of the backrest panel.

Embodiment 9. The furniture system of embodiment 8 or any other embodiment, wherein the vertical backrest surface supporting movement of the backrest pillow is an upright member of the modular furniture system.

Embodiment 10. The furniture system of embodiment 1 or any other embodiment, wherein the reclining mechanism is configured to rotate at least about 90° within the housing.

Embodiment 11. The furniture system of embodiment 10 or any other embodiment, wherein the reclining mechanism is configured to rotate between two orientations, such as a shallow seat configuration and a deep seat configuration within the housing, the two orientations being achieved by rotating the reclining mechanism about 90° within the housing, to move from one orientation to the other.

Embodiment 12. The furniture system of embodiment 1 or any other embodiment, wherein the modular furniture assembly or the reclining assembly comprises embedded electrical or functional components, the electrical or functional components including one or more speakers, induction chargers, charging stations, power hubs, subwoofers or haptic feedback devices.

Embodiment 13. A reclining assembly comprising:

a base comprising a housing and a footrest assembly, wherein the footrest assembly comprises a footrest assembly having a rotatable footrest panel;

a reclining mechanism mounted within the housing and coupled to the footrest assembly, wherein the rotatable footrest panel is configured to rotate between at least forwardly and rearwardly rotated positions relative to a generally horizontal footrest panel position; and a backrest panel coupled to the base.

Embodiment 14. The reclining assembly of embodiment 13 or any other embodiment, wherein the reclining mechanism is selectively mountable within the housing.

Embodiment 15. The reclining assembly of embodiment 13 or any other embodiment, wherein the rotatable footrest panel comprises at least two interchangeable footrest panels.

Embodiment 16. The reclining assembly of embodiment 15 or any other embodiment, wherein the at least two interchangeable footrest panels include a footrest panel for use with a shallow seat configuration and a footrest panel for use with a deep seat configuration.

Embodiment 17. The reclining assembly of embodiment 13 or any other embodiment, wherein the footrest panel includes a front facia, wherein as the rotatable footrest panel is moved to a stowed position, the rotatable footrest panel passively locates itself into a home position.

Embodiment 18. The reclining assembly of embodiment 17 or any other embodiment, wherein passive alignment of the rotatable footrest panel as it moves to the stowed position is achieved with at least one of a mechanical alignment mechanism or an electronic mechanism (e.g., a Hall Sensor).

Embodiment 19. The reclining assembly of embodiment 13 or any other embodiment, wherein the rotatable footrest panel is configured to be concealable in the housing.

Embodiment 20. The reclining assembly of embodiment 13 or any other embodiment, wherein the reclining mechanism extends through the base to rest on a support surface.

Embodiment 21. The reclining assembly of embodiment 13 or any other embodiment, wherein the base rests on a support surface.

Embodiment 22. The reclining assembly of embodiment 13 or any other embodiment, wherein the reclining mechanism is configured to provide at least two reclining movements.

Embodiment 23. The reclining assembly of embodiment 13 or any other embodiment, wherein the reclining mechanism movement is controlled by a plurality of actuators, a firstactuator or actuator stage for linearly extending a seat base and/or footrest in an x dimension, a second actuator or actuator stage for further linearly extending the footrest in the x dimension, and a third actuator or actuator stage for controlling vertical movement of the footrest in a y or z dimension.

Embodiment 24. The reclining assembly of embodiment 23 or any other embodiment, wherein the first and second actuator stages are achieved with a single actuator, that includes two stages.

Embodiment 25. The reclining assembly of embodiment 24 or any other embodiment, wherein the single actuator with two stages includes two lead screws.

Embodiment 26. The reclining assembly of embodiment 13 or any other embodiment, wherein a first reclining movement moves the footrest assembly with respect to the housing.

Embodiment 27. The reclining assembly of embodiment 26 or any other embodiment, wherein a second reclining movement moves a seat base and/or seat cushion with respect to the base.

Embodiment 28. The reclining assembly of embodiment 26 or any other embodiment, wherein such movement is a linear translation movement forward.

Embodiment 29. The reclining assembly of embodiment 26 or any other embodiment, wherein such movement is both linear forward movement, while a front edge of the seat cushion and/or seat base also moves upward to adjust a pitch of the seat cushion and/or seat base.

Embodiment 30. The reclining assembly of embodiment 29 or any other embodiment, wherein such movement includes dropping a back edge of the seat, while optionally also moving the front edge of the seat upward, in order to relieve pressure on a backside of a user's knees.

Embodiment 31. The reclining assembly of embodiment 30 or any other embodiment, wherein such movement ensures circulation doesn't get cut off in a user's popliteal gap.

Embodiment 32. The reclining assembly of embodiment 13 or any other embodiment, further comprising a back cushion attached to the backrest panel.

Embodiment 33. The reclining assembly of embodiment 32 or any other embodiment, wherein the back cushion is attached with hook and loop fasteners, snaps, or a pocket.

Embodiment 34. The reclining assembly of embodiment 33 or any other embodiment, wherein any such pocket includes a bellows to accommodate expansion/closing of a gap between the backrest panel and an upright member that a top end of the backrest panel is supported against.

Embodiment 35. The reclining assembly of embodiment 13 or any other embodiment, wherein moving a seat cushion or seat base causes the backrest panel to move with the seat cushion or seat base, thereby reclining the backrest panel against an upright member.

Embodiment 36. The reclining assembly of embodiment 32 or any other embodiment, wherein the back cushion is attached to a seat cushion, so that as the seat cushion is pulled forward, a bottom of the back cushion is also pulled forward.

Embodiment 37. The reclining assembly of embodiment 13 or any other embodiment, wherein the reclining mechanism is configured to be rotated within the housing about 90°, between a shallow seat configuration and a deep seat configuration.

Embodiment 38. The reclining assembly of embodiment 13 or any other embodiment, wherein the reclining mechanism is configured to be rotated in the housing between a shallow seat configuration and a deep seat configuration.

Embodiment 39. The reclining assembly of embodiment 13 or any other embodiment, wherein the rotatable footrest panel is configured to be rotated at least about 45° (relative to horizontal) away from the reclining assembly about an attachment point.

Embodiment 40. The reclining assembly of embodiment 13 or any other embodiment, wherein the rotatable footrest panel is configured to be rotated at least about 45° (relative to horizontal) toward the reclining assembly about the attachment point.

Embodiment 41. The reclining assembly of embodiment 13 or any other embodiment, wherein in the reclined position, a seat angle is about 10 to 15°, a back angle corresponding to an angle of linkage is about 25 to 35°, or about 30°, and a provided popliteal gap is 3 to 12 inches, within a zone of adjustability.

Embodiment 42. The reclining assembly of embodiment 13 or any other embodiment, wherein the reclining mechanism further comprises a locking mechanism.

Embodiment 43. The reclining assembly of embodiment 42 or any other embodiment, wherein the locking mechanism is provided as part of one of a gas spring actuator, an electrically driven linear actuator, or is a mechanical latching mechanism.

Embodiment 44. The reclining assembly of embodiment 43 or any other embodiment, wherein the locking mechanism maintains a degree of reclining for the reclining assembly.

Embodiment 45. A furniture system comprising:

a reclining assembly, the reclining assembly comprising (i) a housing, (ii) a footrest assembly, and (iii) a reclining mechanism configured to selectively move the footrest assembly and/or a seat base with respect to the housing, wherein the reclining mechanism is mounted within the housing; and wherein the footrest assembly comprises a rotatable footrest panel.

Embodiment 46. The furniture system of embodiment 45 or any other embodiment, wherein the reclining assembly is configured to be coupled to a modular furniture assembly comprising a base and an upright member that can be selectively coupled together.

Embodiment 47. A furniture system comprising:

a reclining assembly configured to be selectively coupled to a modular furniture assembly comprising a base and an upright member that can be selectively coupled together, the reclining assembly comprising (i) a housing, (ii) a footrest assembly and (iii) a reclining mechanism configured to selectively move the footrest assembly and/or a seat base with respect to the housing, wherein the reclining mechanism is mounted within the housing, wherein the reclining mechanism is configured to selectively extend a footrest assembly out of a deep side or a shallow side of the housing.

Embodiment 48. The reclining assembly of embodiment 47 or any other embodiment, wherein the footrest assembly comprises a rotatable footrest panel.

Embodiment 49. The reclining assembly of embodiment 13, or a furniture assembly of embodiment 45 or 47 or any other embodiment, wherein a backrest support surface can be of any configuration, including a standard upright member, a roll arm upright member, or an inclined/angled upright member.

Embodiment 50. The reclining assembly of embodiment 13, or a furniture assembly of embodiment 45 or 47 or any other embodiment, wherein a top edge of a backrest panel or other backrest linkage conforms to a given shape of a backrest support surface as the reclining mechanism reclines.

Embodiment 51. The reclining assembly of embodiment 13, or a furniture assembly of embodiment 45 or 47 or any other embodiment, wherein a seat cushion includes a cutout to accommodate a backrest panel or backrest linkage mechanism, so that when looking at the reclining assembly or furniture assembly the backrest panel or backrest linkage mechanism is hidden.

Embodiment 52. The reclining assembly of embodiment 13, or a furniture assembly of embodiment 45 or 47 or any other embodiment, wherein a backrest panel or backrest linkage mechanism includes a roller or other friction reducing mechanism to reduce wear on a corresponding upright member or other backrest support surface.

Embodiment 53. The reclining assembly or furniture assembly of embodiment 52 or any other embodiment, wherein the backrest support surface includes a high rub count fabric, plastic, or other material (e.g., KEVLAR), or a plastic or other relatively rigid insert in the backrest support surface to increase wear resistance.

Embodiment 54. The reclining assembly or furniture assembly of embodiment 52 or any other embodiment, wherein the backrest support surface includes a tank tread with a wheel, or a translating plate with play that can move relative to the rest of the backrest, to reduce wear on the upright member or other backrest support surface.

Embodiment 55. The reclining assembly of embodiment 13, or a furniture assembly of embodiment 45 or 47 or any other embodiment, wherein a backrest plate moves down as the reclining mechanism moves to the reclined position.

Embodiment 56. The reclining assembly of embodiment 13, or a furniture assembly of embodiment 45 or 47 or any other embodiment, wherein an upright member or other backrest support surface itself moves down or rotates rearwardly to aid in creation of a desired backrest angle as the reclining mechanism moves to the reclined position.

Embodiment 57. The reclining assembly of embodiment 13, or a furniture assembly of embodiment 45 or 47 or any other embodiment, wherein the housing or reclining mechanism includes ramps on which rollers of the reclining mechanism roll, the ramps being on an inside, an outside, or on a central portion of the housing.

Embodiment 58. The reclining assembly of embodiment 13, or a furniture assembly of embodiment 45 or 47 or any other embodiment, wherein a backrest pillow includes an adjustable headrest.

Embodiment 59. The reclining assembly of embodiment 13, or a furniture assembly of embodiment 45 or 47 or any other embodiment, wherein the backrest pillow includes a headrest, the headrest being adjustable, not adjustable, or selectively deployable.

Embodiment 60. The reclining assembly of embodiment 13, or a furniture assembly of embodiment 45 or 47 or any other embodiment, wherein a headrest is stowed within an upright member or other backrest support surface, or a backrest pillow, and is deployable therefrom.

Embodiment 61. The reclining assembly of embodiment 13, or a furniture assembly of embodiment 45 or 47 or any other embodiment, wherein a backrest pillow includes a flexible, but semi-rigid panel, to adjust an ability of a seated user to feel a corner of a backrest panel when leaning back into the backrest pillow.

Embodiment 62. The reclining assembly of embodiment 13, or a furniture assembly of embodiment 45 or 47 or any other embodiment, wherein a backrest pillow includes soft and rigid portions, with the rigid portion oriented rearward to mask any ability of a seated user leaning backward to feel a hard corner of an upright member or other backrest support surface.

Embodiment 63. The reclining assembly of embodiment 13, or a furniture assembly of embodiment 45 or 47 or any other embodiment, wherein a gap between an upright member or other backrest support surface and a backrest panel or other linkage is covered.

Embodiment 64. The reclining assembly or furniture assembly of embodiment [0001] 63 or any other embodiment, wherein the gap is covered by a mechanism analogous to a rolltop desk, a swimming pool cover or a bellows.

Embodiment 65. The reclining assembly of embodiment 13, or a furniture assembly of embodiment 45 or 47 or any other embodiment, wherein a lever or other deployment mechanism (pull cord, etc.) is recessed into a framework of the base between adjacent base sections so that a seated user does not feel the lever when sitting thereover.

Embodiment 66. The reclining assembly of embodiment 13, or a furniture assembly of embodiment 45 or 47 or any other embodiment, wherein an upright member or other backrest support surface itself may selectively rotate away from vertical (e.g., segmented movement, or movement of entire backrest) during reclining of the reclining mechanism.

Embodiment 67. The reclining assembly of embodiment 13, or a furniture assembly of embodiment 45 or 47 or any other embodiment, wherein actuation of the reclining mechanism may be achieved through voice command.

Embodiment 68. The reclining assembly of embodiment 13, or a furniture assembly of embodiment 45 or 47 or any other embodiment, wherein a remote control docking station in a seat cushion or base framework includes a wireless charger to ensure that the remote control is always charged.

Embodiment 69. The reclining assembly or furniture assembly of embodiment 68 or any other embodiment, wherein the remote control is configured to sleep when not in active use to reduce power consumption, wherein waking of the remote control is achieved when a user of the reclining assembly or furniture assembly sits near the remote control, waking it up.

Embodiment 70. The reclining assembly or furniture assembly of embodiment 68 or any other embodiment, wherein each remote in a reclining assembly or furniture assembly including a plurality of recliner-enabled seating positions and associated plurality of remotes is factory paired to its particular reclining mechanism of a given seating position.

Embodiment 71. The reclining assembly or furniture assembly of embodiment 68 or any other embodiment, wherein the remote control is tethered either with a retractable cord and/or a very short cord, such as 9 inches or less.

Embodiment 72. The reclining assembly of embodiment 13, or a furniture assembly of embodiment 45 or 47 or any other embodiment, wherein the reclining assembly or furniture assembly includes a backrest pillow capable of changing lengths, to accommodate a difference in needed pillow length between deep seat and shallow seat configurations.

Embodiment 73. The reclining assembly or furniture assembly of embodiment 72 or any other embodiment, wherein such pillow adjustment is achieved through insertion or removal of a foam insert, or inflation or deflation of a pillow bladder.

Embodiment 74. The reclining assembly of embodiment 13, or a furniture assembly of embodiment 45 or 47 or any other embodiment, wherein the footrest panel is heated.

Embodiment 75. The reclining assembly of embodiment 13, or a furniture assembly of embodiment 45 or 47 or any other embodiment, wherein a height of a front edge of the seat base or seat cushion stays constant, when changing from the shallow to deep configuration, even in the reclined position.

Embodiment 76. The reclining assembly or furniture assembly of embodiment 75 or any other embodiment, wherein because the deep configuration is longer, an angle of inclination of the seat base or seat cushion is lower than in the shallow configuration, to ensure that the front edge of the seat base or seat cushion is constant, in both configurations, when reclined.

Embodiment 77. The reclining assembly of embodiment 13, or a furniture assembly of embodiment [0001] 45 or [0001] 47 or any other embodiment, wherein a latching mechanism for anchoring the reclining mechanism in the housing is a quick release mechanism, that does not require use of any tools.

Embodiment 78. The reclining assembly of embodiment 13, or a furniture assembly of embodiment 45 or 47 or any other embodiment, wherein the base includes panels on shallow and deep sides, with openings for the reclining mechanism to extend through, wherein the base includes footrest panels for each of deep and shallow configurations.

Embodiment 79. The reclining assembly of embodiment 13, a furniture assembly of embodiment 45 or 47 or any other embodiment, wherein a headrest includes electronic or other functional components (e.g., speakers, heating, cooling, massage, sound, lights, etc.)

Embodiment 80. A headrest for use with a furniture system, wherein the headrest is detachable from the furniture system, or provided separately therefrom, wherein the headrest includes electronic or other functional components (e.g., speakers, heating, cooling, massage, sound, or lights).

Embodiment 81. The reclining assembly of embodiment 13, a furniture assembly of embodiment 45 or 47 or any other embodiment, wherein the seat base includes a coupling post in a front corner thereof, to allow removal of either a deep or a shallow side panel, to provide an opening for the reclining mechanism to operate through.

Embodiment 82. The reclining assembly or furniture assembly of embodiment [0001] 81 or any other embodiment, wherein a removed panel is used as a footrest panel.

Embodiment 83. A reclining furniture system comprising:

a reclining assembly comprising a base providing a seating surface having a width and a depth of different dimensions, the furniture system being configured to allow the user to orient the width or the depth of the base to form a front edge of the base, wherein a footrest assembly selectively extends from the front edge of the base, wherein the reclining assembly includes a reclining mechanism housed within the base, the reclining mechanism being configured to selectively recline the seating surface with respect to a remainder of the base in either the orientation where the width of the base forms the front edge of the seat or the depth of the base forms the front edge of the seat.

Embodiment 84. The reclining furniture system of embodiment 83 or any other embodiment, wherein the reclining mechanism is housed entirely within a footprint of the base.

Embodiment 85. A reclining furniture system comprising:

a reclining assembly comprising a base providing a seating surface, wherein the reclining assembly includes a reclining mechanism housed entirely within a footprint of the base, the reclining assembly being configured to selectively recline the seating surface with respect to a remainder of the base or the furniture system.

Embodiment 86. The reclining furniture system of embodiment [0001] 85 or any other embodiment, wherein the base is configured to have a width and a depth of different dimensions.

Embodiment 87. The reclining furniture system of embodiment 85, or any other embodiment wherein the base is provided with a seat cushion, the reclining mechanism being housed entirely within a footprint of the seat cushion.

Embodiment 88. The reclining furniture system of embodiment 87 or any other embodiment, wherein the furniture system further comprises one or more upright members attached or attachable to the base, the one or more upright members being configured as at least one of an armrest or a backrest, wherein no portion of the reclining mechanism is housed within the one or more upright members.

Embodiment 89. A reclining furniture system comprising:

a reclining assembly comprising a base providing a seating surface, wherein the reclining assembly includes a reclining mechanism housed within the base, the reclining mechanism being configured to selectively recline the seating surface with respect to a static upright member that is a backrest, wherein the reclining mechanism comprises a rotating gear that engages against a gear rack, a backrest angle reclining as the seating surface of the base is pushed forward by the reclining mechanism, the reclining mechanism further including a back support member or panel having a bottom edge that is pivotally coupled to a back of the base, wherein a top of the back support member or panel slides up or down, adjacent the upright member that is the backrest, wherein as the seating surface reclines forward, the bottom of the back support member or panel also moves forward with the seating surface, and a top of the back support member or panel slides down.

Embodiment 90. The reclining furniture system of embodiment 89 or any other embodiment, wherein the reclining mechanism does not include a linear actuator.

Embodiment 91. A reclining furniture system comprising:

a reclining assembly configured to be selectively coupled to a modular furniture assembly comprising a seat base and an upright member that can be selectively coupled together, wherein the modular furniture assembly is such that the seat base has a length (x) and a width (y), and the upright member has a length (x') and a width (z), wherein the seat base and the upright member have a defined spatial relationship, where the length (x) of the seat base is substantially equal to the length (x') of the upright member, and the length (x) of the seat base is substantially equal to the sum of the width (y) of the seat base and the width (z) of the upright member;

wherein the reclining assembly comprises (i) a housing, (ii) a footrest assembly and (iii) a reclining mechanism housed entirely within a seat base of the reclining assembly, the reclining mechanism being configured to selectively move the footrest assembly and/or the seat base of the reclining assembly with respect to a remainder of the furniture system.

Embodiment 92. The reclining furniture system of embodiment 91 or any other embodiment, wherein the seat base within which the reclining mechanism is housed has substantially the same dimensions as the seat base of the modular furniture assembly that the reclining assembly is selectively coupleable to.

Embodiment 93. The reclining furniture system of embodiment 92 or any other embodiment, wherein the seat base within which the reclining mechanism is housed has dimensions of approximately 35 inches in length by approximately 29 inches in width.

Embodiment 94. A reclining assembly comprising:

a carriage comprising:

a pivot point defining an axis of rotation, a plurality of upper tracks in an upper base member of the carriage, wherein a size and shape of the plurality of upper tracks is defined by the pivot point and desired rotation, a plurality of brackets each having a set of top protrusions that engage and/or communicate with the plurality of upper tracks and a set of bottom protrusions, wherein the plurality of brackets includes a pair of side brackets and a back support bracket, and a back support panel attached to the back support bracket; and a static lower base member comprising a plurality of lower arced tracks, wherein the set of bottom protrusions of the plurality of brackets engage and/or communicate with the plurality of lower arced tracks, and wherein a size and shape of the plurality of lower arced tracks are also defined by the pivot point of the carriage and the desired rotation.

Embodiment 95. The reclining assembly of embodiment 94 or any other embodiment, wherein the plurality of brackets are configured to move within the plurality of upper tracks and within the plurality of lower arced tracks.

Embodiment 96. The reclining assembly of embodiment 95 or any other embodiment, wherein the plurality of brackets are configured to move between an initial configuration and a rotated configuration.

Embodiment 97. The reclining assembly of embodiment 96 or any other embodiment, wherein, in the initial configuration, the pair of side brackets are spaced approximately 11-14 inches from an edge of the carriage.

Embodiment 98. The reclining assembly of embodiment 96 or any other embodiment, wherein, in the rotated configuration, the pair of side brackets are spaced approximately 7-10 inches from an edge of the carriage.

Embodiment 99. The reclining assembly of embodiment 96 or any other embodiment, wherein the side brackets move closer into, or further out from an edge of the carriage as the carriage is rotated from a deep to shallow configuration, or vice versa.

Embodiment 100. The reclining assembly of embodiment 94 or any other embodiment, wherein a lower portion of the carriage further comprises a pair of gear rails configured to receive and engage with corresponding rotating gears of an upper portion of the carriage, the upper portion including a seating surface of the reclining assembly.

Embodiment 101. The reclining assembly of embodiment 100 or any other embodiment, wherein the reclining assembly is configured to facilitate rotation of the seat base between a shallow configuration and a deep configuration.

Embodiment 102. The reclining assembly of embodiment 100 or any other embodiment, wherein the size and shape of the plurality of upper tracks determines a range of rotation for the seat base.

Embodiment 103. The reclining assembly of embodiment 100 or any other embodiment, wherein the size and shape of the plurality of lower arced tracks determines a range of rotation for the seat base.

Embodiment 104. The reclining assembly of embodiment 94 or any other embodiment, wherein the carriage is configured to rotate about the pivot point with respect to the static lower base member.

Embodiment 105. The reclining assembly of embodiment 104 or any other embodiment, wherein rotation of the carriage causes the top and bottom protrusions of the plurality of brackets to move within the plurality of upper tracks and within the plurality of lower arced tracks.

Embodiment 106. The reclining assembly of embodiment 94 or any other embodiment, further comprising a plurality of kick panels attached to the plurality of brackets, wherein the plurality of kick panels are configured to move with the brackets when the plurality of brackets move.

Embodiment 107. The reclining assembly of embodiment 106 or any other embodiment, wherein each of the kick panels is selectively removable from the bracket to which it is attached.

Embodiment 108. The reclining assembly of embodiment 94 or any other embodiment, wherein the static lower base member further comprises a set of feet.

Embodiment 109. The reclining assembly of embodiment 94 or any other embodiment, wherein the plurality of upper tracks comprise a set of left-hand side tracks and a set of right-hand side tracks, wherein the left-and right-hand side tracks are not symmetric.

Embodiment 110. The reclining assembly of embodiment 94 or any other embodiment, wherein the axis of rotation is configured to maintain rotation of the carriage within a footprint of the static lower base member.

Embodiment 111. A reclining assembly comprising:

a carriage comprising:

a pivot point defining an axis of rotation, a plurality of upper tracks formed into an upper base member of the carriage, wherein a size and shape of the plurality of upper tracks is defined by the pivot point, a plurality of brackets each having a set of top protrusions that engage and/or communicate with the plurality of upper tracks and a set of bottom tracks, wherein the plurality of brackets includes a pair of side brackets and a back support bracket, a back support panel attached to the back support bracket, and a reclining mechanism;

a static lower base member comprising a plurality of lower arced tracks, wherein the set of bottom protrusions of the plurality of brackets engage and/or communicate with the plurality of lower arced tracks, and wherein a size and shape of the plurality of lower arced tracks is also defined by the pivot point of the carriage.

Embodiment 112. The reclining assembly of embodiment 111 or any other embodiment, wherein the reclining mechanism of the carriage comprises:

a pair of gear rails on a lower carriage portion of the carriage, configured to receive and engage with corresponding rotating gears on an upper carriage portion of the carriage, the upper carriage portion of the carriage defining a seat base;

a motor to drive the rotating gears, thereby turning the rotating gears and causing them to travel along the pair of gear rails.

Embodiment 113. The reclining assembly of embodiment 112 or any other embodiment, wherein the rotating gears are positioned on a shaft adjacent a back end of the upper carriage portion of the carriage.

Embodiment 114. The reclining assembly of embodiment 112 or any other embodiment, wherein causing the pair of rotating gears to travel along the pair of gear rails causes the seat base to move in relation to the lower carriage portion, thereby reclining the seat base.

Embodiment 115. The reclining assembly of embodiment 112 or any other embodiment, further comprising a second pair of rotating gears and a second pair of gear rails within the upper carriage portion, wherein causing the pair of second pair of rotating gears to travel along the second pair of gear rails causes a footrest panel to extend.

Embodiment 116. The reclining assembly of embodiment 112 or any other embodiment, wherein causing the pair of rotating gears to travel along the pair of gear rails causes the back support panel to recline.

Embodiment 117. The reclining assembly of embodiment 112 or any other embodiment, wherein the motor can be driven manually or electrically.

Embodiment 118. The reclining assembly of embodiment 117 or any other embodiment, wherein the motor is electrically driven, where the reclining assembly further comprises a battery, and a charger for the battery, within the carriage.

Embodiment 119. The reclining assembly of embodiment 112 or any other embodiment, further comprising a controller to drive the motor.

Embodiment 120. The reclining assembly of embodiment 119 or any other embodiment, wherein the controller is incorporated into the seat base or one of the side brackets.

Embodiment 121. The reclining assembly of embodiment 119 or any other embodiment, wherein the controller is selectively stowed along a left or right side, rather than a front edge of the seat base.

Embodiment 122. The reclining assembly of embodiment 119 or any other embodiment, wherein the controller is a wireless remote controller.

Embodiment 123. A furniture system comprising:

a reclining assembly configured to be selectively coupled to a modular furniture assembly comprising a base and an upright member that can be selectively coupled together, wherein the base and upright member each include feet, wherein at least a portion of the coupling is achieved with a shoe coupler, including holes into which the feet of the base and upright member are received, so as to couple the base to the upright member together, the reclining assembly comprising (i) a housing, (ii) a footrest assembly and (iii) a reclining mechanism configured to selectively move the footrest assembly and/or a seat base with respect to the housing, wherein the reclining mechanism is mounted within the housing, wherein the reclining mechanism is configured as a reclining base, which reclining base is interchangeable with a standard modular furniture assembly by interchanging a standard base and/or upright member with the reclining base, so that feet of such a reclining base drop into shoes that would have held the standard base and/or upright member in such a modular furniture assembly.

Embodiment 124. The reclining assembly of embodiment 123 [0001] 123 or any other embodiment, wherein the upright member serves as an armrest or backrest.

The invention claimed is:

1. A reclining furniture system comprising:

a reclining assembly comprising a base providing a seating surface having a width and a depth of different dimensions, the furniture system being configured to allow the user to orient the width or the depth of the base to form a front edge of the base, wherein a footrest assembly selectively extends from the front edge of the base, wherein the reclining assembly includes a reclining mechanism housed within the base, the reclining mechanism being configured to selectively recline the seating surface with respect to a remainder of the base in either the orientation where the width of the base forms the front edge of the seat or the depth of the base forms the front edge of the seat.

2. The reclining furniture system of claim 1, wherein the reclining mechanism is housed entirely within a footprint of the base.

3. The reclining furniture system of claim 1, wherein the base is provided with a seat cushion, the reclining mechanism being housed entirely within a footprint of the seat cushion.

4. The reclining furniture system of claim 3, wherein the furniture system further comprises one or more upright members attachable to the base, the one or more upright members being configured as at least one of an armrest or a backrest, wherein no portion of the reclining mechanism is housed within the one or more upright members.

5. The reclining furniture system of claim 1, wherein the reclining mechanism is removable from a housing of the base.

6. The reclining furniture system of claim 1, wherein the footrest assembly comprises a footrest panel having a first length when the reclining furniture system is in a deep mode.

7. The reclining furniture system of claim 6, wherein the footrest assembly comprises a footrest panel having a second length when the reclining furniture system is in a shallow mode, wherein the second length is longer than the first length.

8. A reclining furniture system, comprising:

an upright member; and a base having a width and a depth of different dimensions, the base being selectively couplable to the upright member to form the reclining furniture system, the base comprising:

a housing; and a reclining mechanism mountable within the housing, the reclining mechanism configured to selectively move a footrest assembly with respect to the housing;

such that the reclining furniture system is selectively operable to provide reclined seating in a shallow seat configuration or a deep seat configuration, as selected by a user.

9. The reclining furniture system of claim 8, wherein the reclining mechanism is selectively mountable within the housing.

10. The reclining furniture system of claim 8, wherein the upright member is selectively attachable to the base, the upright member being configured as at least one of an armrest or a backrest, wherein no portion of the reclining mechanism is housed within the upright member, and wherein the upright member is configured to be a backrest in the shallow seat configuration and is configured to be an armrest in the deep seat configuration.

11. The reclining furniture system of claim 10, wherein the upright member is a first upright member configured as a first armrest, and the reclining furniture system further comprises a second upright member configured as a second armrest, and a third upright member configured as a backrest, and wherein each of the first upright member, second upright member, and third upright member have the same dimensions.

12. The reclining furniture system of claim 11, wherein when the reclining furniture system is in the shallow seat configuration, the first armrest and the second armrest are each configured to abut the backrest in a first orientation.

13. The reclining furniture system of claim 12, wherein when the furniture system is in the deep seat configuration, the first armrest and the second armrest are each configured to abut the backrest in a second orientation, that is different from the first orientation.

14. The reclining furniture system of claim 8, wherein the footrest assembly further comprises a footrest panel.

15. The reclining furniture system of claim 14, wherein the footrest panel is a front edge of the base and the footrest panel either has a first length equivalent to the width of the base or a second length equivalent to the depth of the base.

16. A reclining furniture system capable of operating in a shallow mode or a deep mode, as selected by a user, comprising:

one or more upright members; and a base selectively couplable to the one or more upright members, the base comprising:

a housing; and a reclining mechanism selectively coupled to the housing;

wherein:

when the reclining furniture system is operating in the shallow mode, the reclining mechanism has a footrest panel having a first length, and when the reclining furniture system is operating in the deep mode, the footrest panel has a second length that is shorter than the first length.

17. The reclining furniture system of claim 16, wherein the reclining mechanism is removable from the housing.

18. The reclining furniture system of claim 17, wherein at least one of the one or more upright members is configured to be a backrest in the shallow mode and is configured to be an armrest in the deep mode.

19. The reclining furniture system of claim 16, wherein the reclining mechanism is configured to selectively recline a seating surface with respect to a remainder of the base.

20. The reclining furniture system of claim 16, wherein the reclining mechanism is configured to move either the first footrest panel or the second footrest panel with respect to the housing.

21. The reclining furniture system of claim 16, wherein the one or more upright members are configured as at least one of an armrest or a backrest, wherein no portion of the reclining mechanism is housed within the one or more upright members.

22. The reclining furniture system of claim 1, wherein:

when the reclining furniture system is operating with the width forming the front edge of the base, the reclining mechanism has a first footrest panel having a first length, and when the reclining furniture system is operating with the depth forming the front edge of the base, the reclining mechanism has a second footrest panel with a second length that is shorter than the first length.

* * * * *